US011768045B2

(12) United States Patent
Makarov et al.

(10) Patent No.: US 11,768,045 B2
(45) Date of Patent: Sep. 26, 2023

(54) CASELESS MAGAZINE WEAPON (VARIANTS)

(71) Applicants: Heorhii Heorhiiovych Makarov, m. Kyiv (UA); Hlib Heorhiiovych Makarov, m. Kyiv (UA); Mykola Pavlovych Maznytsia, Dnipropetrovska oblast (UA); Oleksii Serhiiovych Koval, Kyiv (UA)

(72) Inventors: Heorhii Heorhiiovych Makarov, m. Kyiv (UA); Hlib Heorhiiovych Makarov, m. Kyiv (UA); Mykola Pavlovych Maznytsia, Dnipropetrovska oblast (UA); Oleksii Serhiiovych Koval, Kyiv (UA)

( * ) Notice: Subject to any disclaimer, the term of this patent is extended or adjusted under 35 U.S.C. 154(b) by 0 days.

(21) Appl. No.: 17/637,434

(22) PCT Filed: Nov. 5, 2019

(86) PCT No.: PCT/UA2019/000136
§ 371 (c)(1),
(2) Date: Feb. 22, 2022

(87) PCT Pub. No.: WO2021/034295
PCT Pub. Date: Feb. 25, 2021

(65) Prior Publication Data

US 2022/0282945 A1 Sep. 8, 2022

(30) Foreign Application Priority Data

Aug. 20, 2019 (UA) ..... a 2019 08550

(51) Int. Cl.
*F41A 15/20* (2006.01)
*F41A 19/43* (2006.01)
*F41A 21/48* (2006.01)

(52) U.S. Cl.
CPC ..... *F41A 15/20* (2013.01); *F41A 19/43* (2013.01); *F41A 21/482* (2013.01)

(58) Field of Classification Search
CPC ..... F41A 15/20; F41A 19/43; F41A 21/482
See application file for complete search history.

(56) References Cited

U.S. PATENT DOCUMENTS 3,474,560 A * 10/1969 Marcus ..... F41A 9/23 42/15
3,722,123 A * 3/1973 Parisi ..... F41A 9/375 42/16

(Continued)

FOREIGN PATENT DOCUMENTS

RU 2 499 214 C2 11/2013
WO 2012/097334 A2 7/2012
WO 2019/054975 A1 3/2019

OTHER PUBLICATIONS

International Search Report dated May 5, 2020, issued in counterpart International Application No. PCT/UA2019/000136. (2 pages).

*Primary Examiner* — Michelle Clement
(74) *Attorney, Agent, or Firm* — WHDA, LLP

(57) ABSTRACT

A magazine caseless weapon is disclosed and can be used for shooting using the caseless ammunition. The weapon includes a handguard or handguard with bipods, or gunstock, magazine, barrel, barrel latch, multifunctional cartridge, conical bushing of a receiver, the receiver, safety spring, safety, trigger guard with magazine box, trigger bar, trigger bar spring, magazine latch, axis, firing pin, spring of firing pin latch, firing pin latch, conical bushing of the bolt, bolt body, firing hammer, mainspring, mainspring latch, hunting or skeletal buttstock, threaded bushing for back plate screw, back plate or adjustable back plate, threaded bushing of bipods, cross screw, cross screw nut, upper screw, lower screw, caseless ammunition, dowel screw, dowel (Continued)

screw nut, latch of adjustable back plate, adjustable cheek piece, latch of adjustable cheek piece, stop, stop lock, threaded bushing of stop lock, lower part, upper part and screw of muzzle break, folding adjustable bipod, and bipod latch.

9 Claims, 83 Drawing Sheets

(56) References Cited

U.S. PATENT DOCUMENTS

| | | | | |
|---|---|---|---|---|
| 4,123,963 | A * | 11/1978 | Junker | F41A 15/20 102/431 |
| 7,357,059 | B2 * | 4/2008 | Konicke | F41A 29/04 89/26 |
| 7,526,991 | B2 * | 5/2009 | Steimke | F41C 23/14 89/129.01 |
| 7,762,174 | B1 * | 7/2010 | Steimke | F41A 21/481 89/33.02 |
| 8,863,421 | B1 * | 10/2014 | Farage | F41A 3/10 102/431 |
| 9,500,420 | B2 * | 11/2016 | Widder | F41A 21/00 |
| 9,759,499 | B2 * | 9/2017 | Widder | F42B 5/184 |
| 10,948,250 | B2 * | 3/2021 | Sharkov | F41A 21/12 |
| 2020/0232731 | A1 | 7/2020 | Sharkov et al. | |
| 2020/0408477 | A1 * | 12/2020 | Glisovic | C22C 29/065 |
| 2022/0113122 | A1 * | 4/2022 | Makarov | F41A 15/20 |
| 2022/0282945 | A1 * | 9/2022 | Makarov | F41A 21/34 |

* cited by examiner 1-1

1-1

1-1

1-1

A 1-1

CASELESS MAGAZINE WEAPON (VARIANTS)

The proposed invention relates to firearms, specifically to the magazine caseless weapons, and can be used to create the designs for shooting using caseless ammunition.

Some functions of the proposed invention were considered or used in previous designs of firearms, such as the Mauser magazine weapon and the invention "Caseless weapon (variants)" for patent application a201709150 dated Sep. 19, 2017.

There are known designs when the propellant charge disposed in the bullet, developed in the USA for the weapons Volkanik 1860, Gyroyjet 1965, their disadvantages are the low power of the ammunition, which is max 250 J, and the lack of precision of the weapon. In the proposed invention, the propellant is disposed within the ammunition. Due to this and to the design features of the weapon and of the ammunition, high power of the ammunition up to 3500 J is ensured.

The group of the inventions is known that relates to the caseless weapons for magazine, semi-automatic and automatic shooting (international application number: PCT/UA2017/000093; international filing date: Sep. 28, 2017; publication number: WO/2019/054975; publication date: 21 Mar. 2019) containing: the removable front sight, the removable adjustable dioptrical sight, the front grip, the gunstock, the magazine, the receiver cover, the cocking stud, the cocking stud axis, the lock washer of the cocking stud axis, the spring of the cocking stud, the bolt carrier A or B, the rod, the spring of the rod, the percussion piston, the conical bushing of the bolt, the bolt body, the firing hammer latch, the firing hammer spring, the muzzle break, the spring washer of the muzzle break, the smooth bore barrel, the barrel latch, the multifunctional cartridge, the conical bushing of the receiver, the extractor, counter-washer of the extractor, the receiver, the trigger housing B or C, the big front nut, the front swivel, the magazine catch, the magazine latch pusher, the spring of the safety latch, the safety latch, the safety, the trigger bar for semi-automatic shot or automatic shot, the sear, the spring of the trigger bar, the bracket of the percussion mechanism, the axis of the cocking piece, the spiral mainspring, the cocking piece or the lever of the multifunctional catch, the stop of the multifunctional catch, the lock pin splint, the spring of the lock pin splint, the latch of the ramrod, the spring of the ramrod latch, the ramrod, the caseless ammunition. For some military missions, sometimes the extra accurate single shot is required, and with quiet reloading of the weapon, this can only be provided by the weapon created based on the magazine rifle with the turn of the bolt handle, and which is the simplest in terms of the design of assemblies and mechanisms, therefore, the disadvantage of this solution is that: in this group of inventions related to the caseless weapons, there is no classic magazine rifle with a turn of the bolt handle, and the use of the complex and the expensive designs for the extra accurate single shot is not advisable.

Known British design of Lee—Enfield SMLE No. 1Mk 3 magazine rifle, which has become the classic, where the trigger mechanism consists of the trigger lever, that can rotate on the axis, having one end interacting with the trigger, and its other end interacting with the firing hammer of the bolt, and next to the axis, the laminated leaf spring rests against the trigger lever with one end, which interacts with the magazine latch with its other end.

The disadvantages of this solution are the following: in this design, which operates in the partial load manual mode, there is no need to use the complicated design of the trigger lever and the axis; their function can be transferred to the trigger bar and the laminated leaf spring.

To unbreech the bolt from the weapon, the complicated mechanism is employed, which comprises: the spring-loaded flat spring lever with the protrusion that locks the bolt stop, while the lever with the protrusion is installed on the axis and able to rotate on it; the lever with the protrusion has the cover. The disadvantages of this solution are the following: there is no need to use the complicated mechanism in this design, the lever with a protrusion of complicated design, the axis, and the cover. Their function of operation can be transferred to the trigger bar and the bolt.

The object of the proposed invention is creating the extra-accurate magazine caseless weapon (variants) to ensure improvement of the performance, namely: it will increase the reliability of the weapon in severe conditions, provide ease of removing light delays and facilitate loading and unloading, ensure the reliability of the weapon in combat conditions with a forced supply of the ammunition, including polluted ones, improve the stability of the projectile flight path and provide enhanced precision of the shots of the weapon using the stable position and the impromptu shooting.

The second object of the invention is creating the new design of magazine caseless weapon that ensures to remove the blowback, improvement of the shot effectiveness, reduction of the thermal loss, heating of the barrel, and enhancement of safety of the weapon and the shooters.

In the case of use of the magazine caseless weapon, it is advisable to enhance the efficiency of the shot, to reduce the weapon weight and dimensions, to increase the safety of the weapon and the shooters, to improve the stability of the projectile flight within the entire path, and to provide repair and replacement of the parts in the field conditions in case of weapon's destruction.

In the case of the use of the magazine caseless weapon, it is advisable to reduce the restoring force and to ease the weapon loading.

In the case of a magazine caseless weapon, it is advisable to facilitate extraction and enhance its reliability.

For the shooters with different anthropological characteristics, especially as referred to the sniper specialists, by the need to solve various combat missions, it is desirable to provide accurate adjustment, as well as ease of use of the buttstock with the adjustable back plate and the cheek piece.

For extra accurate shooting, the magazine caseless weapon requires the folding adjustable bipod to enhance the weapon stability on the ground and to facilitate the precision of shooting, and it is advisable to ensure a fine adjustment as well as convenience of use of the bipod on the ground.

Technical objects are solved by the fact that according to the first variant of the invention the caseless magazine weapon 1A, which contains a bolt 4 interacting with a receiver 13, configured to reciprocate and rotate about the axis in a guiding slots 158 of the receiver 13, and the said receiver 13 is mounted in the hunting buttstock 6A, a handguard 248, and fixed by a trigger guard with the magazine box 16, an upper screw 36 and a lower screw 37, and the hunting buttstock 6A is fixed by a cross screw 34, the nut of the cross screw 35, and, in the trigger guard with magazine box 16, a magazine 7 is installed; a trigger bar 17 is installed on an axis 20 configured for axial rotation, and interacting with a firing hammer 26; a trigger bar spring 18 and the magazine latch 19 on the axis 20, configured to ensure axial rotation, and the said trigger bar 17 and a magazine latch 19 are spring-loaded by the trigger bar spring 18, and the magazine latch 19 interacts with the magazine 7, and a conical bushing 12 of a receiver 13 is mounted in the receiver 13 and a multifunctional cartridge 11 is mounted on said conical bushing of the receiver 12; a barrel 9A with rear end screwed into the receiver 13 and fixed with a barrel latch 10; a safety 15, spring-loaded through a safety spring 14, which is disposed in the receiver 13 and configured to reciprocate and to rotate about the axis; the handguard 248, in which by the invention the bolt 4 contains a firing pin 21, which is mounted in a conical bushing of the bolt 24, which is configured to rotate on the firing pin 21 and, at the same time, it is permanently pressed by a spring of the firing pin latch 22 to a bolt body 25, and the firing pin 21 is installed in a through-hole 82 of the bolt body 25 and capable to reciprocate; it is loaded by the spring of the firing pin latch 22 and fixed by a firing pin latch 23, inserted into a central blind cylindrical channel 79 of the bolt body 25 and configured to reciprocate, and the bolt 4 contains the firing hammer 26 installed into central blind cylindrical channel 79 and configured for reciprocal motion; and the mainspring capable to compress and expand in the firing hammer 26 is disposed inside the firing hammer 26 and fixed by a mainspring latch 28 in the bolt body 25;

the firing pin 21 is configured in the form of stepped shaft, which has a conical part 52 at front, which passes into a cylindrical part with smaller diameter 53, and an inclined protrusion 54 is formed at the joint of the conical part 52 and the cylindrical part with smaller diameter 53, and the angle of the inclined protrusion d54 relative to the axis of the firing pin 55 is equal to 30-45 degrees, and the cylindrical part with the smaller diameter 53 passes into a cylindrical part with the bigger diameter 56, which passes into a cylindrical piston 57, and said the cylindrical piston 57 passes into a rod section with groove 58, where a rear groove 59 passes into a square part 60 with a cylindrical protrusions 61 disposed at the end of the square part 60, and the rear groove 59, the square part 60 and the cylindrical protrusions 61 interacts with the firing pin latch 23;

the conical bushing of the bolt 24 is configured to rotate on the firing pin 21 and pressed by the spring of the firing pin latch 22 to a glazed area 78 at the end of a cylindrical head 70 of the bolt body 25, and the said conical bushing of the bolt 24 is configured in the form of a truncated cone 62 with a blind conical hole 63, which passes into a hole 64, which forms the wall 65 at the outlet of the big base of the truncated cone 62, and at inlet of the blind conical hole 63 there are at least three a protrusions 66, which interact with a caseless ammunition 38;

the bolt body 25 has a cylindrical part 67, which passes into the thinner cylindrical part 68, where a slots 69 are disposed along the perimeter of outer part of a thinner cylindrical part 68, and the thinner cylindrical part 68 passes into the cylindrical head 70, and a chamfer 71 is disposed at the passage from the cylindrical part 67 into the thinner cylindrical part 68, and at the passage from the thinner cylindrical part 68 into the cylindrical head 70 a locking lugs 72 are made in the form of two protrusions with the ends made in the form of a radius surfaces 73, and the corbelling protrusion consisting of a base 74 and a leading protrusion 75, configured to interact with a leading notch 153 of the receiver 13, and the leading protrusion 75 is the third locking lug of the bolt 4 and interacts with a protrusion 154 of the receiver 13, and the leading protrusion 75 is provided with a handle 76 in the form of the rod with a ball at the end, and at the end face of the base 74 a are 77 is disposed to interact with the leading notch 153 of the receiver 13, and the handle 76 is disposed at an angle to the locking lugs 72, and the face end of the cylindrical head 70 has the glazed area 78 to interact with the conical bushing of the bolt 24;

the central blind cylindrical channel 79 is disposed inside the bolt body 25 and configured to interact with the firing hammer 26, the spring of the firing pin latch 22, the firing pin latch 23, and in the rear part of the central cylindrical channel 79, there are two a lead-in slots 80 and a groove 81 to interact with a protrusions 102 of the mainspring latch 28; whereupon in the front end of the central cylindrical channel 79 the through-hole 82 is disposed to interact with the firing pin 21, and at an end 83 of the cylindrical part 67 are made two screwed protrusions 84 with a screwed surfaces 85 configured to interact with firing hammer 26 are disposed, and the cylindrical part 67 has a rectangular hole 86 to interact with a safety lug 179 of the safety 15;

the firing pin latch 23 is made in the form of a washer 87 with a blind hole 88, a through-hole 89 is made behind the blind hole 88, which repeats the shape of the end of the square part 60 with the cylindrical protrusions 61 of the firing pin 21, and in the washer 87 at inlet of the blind hole 88, a spinways 90 are disposed, and the through-hole 89 in the washer 87 forms a projection 91, configured to fix the firing pin latch 23 on the firing pin 21;

the firing hammer 26 is configured as a rod 92 with a grooves 93 at one end, and at the other end of the rod 92 the hammer 94 is disposed in the form of the rectangular bar, and a slot 95 is made in the hammer 94 and in the adjacent part of the rod 92, configured to interact with the firing hammer 26 with the mainspring latch 28, and a blind hole 96 is disposed inside the firing hammer 26 to interact with a mainspring 27, and at the bottom of the hammer 94, from the side of the rod 92, the cocking stud area 97 is disposed to interact with a sear platform 297 of the trigger bar 17;

the firing hammer 26K configured as the rod 92 with a washer 98 with a slots 99 at one end, and a holes 100 are on the side surface of the rod 92, and at the other end of the rod 92, there is a hammer 94 configured as the rectangular bar, and the slot 95 is disposed in hammer 94 and in the adjacent part of the rod 92 to interact with the firing hammer 26K with the mainspring latch 28, and the blind hole 96 is disposed inside the firing hammer 26K to interact with the mainspring 27, and at the bottom of the hammer 94, from the side of the rod 92, the cocking stud area 97 is disposed to interact with the sear platform 297 of the trigger bar 17;

the mainspring latch 28 is configured in the form of a rod 101 with the two protrusions 102 at one end of the rod 101, and this end passes into a smaller diameter rod 103, and a blind hole 104 is disposed inside the mainspring latch 28;

a muzzle break 105 contains the lower part of a muzzle break 47 in which an upper part of the muzzle break 48 is mounted, and these parts are interconnected by a screws of the muzzle break 49;

the lower part of the muzzle break 47 is configured in the form of the plate 106 with inside a groove 107 at the inlet, which passes into a threaded section 108, which passes into the groove 107, which passes a smooth conical part 109, and the threaded section 108 and the smooth conical part 109 are configured to fix the barrel 9A, and behind the conical part 109, a smooth cylindrical section 110 is disposed with diameter corresponding to the inner bore of the barrel 121, which passes into a cylindrical groove 112, configured to assemble the upper part of the muzzle break 48, and after the assembly of the muzzle break 105, it forms the lock time chamber 347, and the cylindrical groove 112 passes into an outer tube 113, and in the place of the smooth cylindrical section 110 and the cylindrical groove 112, a two slots 114 are disposed at an acute angle to a longitudinal axis 115 of the muzzle break 105, and two slots 114 in the cross section form an angle 116 between themselves, equal to 80-90 degrees, and the slots 114 in the assembled muzzle break 105 form an inclined channel 349 to ensure creation of the exhaust gas jet stream 352 of the propellants, and a threaded holes 117 are made on the outside of the threaded section 108, configured for the screws of the muzzle break 49 at assembling the muzzle break 105;

the upper part of the muzzle break 48 is configured in the form of a plate 106 with the groove 107 at the inlet, which passes into a threaded section 108, which passes into the groove 107, which passes into the smooth conical part 109, and the threaded section 108 and the smooth conical part 109 are configured to fix the barrel 9A, and behind the conical part 109 the smooth cylindrical section 110 with diameter corresponding to an inner channel of the barrel 121 is disposed, which passes into a cylindrical groove 111, and the cylindrical groove 111 is configured to assemble the lower part of the muzzle break 47 and after assembling the muzzle break 105 the lock time chamber 347 is formed in it, and the cylindrical groove 111 passes into an inner tube 118 with an inner smooth hole 119 with diameter corresponding to the inner channel diameter of the barrel 121, and in the place of the smooth cylindrical section 110 and the cylindrical groove 111, the two slots 114 are configured at an acute angle to the longitudinal axis 115 of the muzzle break 105, and the two slots 114 in the cross section form the angle 116 between themselves, equal to 80-90 degrees, and the slots 114 in the assembled muzzle break 105 form the inclined channel 349 to ensure development of the exhaust gas jet stream 352 of the propellants, and a holes 120 are made on the outside of the threaded section 108, configured for a screws of the muzzle break 49 at assembling the muzzle break 105;

the barrel 9A has the smooth inner channel 121 without grooves, and from outside it is configured with a smooth cylindrical section 122, which passes into a threaded section with the buttress thread 123, which passes into a circular groove 124, which passes into a smooth cylindrical section 125 with a groove 126 to interact with the barrel latch 10, and the smooth cylindrical section 125 passes into a cylindrical section 127, which passes into a cylindrical section 128 with a slots 129 along the outer perimeter, and all said sections of the barrel 9A are different in thickness;

the multifunctional cartridge 11 comprising a threaded bushing 133, a spring half-rings 134 configured to interact with the careless ammunition 38, an inner smooth bushing 135 with grooves for the spring half-rings 134, at least one a middle bushing 136 and an outer bushing with variable diameter 137, which has a bigger diameter 138, and the threaded bushing 133 configured with two or more threaded slots, and the bushings 133, 135, 136 and 137 are inserted into each other with tension, and the outer surfaces of the bushings 133, 135, 136 and 137 are polished to a full gloss;

the conical bushing of the receiver 13 has a cylindrical section 139, which passes into a smaller cylindrical section 140, and a conical hole 141 is disposed inside of said conical bushing 141, and configured to interact with the conical bushing of the bolt 24, the small base of which is disposed at the end of the cylindrical section 139;

the receiver 13 is configured with the cylindrical part 142, where at the end of the cylindrical part 142, the multi-layered cylindrical hole with threaded section 143 is configured for mounting of the conical bushing of the receiver 12, installation of the multifunctional cartridge 11 and the barrel, and at the inlet of said multi-layered cylindrical hole with threaded section 143 a cross-threaded hole 144 is configured from the bottom to mount the barrel latch 10, and the said multi-layered cylindrical hole with threaded section 143 passes into a cylindrical groove 145, and the cylindrical groove 145 passes into a complex-shaped section 146, which repeats the shape of the front part of the bolt body 25, and at inlet of the complex-shaped section 146, two cylindrical guiding chamfers 147 are disposed, and on top of the receiver 13 a rail 148 is configured to attach the brackets for different sights, and the rear end of the cylindrical part 142 passes into a complex-shaped bar 149 ended with a console 150 and having a protrusion 151 at its end, in which a hole 152 is disposed to mount the upper screw 36; and also at the point of abutment of the console 150 against the complex-shaped bar 149, the leading notch 153 is made with the protrusion 154 and a slot 155 at the bottom of the leading notch 153 of the complex-shaped bar 149 to interact with a leading protrusion 75 of the bolt body 25, as well as a hole 156 in the complex-shaped bar 149 is configured for the magazine 7, a window 157 to eject the ammunition 38, the guiding slots 158 configured for passage of the locking lugs 72 of the bolt body 25, and also, a stepped through-hole 159, for passage of the bolt body 25 is disposed, and at the junction of the console 150 to the bar of complex-shaped 149 there is a protrusion 160 with a blind hole 161 and the protrusion with a through-hole 162 are configured to interact with the safety 15 and the safety spring 14; between the projection 160 and the projection with the through-hole 162, a slot 163 is disposed, and a through slot 164 is configured in the projection with the through-hole 162 to mount the safety 15, and a blind slots 165 are configured to fix the safety 15 in the "fire" position and to set and release the bolt 4 from the weapon 1A, and a slot 166 is configured in the console 150 for passage of the firing hammer 26 or 26K, and a trapezoidal hole 167 for passage of the trigger bar 17, as well as a rectangular hole 168 at the bottom of the projection 160 and the projection with a through-hole 162 in the guide slot 158 is configured to mount a fixing plate 178 of the safety 15, and a projection 169 is configured in the lower part of the complex-shaped bar 149 to retain the magazine latch 19 in the open position, and a protrusion 170 with a blind threaded hole 171 is configured for the lower screw 37;

the safety 15 in the form of an axis 172 with a blind hole 173 is configured to interact with the safety spring 14, and the axis 172 passes into a base 174 configured in the form of the plate, and a protrusion 175 is disposed on the base 174 to interact with the blind slot 165 of the receiver 13 to retain the safety 15 in the "fire" position and to set and release the bolt 4 from the weapon 1A, and the base 174 passes into a thumb piece 176 configured in the form of the complex-shaped plate, and a cylindrical protrusion 177 is disposed at the end of the thumb piece 176, where the fixing plate 178 with the safety lug 179 is made at the abutment of the base 174 against the thumb piece 176, configured to interact with the locking lug 72 of the bolt body 25 and to fix the locking lug 72 in the receiver 13, and the safety lug 179 interacts with the rectangular hole 86 of the bolt body 25 and is configured to fix the bolt 4 in the receiver 13, and a conical protrusion 180 on the side surface of the thumb piece 176 is configured to interact with the hammer 94 of the firing hammer 26;

the trigger bar 17 is configured in a complex-shaped plate 294 with a protrusion 295 at one end, and the protrusion 295 has a radius surface 296 and the sear platform 297 configured to interact with the platform of the cocking stud 97 of the firing hammer 26, and at the other end of the plate 294 a trigger bar 298 is disposed in the form of the bracket, and in the center of the plate 294 a protrusion 299 with a through-hole 300 is disposed for the axis 20, and a hole 301 is configured between the protrusion 295 and the protrusion 299 of the plate 294 to interact with a long bent end 292 of the trigger bar spring 18;

the magazine latch 19 is configured in a form of a lever 302 made of complex-shaped plate with a button 303 at one end, and a support platform 304 is made on the button 303, and a console 305 is configured in the form of the rectangular rod at the other end of the lever 302, and a slot 306 is disposed in the center of the console 305 to interact with the trigger bar spring 18, while above the button 303 a protrusion 307 is disposed with a hole 308 and a slot 309 configured to interact with a short bent end 293 of the trigger bar spring 18, as well as a hole 310 to interact with the axis 20;

the trigger guard with the magazine box 16 is configured a form of complex-shaped plate 311 with a cylindrical protrusion 312 with the hole 312A purposed for the lower screw 37, and a slot 313 at one end, and at the other end of the plate 311 there is a trigger guard 314, a complex-shaped protrusion 315, the slot 313, and the projection 315 has a through-hole 316 configured for the axis 20 and the hole 316A for the cross screw 34, and a threaded hole 317 is disposed in front of the trigger guard 314 in the plate 311, configured for the upper screw 36, as well as a magazine box 318 is in the center of the plate 311 configured to interact with the magazine 7, and a slot 319 with the inclined platform 320, which are configured to interact with the magazine latch 19;

the handguard 248 is configured in a form of a complex-shaped bar 249 with a complex-shaped through-hole 250 disposed inside to interact with the protrusion 170 of the receiver 13, and a stepped hole 251 is made in the bar 249 configured to interact with the barrel latch 10, and a longitudinal blind hole 252 configured to interact with a threaded bushing of the bipod 33;

the hunting buttstock 6A containing a buttstock 29A with a threaded bushings 30, on which a back plate 31A is installed and fixed with the screws of a back plate 32 in the threaded bushings 30.

According to the second variant of the invention, the caseless magazine weapon 1B, which contains a bolt 4 interacting with a receiver 13, configured to reciprocate and rotate about the axis in a guiding slots 158 of the receiver 13, and the said receiver 13 is mounted in the hunting gunstock 8 and fixed by a trigger guard with the magazine box 16, an upper screw 36, a lower screw 37, a dowel screw 39 and a nut of the dower screw 40, and, in the trigger guard with magazine box 16, a magazine 7 is installed; a trigger bar 17 is installed on an axis 20 configured for axial rotation, and interacting with a firing hammer 26; a trigger bar spring 18 and a magazine latch 19 on the axis 20 are configured to ensure axial rotation, and the said trigger bar 17 and the magazine latch 19 are spring-loaded by the trigger bar spring 18, and the magazine latch 19 interacts with the magazine 7, and a conical bushing 12 of a receiver 13 is mounted in the receiver 13 and a multifunctional cartridge 11 is mounted on said conical bushing of the receiver 12; a barrel 9A with rear end screwed into the receiver 13 and fixed with a barrel latch 10; a safety 15, loaded through a safety spring 14, which is disposed in the receiver 13 and configured to reciprocate and to rotate about the axis; a handguard 248, in which by the invention the bolt 4 contains a firing pin 21, which is mounted in a conical bushing of the bolt 24, which is configured to rotate on the firing pin 21 and at the 315 same time, it is permanently pressed by a spring of the firing pin latch 22 to a bolt body 25, and the firing pin 21 is installed in a through-hole 82 of the bolt body 25 with ability to reciprocate; it is spring-loaded by the spring of the firing pin latch 22 and fixed by a firing pin latch 23, inserted into a central blind cylindrical channel 79 of the bolt body 25 and configured to reciprocate, and the bolt 4 contains the firing hammer 26 installed into the central blind 320 cylindrical channel 79 and configured for reciprocal motion; and the mainspring capable to compress and expand in the firing hammer 26 is disposed inside the firing hammer 26 and fixed by a mainspring latch 28 in the bolt body 25;

the firing pin 21 is configured in the form of stepped shaft, which has a part 52 at front of it, which passes into a cylindrical part with the smaller diameter 53, and an inclined protrusion 54 is formed at the joint of the conical part 52 and the cylindrical part with the smaller diameter 53, and the angle of the inclined protrusion d54 relative to the axis of the firing pin 55 is equal to 30-45 degrees, and the cylindrical part with the smaller diameter 53 passes into a cylindrical part with the bigger diameter 56, which passes into a cylindrical piston 57, and said the cylindrical piston 57 passes into a rod section with the grooves 58, where a rear groove 59 passes into a square part 60 with a cylindrical protrusions 61 disposed at the end of the square part 60, and the rear grooves 59, the square part 60 and the cylindrical protrusions 61 interact with the firing pin latch 23;

the conical bushing of the bolt 24 is configured to rotate on the firing pin 21 and pressed by the spring of the firing pin latch 22 to a glazed area 78 at the end of a cylindrical head 70 of the bolt body 25, and the said conical bushing of the bolt 24 is configured in the form of a truncated cone 62 with a blind conical hole 63, which passes into a hole 64, which forms the wall 65 at the outlet of the big base of the truncated cone 62, and at inlet of the blind conical hole 63 there are at least three a protrusions 66, which interact with a caseless ammunition 38;

the bolt body 25 has a cylindrical part 67, which passes into a thinner cylindrical part 68, where a slots 69 are disposed along the perimeter of outer part of the thinner cylindrical part 68, and the thinner cylindrical part 68 passes into the cylindrical head 70, and a chamfer 71 is disposed at the passage from the cylindrical part 67 into the thinner cylindrical part 68, and at the passage from the thinner cylindrical part 68 into the cylindrical head 70 a locking lugs 72 are made in the form of two protrusions with the ends made in the form of a radius surfaces 73, and the corbelling protrusion consisting of a base 74 and the leading protrusion 75, configured to interact with a leading notch 153 of the receiver 13, and the leading protrusion 75 is the third locking lug of the bolt 4 and interacts with the protrusion 154 of the receiver 13, and the leading protrusion 75 is provided with a handle 76 in the form of the rod with a ball at the end, and at the end face of the base 74 a area 77 is disposed to interact with the leading notch 153 of the receiver 13, and the handle 76 is disposed at an angle to the locking lugs 72, and the face end of the cylindrical head 70 has the glazed area 78 to interact with the conical bushing of the bolt 24;

the central blind cylindrical channel 79 is disposed inside the bolt body 25 and configured to interact with the firing hammer 26, the spring of the firing pin latch 22, the firing pin latch 23, and in the rear part of the central cylindrical channel 79, there are two a lead-in slots 80 and a groove 81 to interact with a protrusions 102 of the mainspring latch 28; whereupon in the front end of the central cylindrical channel 79 the through-hole 82 is disposed to interact with the firing pin 21, and at an end 83 of the cylindrical part 67 are made two screwed protrusions 84 with a screwed surfaces 85 configured to interact with firing hammer 26 are disposed, and the cylindrical part 67 has a rectangular hole 86 to interact with a safety lug 179 of the safety 15;

the firing pin latch 23 is made in the form of a washer 87 with a blind hole 88, a through-hole 89 is made behind the blind hole 88, which repeats the shape of the end of the rectangular part 60 with the cylindrical protrusions 61 of the firing pin 21, and in the washer 87 at inlet of the blind hole 88, a spinways 90 are disposed, and the through-hole 89 in the washer 87 forms a projection 91, configured to fix the firing pin latch 23 on the firing pin 21;

the firing hammer 26 is configured as a rod 92 with a grooves 93 at one end, and at the other end of the rod 92 the hammer 94 is disposed in the form of the rectangular bar, and a slot 95 is made in the hammer 94 and in the adjacent part of the rod 92, configured to interact with the firing hammer 26 with the mainspring latch 28, and a blind hole 96 is disposed inside the firing hammer 26 to interact with a mainspring 27, and at the bottom of the hammer 94, from the side of the rod 92, the cocking stud area 97 is disposed to interact with a sear platform 297 of the trigger bar 17;

the firing hammer 26K configured as the rod 92 with a washer 98 with a slots 99 at one end, and a holes 100 are on the side surface of the rod 92, and at the other end of the rod 92, there is a hammer 94 configured as the rectangular bar, and the slot 95 is disposed in hammer 94 and in the adjacent part of the rod 92 to interact with the firing hammer 26K with the mainspring latch 28, and the blind hole 96 is disposed inside the firing hammer 26K to interact with the mainspring 27, and at the bottom of the hammer 94, from the side of the rod 92, the cocking stud area 97 is disposed to interact with the sear platform 297 of the trigger bar 17;

the mainspring latch 28 is configured in the form of a rod 101 with the two protrusions 102 at one end of the rod 101, and this end passes into a smaller diameter rod 103, and a blind hole 104 is disposed inside the mainspring latch 28;

a muzzle break 105 contains a lower part of the muzzle break 47, in which an upper part of the muzzle break 48 is mounted, and these parts are interconnected by the screws of the muzzle break 49;

the lower part of the muzzle break 47 is configured in the form of the plate 106 with inside a groove 107 at the inlet, which passes into a threaded section 108, which passes into the groove 107, which passes into a smooth conical part 109, and the threaded section 108 and the smooth conical part 109 are configured to fix the barrel 9A, and behind the conical part 109, a smooth cylindrical section 110 is disposed with diameter corresponding to an inner channel of the barrel 121, which passes into a cylindrical groove 112, configured to assemble the upper part of the muzzle break 48, and after the assembly of the muzzle break 105, it forms the lock time chamber 347, and the cylindrical groove 112 passes into an outer tube 113, and in the place of the smooth cylindrical section 110 and the cylindrical groove 112, a two slots 114 are disposed at an acute angle to a longitudinal axis 115 of the muzzle break 105, and the two slots 114 in the cross section form an angle 116 between themselves, equal to 80-90 degrees, and the slots 114 in the assembled muzzle break 105 form an inclined channel 349 to ensure development of the exhaust gas jet stream 352 of the propellants, and a threaded holes 117 are made on the outside of the threaded section 108, configured for the screws of a muzzle break 49 at assembling the muzzle break 105;

the upper part of the muzzle break 48 is configured in the form of a plate 106 with the groove 107 at the inlet, which passes into a threaded section 108, which passes into the groove 107, which passes into the smooth conical part 109, and the threaded section 108 and the smooth conical part 109 are configured to fix the barrel 9A, and behind the conical part 109 the smooth cylindrical section 110 with diameter corresponding to the inner channel of the barrel 121 is disposed, which passes into a cylindrical groove 111, and the cylindrical groove 111 is configured to assemble the lower part of the muzzle break 47 and after assembling the muzzle break 105 the lock time chamber 347 is formed in it, and the cylindrical groove 111 passes into the inner tube 118 with an inner smooth hole 119 with diameter corresponding to the inner channel diameter of the barrel 121, and in the place of the smooth cylindrical section 110 and the cylindrical groove 111, the two slots 114 are configured at an acute angle to the longitudinal axis 115 of the muzzle break 105, and the two slots 114 in the cross section form the angle 116 between themselves, equal to 80-90 degrees, and the slots 114 in the assembled muzzle break 105 form an inclined channel 349 to ensure development of the exhaust gas jet stream 352 of the propellants, and a holes 120 are made on the outside of the threaded section 108, configured for the screws of the muzzle break 49 at assembling the muzzle break 105;

the barrel 9A has the smooth inner channel 121 without grooves, and from outside it is configured with a smooth cylindrical section 122, which passes into a threaded section with a buttress thread 123, which passes into a circular groove 124, which passes into a smooth cylindrical section 125 with a groove 126 to interact with the barrel latch 10, and the smooth cylindrical section 125 passes into a cylindrical section 127, which passes into a cylindrical section 128 with a slots 129 along the outer perimeter, and all said sections of the barrel 9A are different in thickness;

the multifunctional cartridge 11 comprising a threaded bushing 133, a spring half-rings 134 configured to interact with the careless ammunition 38, a inner smooth bushing 135 with grooves for the spring half-rings 134, at least one a middle bushing 136 and an outer bushing with variable diameter 137, which has a bigger diameter 138, and the threaded bushing 133 configured with two or more threaded slots, and the bushings 133, 135, 136 and 137 are inserted into each other with tension, and the outer surfaces of the bushings 133, 135, 136 and 137 are polished to a full gloss;

the conical bushing of the receiver 13 has a cylindrical section 139, which passes into a smaller cylindrical section 140, and a conical hole 141 is disposed inside of said conical bushing 141, and configured to interact with the conical bushing of the bolt 24, the small base of which is disposed at the end of the cylindrical section 139;

the receiver 13 is configured with cylindrical part 142, where at the end of the cylindrical part 142, the multi-layered cylindrical hole with threaded section 143 is configured for mounting of the conical bushing of the receiver 12, installation of the multifunctional cartridge 11 and the barrel, and at the inlet of said multi-layered cylindrical hole with threaded section 143 a cross-threaded hole 144 is configured from the bottom to mount the barrel latch 10, and the said multi-layered cylindrical hole with threaded section 143 passes into a cylindrical groove 145, and the cylindrical groove 145 passes into a complex-shaped section 146, which repeats the shape of the front part of the bolt body 25, and at inlet of the complex-shaped section 146, two cylindrical guiding chamfers 147 are disposed, and on top of the receiver 13 a rail 148 is configured to attach the brackets for different sights, and the rear end of the cylindrical part 142 passes into a complex-shaped bar 149, ended with a console 150 having a protrusion 151 at its end, in which a hole 152 is disposed to mount the upper screw 36; and also at the point of abutment of the console 150 against the complex-shaped bar 149, a leading notch 153 is made with the protrusion 154 and a slot 155 at the bottom of the leading notch 153 of the complex-shaped bar 149 to interact with the leading protrusion 75 of the bolt body 25, as well as a hole 156 in the complex-shaped bar 149 is configured for the magazine 7, a window 157 to eject the ammunition 38, the guiding slots 158 configured for passage of the locking lugs 72 of the bolt body 25, and also, f stepped through-hole 159 for passage of the bolt body 25, and at the junction of the console 150 to the bar of complex-shaped 149 there is a protrusion 160 with a blind hole 161 and the protrusion with a through-hole 162 are configured to interact with the safety 15 and the safety spring 14; between the projection 160 and the projection with the through-hole 162, a slot 163 is disposed, and a through slot 164 is configured in the projection with the through-hole 162 to mount the safety 15, and a blind slots 165 are configured to fix the safety 15 in the "fire" position and to set and release the bolt 4 from the weapon 1C, and a slot 166 is configured in the console 150 for passage of the firing hammer 26 or 26K, and a trapezoidal hole 167 for passage of the trigger bar 17, as well as a rectangular hole 168 at the bottom of the projection 160 and the projection with a through-hole 162 in the guide slot 158 is configured to mount a fixing plate 178 of the safety 15, and a projection 169 is configured in the lower part of the complex-shaped bar 149 to retain the magazine latch 19 in the open position, and a protrusion 170 with a blind threaded hole 171 configured for the lower screw 37;

the safety 15 in the form of an axis 172 with a blind hole 173 is configured to interact with the safety spring 14, and the axis 172 passes into a base 174 configured in the form of the plate, and a protrusion 175 is disposed on the base 174 to interact with the blind slot 165 of the receiver 13 to retain the safety 15 in the "fire" position and to set and release the bolt 4 from the weapon 1A, and the base 174 passes into a thumb piece 176 configured in the form of the complex-shaped plate, and a cylindrical protrusion 177 is disposed at the end of the thumb piece 176, where the fixing plate 178 with the safety lug 179 is made at the abutment of the base 174 against the thumb piece 176, configured to interact with the locking lug 72 of the bolt body 25 and to fix the locking lug 72 in the receiver 13, and the safety lug 179 interacts with the rectangular hole 86 of the bolt body 25 and is configured to fix the bolt 4 in the receiver 13, and a conical protrusion 180 on the side surface of the thumb piece 176 is configured to interact with the hammer 94 of the firing hammer 26;

the trigger bar 17 is configured in a form of a complex-shaped plate 294 with a protrusion 295 at one end, and the protrusion 295 has a radius surface 296 and the sear platform 297 configured to interact with the platform of the cocking stud 97 of the firing hammer 26, and at the other end of the plate 294 a trigger bar 298 is disposed in the form of the bracket, and in the center of the plate 294 a protrusion 299 with a through-hole 300 is disposed for the axis 20, and a hole 301 is configured between the protrusion 295 and the protrusion 299 of the plate 294 to interact with a long bent end 292 of the trigger bar spring 18;

the magazine latch 19 is configured in a form of a lever 302 made of complex-shaped plate with a button 303 at one end, and a support platform 304 is made on the button 303, and a console 305 is configured in the form of the rectangular rod at the other end of the lever 302, and a slot 306 is disposed in the center of the console 305 to interact with the trigger bar spring 18, while above the button 303 a protrusion 307 is disposed with a hole 308 and a slot 309 configured to interact with a short bent end 293 of the trigger bar spring 18, as well as a hole 310 to interact with the axis 20;

the trigger guard with the magazine box 16 is configured in a form of complex-shaped plate 311 with a cylindrical protrusion 312 with the hole 312A purposed for the lower screw 37, and a slot 313, and at the end of the plate 311, a trigger guard 314, a complex-shaped protrusion 315, the slot 313 are disposed, and the projection 315 has a through-hole 316 configured for the axis 20 and the hole 316A for the cross screw 34, and a threaded hole 317 is disposed in front of the trigger guard 314 in the plate 311, configured for the upper screw 36, as well as a magazine box 318 is in the centre of the plate 311 configured to interact with the magazine 7, and a slot 319 with the inclined platform 320 is configured to interact with the magazine latch 19;

the handguard 248 is configured in a form of a complex-shaped bar 249 with a complex-shaped through-hole 250 disposed inside to interact with the protrusion 170 of the receiver 13, and a stepped hole 251 is made in the bar 249 configured to interact with the barrel latch 10, and a longitudinal blind hole 252 configured to interact with the threaded bushing of the bipod 33;

the hunting gunstock containing the gunstock 8 with a threaded bushings 30, on which a back plate 31A is installed and fixed with the screws of a back plate 32 in the threaded bushings 30, and also the threaded bushing 33 is installed in the gunstock 8.

According to the third variant of the invention, the caseless magazine weapon 1C, 515 which contains a bolt 4 interacting with a receiver 13, configured to reciprocate and rotate about the axis in a guiding slots 158 of the receiver 13, and the said receiver 13 is mounted in a skeletal buttstock 29C, a handguard 248, and fixed by a trigger guard with the magazine box 16, an upper screw 36 and a lower screw 37, and the skeletal buttstock 29C is fixed by a cross screw 34, the nut of the cross screw 35, and, in the trigger guard with magazine box 16, 520 a magazine 7 is installed; the trigger bar 17 is installed on an axis 20 and configured for axial rotation, and interacting with a firing hammer 26, a trigger bar spring 18 and a magazine latch 19 on the axis 20, configured to ensure axial rotation, and the said trigger bar 17 and the magazine latch 19 are spring-loaded by the trigger bar spring 18, and the magazine latch 19 interacts with the magazine 7, and a conical bushing 12 of a receiver 13 is mounted in the 525 receiver 13 and a multifunctional cartridge 11 is mounted on said conical bushing of the receiver 12; a barrel 9C with the muzzle break 105 screwed on the front end of it and fixed by the screws of the muzzle break 49, and the rear end is screwed into the receiver 13 and fixed by a barrel latch 10; a safety 15, spring-loaded through a safety spring 14, which is disposed in the receiver 13 and configured to reciprocate and to rotate about the axis; fixed at 530 front side by a latch of the bipod 51 in the handguard 248 a folding adjustable bipod 50; an adjustable cheek piece 42 fixed on the skeletal buttstock 29C by a latches of adjustable cheek piece 43; a adjustable back plate 31C fixed on the skeletal buttstock 29C by a latch of the adjustable back plate 41; the handguard 248, in which by the invention, the bolt 4 contains a firing pin 21, which is mounted in a conical bushing of the bolt 24 and configured to rotate on the firing pin 21 and at the same time, it is permanently pressed by the spring of the firing pin latch 22 to a bolt body 25, and the firing pin 21 is installed in a through-hole 82 of the bolt body 25 with ability to reciprocate; it is loaded by the spring of the firing pin latch 22 and fixed by a firing pin latch 23, inserted into a central blind cylindrical channel 79 of the bolt body 25 and configured to reciprocate, and the bolt 4 contains the firing hammer 26 installed into the central blind cylindrical channel 79 and configured for reciprocal motion; and the mainspring capable to compress and expand in the firing hammer 26 is disposed inside the firing hammer 26 and fixed by a mainspring latch 28 in the bolt body 25;

the firing pin 21 is configured in the form of stepped shaft, which has a conical part 52 at front, which passes into a cylindrical part with the smaller diameter 53, and an inclined protrusion 54 is formed at the joint of the conical part 52 and the cylindrical part with the smaller diameter 53, and the angle of the inclined protrusion d54 relative to the axis of the firing pin 55 is equal to 30-45 degrees, and the cylindrical part with the smaller diameter 53 passes into a cylindrical part with the bigger diameter 56, which passes into a cylindrical piston 57, and said the cylindrical piston 57 passes into the rod section with the grooves 58, where a rear groove 59 passes into a square part 60 with a cylindrical protrusions 61 disposed at the end of the square part 60, and the rear grooves 59, the square part 60 and the cylindrical protrusions 61 interact with the firing pin latch 23;

the conical bushing of the bolt 24 is configured to rotate on the firing pin 21 and pressed by the spring of the firing pin latch 22 to a glazed area 78 at the end of a cylindrical head 70 of the bolt body 25, and the said conical bushing of the bolt 24 is configured in the form of a truncated cone 62 with a blind conical hole 63, which passes into a hole 64, which forms the wall 65 at the outlet of the big base of the truncated cone 62, and at inlet of the blind conical hole 63 there are at least three a protrusions 66, which interact with a caseless ammunition 38;

the bolt body 25 has a cylindrical part 67, which passes into a thinner cylindrical part 68, where a slots 69 are disposed along the perimeter of outer part of the thinner cylindrical part 68, and the thinner cylindrical part 68 passes into the cylindrical head 70, the trigger guard with the magazine box 16 and a chamfer 71 is disposed at the passage from the cylindrical part 67 into the thinner cylindrical part 68, and at the passage from the thinner cylindrical part 68 into the cylindrical head 70 a locking lugs 72 are made in the form of two protrusions with the ends made in the form of a radius surfaces 73, and the corbelling protrusion consisting of a base 74 and a leading protrusion 75, configured to interact with the leading notch 153 of the receiver 13, and the leading protrusion 75 is the third locking lug of the bolt 4 and interacts with the protrusion 154 of the receiver 13, and the leading protrusion 75 is provided with a handle 76 in the form of the rod with a ball at the end, and at the end face of the base 74 a area 77 is disposed to interact with the leading notch 153 of the receiver 13, and the handle 76 is disposed at an angle to the locking lugs 72, and the face end of the cylindrical head 70 has the glazed area 78 to interact with the conical bushing of the bolt 24;

the central blind cylindrical channel 79 is disposed inside the bolt body 25 and configured to interact with the firing hammer 26, the spring of the firing pin latch 22, the firing pin latch 23, and in the rear part of the central cylindrical channel 79, there are two a lead-in slots 80 and a groove 81 to interact with a protrusions 102 of the mainspring latch 28; whereupon in the front end of the central cylindrical channel 79 the through-hole 82 is disposed to interact with the firing pin 21, and at an end 83 of the cylindrical part 67 are made two screwed protrusions 84 with a screwed surfaces 85 configured to interact with firing hammer 26 are disposed, and the cylindrical part 67 has a rectangular hole 86 to interact with a safety lug 179 of the safety 15;

the firing pin latch 23 is made in the form of a washer 87 with a blind hole 88, a through-hole 89 is made behind the blind hole 88, which repeats the shape of the end of the square part 60 with the cylindrical protrusions 61 of the firing pin 21, and in the washer 87 at inlet of the blind hole 88, a spinways 90 are disposed, and the through-hole 89 in the washer 87 forms a projections 91, configured to fix the firing pin latch 23 on the firing pin 21;

the firing hammer 26 is configured as a rod 92 with a grooves 93 at one end, and at the other end of the rod 92 the hammer 94 is disposed in the form of the rectangular bar, and the a 95 is made in the hammer 94 and in the adjacent part of the rod 92, configured to interact with the firing hammer 26 with the mainspring latch 28, and a blind hole 96 is disposed inside the firing hammer 26 to interact with a mainspring 27, and at the bottom of the hammer 94, from the side of the rod 92, the cocking stud area 97 is disposed to interact with a sear platform 297 of the trigger bar 17;

the firing hammer 26K configured as the rod 92 with a washer 98 with a slots 99 at one end, and a holes 100 are on the side surface of the rod 92, and at the other end of the rod 92, there is a hammer 94 configured as the rectangular bar, and the slot 95 is disposed in hammer 94 and in the adjacent part of the rod 92 to interact with the firing hammer 26K with the mainspring latch 28, and the blind hole 96 is disposed inside the firing hammer 26K to interact with the mainspring 27, and at the bottom of the hammer 94, from the side of the rod 92, the cocking stud area 97 is disposed to interact with the sear platform 297 of the trigger bar 17;

the mainspring latch 28 is configured in the form of a rod 101 with the two protrusions 102 at one end of the rod 101, and this end passes into a smaller diameter rod 103, and a blind hole 104 is disposed inside the mainspring latch 28;

the muzzle break 105 contains a lower part of the muzzle break 47, in which an upper part of the muzzle break 48 is mounted, and these parts are interconnected by the screws of the muzzle break 49;

the lower part of the muzzle break 47 is configured in the form of the plate 106 with inside a groove 107 at the inlet, which passes into the threaded section 108, which passes into the groove 107, which passes into a smooth conical part 109, and the threaded section 108 and the smooth conical part 109 are configured to fix the barrel 9A, and behind the conical part 109, a smooth cylindrical section 110 is disposed with diameter corresponding to an inner channel of the barrel 121, which passes into a cylindrical groove 112, configured to assemble the upper part of the muzzle break 48, and after the assembly of the muzzle break 105, it forms the lock time chamber 347, and the cylindrical groove 112 passes into an outer tube 113, and in the place of the smooth cylindrical section 110 and the cylindrical groove 112, a two slots 114 are disposed at an acute angle to a longitudinal axis 115 of the muzzle break 105, and the two slots 114 in the cross section form an angle 116 between themselves, equal to 80-90 degrees, and the slots 114 in the assembled muzzle break 105 form an inclined channel 349 to ensure development of the exhaust gas jet stream 352 of the propellants, and a threaded holes 117 are made on the outside of the threaded section 108, configured for the screws of a muzzle break 49 at assembling the muzzle break 105;

the upper part of the muzzle break 48 is configured in the form of a plate 106 with the groove 107 at the inlet, which passes into a threaded section 108, which passes into the groove 107, which passes into the smooth conical part 109, and the threaded section 108 and the smooth conical part 109 are configured to fix the barrel 9A, and behind the conical part 109 the smooth cylindrical section 110 with diameter corresponding to the inner channel of the barrel 121 is disposed, which passes into a cylindrical groove 111, and the cylindrical groove 111 is configured to assemble the lower part of the muzzle break 47 and after assembling the muzzle break 105 the lock time chamber 347 is formed in it, and the cylindrical groove 111 passes into an inner tube 118 with an inner smooth hole 119 with diameter corresponding to the inner channel diameter of the barrel 121, and in the place of the smooth cylindrical section 110 and the cylindrical groove 111, the two slots 114 are configured at an acute angle to the longitudinal axis 115 of the muzzle break 105, and two slots 114 in the cross section form the angle 116 between themselves, equal to 80-90 degrees, and the slots 114 in the assembled muzzle break 105 form the inclined channel 349 to ensure development of the exhaust gas jet stream 352 of the propellants, and a holes 120 are made on the outside of the threaded section 108, configured for the screws of the muzzle break 49 at assembling the muzzle break 49;

the barrel 9C has the smooth inner channel 121 without grooves, and from outside it is configured with a smooth cylindrical section 122, which passes into a threaded section with the buttress thread 123, which passes into a circular groove 124, which passes into a smooth cylindrical section 125 with a groove 126 to interact with the barrel latch 10, and the smooth cylindrical section 125 passes into a cylindrical section 127, which passes into a cylindrical section 128 with a slots 129 along the outer perimeter, which passes into a slot 130, and all said sections of the barrel 9C are different in thickness;

the multifunctional cartridge 11 comprising a threaded bushing 133, a spring half-rings 134 configured to interact with the careless ammunition 38, a inner smooth bushing 135 with grooves for the spring half-rings 134, at least one a middle bushing 136 and an outer bushing with variable diameter 137, which has a bigger diameter 138, and the threaded bushing 133 configured with two or more threaded slots, and the bushings 133, 135, 136 and 137 are inserted into each other with tension, and the outer surfaces of the bushings 133, 135, 136 and 137 are polished to a full gloss;

the conical bushing of the receiver 13 has a cylindrical section 139, which passes into a smaller cylindrical section 140, and a conical hole 141 is disposed inside of said conical bushing 141, and configured to interact with the conical bushing of the bolt 24, the small base of which is disposed at the end of the cylindrical section 139;

the receiver 13 is configured with cylindrical part 142, where at the end of the cylindrical part 142, the multi-layered cylindrical hole with threaded section 143 is configured for mounting of the conical bushing of the receiver 12, installation of the multifunctional cartridge 11 and the barrel, and at the inlet of said multi-layered cylindrical hole with threaded section 143 a cross-threaded hole 144 is configured from the bottom to mount the barrel latch 10, and the said multi-layered cylindrical hole with threaded section 143 passes into a cylindrical groove 145, and the cylindrical groove 145 passes into a complex-shaped section 146, which repeats the shape of the front part of the bolt body 25, and at inlet of the complex-shaped section 146, two cylindrical guiding chamfers 147 are disposed, and on top of the receiver 13 a rail 148 is configured to attach the brackets for different sights, and the rear end of the cylindrical part 142 passes into a complex-shaped bar 149, ended with a console 150 having a protrusion 151 at its end, in which a hole 152 is disposed to mount the upper screw 36; and also at the point of abutment of the console 150 against the complex-shaped bar 149, the leading notch 153 is made with a protrusion 154 and a slot 155 at the bottom of the leading notch 153 of the complex-shaped bar 149 to interact with the leading protrusion 75 of the bolt body 25, as well as a hole 156 in the complex-shaped bar 149 is configured for the magazine 7, a window 157 to eject the ammunition 38, the guiding slots 158 configured for passage of the locking lugs 72 of the bolt body 25, and also, a stepped through-hole 159 for passage of the bolt body 25, and at the junction of the console 150 to the bar of complex-shaped 149 there is a protrusion 160 with a blind hole 161 and the protrusion with a through-hole 162 are configured to interact with the safety 15 and the safety spring 14; between the projection 160 and the projection with the through-hole 162, a slot 163 is disposed, and a through slot 164 is configured in the projection with the through-hole 162 to mount the safety 15, and a blind slots 165 are configured to fix the safety 15 in the "fire" position and to set and release the bolt 4 from the weapon 1C, and a slot 166 is configured in the console 150 for passage of the firing hammer 26 or 26K, and a trapezoidal hole 167 for passage of the trigger bar 17, as well as a rectangular hole 168 at the bottom of the projection 160 and the projection with the through-hole 162 in the guide slot 158 is configured to mount a fixing plate 178 of the safety 15, and a projection 169 is configured in the lower part of the complex-shaped bar 149 to retain the magazine latch 19 in the open position, and a protrusion 170 with a blind threaded hole 171 configured for the lower screw 37;

the safety 15 in the form of an axis 172 with a blind hole 173 is configured to interact with the safety spring 14, and the axis 172 passes into a base 174 configured in the form of the plate, and a protrusion 175 is disposed on the base 174 to interact with the blind slot 165 of the receiver 13 to retain the safety 15 in the "fire" position and to set and release the bolt 4 from the weapon 1A, and the base 174 passes into a thumb piece 176 configured in the form of the complex-shaped plate, and a cylindrical protrusion 177 is disposed at the end of the thumb piece 176, where the fixing plate 178 with the safety lug 179 is made at the abutment of the base 174 against the thumb piece 176, configured to interact with the locking lug 72 of the bolt body 25 and to fix the locking lug 72 in the receiver 13, and the safety lug 179 interacts with the rectangular hole 86 of the bolt body 25 and is configured to fix the bolt 4 in the receiver 13, and a conical protrusion 180 on the side surface of the thumb piece 176 is configured to interact with the hammer 94 of the firing hammer 26;

the trigger bar 17 is configured in a form of a complex-shaped plate 294 with a protrusion 295 at one end, and the protrusion 295 has a radius surface 296 and the sear platform 297 configured to interact with the platform of the cocking stud 97 of the firing hammer 26, and at the other end of the plate 294 a trigger bar 298 is disposed in the form of the bracket, and in the center of the plate 294 a protrusion 299 with a through-hole 300 is disposed for the axis 20, and a hole 301 is configured between the protrusion 295 and the protrusion 299 of the plate 294 to interact with a long bent end 292 of the trigger bar spring 18;

the magazine latch 19 is configured in a form of a lever 302 made of complex-shaped plate with a button 303 at one end, and a support platform 304 is made on the button 303, and a console 305 is configured in the form of the rectangular rod at the other end of the lever 302, and a slot 306 is disposed in the center of the console 305 to interact with the trigger bar spring 18, while above the button 303 a protrusion 307 is disposed with a hole 308 and a slot 309 configured to interact with a short bent end 293 of the trigger bar spring 18, as well as a hole 310 to interact with the axis 20;

the trigger guard with the magazine box 16 is configured in a form of complex-shaped plate 311 with a cylindrical protrusion 312 with the hole 312A purposed for the lower screw 37, and a slot 313 at one end, and at the other end of the plate 311 there is a trigger guard 314, a complex-shaped protrusion 315, the slot 313, and the projection 315 has a through-hole 316 configured for the axis 20 and the hole 316A—for the cross screw 34, and a threaded hole 317 is disposed in front of the trigger guard 314 in the plate 311, configured for the upper screw 36, as well as a magazine box 318 is in the centre of the plate 311 configured to interact with the magazine 7, and a slot 319 with the inclined platform 320, which are configured to interact with the magazine latch 19;

the handguard 248 is configured in the form of the complex-shaped bar 249 with a complex-shaped through-hole 250 disposed inside to interact with the protrusion 170 of the receiver 13, and a stepped hole 251 is made in the bar 249 configured to interact with the barrel latch 10, and a longitudinal blind hole 252 configured to interact with a threaded bushing of the bipod 33;

the folding adjustable bipod 50 contains a bipod bracket 253 configured for axial rotation on the latch of the bipod—51, bipod stubs 255 installed on the bipod bracket 25 and fixed with screws of bipod stubs 254, and they are configured for axial rotation on the screws of the bipod stubs 254; it also contains bipod stubs latches 256 configured to reciprocate and is spring-loaded by plate springs 257, and interact at the same time with the bipod bracket 253 and the bipod stubs 255, it also contains conical nuts 258 and withdrawable locks 259;

the bipod bracket 253 is configured in a form of a flat bent plate 260 of complex shape with the protrusions 261 at the ends, and through-holes 262 are disposed in the protrusions 261 and configured for the screws of the bipod stubs 254, and semi-circular conical holes 263 are disposed on the external walls of the protrusions 261 configured for interaction and fixing the bipod stubs 255 in the bipod bracket 253 by the bipod stubs latch 256, and the external walls of the protrusions 261 are configured radius 264, and through-hole 265 configured to interact with the latch of the bipod 51 is disposed in a center of the flat bent plate 260;

the bipod stubs latch 256 is configured in the form of the stepped cylinder, which starts from a release button 266, which passes into a cylindrical part 267 with a smaller diameter, which passes into a cylindrical part 268 with a smaller diameter, which passes into a conic-cylindrical part 269 with a larger diameter, which passes into a cylindrical part 270 with a smaller diameter, which ends with a washer 271;

the bipod stub 255 is configured in the form of a complex-shaped plate 272, which passes into a tube 273, and a through slot 274 is disposed in the upper part of the plate 272 and configured to interact with the bipod bracket 253, as well as a through threaded hole 275 configured to interact with the screw of the bipod stub 254, and a through-hole 276 is disposed in the lower part of the plate 272 to interact with the bipod stubs latch 256, and the tube 273 passes into a cylindrical section with an outer thread 277, which passes into a radius groove 278, and the groove 278 passes into the conical head with through cross slots 279, which form lugs of retaining clamps 280, and a cylindrical protrusion 281 is disposed at the ends of the lugs of the retaining clamps 280 configured to fix the withdrawable lock 259, and a longitudinal hole 282 is disposed inside the bipod stub 255 configured to interact with the withdrawable lock 259;

the conical nut 258 is configured in the form of a cylindrical section with a notch 283, which passes into a conical section 284, a threaded section 285 is disposed inside the cylindrical section 283, which passes into a groove 286, which passes into an inner conical section 287;

the withdrawable lock 259 is configured in a form of a rod 288 with a cylinder-conical head 289 at one end, and a cylindrical head 290 at the other end, with grooves 291 disposed along the entire length of the rod 288;

the skeletal buttstock 29C is configured in the form of a complex-shaped bar 181 with a through hole 182 disposed inside, which has formed a firing handle 183, a rack 184, a lower jumper 185, a upper jumper 186, and a console 187 is disposed in the bar 181 at the side of the rack 184, and a grasp 188 is configured in the bar 181 at the side of the firing handle 183, and a blind longitudinal hole 189 is disposed in the console 187 to interact with the adjustable back plate 31C, and a threaded holes 190 to interact with the latch of the adjustable back plate 41, besides, the side surfaces of the console 187 has the rows of a spherical recesses 191 to interact with a retaining pin 212 for the adjustable back plate latch 41, and a slots 192 are disposed inside the grasp 188 configured to mount the receiver 13, and a slots 193 configured to mount the trigger guard with magazine box 16, and a cross hole 194 is disposed in the grasp 188 configured to mount the cross screw 34 and the nut of the cross screw 35, and also a vertical hole 195 is made to mount the upper screw of the trigger guard with the magazine box 36, and a hole 196 is disposed in a rack 184 to mount a threaded bushing of the stop lock 46, which passes into a conical hole 197 configured to interact with the stop lock 45, and the conical hole 197 passes into a blind hole 198 configured to interact with a stop 44;

the stop lock 45 is configured in the form of a cylindrical section with the notches 199, which passes into a groove 200, which passes into a cylindrical section with an outer thread 201, which passes into a radius groove 202, which passes into the conical head with the through cross slots 203, which form the lugs of the retaining clamps 204, and a cylindrical protrusion 205 is made at the ends of the lugs of the retaining clamps 204, which is configured to fix the stop 44, and a hole 206 is made inside the stop lock 45 to interact with the stop 44;

the stop 44 is configured in the form of a rod 207 with a cylindrical head 208 at one end with the disk with notches at the other end, and the grooves 210 are disposed along the entire length of the rod 207;

the latch of the adjustable back plate 41 containing an adjusting screw 211, in which a blind hole 218 with a threaded section 219 and a through-hole 220 is disposed, the retaining pin 212 configured to reciprocate is spring-loaded by a retaining pin spring 213, and the retaining pin spring 213 interacts with the retaining pin 212 at one side and fixed by a stop screw 214 at another side, it is capable to compress and expand in the blind hole 218;

the adjusting screw 211 is configured in the form of a threaded rod 215 with a cylindrical head 216, with a semi-circular slots 217, and the blind hole 218 with the threaded section 219 is disposed inside the adjusting screw 211, and the blind hole 218 passes into the through-hole 220;

the adjustable back plate 31C contains a back plate bracket 221 into which a back plate extension piece 222 and a back plate 223 are installed, which are connected to the back plate bracket 221 by the back plate screws 224;

the back plate bracket 221 is configured in the form of a longitudinal plate 225 and a transverse plate 226 connected at right angles to each other, and a slot 227 is disposed at side surfaces of the longitudinal plate 225 and a number of spherical recesses 228 are disposed inside the slot, and the slot 227 and the spherical recesses 228 are configured to interact with the latch of the adjustable back plate 41, and the transverse plate 226 repeats the shape of the back plate 223, and a complex-shaped blind hole 229 is disposed inside the transverse plate 226 to fix the back plate extension piece 222, and threaded holes 230 are disposed inside the transverse plate 226 and configured for the back plate screws 224;

the adjustable cheek piece 42 containing a cheek piece clamp 231 rigidly connected to a cheek piece 232 by cheek piece screws 233, and the adjustable cheek piece latches s 43 are made in the form of the threaded rod with the ring spring and the cylindrical head with semi-circular slots to interact with rests of the cheek piece clamp 234 configured to reciprocate in the cheek piece clamp 231, and they are configured for joint reciprocal motion with the latches of the adjustable cheek piece 43;

the cheek piece clamp 231 is configured in a form of a bent plate 235 with free ends 236, whereoutside the free ends 236 protrusions 237 are configured, and at the edges of the protrusions 237 through-holes 238 are configured to interact with the rests of the cheek piece clamp 234, and in the center of the protrusions 237 threaded holes 239 are configured to interact with the latches of the adjustable cheek piece 43, and in the upper part of the bent plate 235 the threaded holes 240 are configured to interact with the cheek piece screws 233;

the rest of the cheek piece clamp 234 containing sleeve stop 241, in which into the blind holes with the threaded section 245 and through holes 246 the retaining pins 212 are installed which are configured to reciprocate and spring-loaded by the retaining pin spring 213, and the retaining pin springs 213 interacts with the retaining pin 212 at one side, and at another side, it is fixed by thrust screws 242 and capable to compress and expand in the blind holes with the threaded section 245;

the sleeve stop 241 is configured in a form of a plate 243 with cylindrical protrusions 244 disposed at the ends of the plate 243, and the blind holes with the threaded section 245 and the through-holes 246 are configured in the cylindrical protrusions 244 to interact with the retaining pin 212, the retaining pin spring 213, the thrust screw 242, and in the center of the plate 243 a threaded hole 247 is configured to interact with the latches of the adjustable cheek piece 43.

Preferably, the threaded bushing 133 and an inner smooth bushing 135 are made of 840 carbide and refractory material.

Preferably, the spring half-rings 134 are made of carbide and refractory material.

In the proposed weapons 1A, 1B, 1C, facilitation of cocking, charging and discharging is attained by the fact that: when the bolt 4 is pushed back after firing, ammunition 38 is not available, and in case of the failure to fire, ammunition 38 possesses the free gap between the walls of the multifunctional cartridge 11, taking into account the cone ratio of the conical bushing 24 of the bolt 4, the extraction of ammunition 38 and facilitated discharge of the weapons 1A, 1B, 1C is facilitated.

The trigger bar spring 18 is cocked in case of closing of the bolt, when the bolt 4 gains the maximum run-out impulse, the cocking force is thus reduced, and loading of the weapon 1A, 1B, 1C is facilitated.

As for the proposed weapon 1A, 1B, 1C, the extraction is facilitated with enhancement of its reliability by the fact that: to extract the ammunition 38, it is necessary to open and to pull back the bolt 4 up to extreme rear position, and the rear part of the ammunition 38 is in the conical bushing 24, in the bolt 4, and bears against the protrusions 66, and the rear part of the ammunition 38 is retained in the cylindrical part of smaller diameter 53 by means of inclined protrusion 54 of the firing pin 21 using the expanding ring 323 disposed in a external marker-washer 324 and the inner washer 325 of the ignition block 326), in case of mechanical extraction. For the purpose of magnetic extraction of ammunition 38, there is a magnetic extraction marker-washer 328 within the ignition block 327, which is magnetized to the firing pin 21. The gap 330 is disposed between the end of the conical part 52 of the firing pin 21 and the capsule with the anvil 329 of the ignition block 326 or 327. The gap 330 between the end of the conical part 52 of the firing pin 21 and the capsule with the anvil 329 of the ignition block 326 or 327, ensures impossibility for the primer with the anvil 329 to be pined on by the conical part 52 of the firing pin 21, which contributes to the security of the charging and recharging cycle. Further, it is necessary to remove the ammunition 38 from the weapon 1A, 1B, 1C using the magnet 331 or the hand extractor 332 configured in the form of the rod with the semi-circular plate.

In accordance with the second method of extraction of the ammunition 38, it is required to turn a safety 15 into the middle position, to open, and to remove the bolt 4 from the weapon 1A, 1B, 1C. Hereafter, remove by hand the ammunition 38 from the bolt 4 and install the bolt 4 in the receiver 13, delivering another ammunition 38 from the magazine 7 to a cartridge 11 of the receiver, if required. Set the safety 15 into the position of protection. This ensures the facilitation of the extraction and enhancement of its reliability.

Assurance of reliability of the weapon 1A, 1B, 1C. in the combat conditions, with a forced supply of the ammunition 38, including contaminated ones, is achieved by the fact that: when manually feeding of ammunition, including the contaminated ones, from the magazine 7 into the multifunctional cartridge 11, the ammunition 38 has the free gap between the walls of the multifunctional cartridge 11, and this enhances the reliability of the weapon in the combat conditions.

Use of the present invention ensures accurate adjustment, as well as flexibility in the application of the skeletal buttstock with the adjustable back plate and the cheek piece 6C by the shooters with different anthropological characteristics in accordance with the need to solve various combat missions. This is achieved by the fact that; for vertical and horizontal adjustment of the adjustable cheek piece 42, it is necessary to unscrew the latches of the adjustable cheek piece 43 from the threaded holes 239 of the cheek piece clamp 231 at a distance so that the sleeve stops 241 displaced by the spring rings of the latches of the adjustable cheek piece 43, will move away from the spherical recesses 191 on the side surfaces of the console 187 of the skeletal gunstock 29C, and with them, the retaining pins 212 of the sleeve stop 241 will be displaced at a distance at which the spherical sections of the retaining pin 212, spring-loaded by the retaining pin spring 213, begin to drop out of the spherical recesses 191. In such conditions, the adjustable cheek piece 42 will move vertically and horizontally within the area of the spherical recesses 191. After installing the adjustable cheek piece 42 in the position appropriate for the shooter, the latches of the adjustable cheek piece 43 should be tightened, and this will ensure secure fastening of the adjustable cheek piece 42 on the weapon 1C.

To adjust the length of the adjustable back plate 31C is required to unscrew the adjusting screws 211 for the adjustable back plate latch 41 from the threaded holes 190 of the skeletal buttstock 29C at a distance so that the adjusting screws 211 would displace the retaining pins 212 at a distance at which the spherical sections of the retaining pin 212, spring-loaded by the retaining pin spring 213, begin to drop out of the spherical recesses 228 of the back plate bracket 221. In such conditions, the adjustable back plate 31C is displaced over the length within the area of the spherical recesses 228. After installing the adjustable back plate 31C in the position appropriate for the shooter, the latches of the adjustable back plate 41 should be tightened, and this will ensure secure fastening of the adjustable back plate 31C on the weapon 1C.

To remove the adjustable back plate 31C from the skeletal buttstock 29C, it is required to unscrew the adjusting screws 211 to a distance at which the spherical parts of the retaining pin 212 move away from the slots 227 of the back plate bracket 221, and the adjustable back plate 31C can be removed.

To adjust the height of the stop 44 is required to unscrew the stop lock 45 by a couple of turns from the threaded bushing of the stop lock 46, and the lugs of the retaining clamps 204 of the stop lock 45 will move apart and the cylindrical protrusions 205 at the ends of the lugs of the retaining clamps 204 will release the stop 44, and it will be able to move freely in the blind hole 198 skeletal buttstock 29C. The drop-out of the stop 44 from the skeletal buttstock 29C is prevented by the cylindrical head 208 at the end of the rod 207 of the stop 44. After installing the stop 44 in the position appropriate for the shooter, the stop lock 45 should be tightened, while the lugs of the retaining clamps 204 of the stop lock 45 will be joined due to the conical hole 197 of the skeletal buttstock 29C, and the cylindrical protrusions 205 at the ends of the lugs of the retaining clamps 204 will fasten the stop 44 and it will not be able to move in the blind hole 198 of the skeletal buttstock 29C, which will ensure reliable fastening of the stop 44 on the weapon 1C.

To remove the stop 44 from the skeletal buttstock 29C, it is required to unscrew completely the stop lock 45 from the threaded bushing of the stop lock 46, then the stop lock will be removed together with the stop 44 as a single assembly unit, then the stop 44 is to dismantled by taking it out from the stop lock 45, this is possible due to the fact that the within a passage of the cylindrical head 208 the cylindrical protrusions 205 at the ends of the lugs of the retaining clamps 204 will freely move apart and pass the cylindrical head 208 with the rod 207 of the stop 44 through the hole 206 of the stop lock 45.

Use of the present invention ensures accurate adjustment, as well as flexibility in the application of the skeletal buttstock with the adjustable back plate and the cheek piece 6C by the shooters with different anthropological characteristics in accordance with the need to solve various combat missions. This is achieved by the fact that; for vertical and horizontal adjustment of the adjustable cheek piece 42, it is necessary to unscrew the latches of the adjustable cheek piece 43 from the threaded holes 239 of the cheek piece clamp 231 at a distance so that the sleeve stops 241 displaced by the spring rings of the latches of the adjustable cheek piece 43, will move away from the spherical recesses 191 on the side surfaces of the console 187 of the skeletal gunstock 29C, and with them the retaining pins 212 of the sleeve stops 241 will be displaced at a distance at which the spherical sections of the retaining pin 212, spring-loaded by the retaining pin spring 213, begin to drop out of the spherical recesses 191. In such condition, the adjustable cheek piece 42 will move vertically and horizontally within the area of the spherical recesses 191. After installing the adjustable cheek piece 42 in the position appropriate for the shooter, the latches of the adjustable cheek piece 43 should be tightened, and this will ensure secure fastening of the adjustable cheek piece 42 on the weapon 1C.

To adjust the length of the adjustable back plate 31C, is required to unscrew the adjusting screws 211 for the adjustable back plate latch 41 from the threaded holes 190 of the skeletal buttstock 29C at a distance so that the adjusting screws 211 would displace the retaining pins 212 at a distance at which the spherical sections of the retaining pin 212, spring-loaded by the retaining pin spring 213, begin to drop out of the spherical recesses 228 of the back plate bracket 221. In such condition, the adjustable back plate 31C is displaced over the length within the area of the spherical recesses 228. After installing the adjustable back plate 31C in the position appropriate for the shooter, the latches of the adjustable back plate 41 should be tightened, and this will ensure secure fastening of the adjustable back plate 31C on the weapon 1C.

To remove the adjustable back plate 31C from the skeletal buttstock 29C, it is required to unscrew the adjusting screws 211 to a distance at which the spherical parts of the retaining pin 212 move away from the slots 227 of the back plate bracket 221, and the adjustable back plate 31C can be removed.

To adjust the height of the stop 44 is required to unscrew the stop lock 45 by a couple of turns from the threaded bushing of the stop lock 46, and the lugs of the retaining clamps 204 of the stop lock 45 will move apart and the cylindrical protrusions 205 at the ends of the lugs of the retaining clamps 204 will release the stop 44 and it will be able to move freely in the blind hole 198 skeletal buttstock 29C. The drop-out of the stop 44 from the skeletal buttstock 29C is prevented by the cylindrical head 208 at the end of the rod 207 of the stop 44. After installing the stop 44 in the position appropriate for the shooter, the stop lock 45 should be tightened, while the lugs of the retaining clamps 204 of the stop lock 45 will be joined due to the conical hole 197 of the skeletal buttstock 29C, and the cylindrical protrusions 205 at the ends of the lugs of the retaining clamps 204 will fasten the stop 44 and it will not be able to move in the blind hole 198 of the skeletal buttstock 29C, which will ensure reliable fastening of the stop 44 on the weapon 1C.

To remove the stop 44 from the skeletal buttstock 29C, it is required to unscrew completely the stop lock 45 from the threaded bushing of the stop lock 46, then the stop lock will be removed together with the stop 44 as a single assembly unit, then the stop 44 is to dismantled by taking it out from the stop lock 45, this is possible due to the fact that the within a passage of the cylindrical head 208 the cylindrical protrusions 205 at the ends of the lugs of the retaining clamps 204 will freely move apart and pass the cylindrical head 208 with the rod 207 of the stop 44 through the hole 206 of the stop lock 45.

Use of the present invention ensures accurate adjustment, as well flexibility in the application of the folding adjustable bipod 50 in accordance with topographical relief if required to solve various combat missions. This is achieved by the fact that the folding adjustable bipod 50 is configured for lateral oscillation on the latch of the bipod 51, and it can be fixed in the desired position by screwing tightly to the weapon 1A or 1B or 1C by the latch of the bipod 51.

The bipod stub 255 of the folding adjustable bipod 50, can be folded into different positions and being fixed in these positions without any backlash. For this purpose, the button 266 of the bipod stubs latch 256 is to be pressed until it stops, and the conic-cylindrical part 269 of the bipod stubs latch 256 will come out of engagement with the semi-circular conical hole 263 of the bipod bracket 253, thus the bipod stub 255 will be able to rotate on the screw of the bipod stub 254 in the bipod bracket 253. Further, while holding the bipod stub latch 256 spring-loaded by the plate spring of the latch 257 in the pressed condition, the bipod stub 255 should be set in the desired position, and the bipod stubs latch 256 will be aligned with the semi-circular conical hole 263 of the bipod bracket 253. Then it is required to release the bipod stubs latch 256. Under the action of the plate spring of the latch 257, it is engaged by its conic-cylindrical part 269 of the bipod stubs latch 256 with the semi-circular conical hole 263 of the bipod bracket 253, and the bipod stub 255 will be fixed without any backlash. All above operations should be repeated for the second bipod stub 255.

To adjust the height of the withdrawable lock 259 it is required to unscrew the conical nut 258 by a couple of turns from the cylindrical section with the outer thread 277 of the bipod stub 255, and the lugs of the retaining clamps 280 of the bipod stub 255 will move apart and the cylindrical protrusions 281 at the ends of the lugs of the retaining clamps 280 will release the withdrawable lock 259 and it will be able to move freely in the longitudinal hole 282 of the bipod stub 255. The drop-out of the withdrawable lock 259 from the bipod stub 255 is prevented by the cylindrical head 290 at the end of the rod 288 of the withdrawable lock 259. After installing the withdrawable lock 259 in a position appropriate for the shooter, the conical nut 258 should be tightened, while the lugs of the retaining clamps 280 of the bipod stub 255 will be joined due to the conical section 287 of the conical nut 258, and the cylindrical protrusions 281 at the ends of the lugs of the retaining clamps 280 will fasten the withdrawable lock 259 and it will not be able to move in the longitudinal hole 282 of the bipod stub 255, which will ensure reliable fixation of the withdrawable lock 259 on the adjustable bipod 50 in any position.

To remove the withdrawable lock 259 from the bipod stub 255, it is required to unscrew completely the conical nut 258 from the cylindrical section with the outer thread 277 of the bipod stub 255, then the conical nut 258 will be removed together with the withdrawable lock 259 as a single assembly unit, then the withdrawable lock 259 is to dismantled by taking it out from the conical nut 258, this is possible due to the fact that the within passage of the cylindrical head 290 the cylindrical protrusions 281 at the ends of the lugs of the retaining clamps 280 will freely move apart and pass the cylindrical head 290 with the rod 288 of the withdrawable lock 259 through the longitudinal hole 282 of the bipod stub 255.

A distinctive feature of the proposed invention is the fact that within shot the ammunition 38 has surrounded by a large mass of metal—the multi-layered multifunctional cartridge 11, the receiver 13 and the bolt 4. The wall thickness of a projectile 335 is 1.5-2 times more if compared with the thickness of the cartridge wall in the traditional weapon, which ensures greater thermal inertia, and the free gap between the walls of the multifunctional cartridge 11 and the walls of the projectile 335 reduces the contact zone of heat transfer from the heated multifunctional cartridge 11 to the projectile 335. Thus, the moment of self-ignition of the ammunition 38 inside of the heated weapon 1A, 1B, 1C has moved away significantly.

Another feature of the proposed weapon is the fact that magazine caseless weapons 1A, 1B, 1C can be dismantled up to the factory level, and thereafter it can be assembled using the simple screw-driver under all conditions, that ensures repairs and replacement of the parts under field conditions in case of destruction of the weapon.

A brief description of the Figures related to the invention:

FIG. 1B and FIG. 4B show a side view of the weapon 1B.

FIG. 1C and FIG. 4C show a side view of the weapon 1C.

FIG. 86, FIG. 87, FIG. 88, FIG. 89, FIG. 90, FIG. 91, FIG. 92, FIG. 93 and FIG. 94 show operation of the proposed caseless weapon 1A, 1B, 1C when firing.

DESIGNATIONS IN THE FIGURES OF THE DRAWINGS USED IN THE DECLARED INVENTION

Figure 1A:
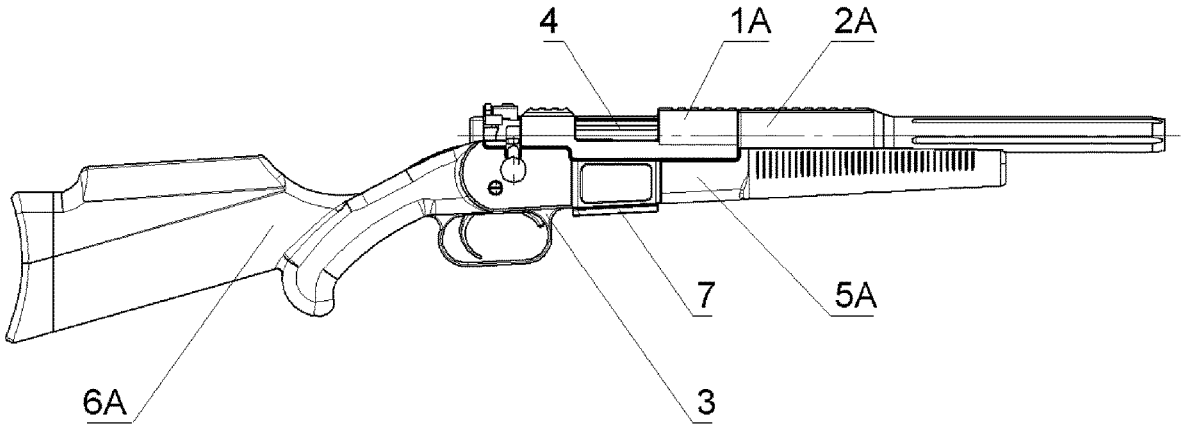
FIG. 1A and FIG. 2A show schematic side view of the weapon 1A.

1A—caseless magazine weapon with the handguard and the hunting buttstock;
1B—caseless magazine weapon with the hunting gunstock;
1C—caseless magazine weapon with nonintegrated handguard and the skeletal buttstock;
2A—receiver with barrel and mechanisms;
3—trigger guard with magazine box and mechanisms;
4—bolt;
5A—handguard;
5C—handguard with the bipods;
6A—hunting buttstock;
6B—skeletal buttstock with adjustable back plate and cheek piece;
7—magazine;
8—gunstock;
9A—barrel;
9C—barrel;
10—barrel latch;
11—multifunctional cartridge;
12—conical bushing of receiver 13;
13—receiver;
14—safety spring;
15—safety;
16—trigger guard with a magazine box;
17—trigger bar;
18—trigger bar spring;
19—magazine latch;
20—axis of the trigger bar and the magazine latch;
21—firing pin;
22—spring of the firing pin latch;
23—firing pin latch;
24—conical bushing of the bolt;
25—bolt body;
26—firing hammer;
27—mainspring;
28—mainspring latch;
29A—hunting buttstock;
29C—skeletal buttstock;
30—threaded bushing for the back plate screw;
31A—back plate;
31C—adjustable back plate;
32—back plate screws;
33—threaded bushing of the bipods;
34—cross screw of the buttstock;

35—nut of the cross screw;
36—upper screw;
37—lower screw;
38—caseless ammunition;
39—dowel screw;
40—dowel screw nut;
41—latch of adjustable back plate;
42—adjustable cheek piece;
43—latch of adjustable cheek piece;
44—stop;
45—stop lock 44;
46—threaded bushing of the stop lock;
47—lower part of muzzle break;
48—upper part of muzzle break;
49—screw of muzzle break;
50—folding adjustable bipod;
51—bipod latch 50;
52—conical part on the firing pin 21;
53—cylindrical part of firing pin 21 with smaller diameter;
54—inclined protrusion on the firing pin 21;
d54—angle of inclined protrusion on the firing pin 21;
55—axis of the firing pin;
56—cylindrical part of firing pin 21 with bigger diameter;
57—cylindrical piston on firing pin 21;
58—rod section with grooves on firing pin 21;
59—rear groove on firing pin 21;
60—square part on the firing pin 21;
61—cylindrical protrusions on firing pin 21;
62—truncated cone on the conical bushing of the bolt 24;
63—blind conical hole on the conical bushing of the bolt 24;
64—hole in the conical bushing of the bolt 24;
65—thick wall on the conical bushing of the bolt 24;
66—protrusion in the conical bushing of the bolt 24;
67—cylindrical part of the bolt body 25;
68—thinner cylindrical part of the bolt body 25;
69—slot on the bolt body 25;
70—cylindrical head of the bolt body 25;
71—chamfer on the bolt body 25;
72—locking lug of the bolt body 25;
73—radius surface of the bolt body 25;
74—base on the bolt body 25;
75—leading protrusion on the bolt body 25;
76—handle on the bolt body 25;
77—area on the bolt body 25;
78—glazed area on the bolt body 25;
79—blind cylindrical channel in the bolt body 25;
80—lead-in slot on the bolt body 25;
81—groove on the bolt body 25;
82—through-hole on the bolt body 25;
83—end face on the bolt body 25;
84—screwed protrusion on the bolt body 25;
85—the screwed surface of the bolt body 25;
86—rectangular hole on the bolt body 25;
87—washer of the firing pin latch 23;
88—blind hole in the washer 87;
89—through-hole in washer 87;
90—splineways on the washer 87;
91—protrusion in the washer 87;
92—rod on the firing hammer 26;
93—groove on the firing hammer 26;
94—hammer on the firing hammer 26;
95—slot in the firing hammer 26;
96—blind hole in the firing hammer 26;
97—the cocking stud area on the firing hammer 26;
98—washer of the firing hammer 26K;
99—slots on the firing hammer 26K;
100—holes of the firing hammer 26K;
101—rod of the mainspring latch 28;
102—protrusion on the mainspring latch 28;
103—a smaller diameter rod on the mainspring latch 28;
104—blind hole in the mainspring latch 28;
105—muzzle break;
106—plate of lower part of the muzzle break 47 of upper part of the muzzle break 48;
107—grooves in the plate 106;
108—threaded section in the plate 106;
109—smooth conical part in the plate 106;
110—smooth cylindrical section on the plate 106;
111—cylindrical groove at the upper 48 part of muzzle break;
112—cylindrical groove in the plate 106;
113—outer tube at the lower part 47 of muzzle break;
114—slots in the plate 106;
115—longitudinal axis of the muzzle break 105;
116—angle formed at the cross-section between two slots 114;
117—threaded holes outside the lower part of the muzzle break 47;
118—inner tube at the upper part of the muzzle break 48;
119—inner smooth hole in the inner tube 118;
120—holes at the upper part 48 of the muzzle break;
121—smooth inner channel in the barrel 9A and 9C;
122—smooth cylindrical section on the barrel 9A and 9C;
123—threaded section with buttress thread on the barrel 9A and 9C;
124—circular groove on the barrel 9A and 9C;
125—smooth cylindrical section on the barrel 9A and 9C;
126—groove on the barrels 9A and 9C;
127—conical part on the barrel 9A and 9C;
128—cylindrical section on the barrel 9A and 9C;
129—slots on the barrel 9A and 9C;
130—slot on the barrel 9C;
131—section with thread on the barrel 9C;
132—smooth conical part on the barrel 9B;
133—threaded bushing of the multifunctional cartridge 11;
134—spring-loaded half-rings in the multifunctional cartridge 11;
135—inner smooth bushing of the multifunctional cartridge 11;
136—middle bushing in the multifunctional cartridge 11;
137—outer bushing of multifunctional cartridge 11 with variable diameter;
138—bigger diameter of the outer bushing with variable diameter 137;
139—cylindrical section of the conical bushing of the receiver 13;
140—smaller cylindrical section of the conical bushing of the receiver 13;
141—conical hole inside the conical bushing of the receiver 13;
142—cylindrical part of the receiver 13;
143—multi-layered cylindrical hole with the threaded section at the end of cylindrical part 142;
144—cross-threaded hole at the inlet of the multi-layered cylindrical hole with threaded section 143;
145—cylindrical groove of the receiver 13;
146—complex-shaped section of the receiver 13;
147—cylindrical guiding chamfers at inlet of complex-shaped section 146;
148—rail of the receiver 13;

149—complex-shaped bar at rear end of the cylindrical part 142;
150—console at rear end of complex-shaped bar 149;
151—protrusion at the end of the console 150;
152—hole in the protrusion 151;
153—leading notch at junction between the console 150 and the complex-shaped bar 149;
154—protrusion in the complex-shaped bar 149;
155—slot in the complex-shaped bar 149;
156—console at rear end of complex-shaped bar 149;
157—window in the complex-shaped bar 149;
158—guiding slots in the complex-shaped bar 149;
159—stepped through-hole in the complex-shaped bar 149;
160—protrusion in the complex-shaped bar 149;
161—blind hole on the protrusion 160;
162—protrusion with through-hole in the complex-shaped bar 149;
163—slot between the protrusion 160 and the protrusion with threaded hole 162;
164—through slot in the protrusion 162;
165—blind slots in the protrusion 162;
166—slot in the console 150;
167—trapezoidal hole in the console 150;
168—rectangular hole at the bottom of the protrusions 161 and 162 in the guiding slot 158;
169—protrusion in the lower part of the complex-shaped bar 149;
170—protrusion in the lower part of the complex-shaped bar 149;
171—blind threaded hole in the protrusion 170;
172—axis on the safety 15;
173—blind hole on the axis 172;
174—base on the safety 15;
175—protrusion on the base 174;
176—thumb piece on the safety 15;
177—cylindrical protrusion on the end of the thumb piece 176;
178—fixing plate at junction between the base 174 with the thumb piece 176;
179—safety lug on the clamping plate 178;
180—conical protrusion on the side surface of the thumb piece 176;
181—bar of the skeletal buttstock 29C;
182—through hole inside the bar 181;
183—firing handle in the bar 181;
184—rack in the bar 181;
185—lower jumper in the bar 181;
186—upper jumper in the bar 181;
187—console in the bar 181 at the side of the rack 184;
188—grasp in the bar 181 at a side of the shooting handle 183;
189—blind longitudinal hole in the console 187;
190—threaded holes in the console 187;
191—spherical recesses at the side surfaces of the console 187;
192—slots inside the grasp 188;
193—slots inside the grasp 188;
194—cross hole in the grasp 188;
195—vertical hole in the grasp 188;
196—hole in the rack 184;
197—conical hole in the rack 184;
198—blind hole in the rack 184;
199—cylindrical section with notches on the stop lock 45;
200—groove on the stop lock 45;
201—cylindrical section with the outer thread on the stop lock 45;
202—radius groove on the stop lock 45;
203—through cross slots on the stop lock 45;
204—lugs of the retaining clamps on the stop lock 45;
205—cylindrical protrusion at the ends of the lugs of the retaining clamps 204;
206—hole inside the stop lock 45;
D206—diameter of the hole 206;
207—rod of the stop 44;
208—cylindrical head at one end of the rod 207;
D208—diameter of the cylindrical head 208;
209—disk with notches at the other end of the rod 207;
210—grooves on the rod 207;
211—adjusting screw for the adjustable back plate latch 41;
212—retaining pin for the adjustable back plate latch 41 and the cheek piece clamp 231;
213—retaining pin spring for the adjustable back plate latch 41 and the cheek piece clamp 231;
214—stop screw for the adjustable back plate latch 41
215—threaded rod on the adjusting screw 211;
216—cylindrical head on the adjusting screw 211;
217—semi-circular slots on the adjusting screw 211;
218—blind hole inside the adjusting screw 211;
219—threaded section inside the adjusting screw 211;
220—through-hole inside the adjusting screw 211;
221—back plate bracket;
222—back plate extension piece;
223—back plate;
224—back plate screws;
225—longitudinal plate in the back plate bracket 221;
226—transverse plate in the back plate bracket 221;
227—slot at side surfaces of the longitudinal plate 225;
228—spherical recesses inside the slot 227;
229—blind hole inside the transverse plate 226;
230—threaded holes inside the transverse plate 226;
231—cheek piece clamp;
232—cheek piece;
233—cheek piece screws;
234—rests of the cheek piece clamp;
235—bent plate in the cheek piece clamp 231;
236—free ends of the bent plate 235;
237—protrusions outside the free ends 236;
238—through-holes at the edges of the protrusions 237;
239—threaded holes in the center of the protrusions 237;
240—threaded holes in the upper part of the bent plate 235;
241—sleeve stop of the rest for the cheek piece clamp 234;
242—thrust screws for the cheek piece clamp 231 the sleeve stop 241;
243—plate on the sleeve stop 241;
244—cylindrical protrusions on the ends of the plate 243;
245—blind holes with the threaded section in the cylindrical protrusions 244;
246—through-holes in the cylindrical protrusions 244;
247—threaded hole in the center of the plate 243;
248—handguard;
249—bar in the handguard 248;
250—through-hole in the bar 249;
251—stepped hole in the bar 249;
252—longitudinal blind hole in the bar 249;
253—bipod bracket;
254—bipod stubs screws;
255—bipod stubs;
256—bipod stubs latches;
257—plate springs of the latch;
258—conical nuts;

259—withdrawable locks;
260—flat bent plate in the bipod bracket 253;
261—protrusions at the ends of the flat bent plate 260;
262—through-holes in the protrusions 261;
263—semi-circular conical holes on external walls of the protrusions 261;
264—radius external walls of the protrusions 261;
265—through-hole in the center of the flat bent plate 260;
266—release button at the start of the bipod stubs latch 256;
267—cylindrical part of the bipod stubs latch 256;
268—cylindrical part of the bipod stubs latch 256;
269—conic-cylindrical part of the bipod stubs latch 256;
270—cylindrical part on the bipod stubs latch 256;
271—washer on the bipod stubs latch 256;
272—plate on the bipod stub 255;
273—tube on the bipod stub 255;
274—through slot in the upper part of the plate 272;
275—through threaded hole in the upper part of the plate 272;
276—through-hole in the lower part of the plate 272;
277—cylindrical section with the outer thread on the bipod stub 255;
278—radius groove on the bipod stub 255;
279—through cross slots on the bipod stub 255;
280—lugs of the retaining clamps on the bipod stub 255;
281—cylindrical protrusion at the end of the lugs of the retaining clamps 280;
282—longitudinal hole inside the bipod stub 255;
283—cylindrical section with the notches on the conical nut 258;
284—conical section inside the conical nut 258;
285—threaded section inside the cylindrical section 283;
286—grooves inside the conical nut 258;
287—conical section inside the conical nut 258;
288—rod on the withdrawable lock 259;
289—cylinder-conical head at the end of the rod 288;
290—cylindrical head at the end of the rod 288;
291—grooves on the rod 288;
292—long bent end on the spiral trigger bar spring 18;
293—short bent end on the spiral trigger bar spring 18;
294—plate on the trigger bar 17;
295—protrusion on the trigger bar 17;
296—radius surface in the protrusion 295;
297—sear platform in the protrusion 295;
298—trigger bar at the end of the plate 294;
299—protrusion in the center of the plate 294;
300—through-hole in the protrusion 299;
301—hole between the protrusion 295 and the protrusion 299 of the plate 294;
302—lever on the magazine latch 19;
303—button on the magazine latch 19;
304—support platform on the button 303;
305—console at the end of the lever 302;
306—slot in the center of the console 305;
307—protrusion above the button 303;
308—hole in the protrusion 307;
309—slot in the protrusion 307;
310—hole in the protrusion 307;
311—plate of the trigger guard with magazine box 16;
312—cylindrical protrusion with the hole 312A;
313—slot;
314—trigger guard at other end of the plate 311;
315—complex-shaped protrusion;
316—hole in the protrusion 315;
317—threaded hole in the plate 311;
318—magazine box at the center of the plate 311;
319—slot in the magazine box 318;
320—inclined platform;
321—inclined safety gap in the slot 319;
322—protrusion with inclined platform on the magazine 7;
323—expanding ring;
324—external marker-washer;
325—inner washer;
326—ignition block for mechanical extraction;
327—ignition block for magnetic extraction;
328—magnetic extraction marker-washer;
329—capsule with the anvil;
330—gap;
T330—thickness of the gap 330;
331—magnet;
332—hand extractor;
333—lock time;
334—propellant;
335—projectile;
336—forc-flame, which ignites the propellant 334;
337—gases released during the combustion of propellant 334 *rnt;*
338—projectile chamber;
339—leading cylindrical part of the projectile 335;
340—gap between rear cylindrical part 341 of the projectile 335 and inner surface of the multifunctional cartridge 11;
T340—thickness of the gap 340;
341—rear cylindrical part of the projectile 335;
342—ignition time;
343—screw channels on the projectile 335;
344—second period;
345—gas blanket created by the gases 337 via the gap 346;
346—gap configured by rifling on the projectile 335;
T346—thickness of the gap 346;
347—primary chamber in the muzzle break 105;
348—reaction from high velocity gases 337 7 in primary chamber 347;
349—inclined channels in the muzzle break 105;
350—gas flow;
351—reaction from to gas flow 350 on external wall of the inclined channels 349;
352—exhaust gas jet stream;
353—thrust force due to exhaust gas jet stream 352;
354—gas aftereffect period;
355—the air flow, oncoming after the departure of the projectile 335 from the barrel 9A muzzle brake 105; 5;
356—the reaction created by the incoming air stream 3555.

The drawings of the proposed invention will be now explained in greater details.

Figure 2A:
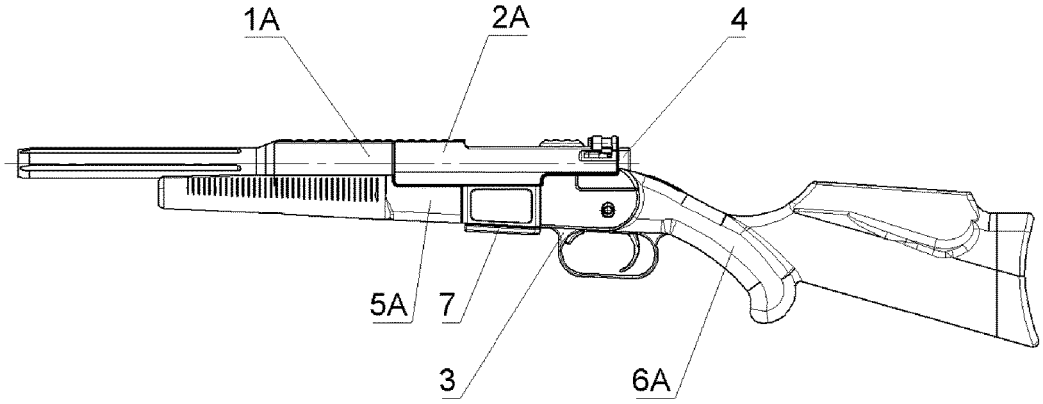

FIG. 1A and FIG. 2A show side view of the caseless magazine weapon with the handguard and the hunting buttstock 1A. This configuration comprising of the following: the receiver with barrel and mechanisms 3, the trigger guard with magazine and mechanisms 3, the bolt 4, the handguard 5A of the hunting buttstock 6A, the magazine 7.

Figure 3A:
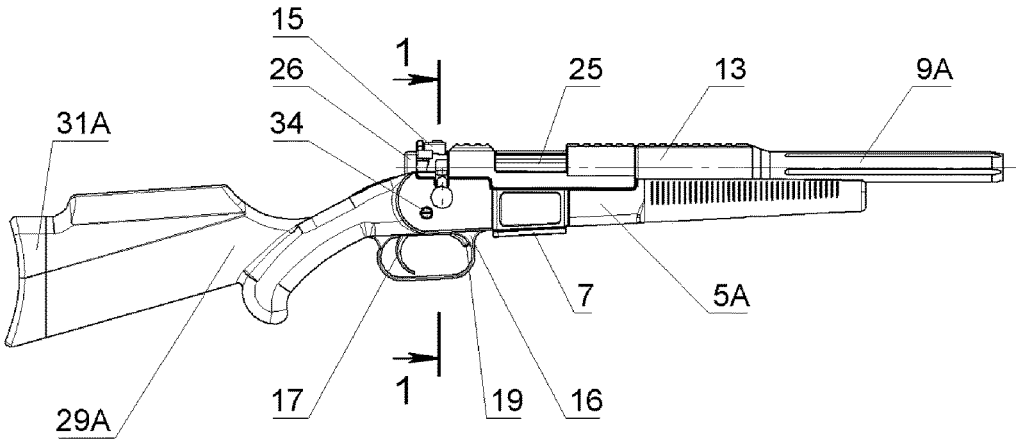
FIG. 3A and FIG. 4A show a side view of the weapon 1A.
Figure 4A:
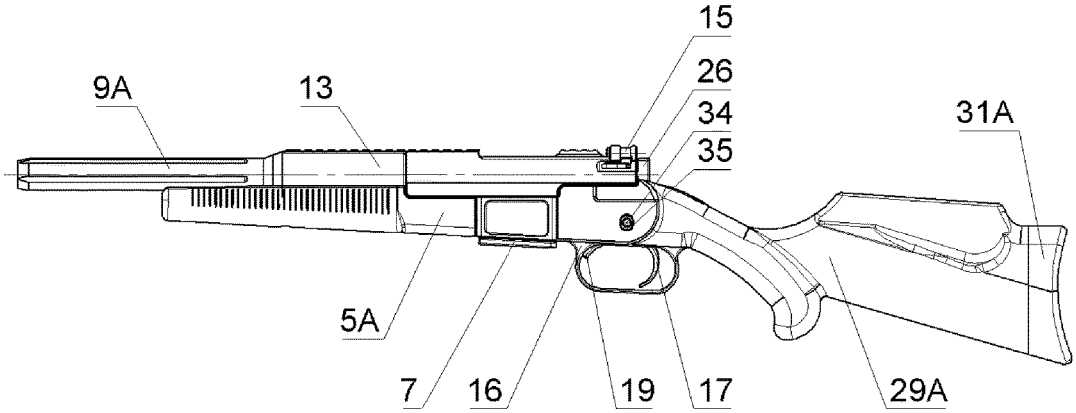
Figure 5A:
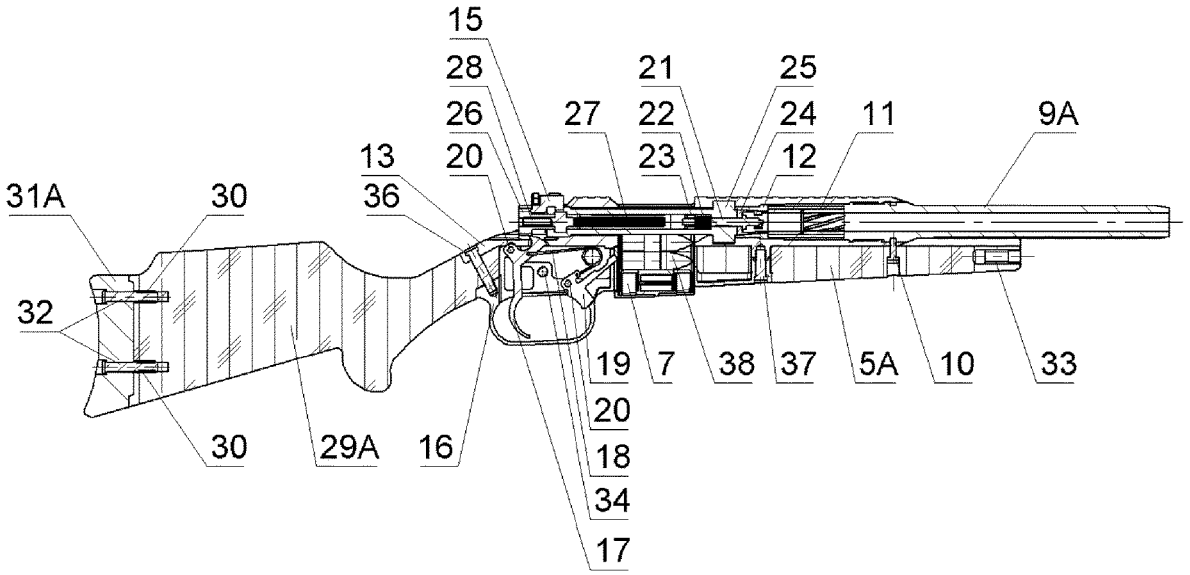
FIG. 5A shows the longitudinal section of the weapon 1A with the handguard and the hunting buttstock.
Figure 6:
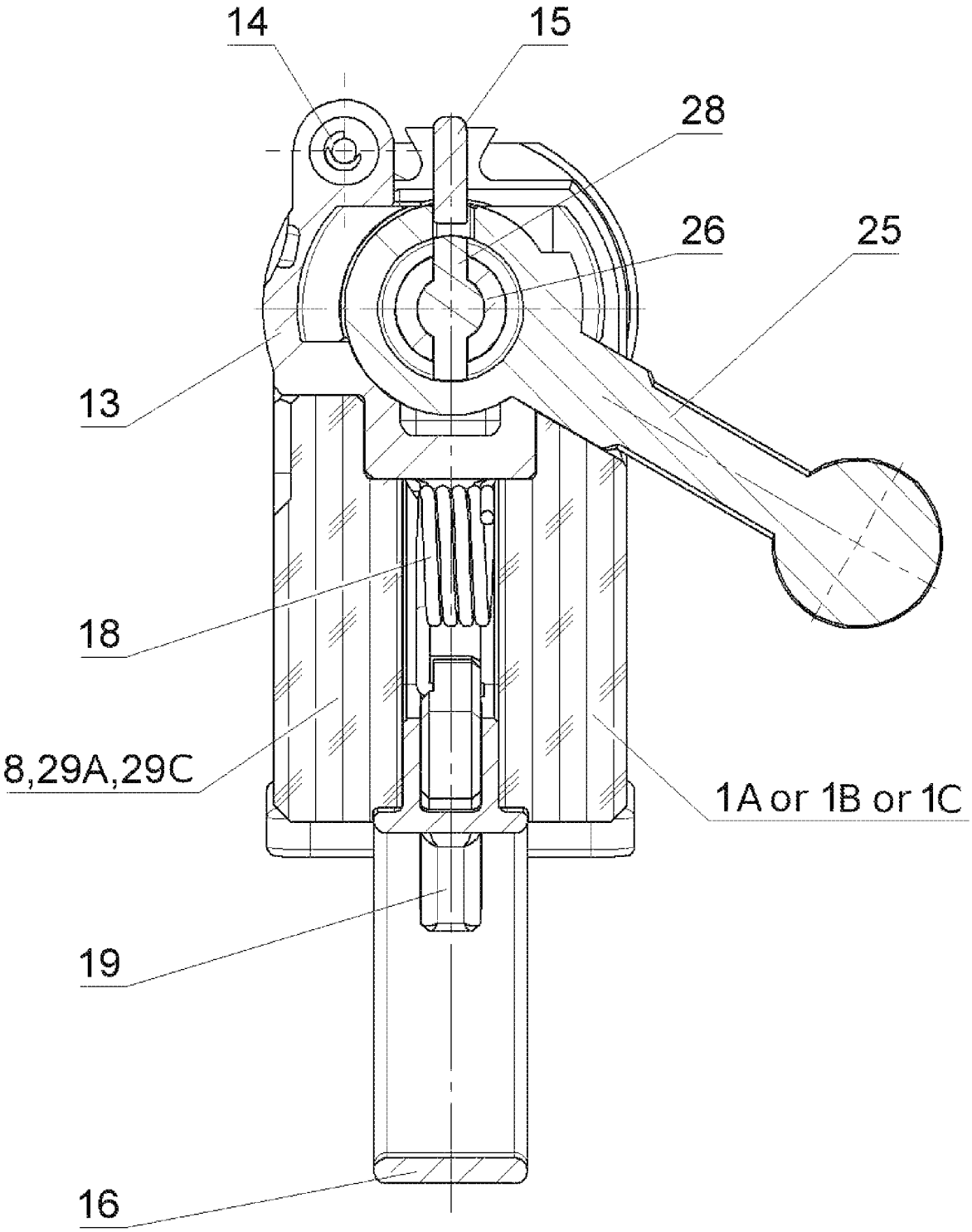
FIG. 6 shows cross-section 1-1, in FIG. 3A—of the weapon 1A.

FIGS. 3A and 4A show side view of the caseless magazine weapon 1A, FIG. 5A shows the longitudinal section of the weapon 1A, FIG. 6 shows Section 1-1 related to FIG. 3A of the weapon 1A. The weapon 1A consists of: the handguard 5A, the magazine 7, the barrel 9A, the barrel latch 10, the multifunctional cartridge 11, the conical bushing of the receiver 12, the receiver 13, the safety spring 14, the safety 15, the trigger guard with magazine box 16, the trigger bar 17, the trigger bar spring 18, the magazine latch 19, the axis 20, the firing pin 21, the spring of firing pin latch 22, the firing pin latch 23, the conical bushing of the bolt 24, the bolt body 25, the firing hammer 26, the mainspring 27, the mainspring latch 28, the hunting buttstock 29A, the threaded bushing for back plate screw 30, the back plate 31A, the back plate screw 32, the threaded bushing of the bipods 33, the cross screw 34, the nut of the cross screw t 35, the upper screw 36, the lower screw 37, the caseless ammunition 38.

Figure 1B:
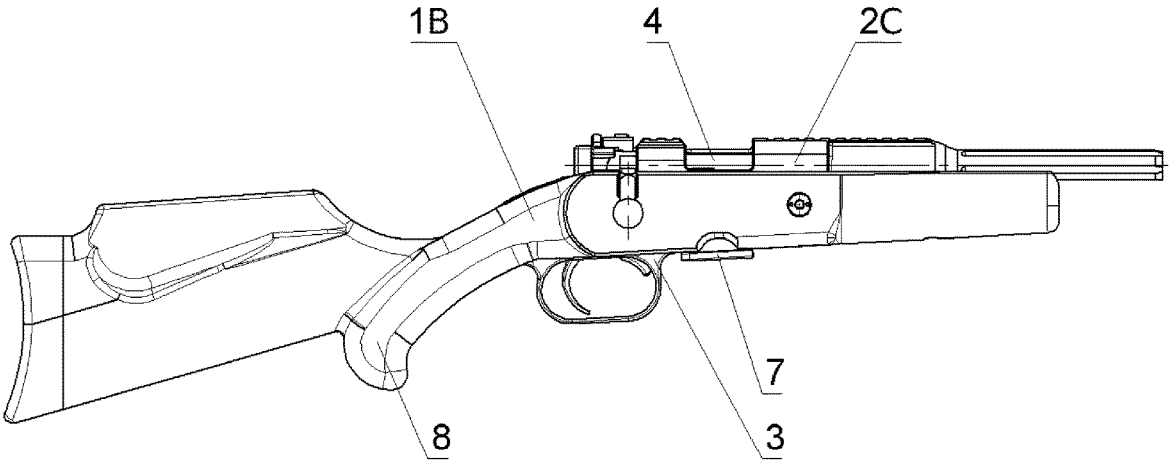
FIG. 1B and FIG. 2B show schematic side view of the weapon 1B.
Figure 2B:
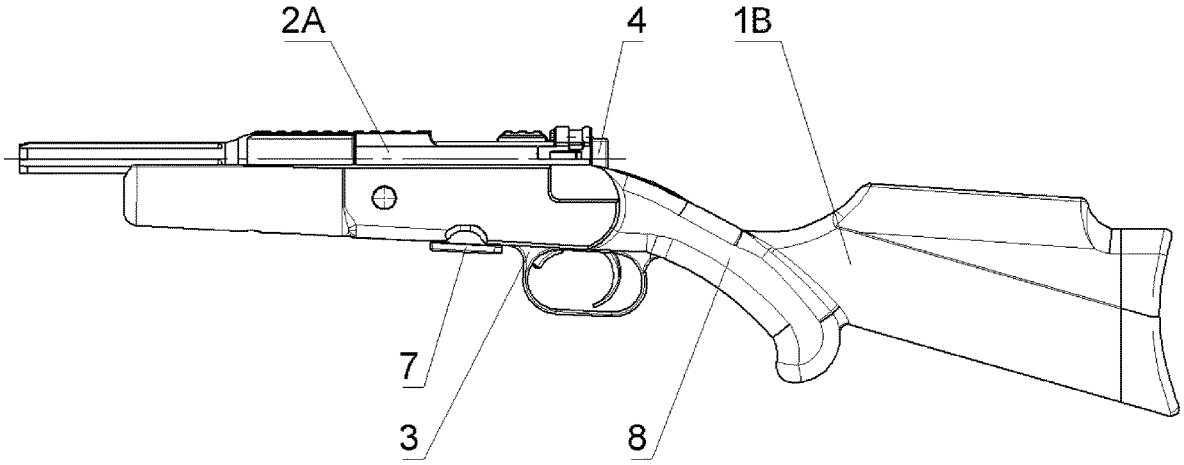

FIG. 1B and FIG. 2B show side view of the caseless magazine weapon with the hunting gunstock 1B. This configuration comprising of the following: the receiver with the barrel and the mechanisms 2A, the trigger guard with the magazine box and the mechanisms 3, the bolt 4, the magazine 7, the gunstock 8.

Figure 3B:
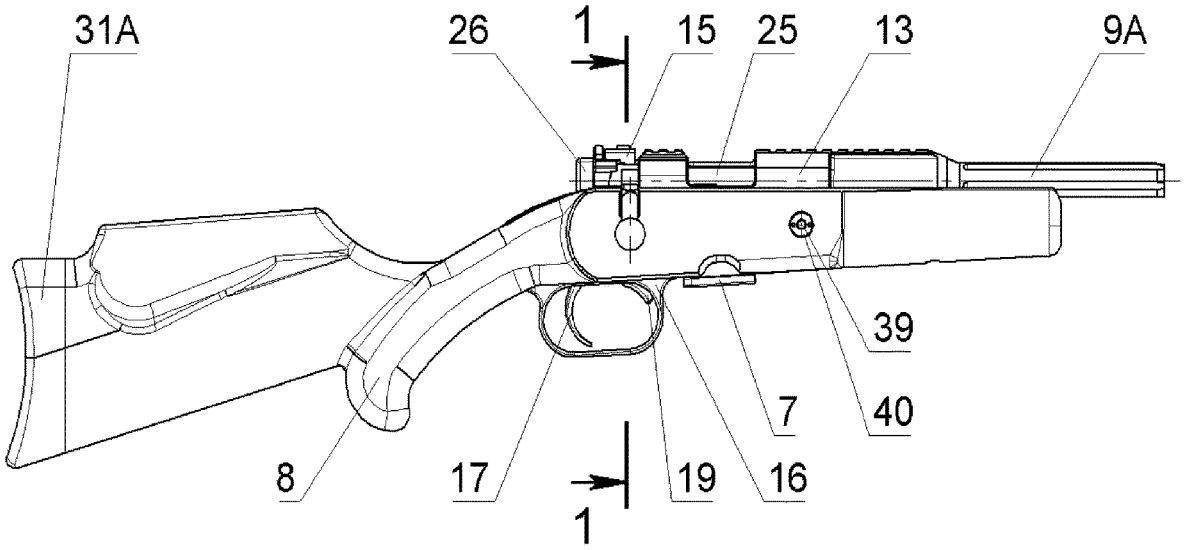
in FIG. 3B—of the weapon 1B.
Figure 4B:
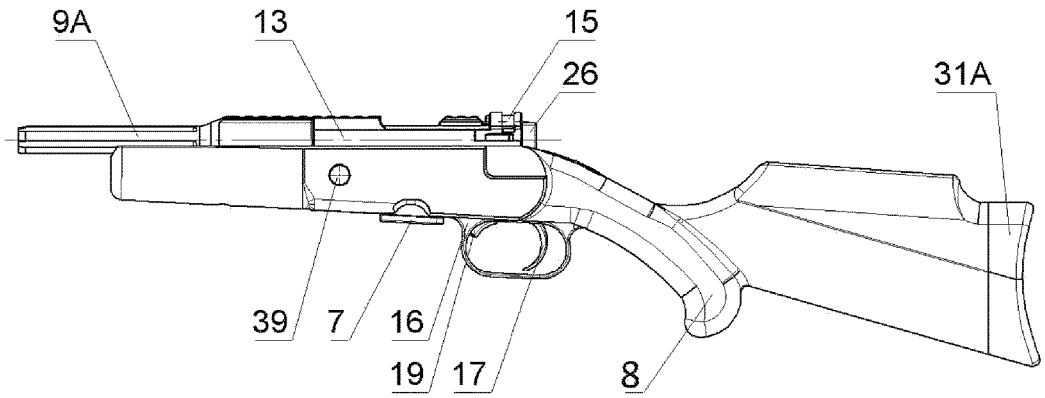
Figure 5B:
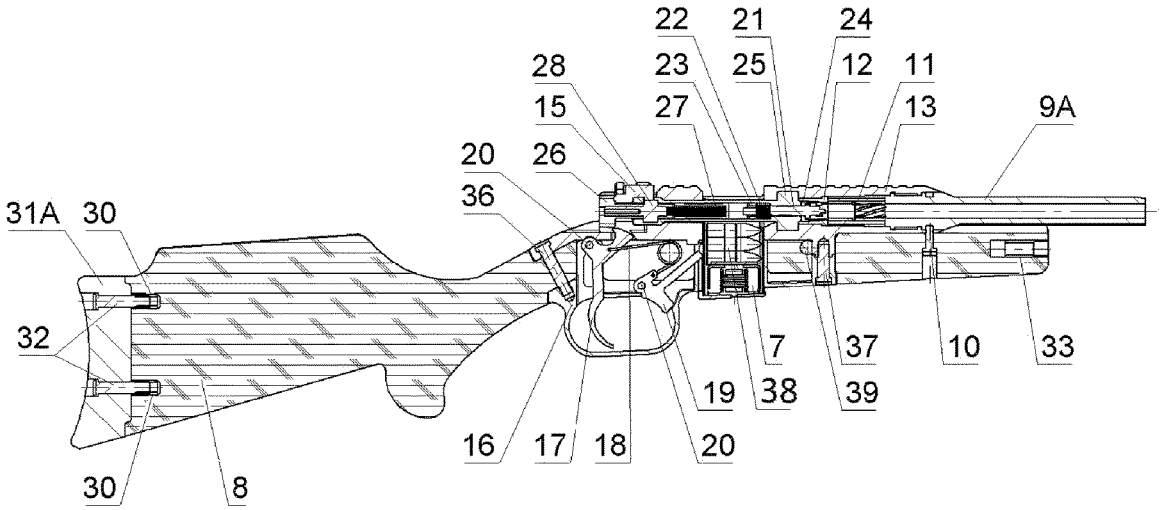
FIG. 5B shows the longitudinal section of the weapon 1B with the hunting gunstock.

FIGS. 3B and 4B show side view of the caseless magazine weapon 1B, FIG. 5B shows the longitudinal section of the weapon 1B, FIG. 6 shows Section 1-1 related to FIG. 3B of the weapon 1B. The weapon 1B consists of: the magazine 7, the handguard 8, the barrel 9A, the barrel latch 10, the multifunctional cartridge 11, the conical bushing of the receiver 12, the receiver 13, the safety spring 14, the safety 15, the trigger guard with magazine box 16, the trigger bar 17, a trigger bar spring 18, the magazine latch 19, the axis 20, the firing pin 21, the spring of firing pin latch 22, the firing pin latch 23, the conical bushing of the bolt 24, the bolt body 25, the firing hammer 26, the mainspring 27, the mainspring latch 28, the threaded bushing for back plate screw 30, the back plate 31A, the back plate screw 32, the threaded bushing of bipods 33, the upper screw 36, the lower screw 37, the caseless ammunition 38, the dowel screw 39, the nut of dowel screw 40.

Figure 1C:
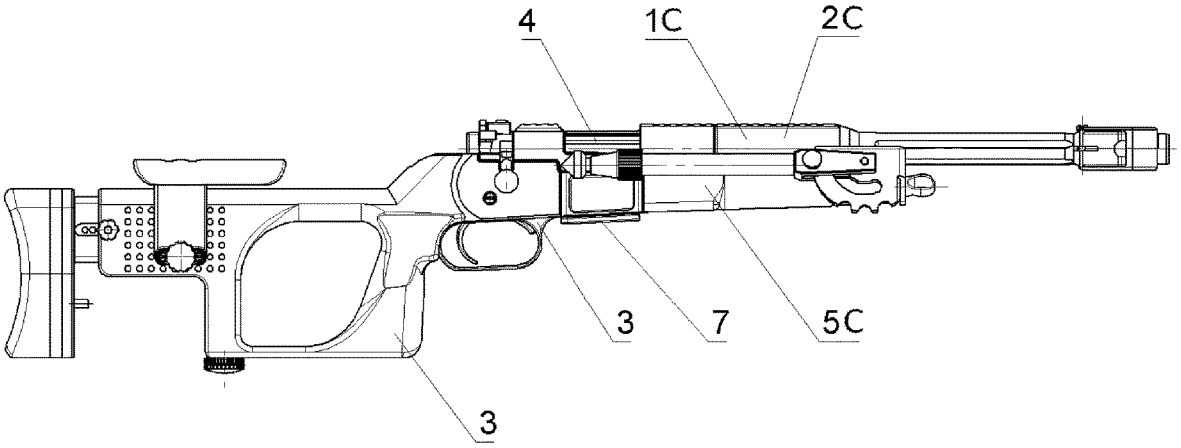
FIG. 1C and FIG. 2C show schematic side view of the weapon 1C.
Figure 2C:
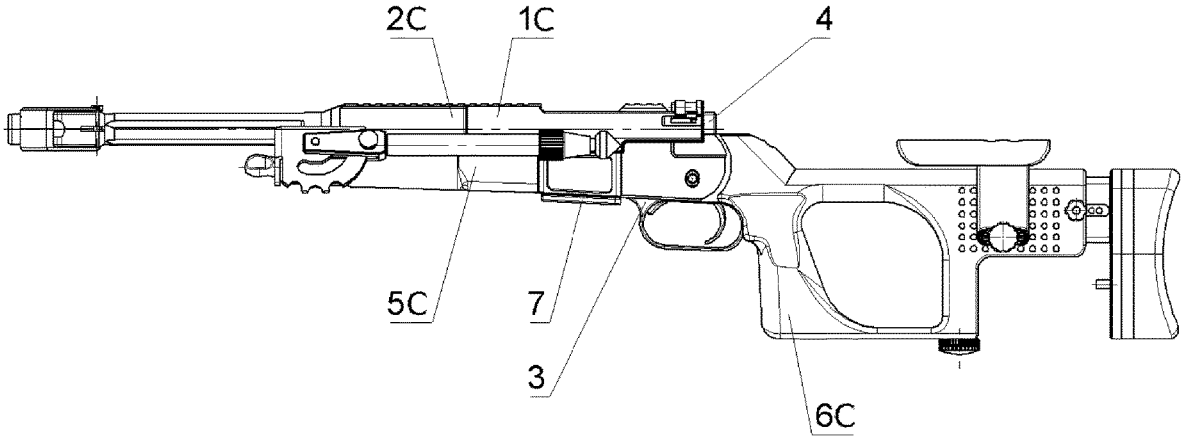

FIG. 1C and FIG. 2C show side view of the caseless magazine weapon with the nonintegrated handguard and the hunting buttstock 1C. This configuration comprising of the following: the receiver with the barrel and the mechanisms 2C, the trigger guard with the magazine box and the mechanisms 3, the bolt 4, the handguard with the bipods 5C, the skeletal buttstock with adjustable back plate and cheek piece 6C, the magazine 7.

Figure 3C:
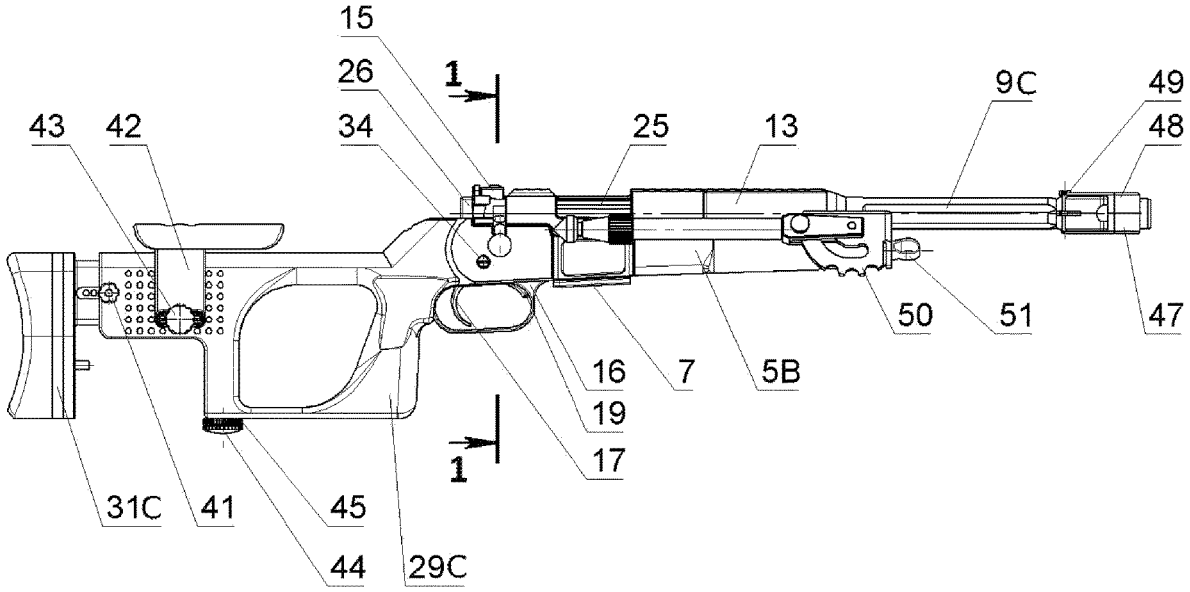
in FIG. 3C—of the weapon 1C.
Figure 4C:
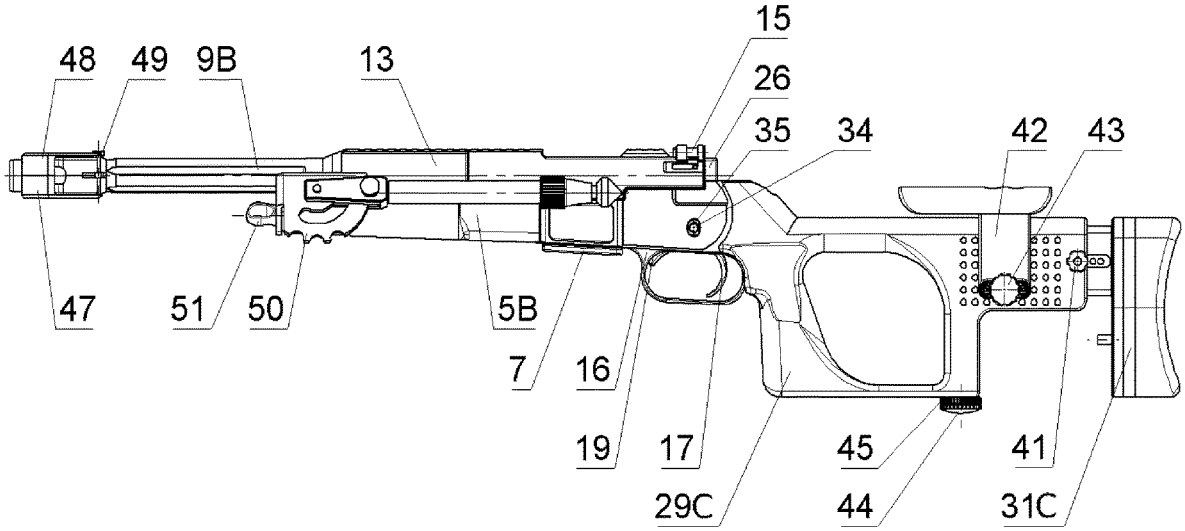
Figure 5C:
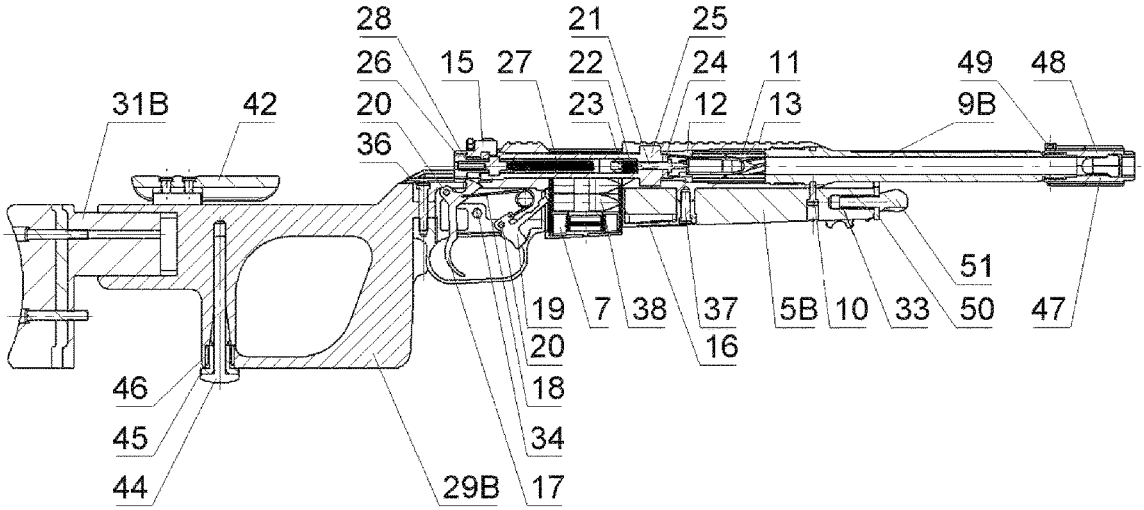
FIG. 5C shows the longitudinal section of the weapon 1C with the handguard and the hunting buttstock.

FIGS. 3C and 4C show side view of the caseless magazine weapon 1C, FIG. 5C shows the longitudinal section of the weapon 1C, FIG. 6 shows Section 1-1 related to FIG. 3C of the weapon 1C. The weapon 1C consists of: the handguard with the bipods 5C, the magazine 7, the barrel 9C, the barrel latch 10, the multifunctional cartridge 11, the conical bushing of the receiver 12, the receiver 13, the safety spring 14, the safety 15, the trigger guard with magazine box 16, the trigger bar 17, the trigger bar spring 18, the magazine latch 19, the axis 20, the firing pin 21, the spring of firing pin latch 22, the firing pin latch 23, the conical bushing of the bolt 24, the bolt body 25, the firing hammer 26, the mainspring 27, the mainspring latch 28, the skeletal buttstock 29C, the adjustable back plate 31C, the threaded bushing of the bipods 33, the cross screw 34, the nut of the cross screw 35, the upper screw 36, the lower screw 37, the caseless ammunition 38, the adjustable back plate 41, the adjustable cheek piece 42, the latch of adjustable cheek piece 43, the stop 44, the stop lock 45, the threaded bushing of stop lock 46, the lower part of muzzle break 47, the upper part of muzzle break 48, the screw of muzzle break 49, the folding adjustable bipod 50, the latch of the bipod 51.

Figure 7A:
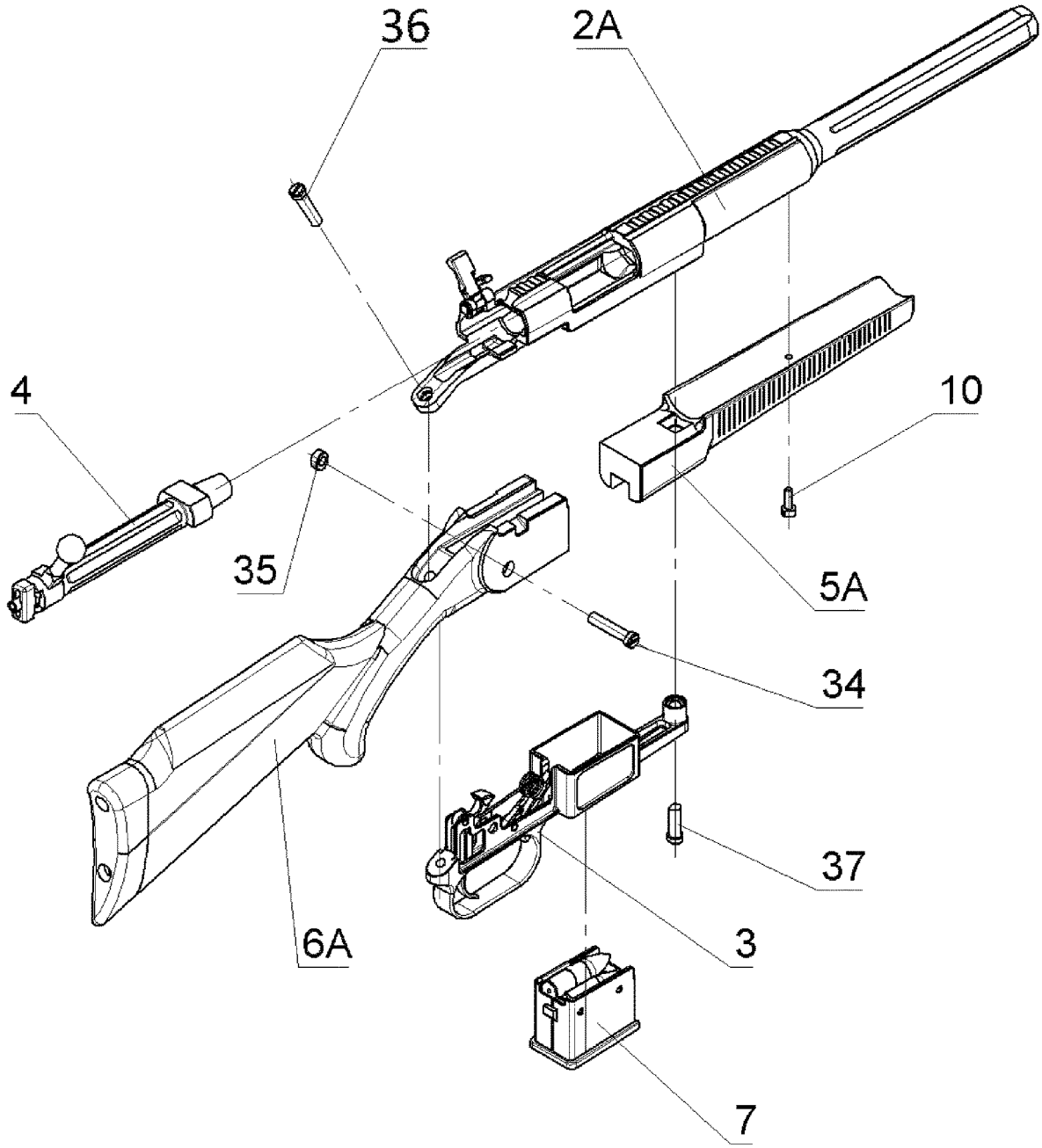
FIG. 7A shows the disassembly of the magazine weapon 1A into the units (side view).

FIG. 7A shows disassembly of the magazine weapon 1A into the units (side view). The units consist of: the receiver with the barrel and the mechanisms 2A, the trigger guard with the magazine box and the mechanisms 3, the bolt 4, the handguard 5A, the barrel latch 10, the cross screw of the buttstock 34, the cross screw nut 35 of the buttstock, the upper screw 36 of the trigger guard with the magazine box, the lower screw 37 of the trigger guard with the magazine box.

Figure 7B:
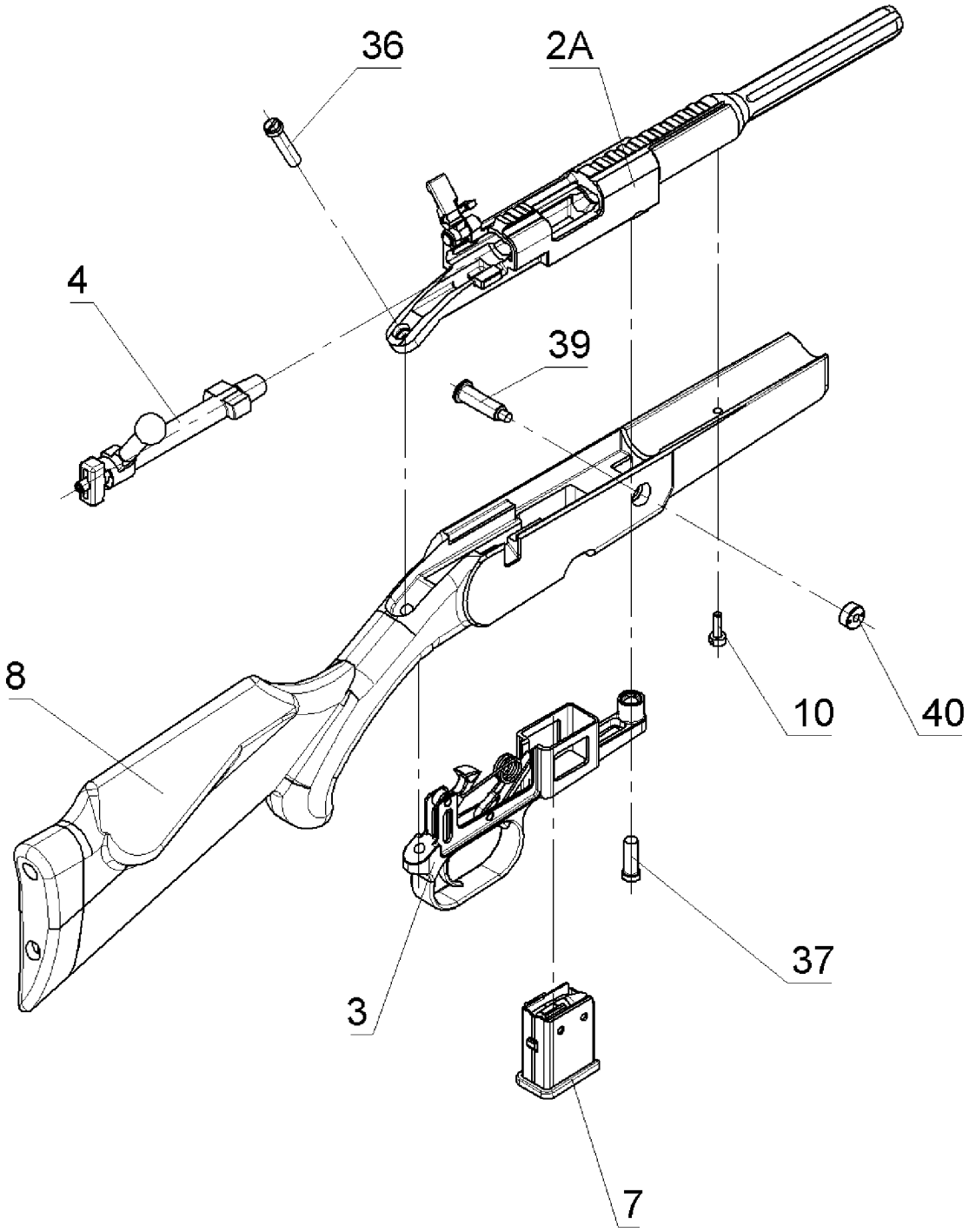
FIG. 7B shows the disassembly of the magazine weapon 1B into units (side view).

FIG. 7B shows disassembly of the magazine weapon 1B into units (side view). The units consist of: the receiver with the barrel and the mechanisms 2A, the trigger guard with the magazine box and the mechanisms 3, the bolt 4, the gunstock 8, the magazine 7, the barrel latch 10, the upper screw 36 of the trigger guard with magazine box, the lower screw 37 of the trigger guard with magazine box, the dowel screw 39, the nut of dowel screw 40 of the gunstock.

Figure 7C:
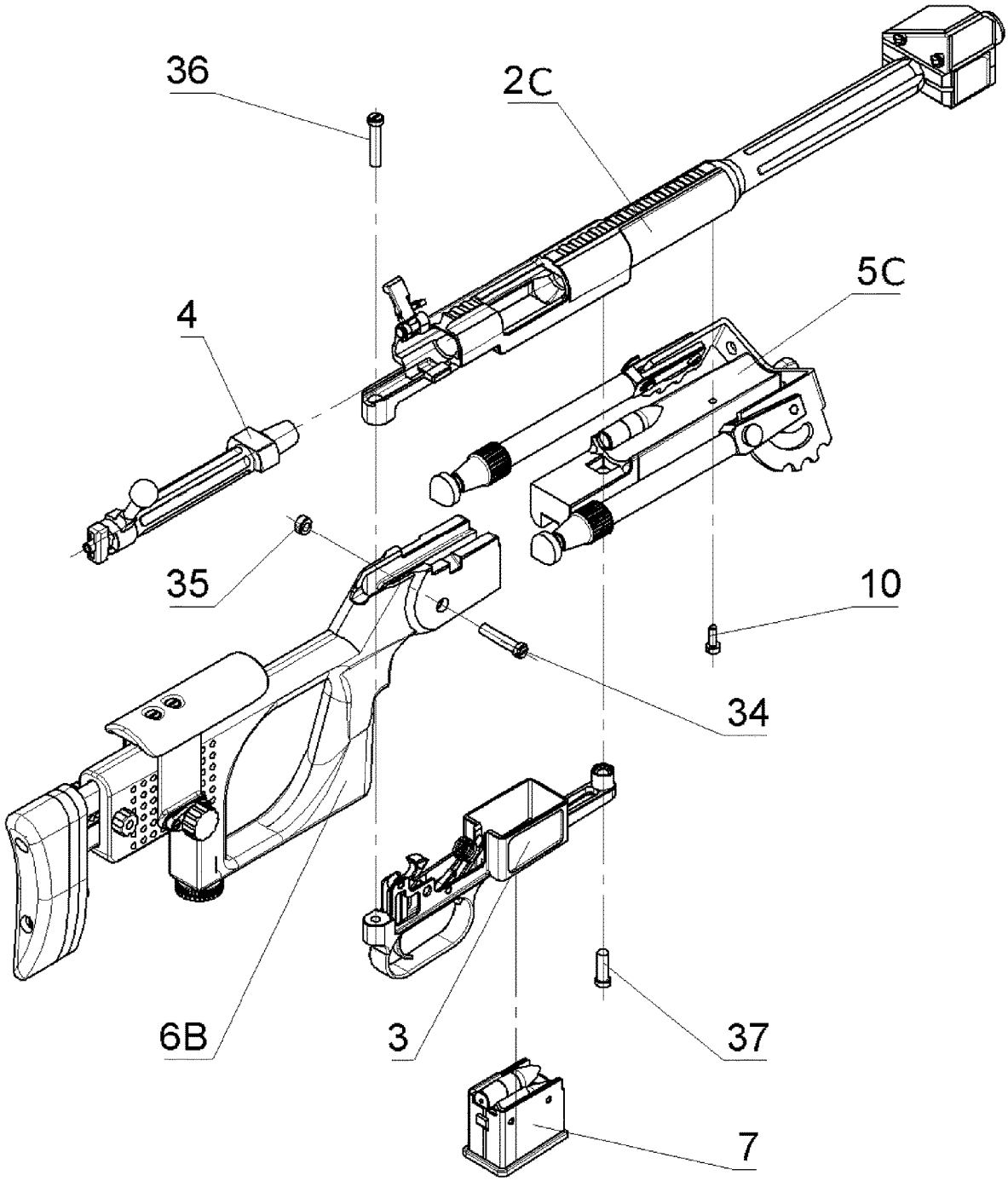
FIG. 7C shows the disassembly of the magazine weapon 1C into units (side view).

FIG. 7C shows the disassembly of the magazine weapon 1C into units (side view). The units consist of: the receiver with the barrel and the mechanisms 2C, the trigger guard with the magazine box and the mechanisms 3, the bolt 4, the handguard with the bipods 5C, the skeletal buttstock with adjustable back plate and cheek piece 6C, the magazine 7, the latch of the barre 10, the cross screw of the buttstock 34, the nut of the cross screw 35 of the buttstock, the upper screw of the trigger guard with magazine box 36, the lower screw of the trigger guard with the magazine box 37.

Figure 8:
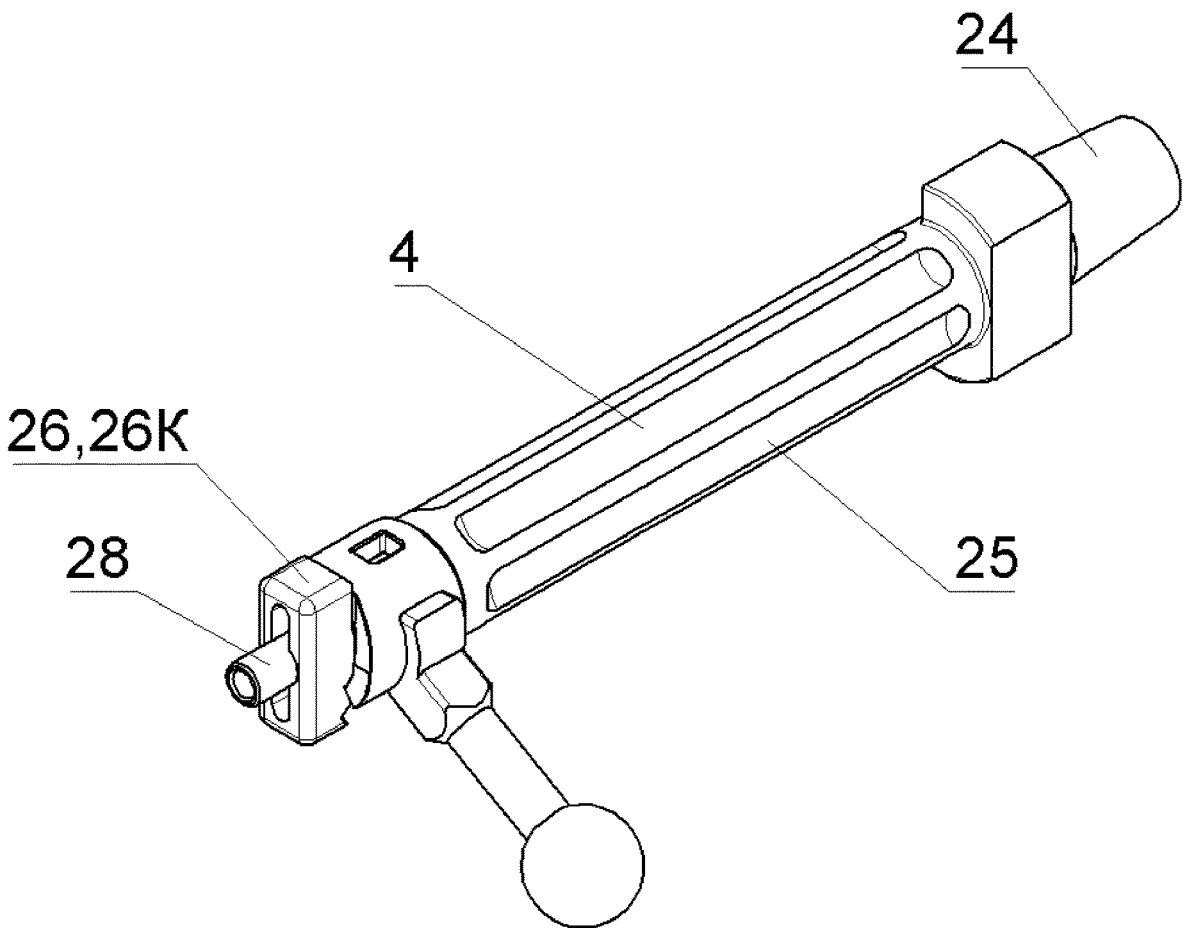
FIG. 8 shows a side view of the bolt 4.
Figure 9:
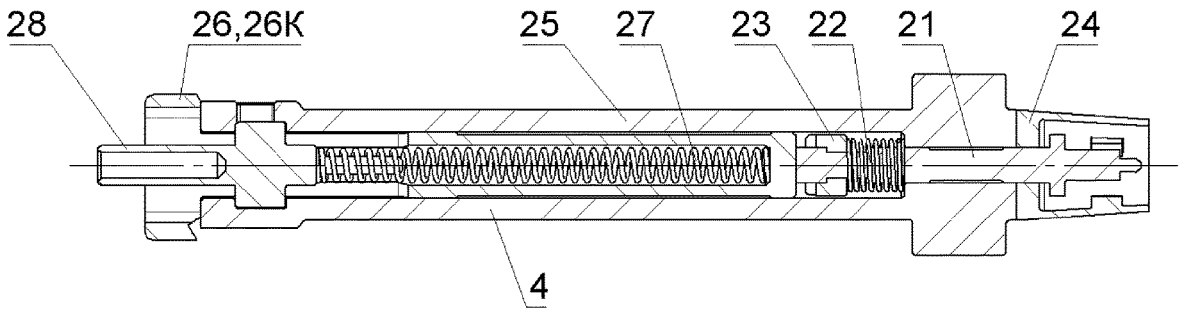
FIG. 9 shows the longitudinal section of the bolt 4.

FIG. 8 shows the side view of the bolt 4, and FIG. 9 shows the longitudinal section of the bolt 4. The bolt consists of: the firing pin 21, the spring of firing pin latch 22, the firing pin latch 23, the conical bushing of the bolt 24, the bolt body 25, the firing hammer 26, the mainspring 27, the mainspring latch 28.

Figure 10:
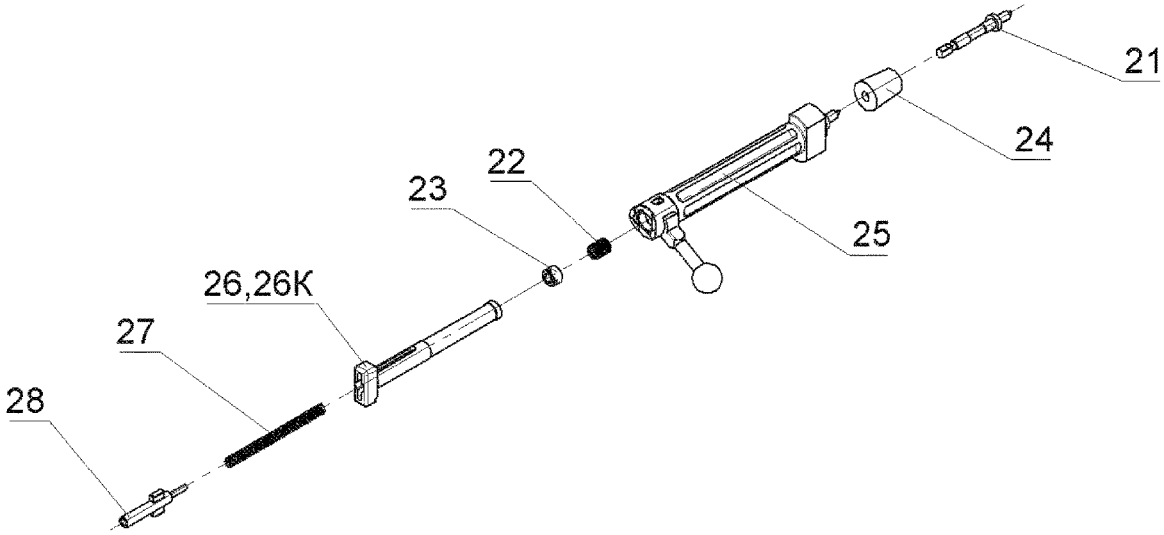
FIG. 10 shows detailing of the bolt 4 (side view).

FIG. 10 shows detailing of the bolt 4 (side view). This configuration consists of: the firing pin 21, the spring of firing pin latch 22, the firing pin latch 23, the conical bushing of the bolt 24, the bolt body 25, the firing hammer 26, the mainspring 27, the mainspring latch 28.

Figure 11:
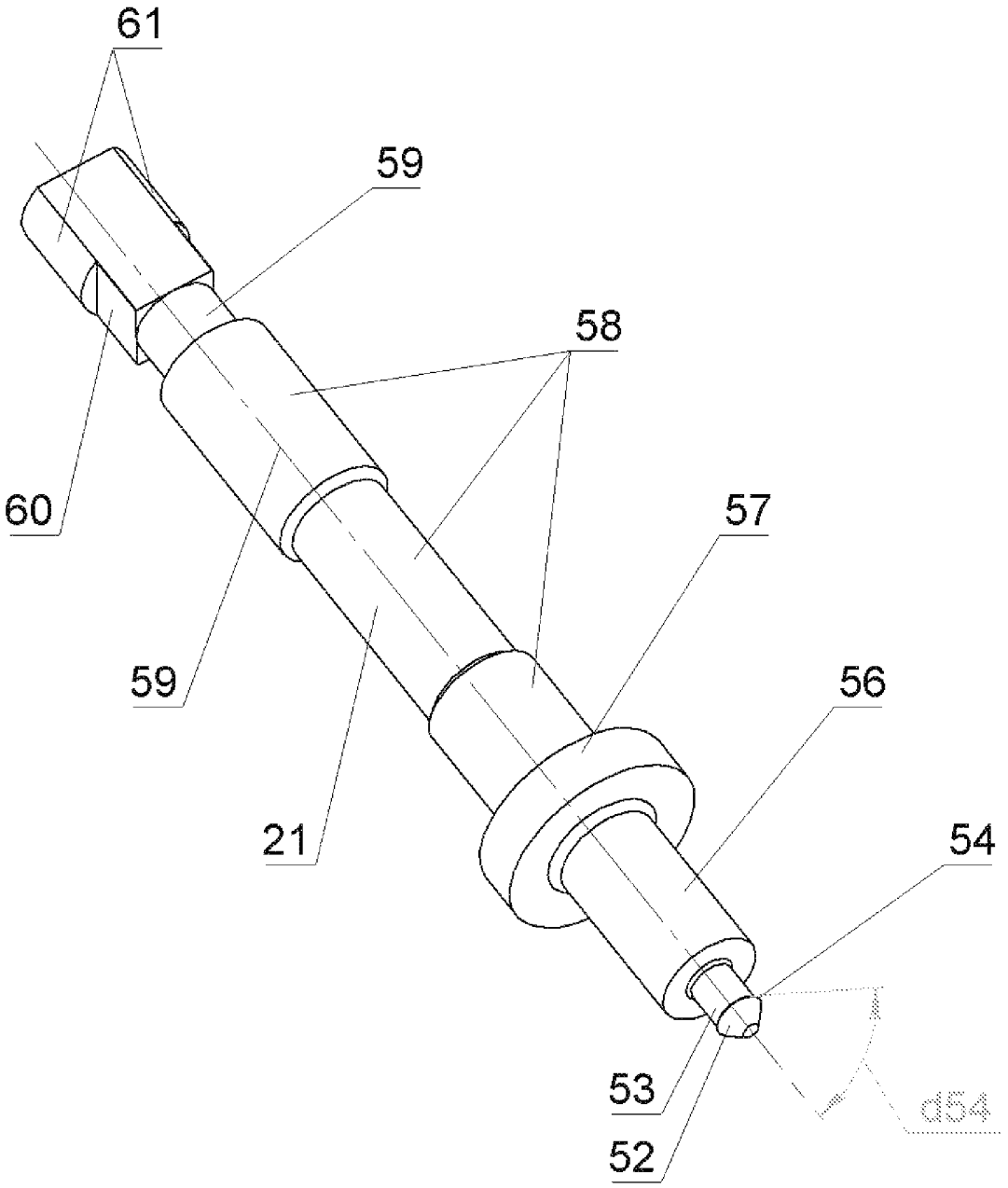
FIG. 11 shows a side view of the firing pin 21.

FIG. 11 shows a side view of the firing pin 21. The firing pin 21 is configured as the stepped shaft. The conical part 52 is disposed in front, which passes into the cylindrical part of the smaller diameter 53, and the inclined protrusion 54 is configured at the junction between the conical part 52 and the cylindrical part of the smaller diameter 53. The angle of inclined protrusion d54 relative to the axis of the firing pin 55 is 30-45 degrees, which is optimal to ensure the tearing force of the ammunition 38 from the screwed bushing 133 of the multifunctional cartridge 11. The cylindrical part of the smaller diameter 53 passes into the cylindrical part of the larger diameter 56, which passes into the cylindrical piston 57. The cylindrical piston 57 passes into the rod section with grooves 58, and the rear groove 59 passes into the square part 60 with the cylindrical protrusions 61 disposed at the end of the square part 60. The rear groove 59, the square part 60, and the cylindrical protrusions 61 are configured to mount and fix the firing pin latch 23 on the firing pin 21. All elements of the firing pin 21, their shapes, and their interaction with each other are shown in FIG. 11.

Figure 12:
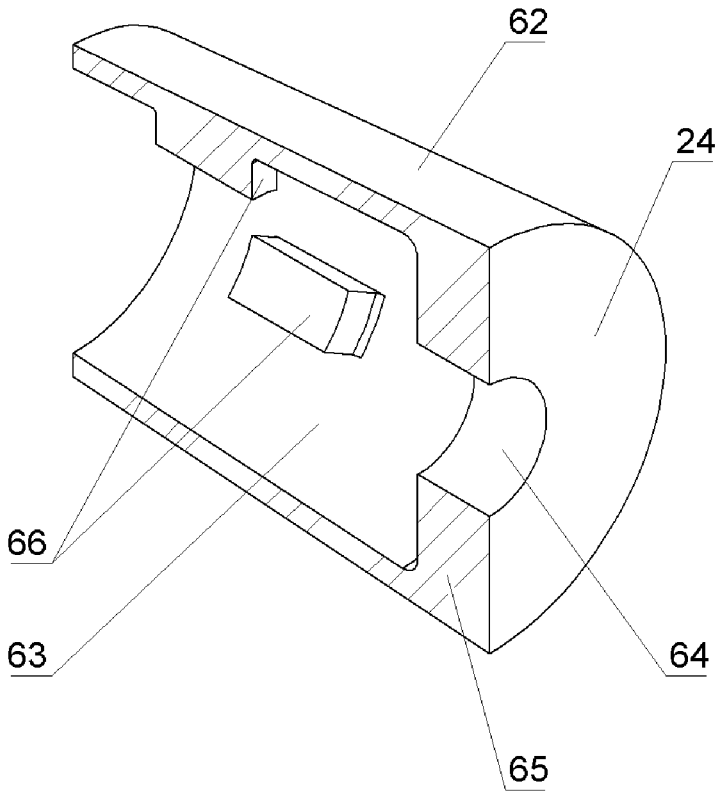
FIG. 12 shows the longitudinal section of the conical bushing of the bolt 24.
Figure 28:
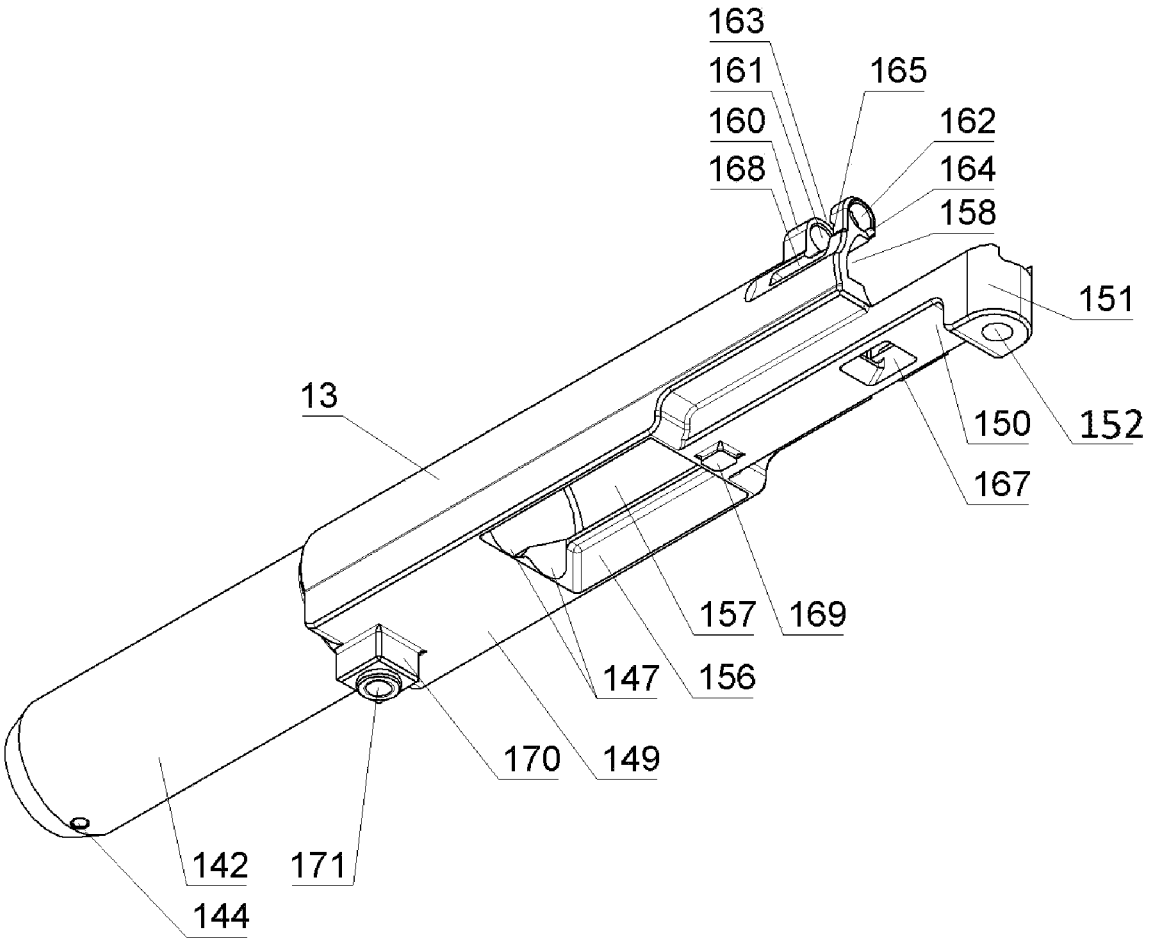

FIG. 28 shows the longitudinal section of the conical bushing of the bolt 24. The conical bushing of the bolt 24 is configured to rotate on the firing pin 21 and it is spring-loaded by the spring of the firing pin latch 22 to the glazed area 78 at the end of the cylindrical head 70 of the bolt body 25. As shown in FIG. 12, the conical bushing of the bolt 24 is configured in the form of the truncated cone 62 with the blind conical hole 63, which passes into the -hole 64 to form the thick wall 65 at the outlet of the large base of the truncated cone 62. At inlet the blind conical hole 63 has the protrusions 66 in a number of three or more, to fix the caseless ammunition 38 and to protect it from inertial split by the firing pin 21 in case of fall-down of the weapon. All elements of the conical bushing of the bolt 24, their shapes, and their interaction with each other are shown in FIG. 12.

Figure 13:
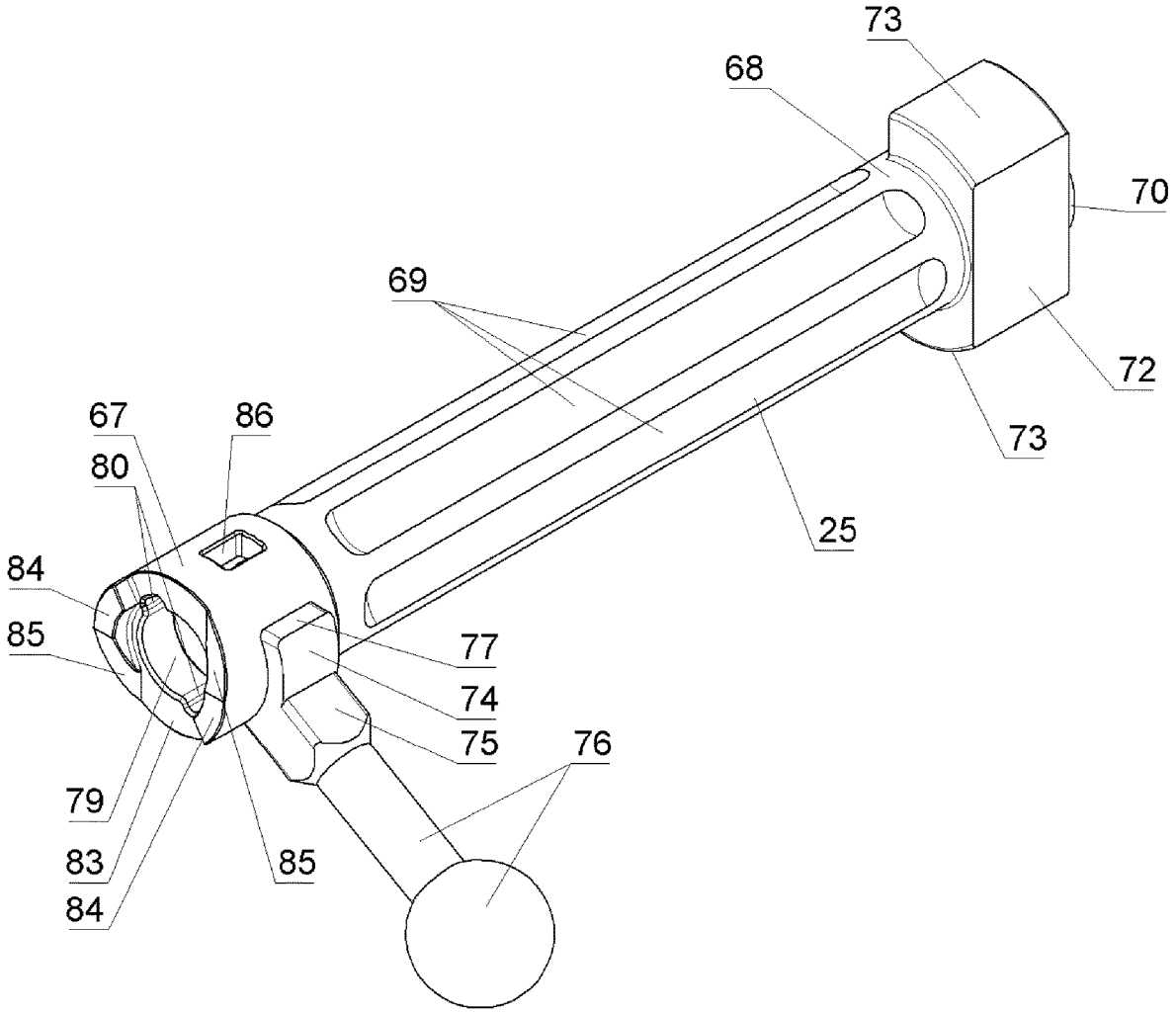
FIG. 13 shows a side view of the bolt body 25.
Figure 14:
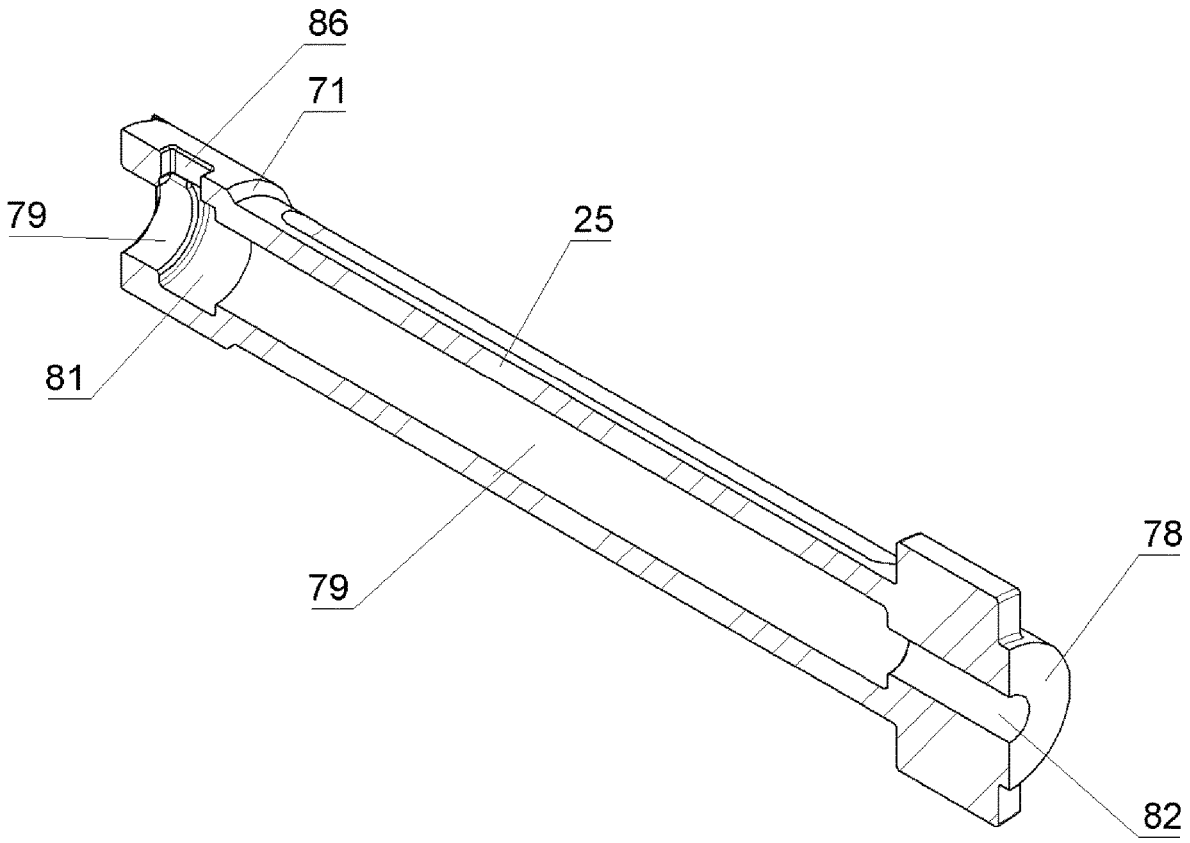
FIG. 14 shows the longitudinal section of the bolt body 25.

FIG. 13 shows the side view of the bolt body 25, and FIG. 9 shows the longitudinal section of the bolt body 25. The bolt body is configured with cylindrical part 67. The cylindrical part 67 passes into the thinner cylindrical part 68, the slots 69 are disposed on the outer surface of the thinner cylindrical part 68 along the perimeter to decrease friction within operation of the bolt 4 and to reduce a contaminant collection. The thinner cylindrical part 68 passes into the cylindrical head 70. The chamfer 71 is disposed in the passage from the cylindrical part 67 into the thinner cylindrical part 68. In the passage of the thinner cylindrical part 68 into the cylindrical head 70, the locking lugs 72 are configured in the form of two protrusions with ends configured in the form of radius surfaces 73. The stepped protrusion is disposed in the cylindrical part 67, consisting of a base 74 and a leading protrusion 75 configured to interact with the leading notch 153 of the receiver 13 when opening and closing the bolt 4. The leading protrusion 75 is the third locking lug of the bolt 4 and in the closed position; it abuts against the protrusion 154 of the receiver 13. The handle 76 is disposed on the leading protrusion 75, configured in the form of a rod at the end of which a ball is disposed to facilitate operations with the bolt 4. At the end of the base 74, the area 77 is configured to interact with the leading notch 153 of the receiver 13. The handle 76 is disposed at an angle to the locking lugs 72. At the end of the cylindrical head 70, the glazed area 78 for the conical bushing of the bolt 24 is disposed. Inside the bolt body 25, the central blind cylindrical channel 79 is disposed for the firing hammer 26, the spring of the firing pin latch 22, and the firing pin latch 23. In the rear end of the central cylindrical channel 79, two lead-in slots 80 and the groove 81 are disposed and configured to interact with the protrusions 102 of the mainspring latch 28. In the front end of the central cylindrical channel 79, the through-hole 82 is disposed and configured to interact with the firing pin 21. At the end 83 of the cylindrical part 67, two screwed protrusions 84 with screwed surfaces 85 are configured to interact with the firing hammer 26. The rectangular hole 86 is disposed in the cylindrical part 67 configured for the safety 15. All elements of the bolt body 25, their shapes, and their interaction with each other are shown in FIG. 13 and FIG. 14.

Figure 15:
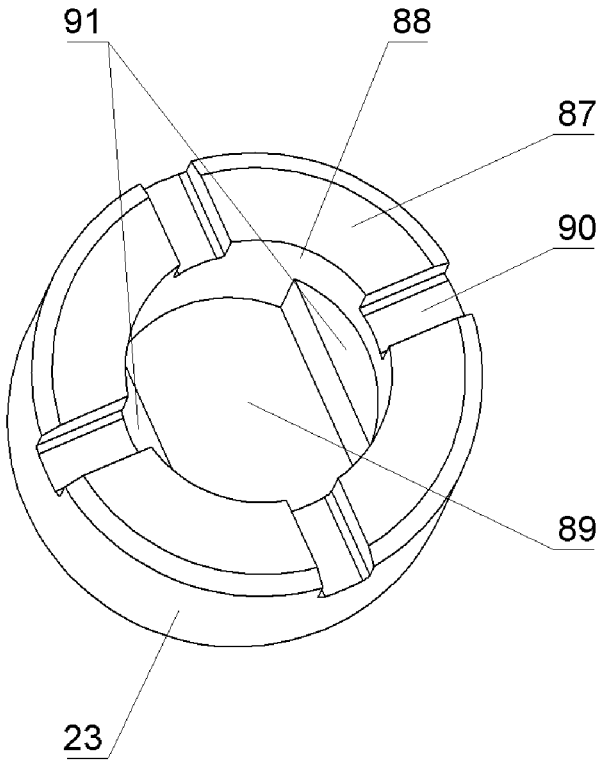
FIG. 15 shows a front view of the firing pin latch 23.

FIG. 15 shows a front view of the firing pin latch 23. The firing pin latch 23 is configured as the washer 87. The blind hole 88 is disposed in the washer 87. The through-hole 89 is disposed behind the blind hole 88, repeating the shape of the end of the square part 60 with the cylindrical protrusions 61 of the firing pin 21. The slots 90 configured for the screwdriver are disposed in the washer 87 at the inlet of the blind hole 88. The through-hole 89 in the washer 87 forms the protrusions 91, which, abutting against the cylindrical protrusions 61 of the firing pin 21, fix the firing pin latch 23 on the firing pin 21. All elements of the firing pin latch 23, their shapes, and their interaction with each other are shown in FIG. 15.

Figure 16:
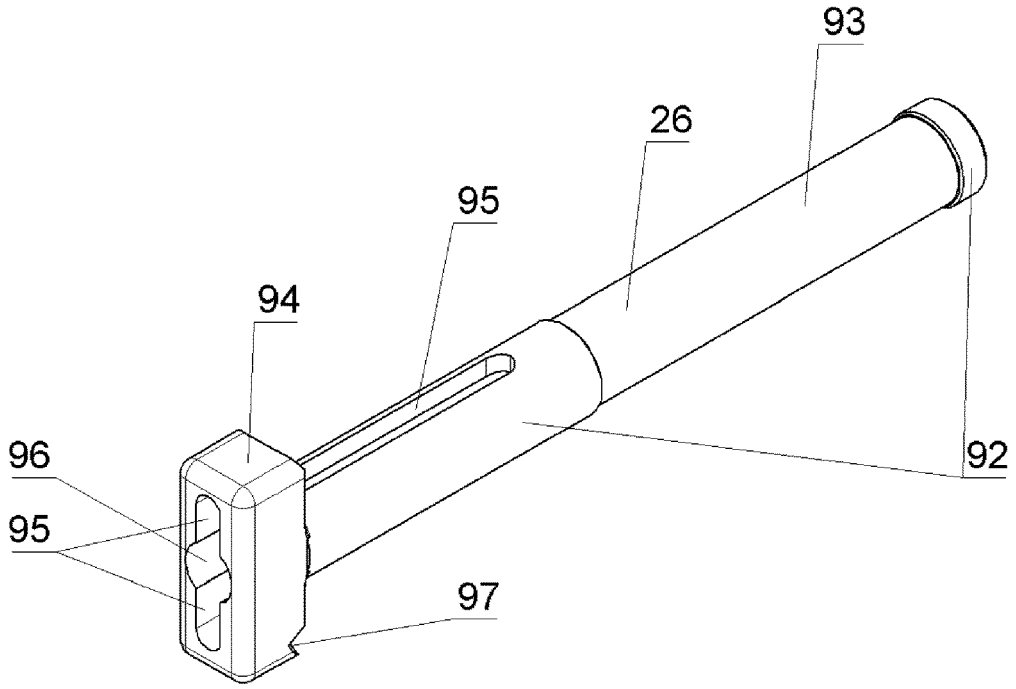
FIG. 16 shows a side view of the firing hammer 26.

FIG. 16 shows a side view of the firing hammer 26. The firing hammer is configured as the rod 92 with grooves 93 at one end. At the other end of the rod 92 the hammer 94 is configured in the form of a rectangular bar. The slot 95 is disposed in the hammer 94 and the adjacent part of the rod 92 to mount into it the mainspring latch 28. The blind hole 96 is disposed inside the firing hammer 26 configured for the mainspring 27. At the bottom part of the hammer 94, from the side of the part of the rod 92, the area of the cocking stud 97 is disposed. All elements of the firing hammer 26, their shapes, and their interaction with each other are shown in FIG. 16.

Figure 17:
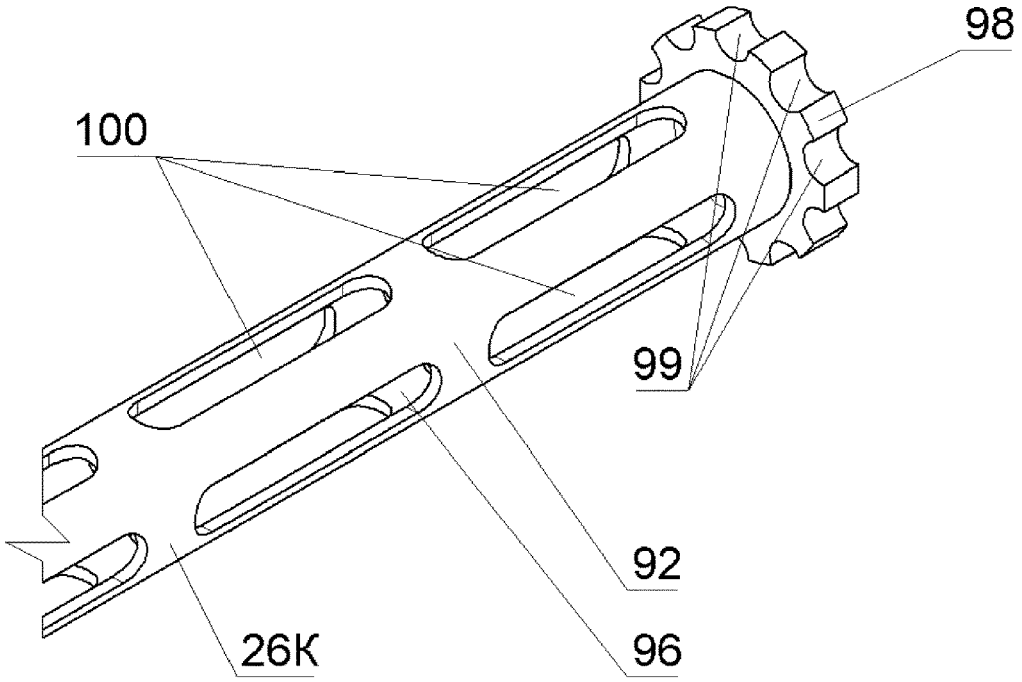
FIG. 17 shows a side view of the percussion 26K.

FIG. 17 shows a side view of the firing hammer 26K, which is used for weapon gauges 20 mm and more. The firing hammer is configured in the form of the rod 92. The washer 98 with the slots 99 to reduce the friction of the firing hammer 26K within operation is disposed at one end of the rod 92. The holes 100 are disposed at the side surface of the rod 92 to reduce the weight of the firing hammer 26K and to decrease the friction of the mainspring 27. At the other end of the rod 92 the hammer 94 is configured in the form of the rectangular bar. The slot 95 is disposed in the hammer 94 and the adjacent part of the rod 92 to mount into it the mainspring latch 28. The blind hole 96 is disposed inside the firing hammer 26 configured for the mainspring 27. At the bottom part of the hammer 94, from the side of the part of the rod 92, the area of the cocking stud 97 is disposed. All elements of the firing hammer 26, their shapes, and their interaction with each other are shown in FIG. 16.

Figure 18:
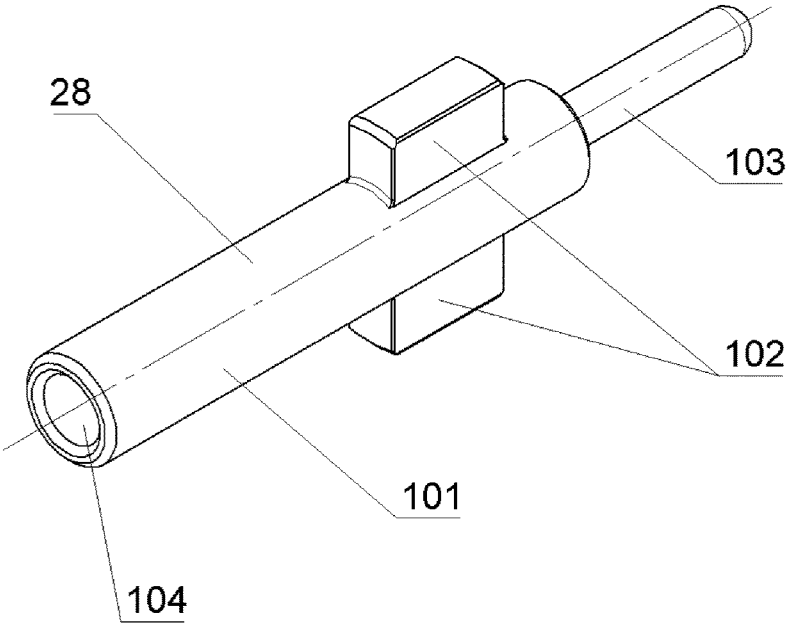
FIG. 18 shows a side view of the mainspring latch 28.

FIG. 18 shows a side view of the mainspring latch 28. The mainspring latch 28 is configured in the form of the rod 101. Two protrusions 102 are disposed at one end of the rod 101 and this end passes into the rod of a smaller diameter 103. The blind hole 104 is disposed inside the mainspring latch 28 to reduce the weight. All elements of the mainspring latch 28, their shapes and interaction with each other are shown in FIG. 18.

Figure 19A:
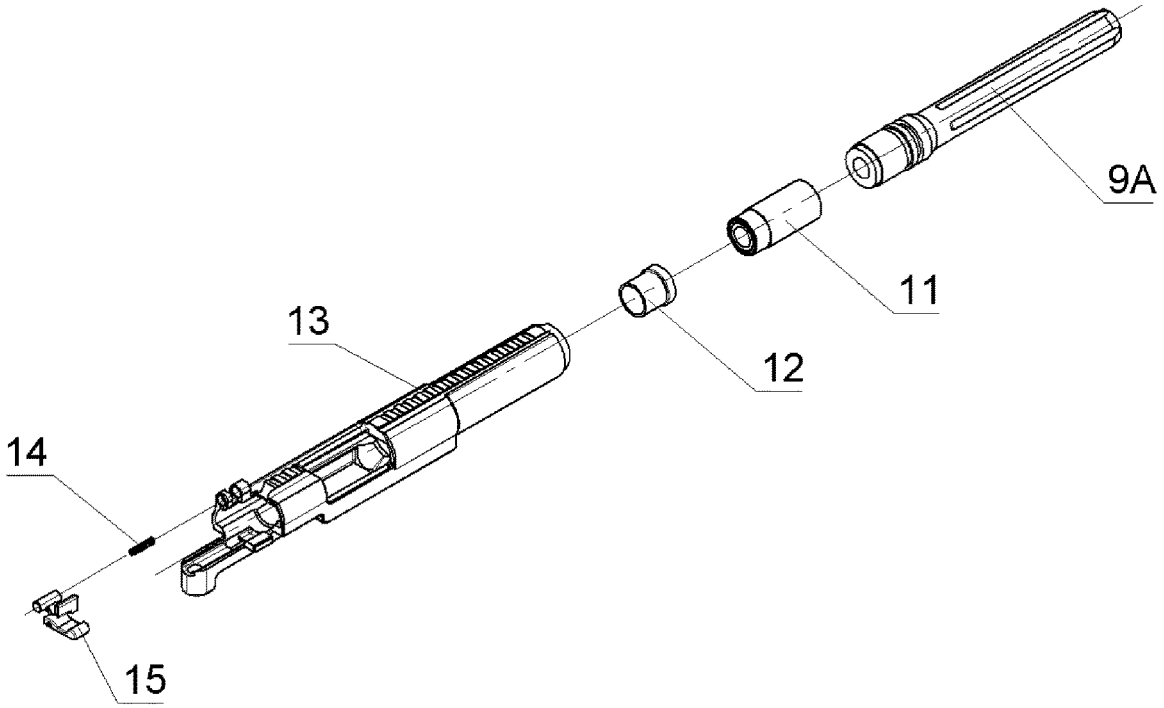
FIG. 19A shows detailing of the receiver with the barrel and mechanisms 2A (side view).

FIG. 19A shows detailing of the receiver with the barrel and mechanisms 2A (side view). This configuration consists of: the barrel 9A with smooth bore, the multifunctional cartridge 11, the conical bushing of the receiver 12, the receiver 13, the safety spring 14, the safety 15.

Figure 19C:
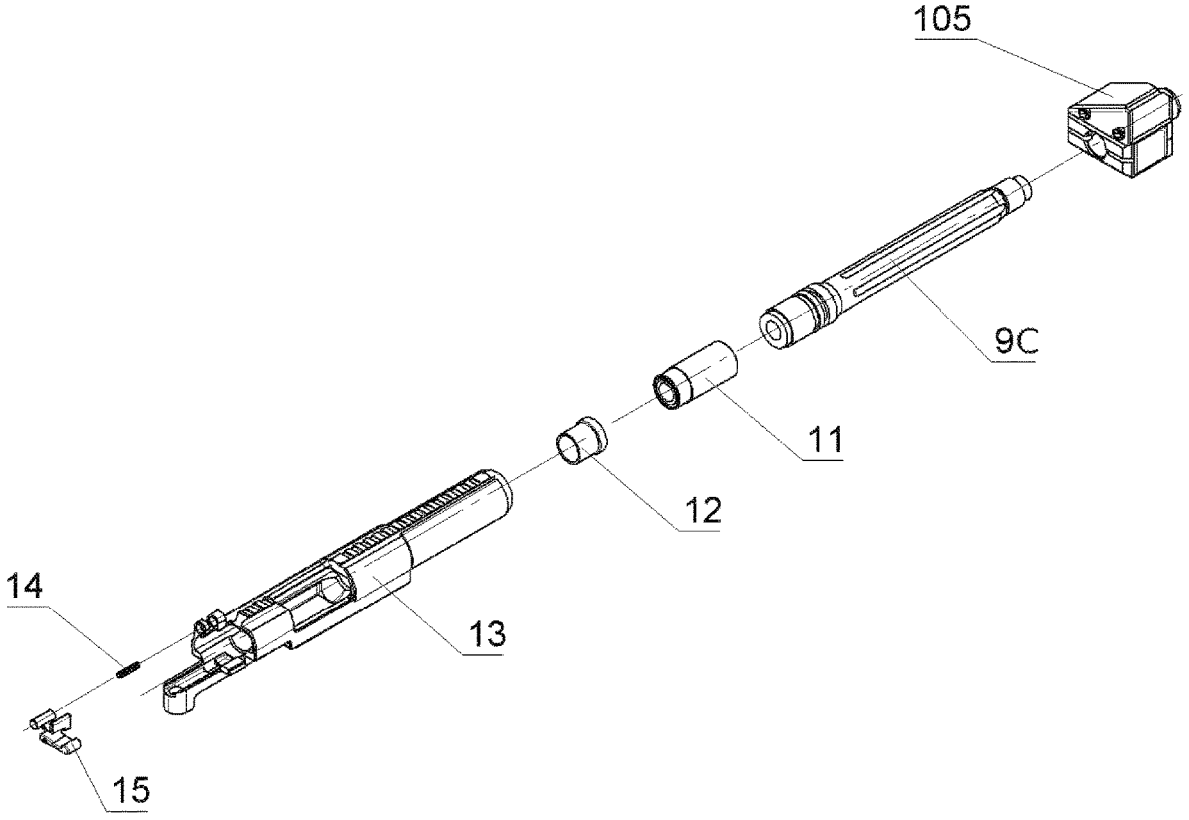
FIG. 19C shows detailing of the receiver with the barrel and mechanisms 2B (side view).

FIG. 19C shows detailing of the receiver with the barrel and mechanisms 2B (side view). This configuration consists of: the muzzle break 105, the barrel 9C with smooth bore, the multifunctional cartridge 11, the conical bushing of the receiver 12, the receiver 13, the safety spring 14, the safety 15.

Figure 20:
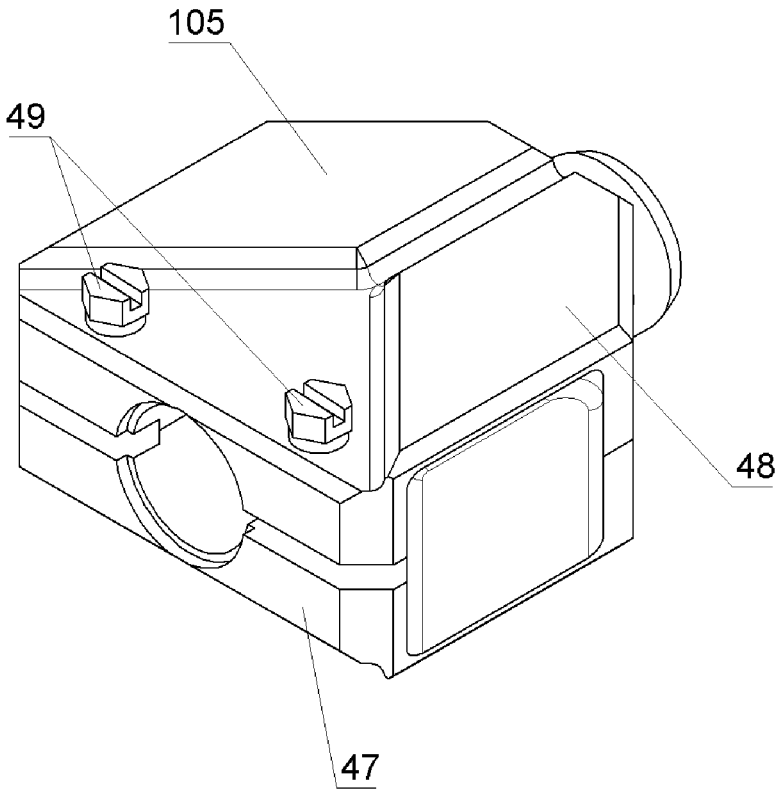
FIG. 20 shows a side view of the muzzle break 105.

FIG. 20 shows a side view of the muzzle break 105. Muzzle break 105 contains the lower part of the muzzle break 47 and the upper part of the muzzle break 48. The parts of the muzzle break 105 are interconnected by the screws of the muzzle break 49.

Figure 21:
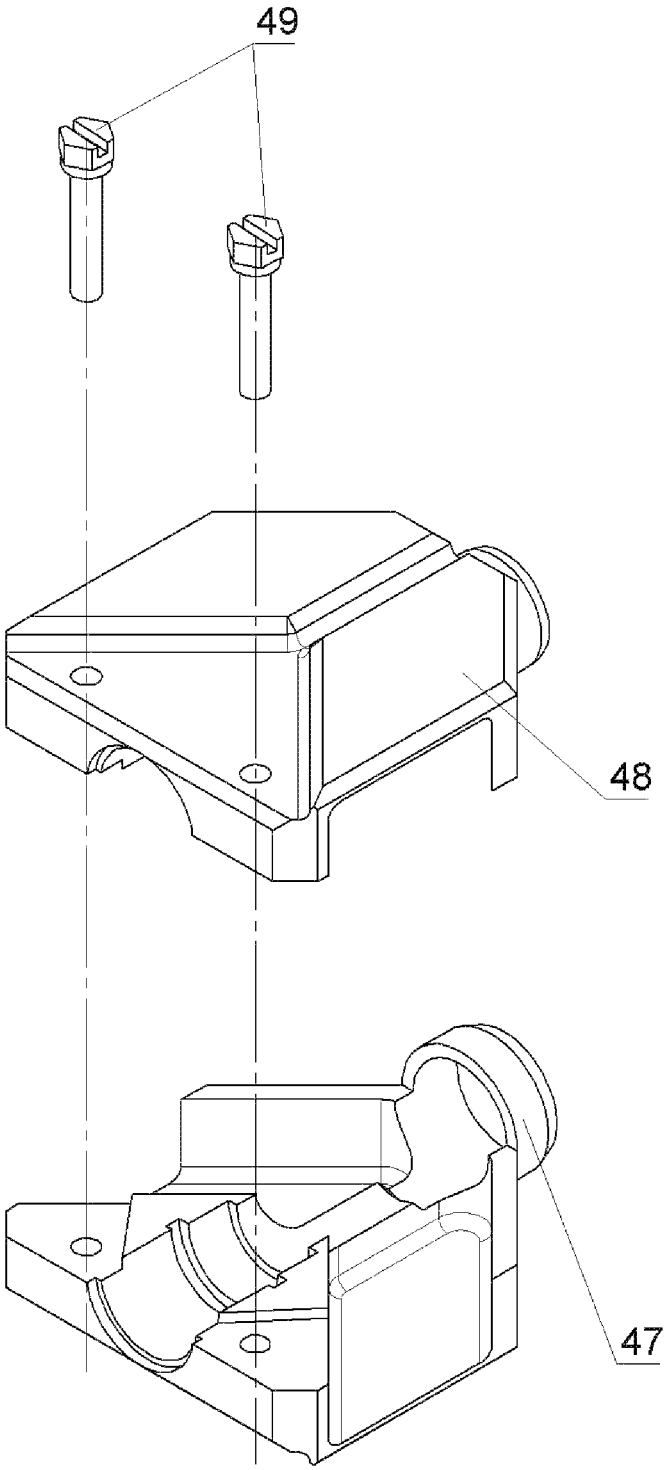
FIG. 21 shows detailing of the muzzle break 105 (side view).

FIG. 21 shows detailing of the muzzle break 105 (side view). This configuration consists of: the lower part of the muzzle break 47, the upper part of the muzzle break 48, the screws of the muzzle break 49.

Figure 22:
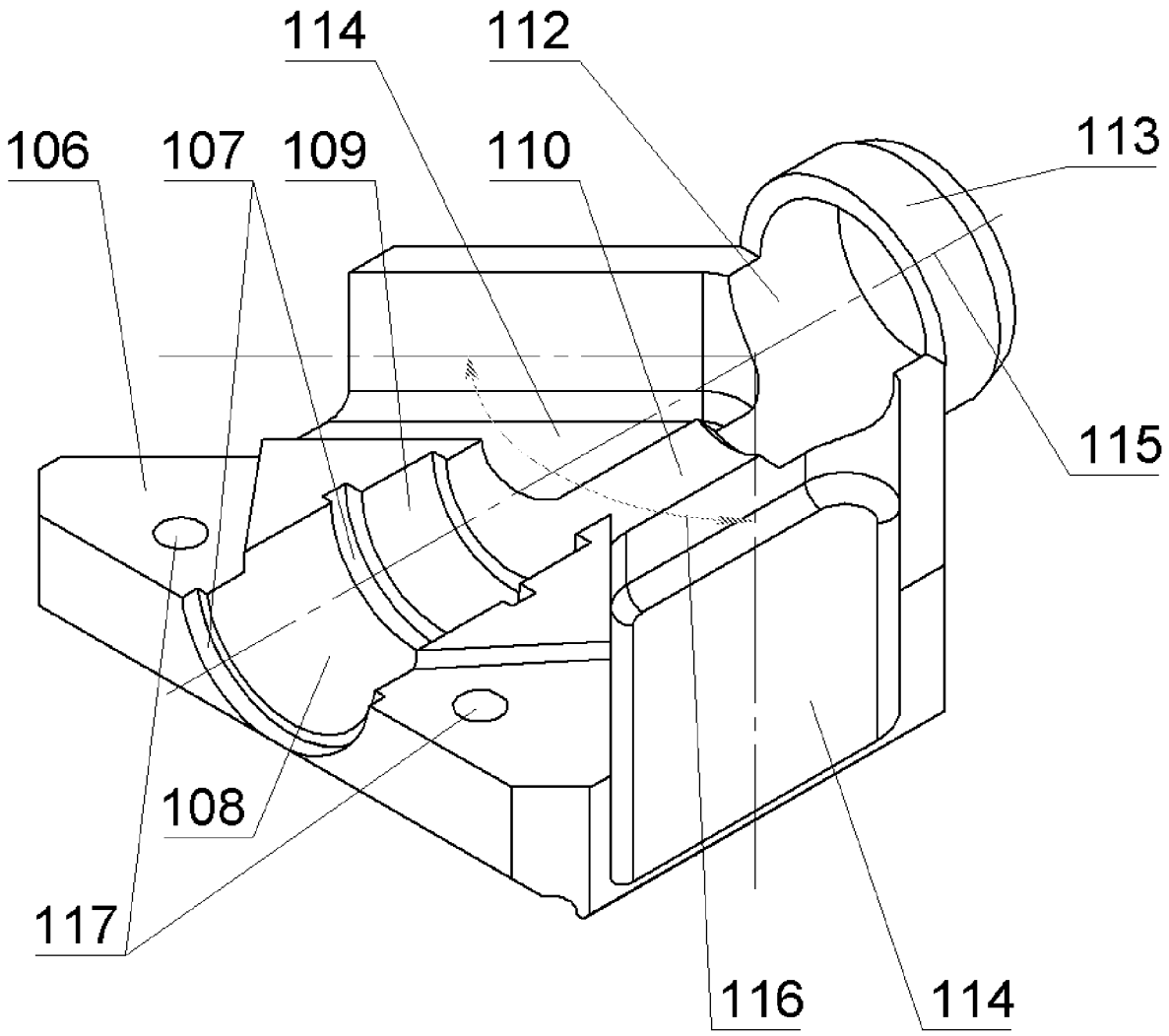
FIG. 22 shows a side view of the lower part of muzzle break 47.

FIG. 22 shows a side view of the lower part of the muzzle break 47. The lower part of the muzzle break 47 is configured in the form of a plate 106 with a groove 107 at the inlet, which passes into the threaded section 108, which passes into the groove 107, which passes over the smooth conical part 109. The threaded section 108 and the smooth conical part 109 are configured to fix the barrel 9C. Behind the conical part 109, the smooth cylindrical section 110 with a diameter corresponding to the inner bore of the barrel 121 is disposed, which passes into the cylindrical groove 112. The cylindrical groove 112 is configured to mount the upper part of the muzzle break 48 and the primary chamber 347 is formed in it after assembly of the muzzle break 105. The cylindrical groove 112 passes into the outer tube 113. In place of the smooth cylindrical section 110 and the cylindrical groove 112, two slots 114 are disposed at an acute angle to the longitudinal axis 115 of the muzzle break 105. In the cross-section with each other, two slots 114 form an angle 116 equal to 80-90 degrees. In the assembled muzzle break 105, the slots 114 form the inclined channel 34 for exhaust gas jet stream 352 of the propellant, ensuring a decrease of the blow-back of the weapon 1C. The threaded holes 117 are disposed outside the threaded section 108 configured for the screws of the muzzle break 49. All elements of the lower part of the muzzle break 47, their shapes and interaction with each other are shown in FIG. 23.

Figure 23:
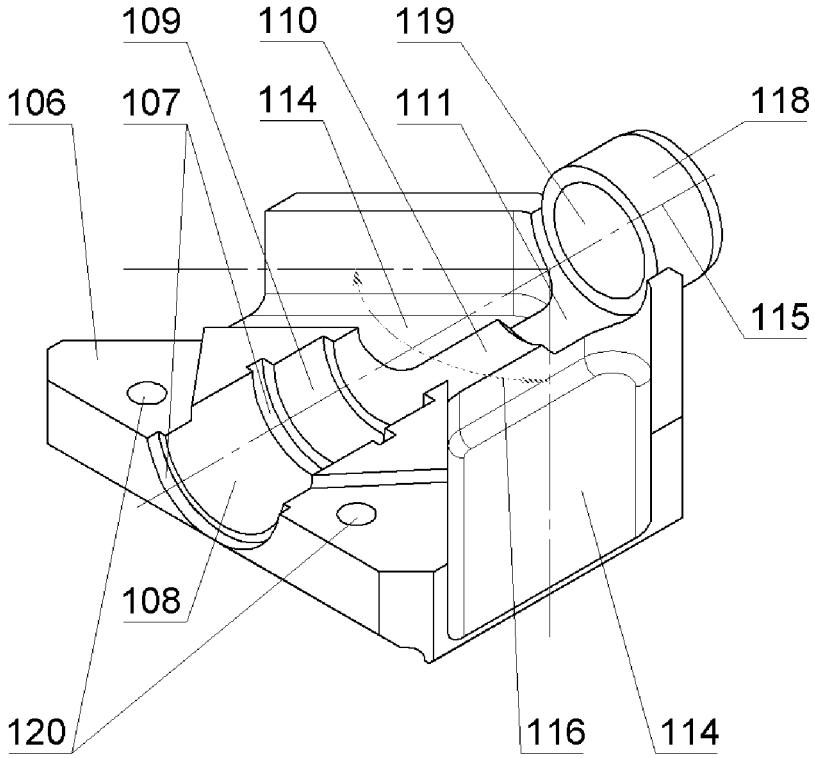
FIG. 23 shows a side view of the upper part of muzzle break 48.

FIG. 23 shows a side view of the upper part of the muzzle break 48. The upper part of the muzzle break 48 is configured in the form of plate 106 with the groove 107, which passes into the threaded section 108, which passes into a groove 107, which passes over the smooth conical part 109. The threaded section 108 and the smooth conical part 109 are configured to fix the barrel 9C. Behind the conical part 109, the smooth cylindrical section 110 with a diameter corresponding to the inner channel of the barrel 121 is disposed, which passes into the cylindrical groove 111. The cylindrical groove 111 is configured to mount the lower part of the muzzle break 47 and the primary chamber 347 is formed in it after assembly of the muzzle break 105. The cylindrical groove 111 passes into the inner tube 118 with an inner smooth hole 119 with a diameter corresponding to the inner channel of the barrel 121. In place of the smooth cylindrical section 110 and the cylindrical groove 111, two slots 114 are disposed at an acute angle to the longitudinal axis 115 of the muzzle break 105. In the cross-section with each other, two slots 114 form an angle 116 equal to 80-90 degrees. In the assembled muzzle break 105, the slots 114 form an inclined channel for exhaust gas jet stream 352 of propellant, ensuring a decrease of the blow-back of the weapon 1C. The holes 120 are disposed outside the threaded section 108 configured for the screws of the muzzle break 49. All elements of the upper part of the muzzle break 48, their shapes and interaction with each other are shown in FIG. 23.

Figure 24A:
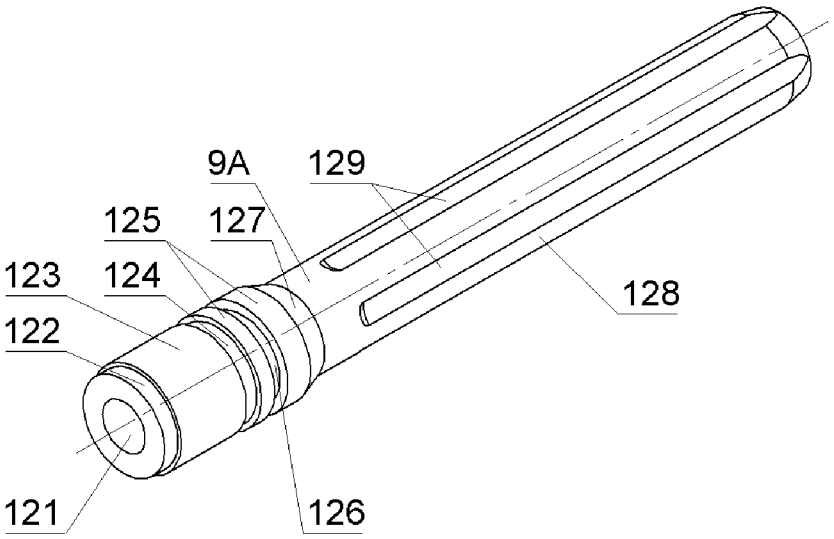
FIG. 24A shows a side view of the barrel 9A.

FIG. 24A shows a side view of the barrel 9A. The barrel 9A is configured with a smooth inner channel 121 without grooves. The barrel 9A is configured with the smooth cylindrical section 122, which passes into the threaded section with the buttress thread 123, which passes into the circular groove 124, which passes into the smooth cylindrical section 125 with the groove 126 configured for the barrel latch 10. The smooth cylindrical section 125 passes into the conical part 127, which passes into the cylindrical section 128 with the grooves 129 along the exterior perimeter. All said sections of the barrel 9A are configured with different thickness and this is shown in FIG. 24A.

Figure 24C:
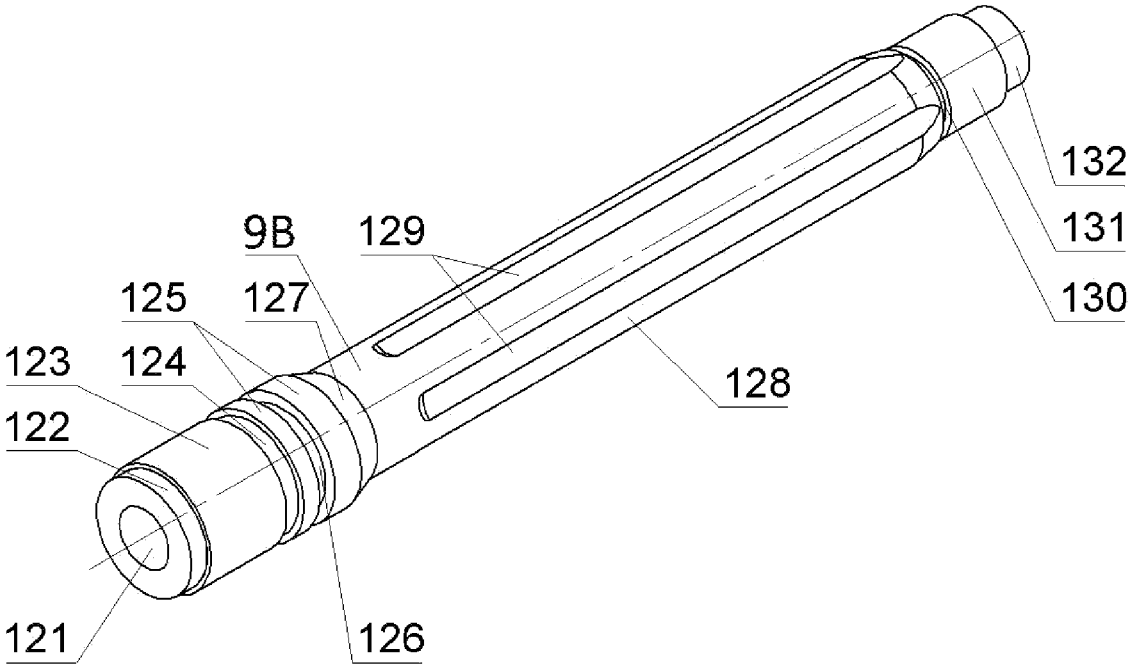
FIG. 24C shows a side view of the barrel 9C.

FIG. 24C shows a side view of the barrel 9C. The barrel 9C is configured with a smooth inner channel 121 without grooves. The barrel 9C is configured with the smooth cylindrical section 122, which passes into the threaded section with the buttress thread 123, which passes into the circular groove 124, which passes into the smooth cylindrical section 125 with the groove 126 configured for the barrel latch 10. The smooth cylindrical section 125 passes into the conical part 127, which passes into the cylindrical section 128 with the grooves 129 along the exterior perimeter, which passes into the groove 130, which passes into the section with thread 131, which passes into the smooth conical part 132. All said sections of the barrel 9C are made with different thickness, and it is shown in FIG. 24C.

Figure 25:
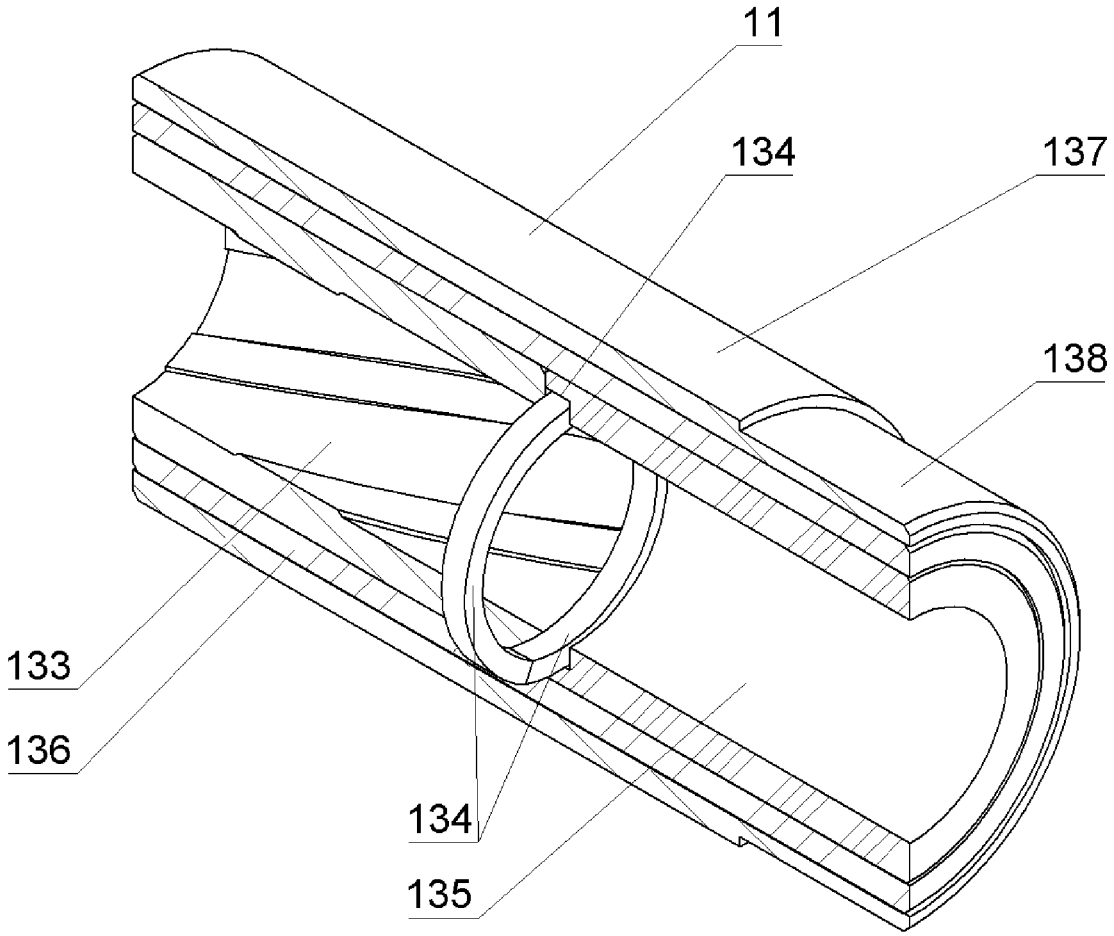
FIG. 25 shows the longitudinal section of the multifunctional cartridge 11.

FIG. 25 shows the longitudinal section of the multifunctional cartridge 11. The multifunctional cartridge 11 contains the threaded bushing 133, the spring half-rings 134, the inner smooth bushing 135 with grooves for the spring half-rings 134, the middle bushing 136 (in number of one or more) and outer bushing with variable diameter 137 having a larger diameter 138. The threaded bushing 133 and the inner smooth bushing 135 are made of carbide and refractory material. Two or more threaded grooves are made in the threaded bushing 133 made of carbide and refractory material. The pitch and shape of the grooves depends on the ammunition used. The bushings 133, 135, 136 and 137 are tightly inserted into each other and form the multifunctional cartridge 26. The outer surfaces of the bushings 133, 135, 136 and 137 are glazed up to high-gloss. The multifunctional cartridge 11 ensures maintaining of high pressure within firing, and the glazing up to high-gloss provides minimal heat loss in the hot spot area. Glazed surface proves itself like the vacuum insulated bottle reflecting the heat flow. Carbide and refractory threaded bushing 133, carbide and refractory inner smooth bushing 135 ensure high reliability of the weapon during high temperature of the gases generated within the propellant combustion. All elements of the multifunctional bushing 11, their shapes and interaction with each other are shown in FIG. 25.

Figure 26:
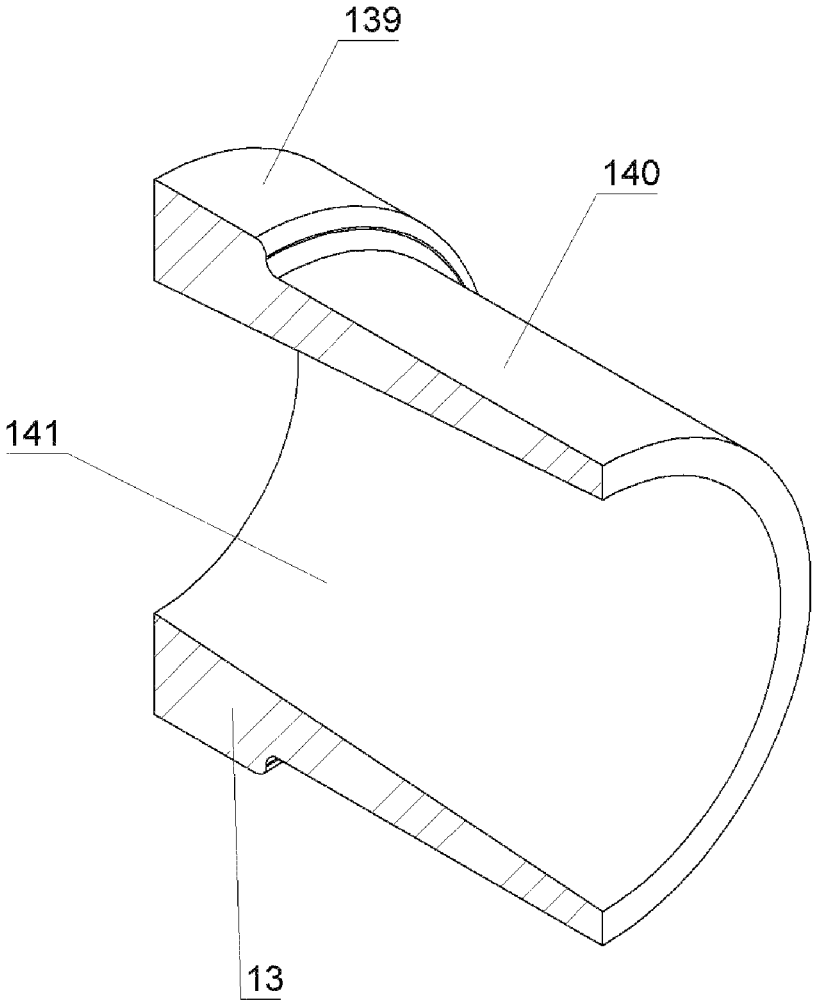
FIG. 26 shows the longitudinal section of the conical bushing of receiver 13.

FIG. 26 shows the longitudinal section of the conical bushing of receiver 13. The conical bushing of the receiver 13 is configured with the cylindrical section 139, which passes into a smaller cylindrical section 140. The conical hole 141 with small base at the end of the cylindrical section 139 is disposed inside the conical bushing of the receiver 13. All elements of the conical bushing of the receiver 13, their shapes and interaction with each other are shown in FIG. 26.

Figure 27:
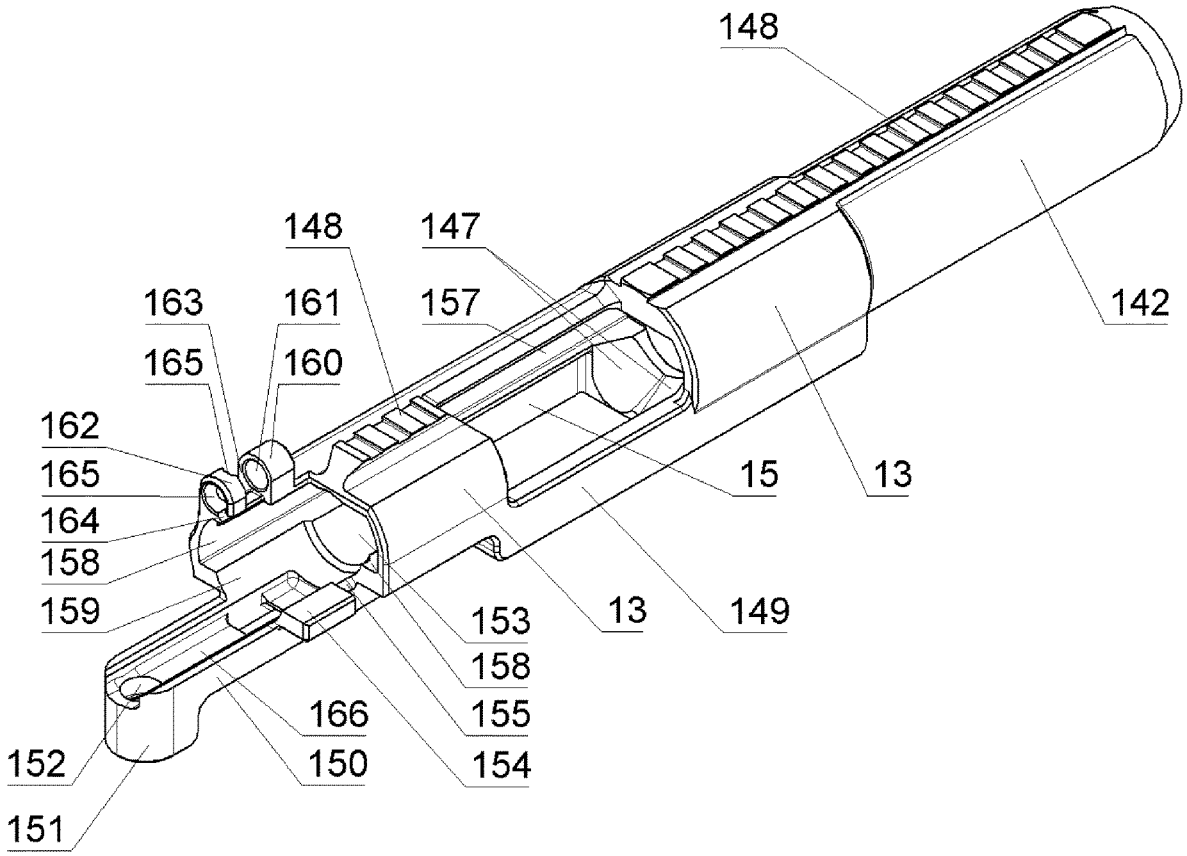
FIG. 27, FIG. 28 show side view of the receiver 13.
Figure 29:
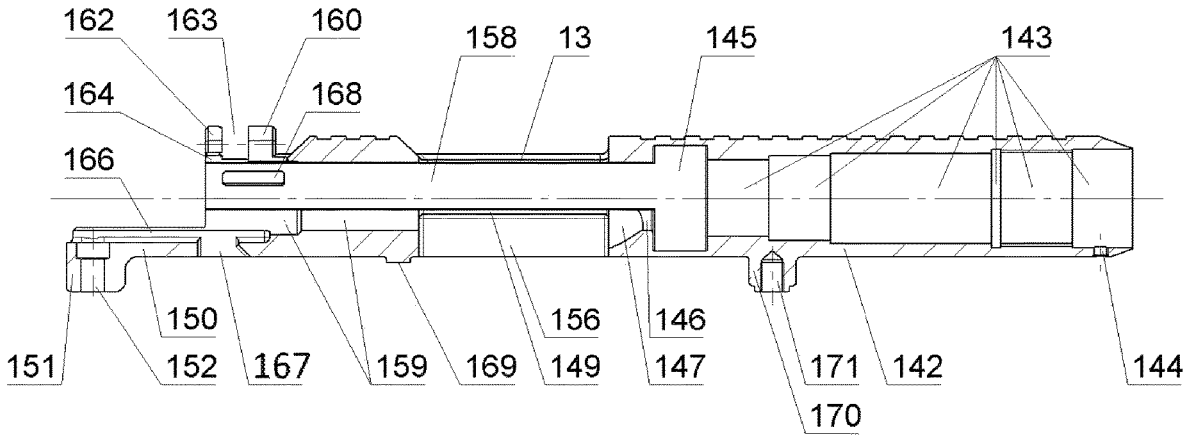
FIG. 29 shows the longitudinal section of the receiver 13.

FIG. 27, FIG. 28 show side view of the receiver 13, and FIG. 29 shows the longitudinal section of the receiver 13. The receiver 13 is configured with cylindrical section 142. At the end of the cylindrical section 142, the multi-layered cylindrical hole with threaded section 143 configured to mount the conical bushing of the receiver 12 purposed for installation of the multifunctional cartridge 11 and of the barrel with a smooth bore 9A or 9C. At inlet of the multi-layered cylindrical hole with threaded section 143, the cross-threaded hole 144 is disposed at the bottom, configured for the barrel latch 10. The multi-layered cylindrical hole with threaded section 143 passes into the cylindrical groove 145. The cylindrical hole 145 passes into the complex-shaped section 146, which repeats the shape of the front section of the bolt body 25. At inlet of the complex-shaped section 146, two cylindrical guide chamfers 147 are configured. On top of the receiver 13, the rail 148 is disposed to attach the brackets for different sights. The rear end of the cylindrical section 142 passes into the complex-shaped bar 149. The complex-shaped bar 149 has the console 150 at the end with butt protrusion 151, and the hole 151 is configured to mount the upper screw 36 of the trigger guard with magazine box. At the junction between the console 150 and the complex-shaped bar 149, the leading notch 153 is disposed, and the complex-shaped bar 149 forms the protrusion 154 and the groove 155 below the notch 153. The leading protrusion 75 of the bolt body 25 is inserted into the slot 155, which abuts against the projection 154, and this ensures additional locking of the bolt 4, and the leading protrusion 75 acts as the third locking lug. The complex-shaped bar 149 has the hole 156 configured for the magazine 7, the window 157 to discharge the ammunition 38, the guiding slots 158, which repeat the shape of the locking lugs 72 of the bolt body 25, the stepped through-hole 159 for the passage of the bolt body 25. At the junction between the console 150 and the complex-shaped bar 149, the protrusion 160 with the blind hole 161 and the protrusion with the through-hole 162 are configured. The safety 15 with the safety spring 14 are installed in the protrusion 160 with the blind hole 161 and in the protrusion 160 with the through-hole 162. The slot 163 is disposed between the protrusion 160 and the protrusion with the through-hole 162. The through slot 164 is formed in the protrusion with the through-hole 162 configured to mount the safety 15, as well as the blind slots 165 purposed to fix the safety 15 in fire position and to set and release the bolt 4 from weapons 1A, 1B, 1C. The console 150 has the slot 166 configured for passage of the firing hammer 26 or 26K, and the trapezoidal hole 167 configured for passage of the trigger bar 17. At the bottom of the protrusion 160 and the protrusion with the through-hole 162, the rectangular hole 168 is disposed in the guiding slot 158 to mount the fixing plate 178 of the safety 15. In the lower part of the complex-shaped bar 149, the protrusion 169 is disposed to fix the magazine latch 19 in the open position, and the protrusion 170 with a blind threaded hole 171 configured for the lower screw 37 of the trigger guard with the magazine box. All elements of the receiver 13, their shapes and interaction with each other are shown in FIG. 27, FIG. 28, FIG. 29.

Figure 30:
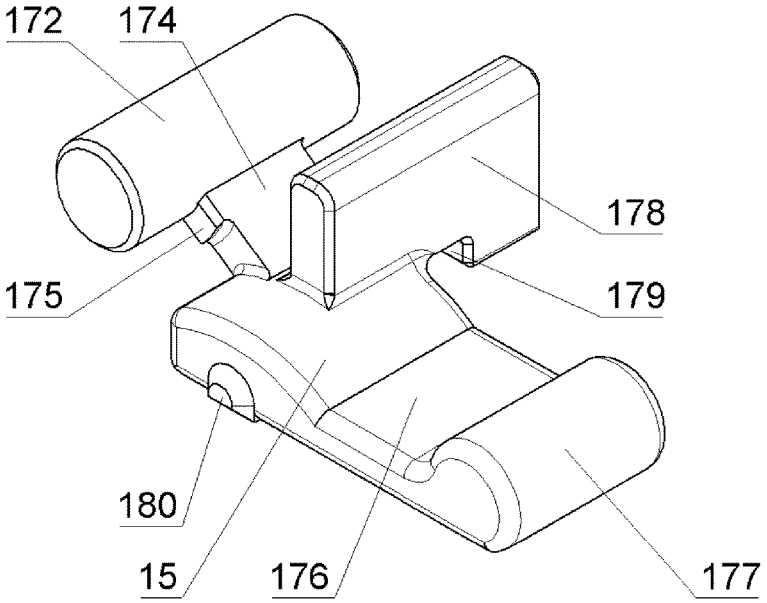
FIG. 30, FIG. 31 show side view of the safety 15.
Figure 31:
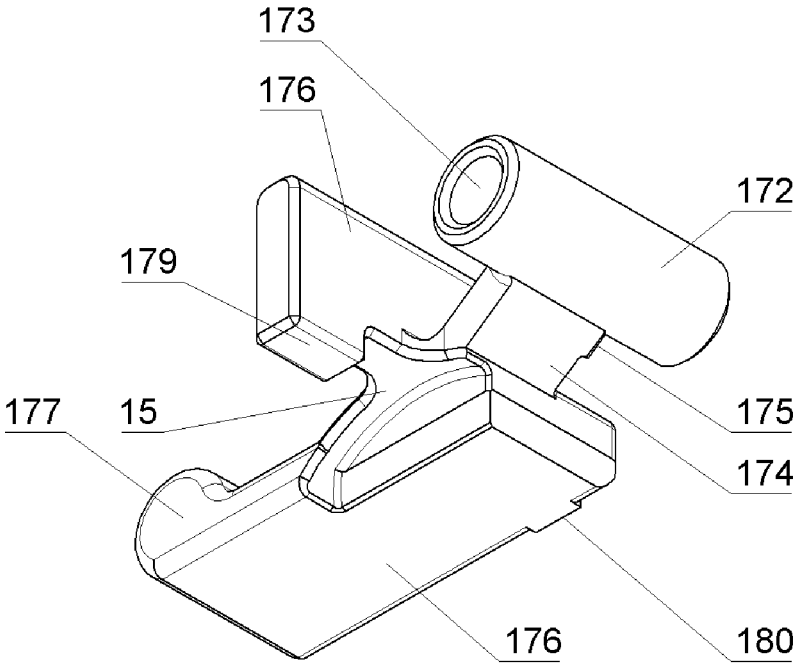

FIG. 30, FIG. 31 show side view of the safety 15. The safety 15 is disposed in a form of axis 172 with the blind hole 173 configured for the safety spring 14. The axis 172 passes into the base 174 configured in a form of the plate. On the base 174 the protrusion 175 is disposed, which interacts with the blind slot 165 of the receiver 13 and fix the safety 15 in fire position and configured to set and remove the bolt 4 from weapons 1A, 1B, 1C. The base 174 passes into the thumb piece 176 configured in the form of the complex-shaped plate. At the end of the thumb piece 176, the cylindrical protrusion 177 is disposed to facilitate operations with the safety 15. At the junction between the base 174 and the thumb piece 176, the fixing plate 178 with the safety lug 179 is disposed. The fixing plate 178 interacts with the locking lug 72 of the bolt body 25 and fixes the locking lug 72 in the receiver 13. The safety lug 179 interacts with the rectangular hole 86 of the bolt body 25 and fixes the bolt 4 in the receiver 13. The conical protrusion 180 is disposed at the side surface of the thumb piece 176 configured to interact with the hammer 94 of the firing hammer 26. All elements of the safety 15, their shapes and interaction with each other are shown in FIG. 30 and FIG. 31.

Figure 32:
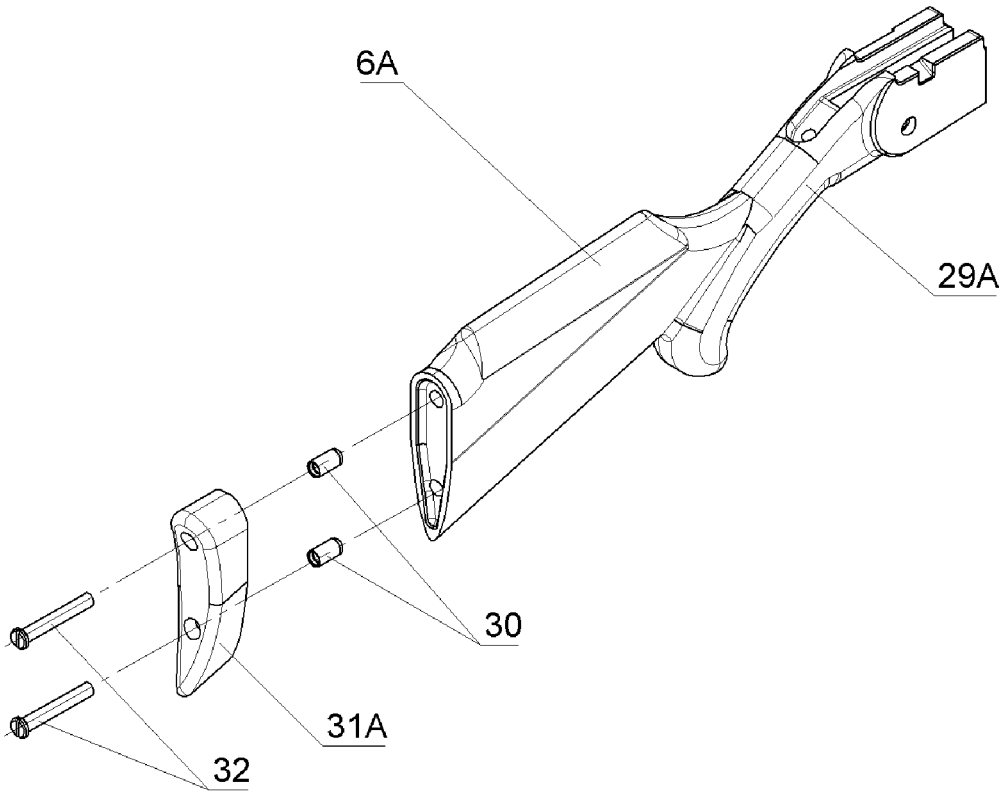
FIG. 32 shows detailing of the hunting buttstock 6A (side view).

FIG. 32 shows detailing of the hunting buttstock 6A (side view). This configuration consists of: the hunting buttstock 29A, the threaded bushing for the back plate screw 30, the back plate 31A, and the back plate screw 32.

Figure 33:
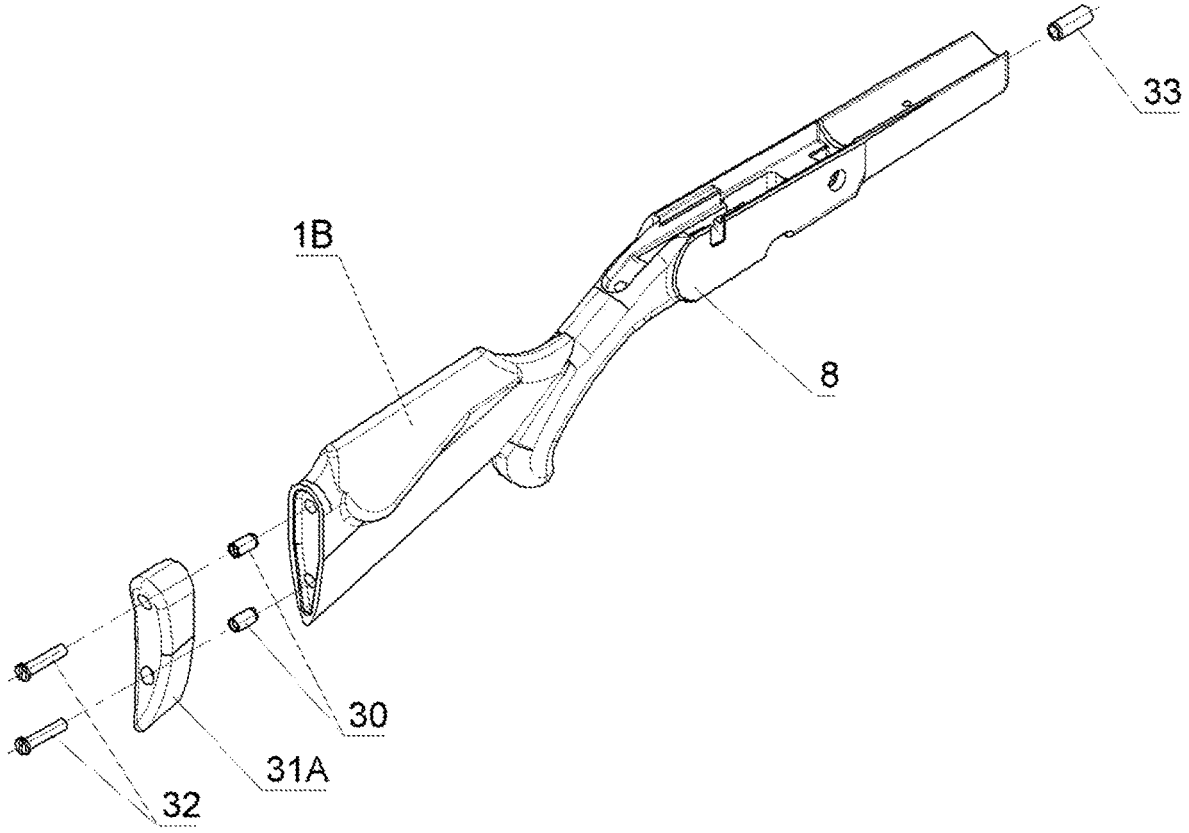
FIG. 33 shows detailing of the hunting gunstock 1C (side view).

FIG. 33 shows detailing of the hunting gunstock 1C (side view). This configuration consists of: the gunstock 8, the threaded bushing for the back plate screw 30, the back plate 31A, the back plate screw 32, the threaded bushing 33 to mount the bipod 50.

Figure 34:
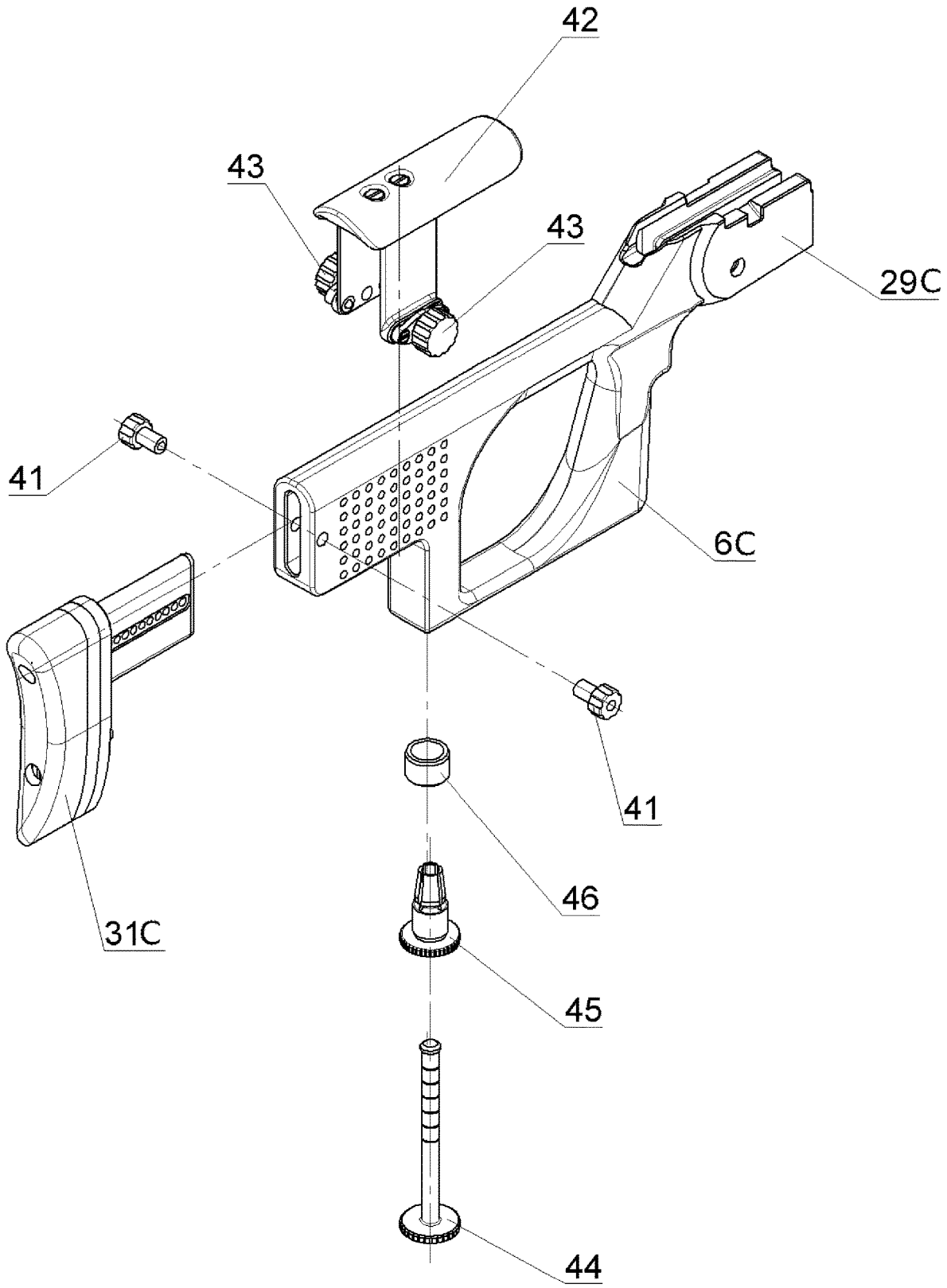
FIG. 34 shows detailing of the skeletal buttstock with the adjustable back plate and the cheek piece 6C (side view).

FIG. 34 shows detailing of the skeletal buttstock with the adjustable back plate and the cheek piece 6C (side view). This configuration consists of: the skeletal buttstock 29C, the adjustable back plate 31C, the latch of the adjustable back plate 41, the adjustable cheek piece 42, the latch of adjustable cheek piece 43, the stop 44, the stop lock 45, the threaded bushing of stop lock 46.

Figure 35:
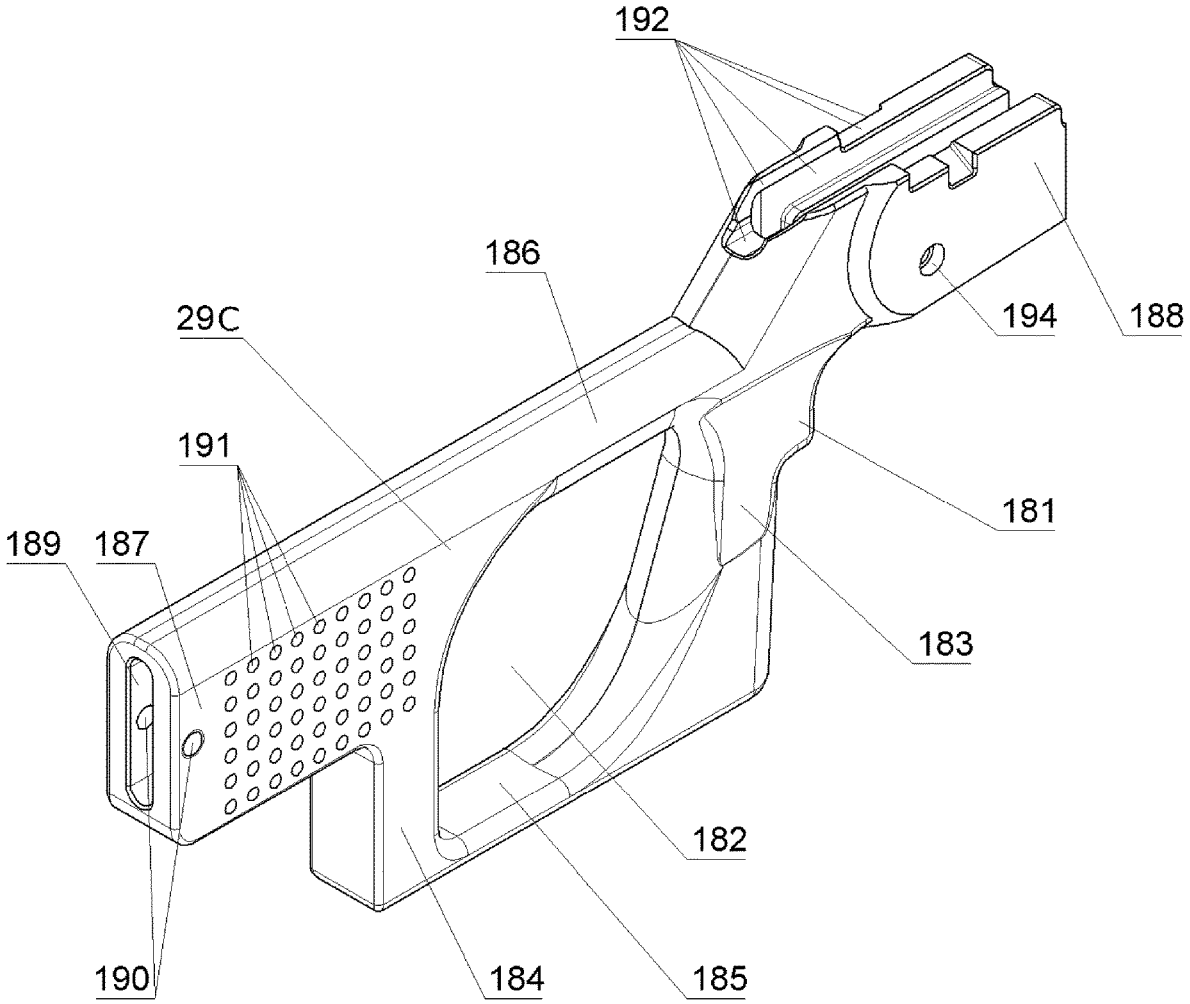
FIG. 35 shows a side view of the skeletal buttstock 29C.
Figure 36:
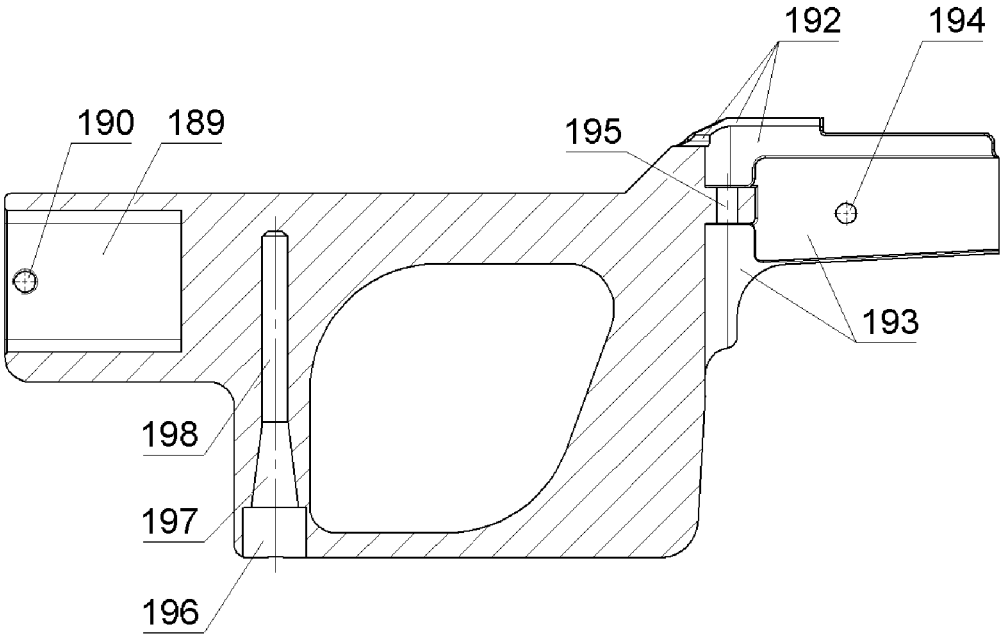
FIG. 36 shows the longitudinal section of the skeletal buttstock 29C.

FIG. 35 shows a side view of the skeletal buttstock 29C, and FIG. 36 shows the longitudinal section of the skeletal buttstock 29C. The skeletal buttstock 29C is configured in the form of the complex-shaped bar 181 with inside through hole 182 of the complex shape, which forms the shooting grip in the bar 181, the rack 184, the lower jumper 185 and the upper jumper 186. The console 187 is disposed in the bar 181 from the side of the rack 184. The grasp 188 is disposed in the bar 181 from the side of the shooting grip 183. The blind longitudinal hole 189 is disposed in the console 187 and configured for the adjustable back plate 31C, as well as the threaded holes 190 for the latches of adjustable back plate 41. The rows of the spherical recesses 191 are disposed at the side surfaces of the console 187, configured for height and horizontal adjustment of the adjustable cheek piece 42. Inside the grasp 188, the slots 192 are disposed to mount the receiver 13, and the slots 193 are also configured to mount the trigger guard with the magazine box and mechanisms 3. The cross hole 194 is disposed in the grasp 188 to mount the cross screw of the buttstock 34, and the nut of the cross screw 35 of the buttstock, and the vertical hole 195 is also made for the upper screw of the trigger guard with the magazine box 36. The hole 196 is disposed in the rack 184 and configured for the threaded bushing of the stop lock 46, which passes into the conical hole 197 for the stop lock 45. The conical hole 197 passes into the blind hole 198 configured for the stop 44.

Figure 37:
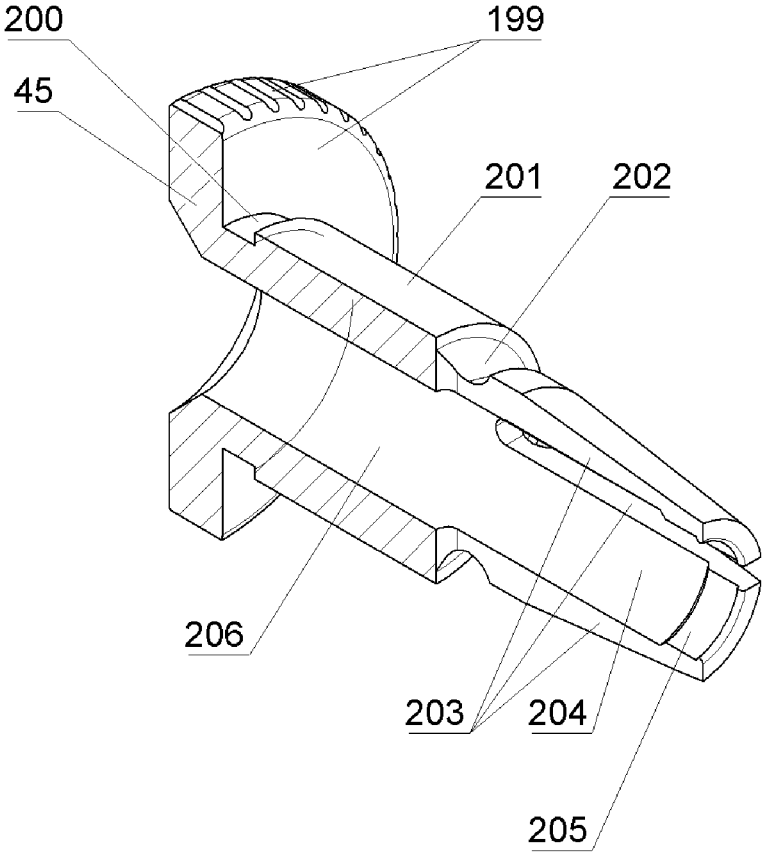
FIG. 37 shows a side view of the stop lock 45.

FIG. 37 shows a side view of the stop lock 45. The stop lock 45 is configured in the form of the cylindrical section with the notches 199, which passes into the groove 200, which passes into the cylindrical section with the outer thread 201, which passes into the radius groove 202. The groove 202 passes into the conical head with the through cross slots 203, which form the lugs of the retaining clamps 204. The cylindrical protrusion 205 is disposed at the ends of the lugs of the retaining clamps 204, configured to fix the stop 44 in any position, as well as in the extreme lower position, which prevents unauthorized removal of the stop 44 from the skeletal buttstock 29C. The hole 206 is disposed inside the stop lock 45, configured for the passage of the stop 44. All elements of the stop lock 45, their shapes and interaction with each other are shown in FIG. 37.

Figure 38:
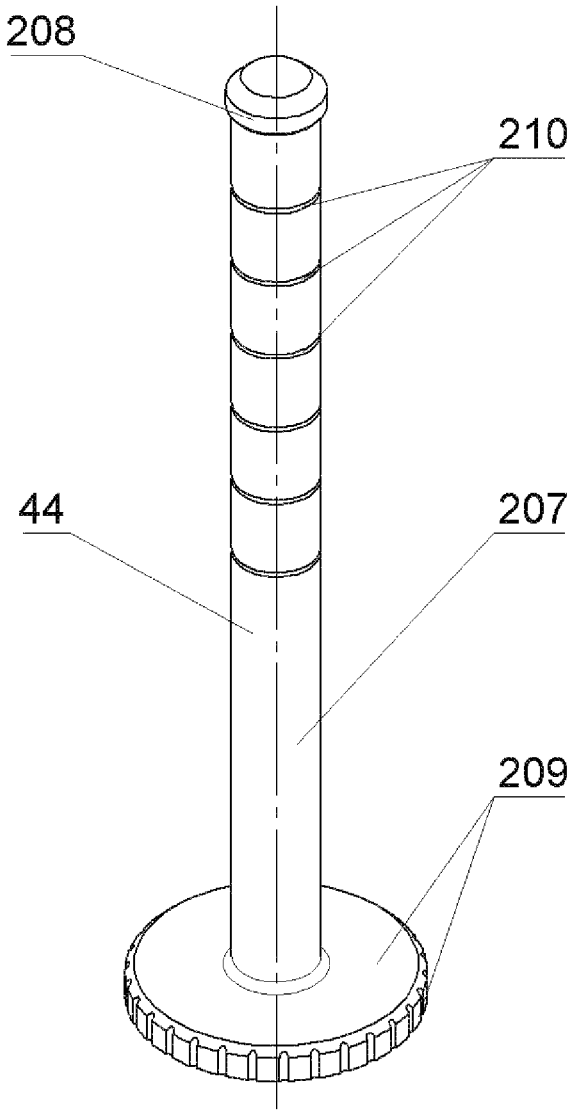
FIG. 38 shows a side view of the stop 44.

FIG. 38 shows a side view of the stop 44. The stop 44 is configured in the form of the rod 207 with the cylindrical head 208 at one end, and with the disk with notches 209 at the other end. Along the entire length of the rod 207, the grooves 210 are disposed to act as the ruler and to facilitate operation of the stop 44. All elements of the stop 44, their shapes and interaction with each other are shown in FIG. 38.

Figure 39:
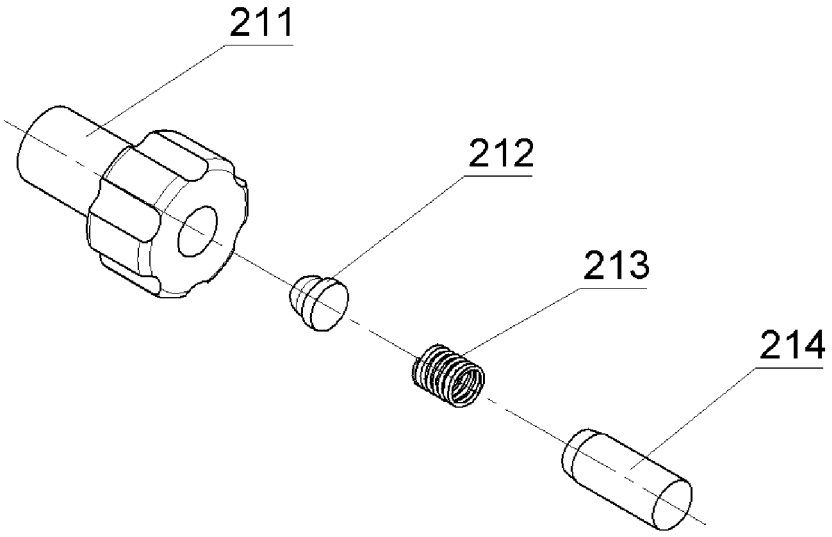
FIG. 39 shows detailing of the latch of the adjustable back plate 41 (side view).

FIG. 39 shows detailing of the latch of the adjustable back plate 41 (side view). This configuration consists of: the adjusting screw 211, the retaining pin 212 configured in the form of the spherical section, which passes into the cylindrical section, the retaining pin spring 213, the stop screw 214 configured in the form of the rod with the groove. All elements of the adjustable back plate 41, their shapes and interaction with each other are shown in FIG. 39.

Figure 40:
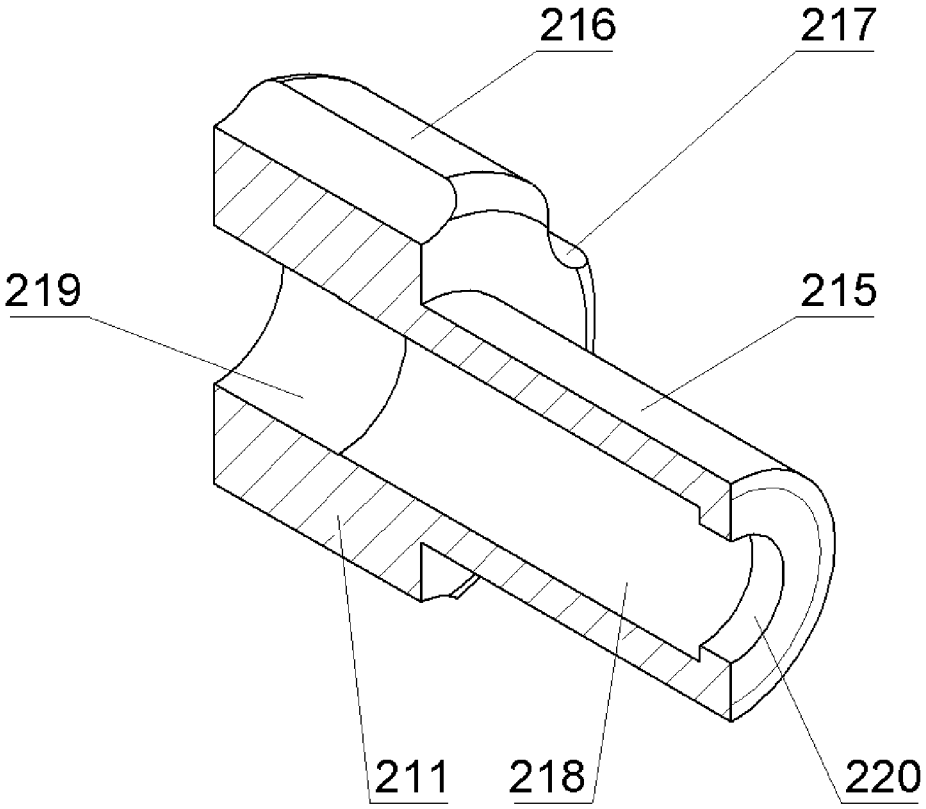
FIG. 40 shows a side view of the adjusting screw 211.

FIG. 40 shows a side view of the adjusting screw 211. The adjusting screw 211 is configured in the form of the threaded rod 215 with the cylindrical head 216 having the semi-circular slots 217. The blind hole 218 with threaded section 219 is configured inside the adjusting screw 211. The blind hole 218 passes into the through-hole 220. All elements of the adjusting screw 211, their shapes and interaction with each other are shown in FIG. 40.

Figure 41:
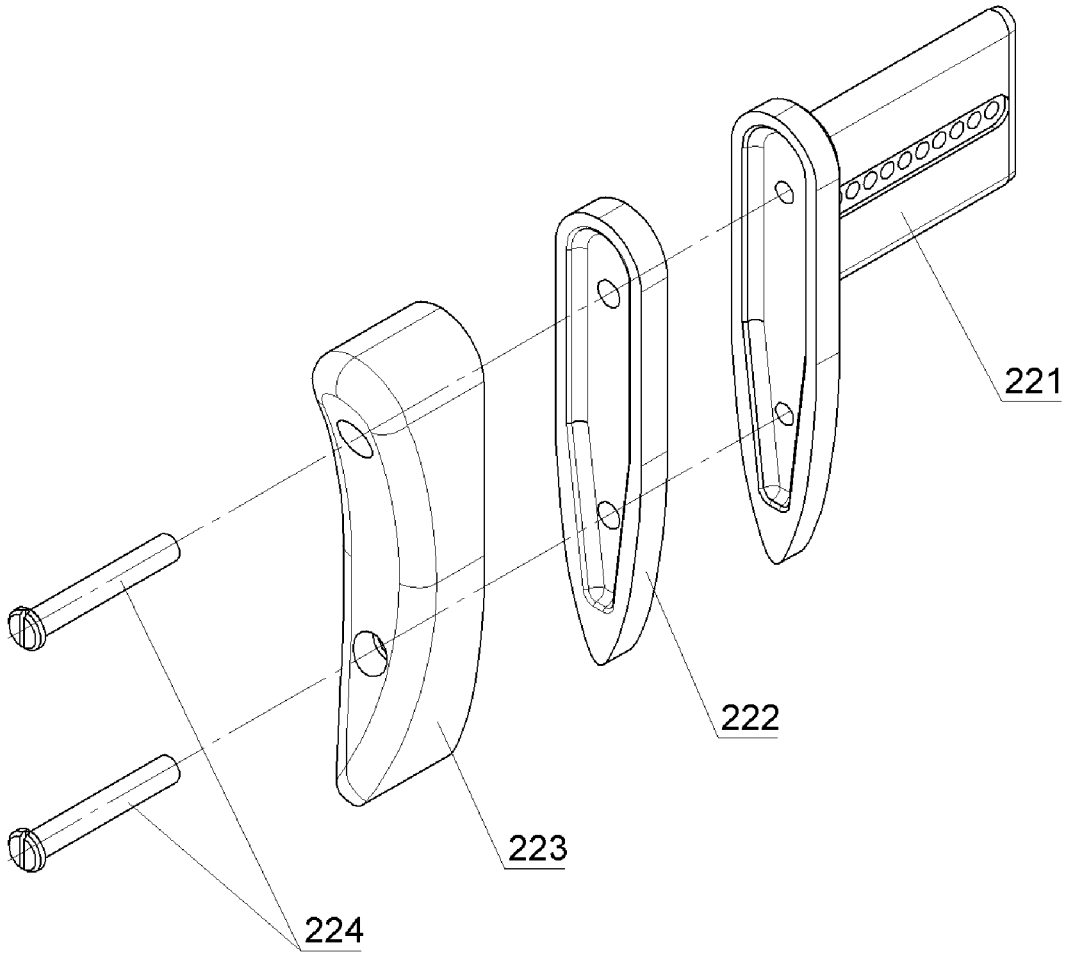
FIG. 41 shows detailing of the adjustable back plate 31C (side view).

FIG. 41 shows detailing of the adjustable back plate 31C (side view). This configuration consists of: the back plate bracket 221, the back plate extension piece 222, the back plate 223, the back plate screws 224.

Figure 42:
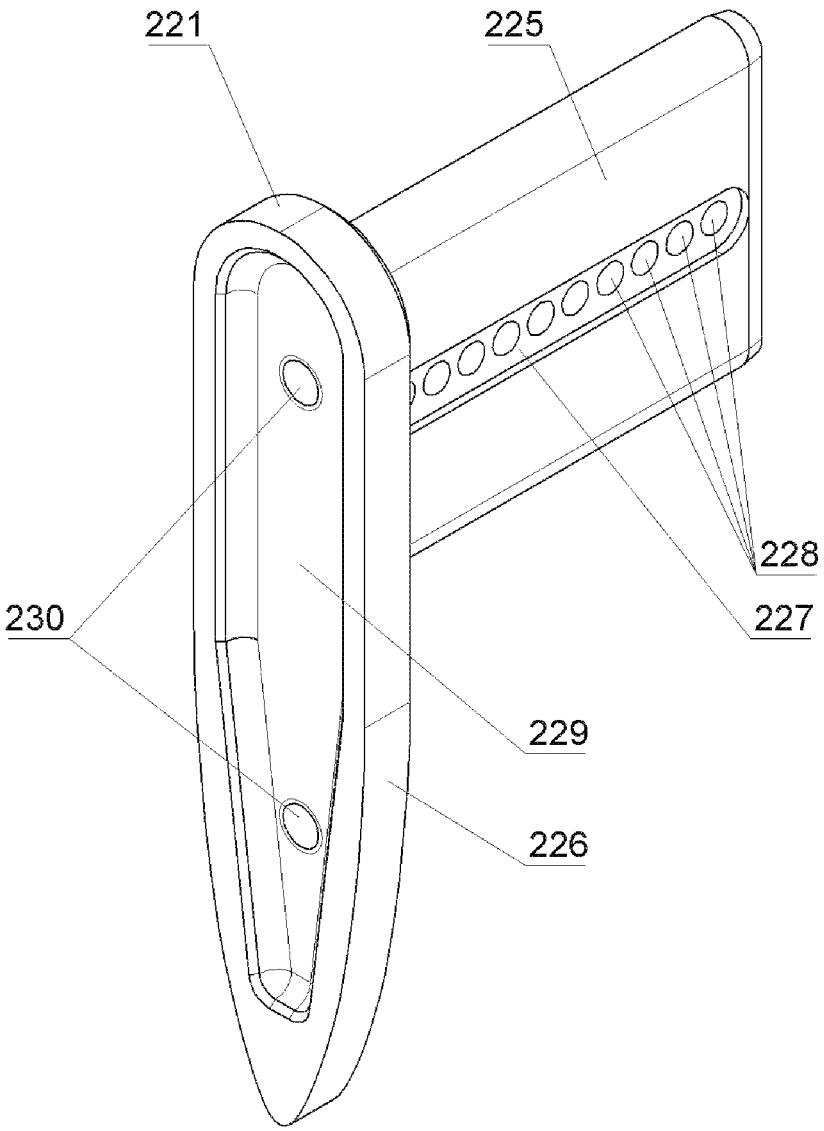
FIG. 42 shows a side view of the back plate bracket 221.

FIG. 42 shows a side view of the back plate bracket 221. The back plate bracket 221 is configured in the form of the longitudinal plate 225 and the transverse plate 226 disposed at right angles to each other. The slot 227 is disposed at the side surfaces of the longitudinal plate 225, and a number of the spherical recesses 228 are disposed inside the slot. The slot 227 and the spherical recesses 228 are configured to interact with the latch of the adjustable back plate 41. The transverse plate 226 repeats the shape of the back plate 223. The complex-shaped hole 229 is disposed inside the transverse plate 226 to fix the back plate extension piece 222. The threaded holes 230 are disposed inside the transverse plate 226, configured for the back plate screws 224. All elements of the back plate bracket 221, their shapes and interaction with each other are shown in FIG. 42.

Figure 43:
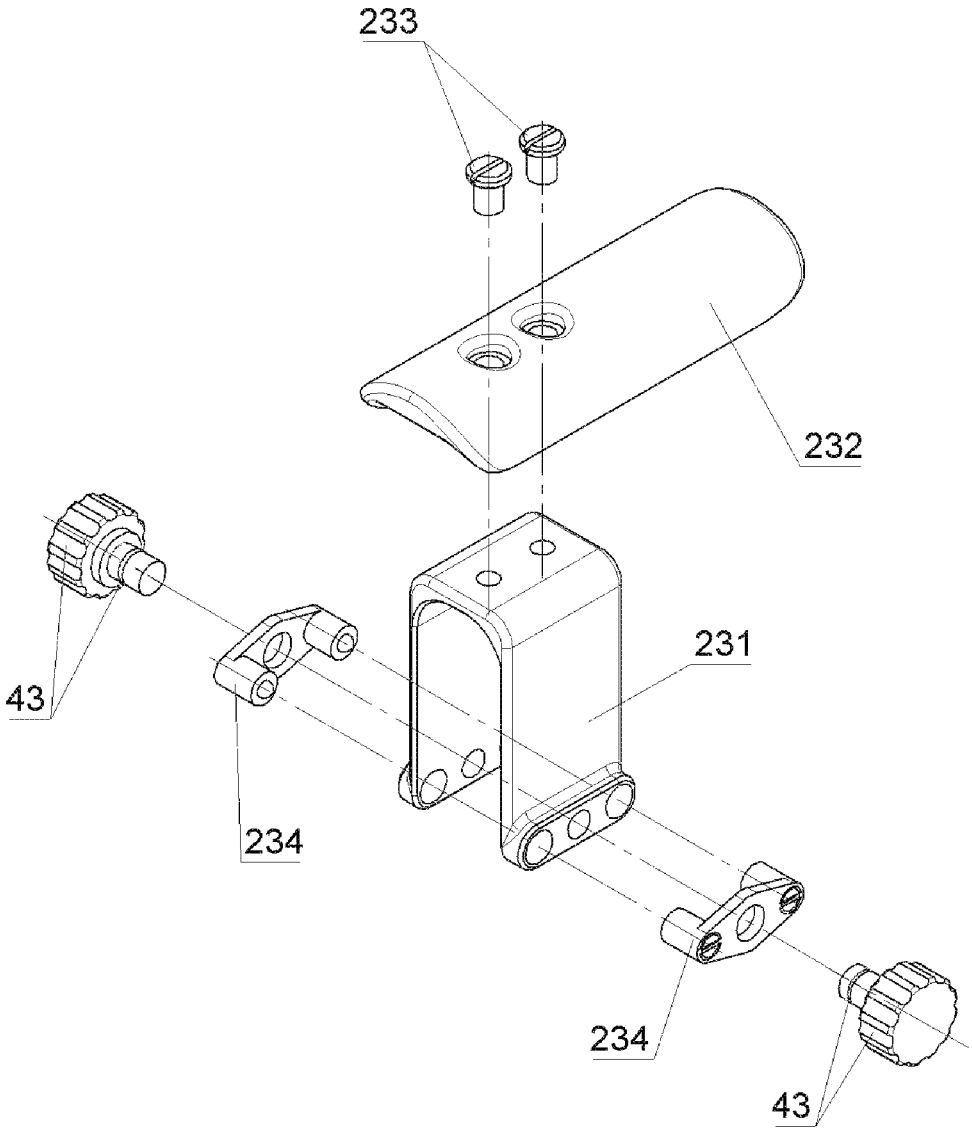
FIG. 43 shows detailing of the adjustable cheek piece 42 (side view).

FIG. 43 shows detailing of the adjustable cheek piece 42 (side view). This configuration consists of: the cheek piece clamp 231, the cheek piece 232 configured in the form of the complex-shaped plate with two holes for the cheek piece screws 233, the latch of adjustable cheek piece 43 configured in the form of the threaded rod with the spring ring and the cylindrical head with the semi-circular slots, the rests of the cheek piece clamp 234.

Figure 44:
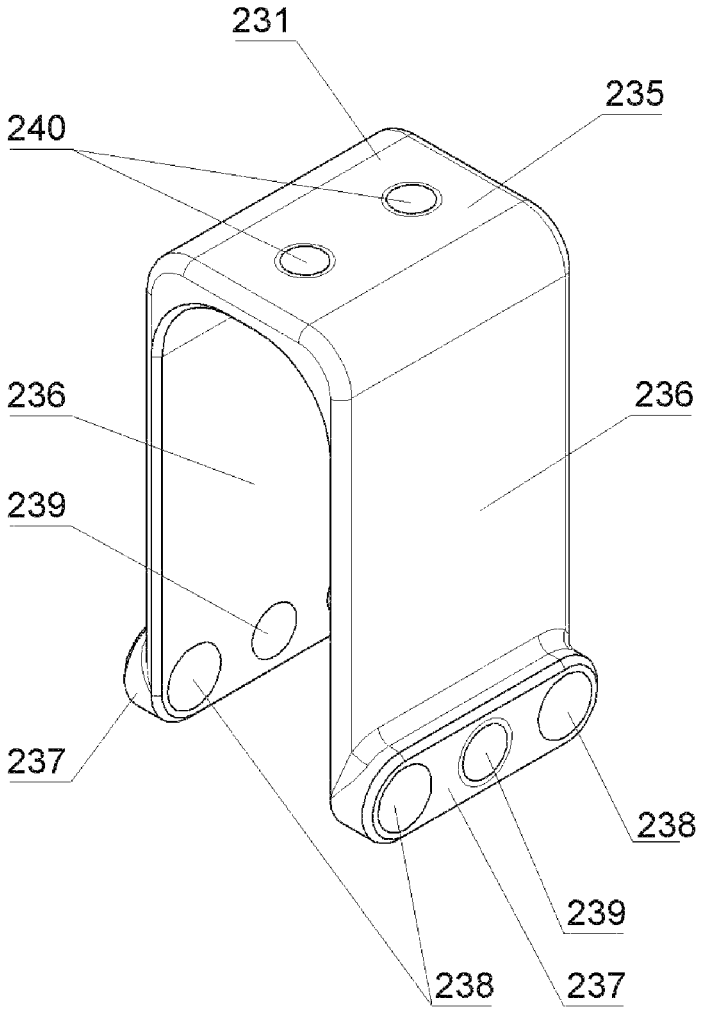
FIG. 44 shows a side view of the cheek piece clamp 231.

FIG. 44 shows a side view of the cheek piece clamp 231. The cheek piece clamp 231 is configured in the form of the bent plate 235 with the free ends 236. On the free ends 236, outside, the protrusions 237 are configured. The through-holes 238 are configured at the edges of the protrusions 237 to interact with the rests of the cheek piece clamp 234. The threaded holes 239 are configured in the center of the protrusions 237 to interact with the latches of the cheek piece 43. In the upper part of the bent plate 235 the threaded holes 240 are configured for the cheek piece screws 233. All elements of the cheek piece clamp 231, their shapes and interaction with each other are shown in FIG. 44.

Figure 45:
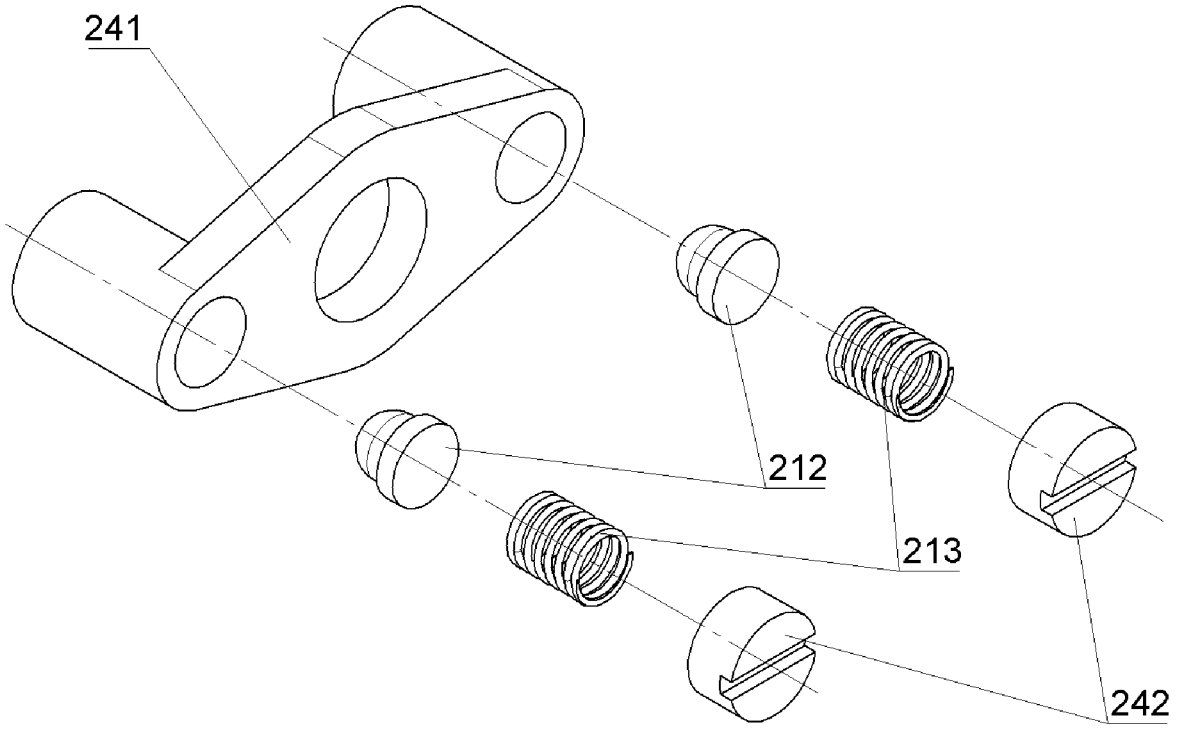
FIG. 45 shows detailing of the rest of the cheek piece clamp 234 (side view).

FIG. 45 shows detailing of the rest of the cheek piece clamp 234 (side view). This configuration consists of: the sleeve stop 241, the retaining pin 212 configured in the form of the spherical section, which passes into the cylindrical section, the retaining pin spring 213, the thrust screw 242, configured in the form of the threaded rod with a slot for the screwdriver. All elements of the rest of the cheek piece clamp 234, their shapes and interaction with each other are shown in FIG. 45.

Figure 46:
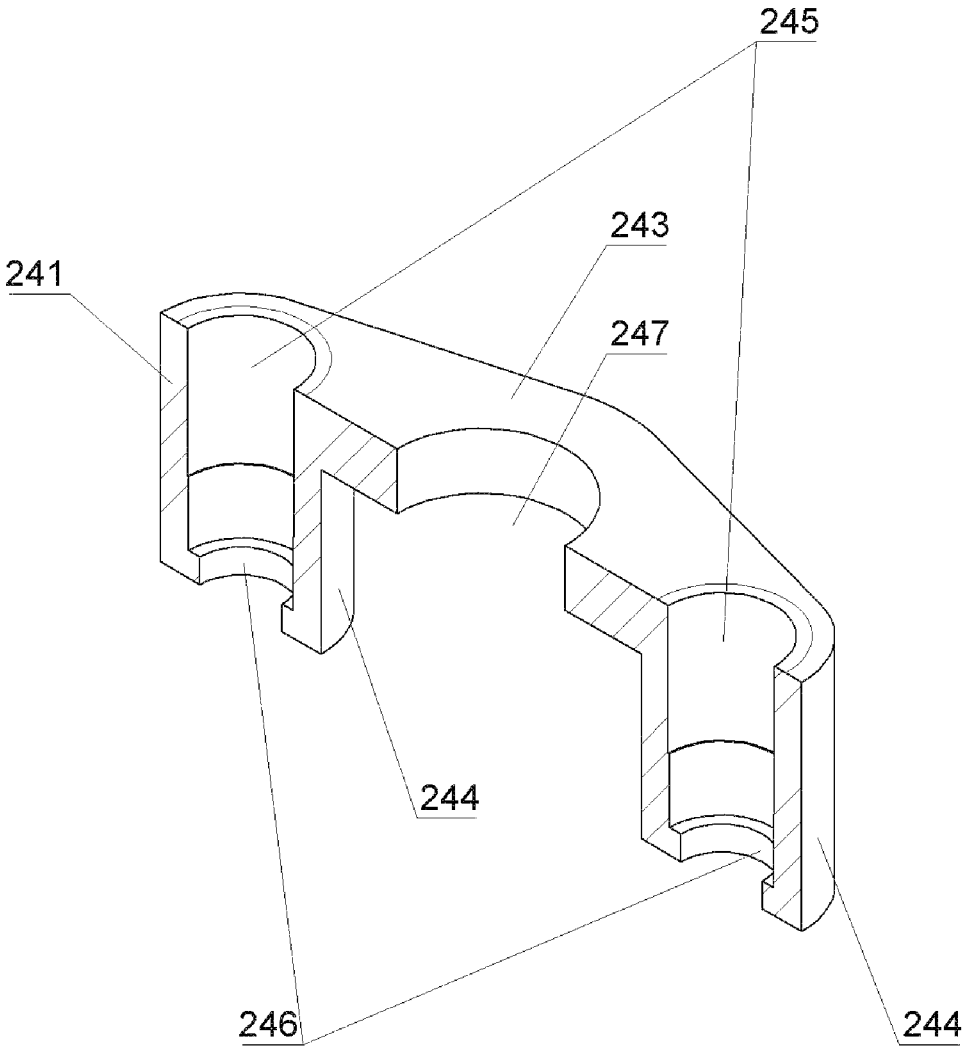
FIG. 46 shows a side view of the sleeve stop 241.

FIG. 46 shows a side view of the sleeve stop 241. The sleeve stop 241 is configured in the form of the plate 243. The cylindrical protrusions 244 are configured at the ends of the plate 243. The blind holes with the threaded section 245 and the through-holes 246 to interact with the retaining pin 212, the retaining pin spring 213, the thrust screw 242 are configured in the cylindrical protrusions 244. In the center of the plate 243 the threaded hole 247 is disposed to interact with the latches of the adjustable cheek piece 43. All elements of the sleeve stop 241, their shapes and interaction with each other are shown in FIG. 46.

Figure 47:
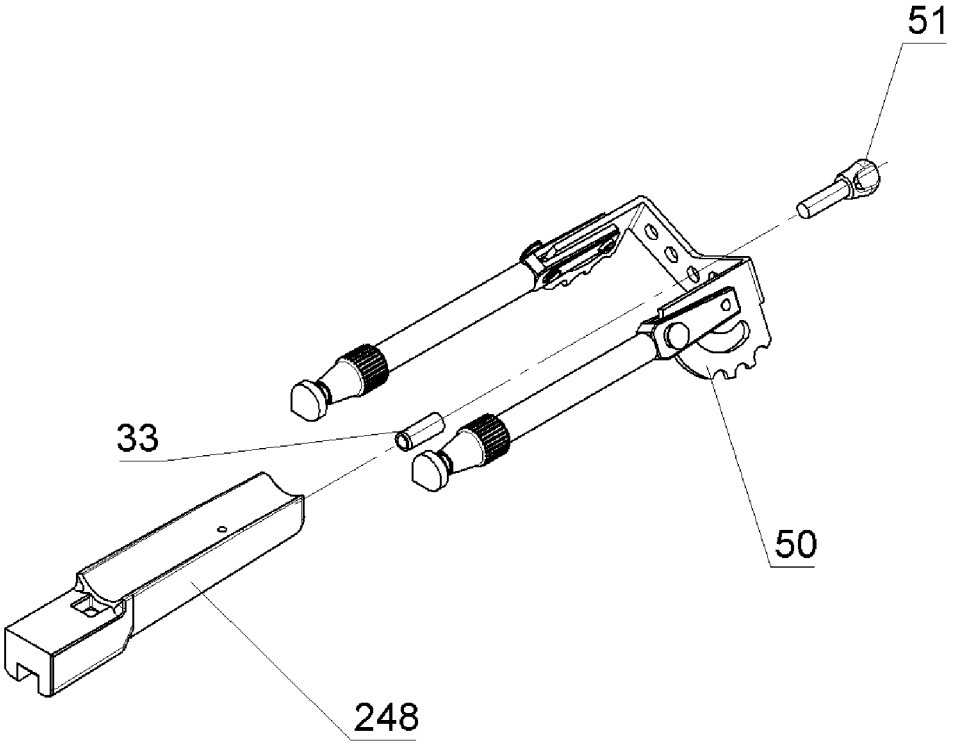
FIG. 47 shows detailing of the handguard with the bipods 5C, (side view).

FIG. 47 shows detailing of the handguard with the bipods 5C, (side view). This configuration consists of: the handguard 248, the threaded bushing of the bipods 33, the folding adjustable bipod 50, the latch of the bipod 51.

Figure 48:
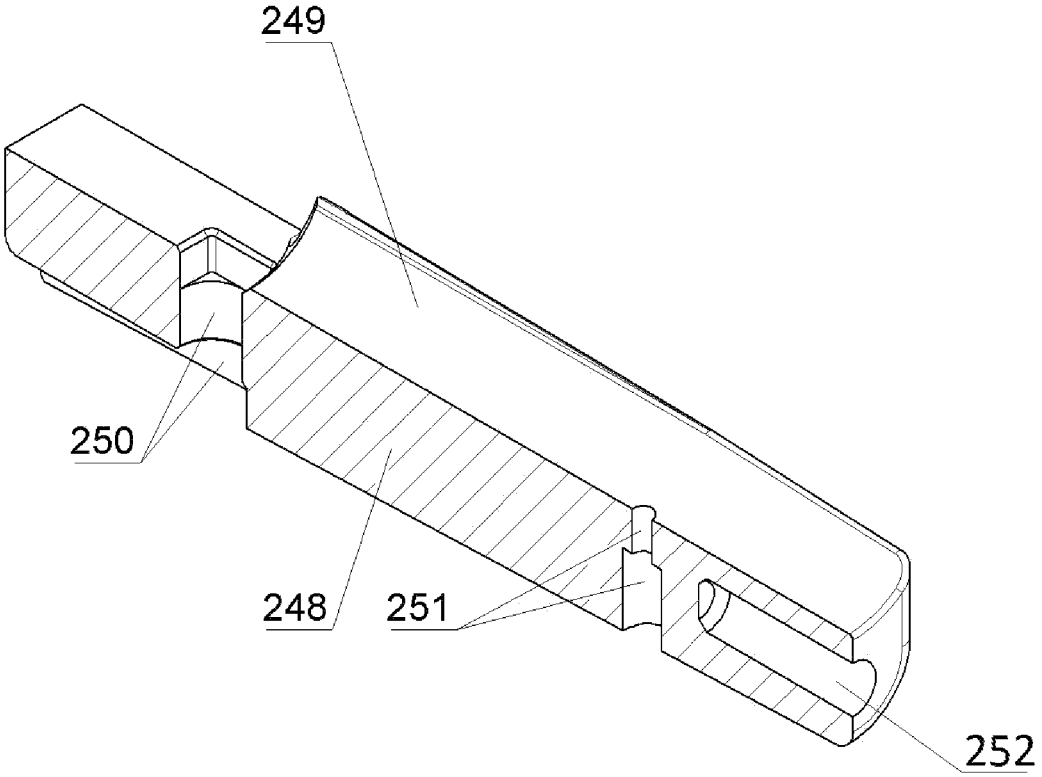
FIG. 48 shows a side view of the handguard 248.

FIG. 48 shows a side view of the handguard 248. The handguard 248 is configured in the form of the complex-shaped bar 249, with the complex-shaped through-hole 250 disposed inside to mount the protrusion 170 of the receiver 13. The bar 249 also has the stepped hole 251 for the barrel latch 10 and the longitudinal blind hole 252 for the threaded bushing of the bipods 33.

Figure 49:
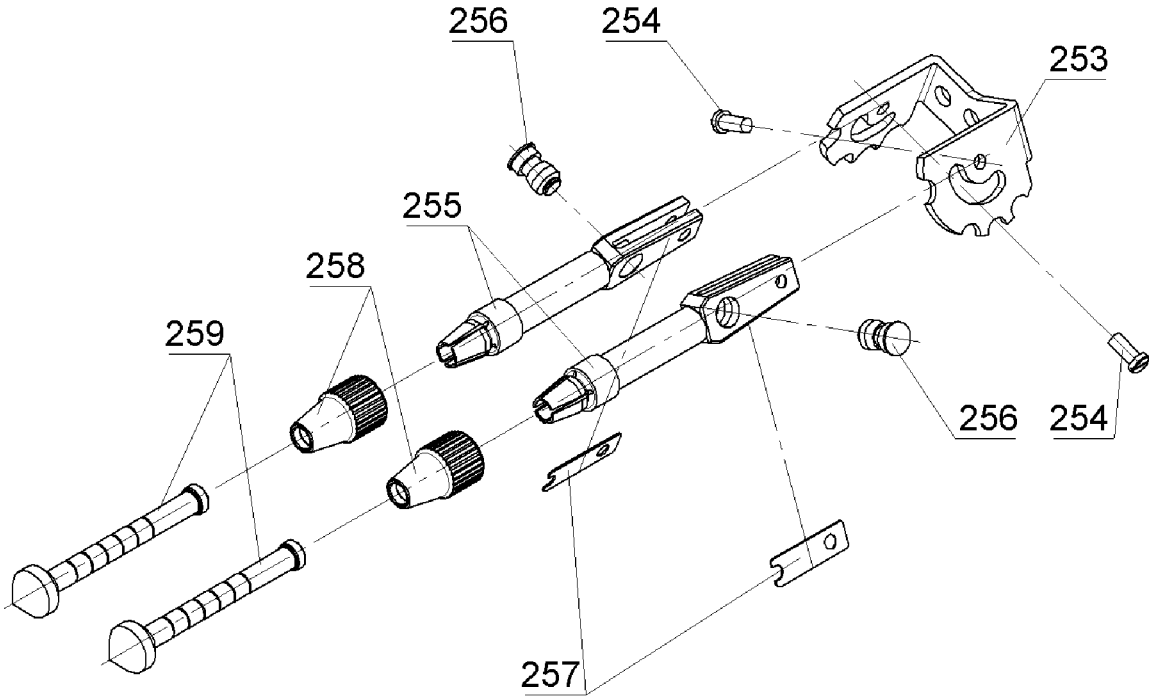
FIG. 49 shows detailing of the folding adjustable bipod 50 (side view).

FIG. 49 shows detailing of the latch of the folding adjustable bipod 50 (side view). This configuration consists of: the bipod bracket 253, the screws of the bipod stubs 254, the bipod stubs 255, the bipod stubs latches 256, the plate springs of the latch 257, configured in the form of the plate with the through-hole and the semi-circular hole, the conical nuts 258, the withdrawable locks 259.

Figure 50:
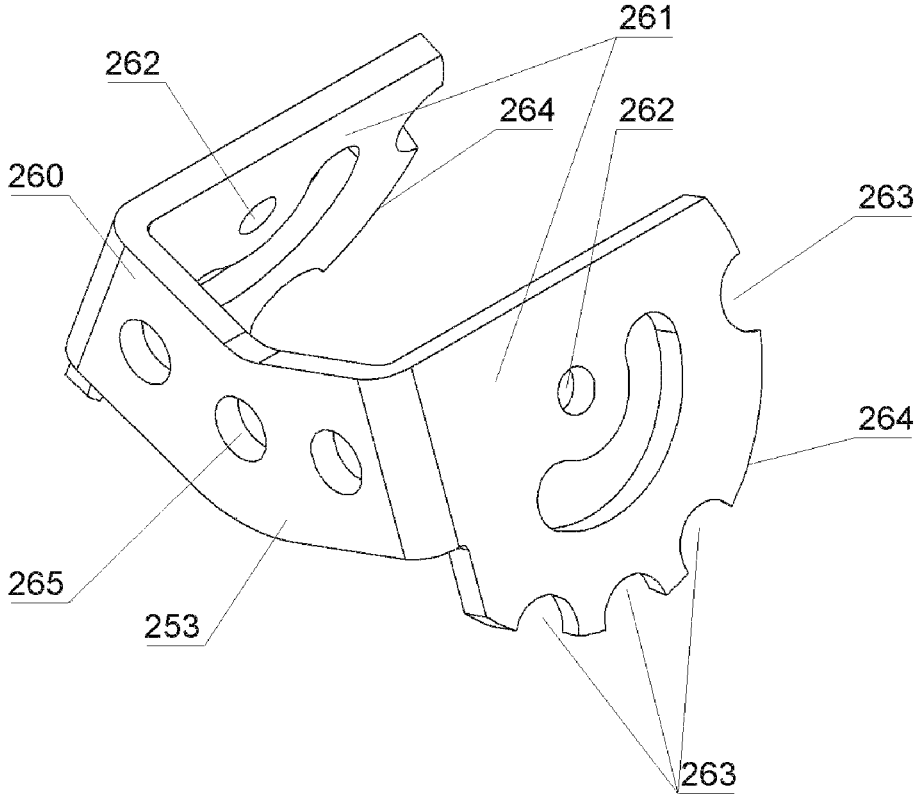
FIG. 50 shows a side view of the bipod bracket 253.

FIG. 50 shows a side view of the bipod bracket 253. The bipod bracket 253 is configured in the form of the complex-shaped flat bent plate 260 with the protrusions 261 disposed at the ends. The through-holes 262 for the screws of the bipod stubs 254 are disposed in the protrusions 261. On the external walls of the protrusions 261, the semi-circular conical holes 263 are disposed to fix the bipod stubs 255 by the bipod stubs latch 256 in the folded, intermediate and open positions. The external walls of the protrusions 261 are configured radius 264. The through-hole 265 configured for the latch of the bipod 51 is disposed in the center of the flat bent plate 260. All elements of the bipod bracket 253, their shapes and interaction with each other are shown in FIG. 50.

Figure 51:
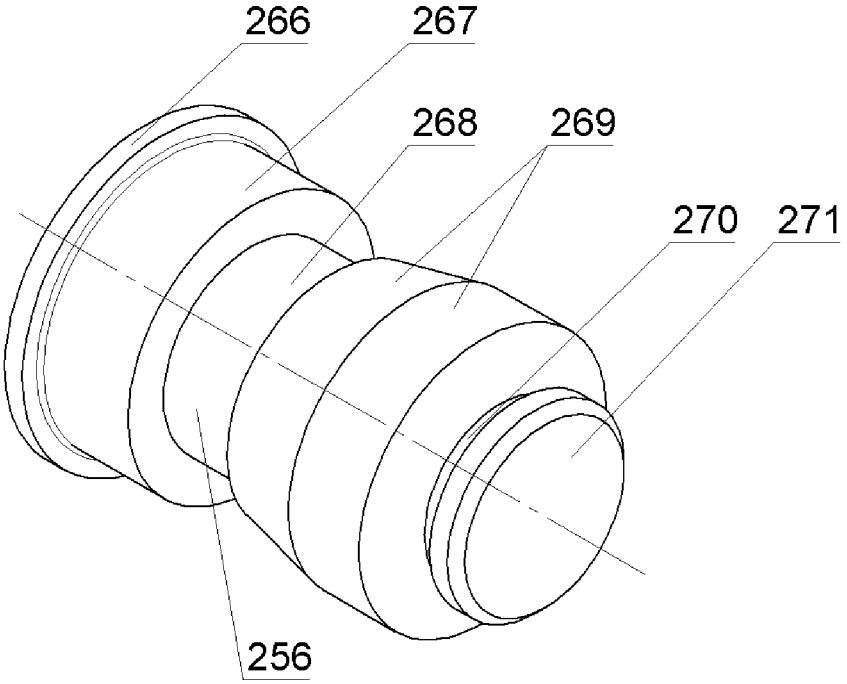
FIG. 51 shows a side view of the bipod stubs latch 256.

FIG. 51 shows a side view of the bipod stubs latch 256. The bipod stubs latch 256 is configured in the form of the stepped cylinder. It starts from the release button 266, which passes into the cylindrical part 267 with a smaller diameter, which passes into the cylindrical part 268 with a smaller diameter, which passes into the conic-cylindrical part 269 with a larger diameter, which passes into the cylindrical part 270 with a smaller diameter, which ends with the washer 271. All elements of the bipod stubs latch 256, their shapes and interaction with each other are shown in FIG. 51.

Figure 52:
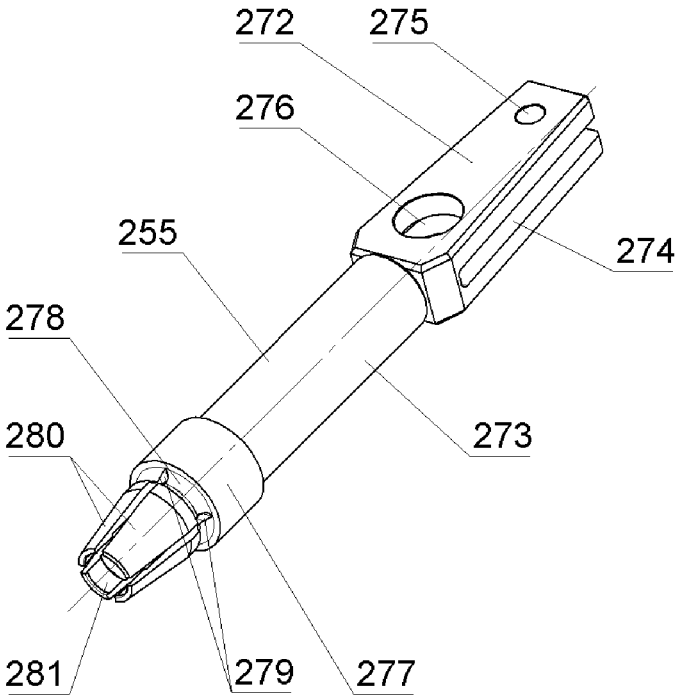
FIG. 52 shows a side view of the bipod stub 255.
Figure 53:
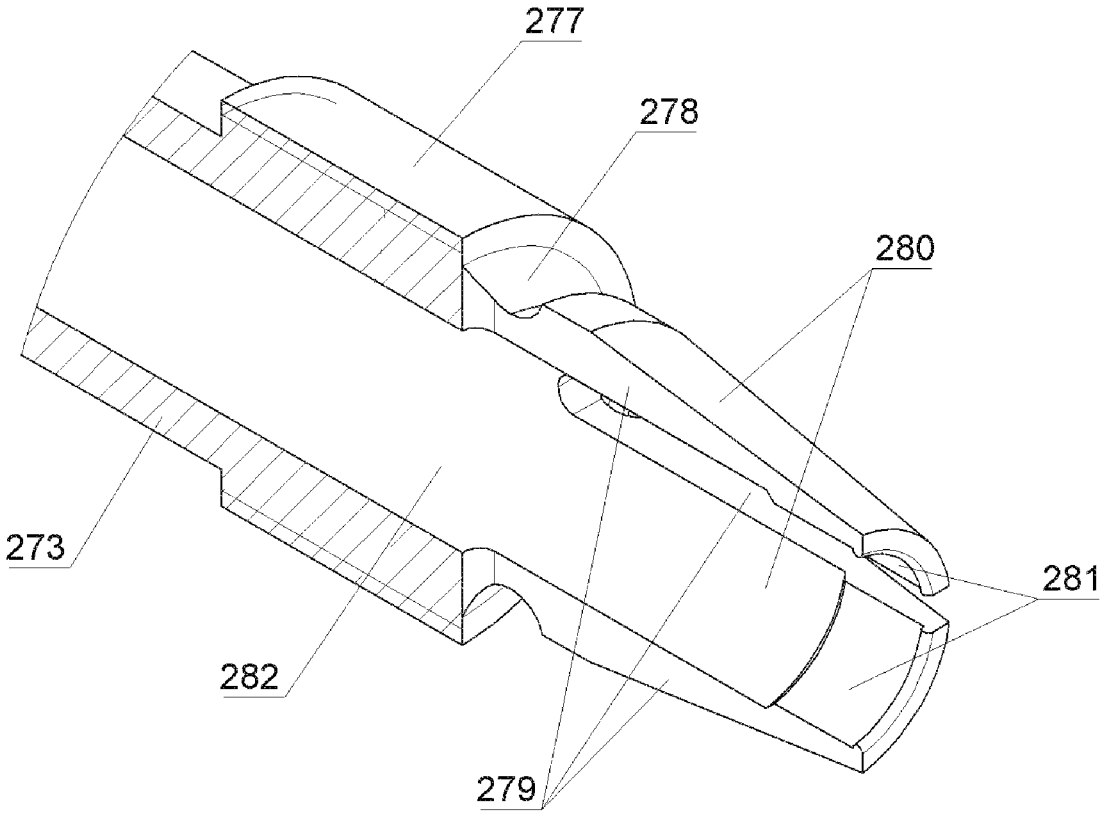
FIG. 53 shows a fragment of the longitudinal section along the lugs of the retaining clamps 280.

FIG. 52 shows a side view of the bipod stub 255, and FIG. 53 shows fragment of the longitudinal section along of the lugs of the retaining clamps 280. The bipod stub 255 is configured in the form of the complex-shaped plate 272, which passes into the tube 273. In the upper part of the plate 272, the through slot 274 is configured for the bipod bracket 253, as well as through the threaded hole 275 for the screw of the bipod stubs 254. In the lower part of the plate 272, the through-hole 276 is configured for the bipod stubs latch 256. The tube 273 passes into the cylindrical section with the outer thread 277, which passes into the radius groove 278. The groove 278 passes into the conical head with the through cross slots 279, which form the lugs of the retaining clamps 280. The cylindrical protrusion 281 is disposed at the ends of the lugs of the retaining clamps 280, configured to fix the withdrawable lock 259 in any position, as well as in the extreme lower position, which prevents unauthorized removal of the withdrawable lock 259 from the bipod stub 255. The longitudinal hole 282 is disposed inside the bipod stub 255, configured for the passage of the withdrawable lock 259. All elements of the bipod stub 255, their shapes and interaction with each other are shown in FIG. 52, FIG. 53.

Figure 54:
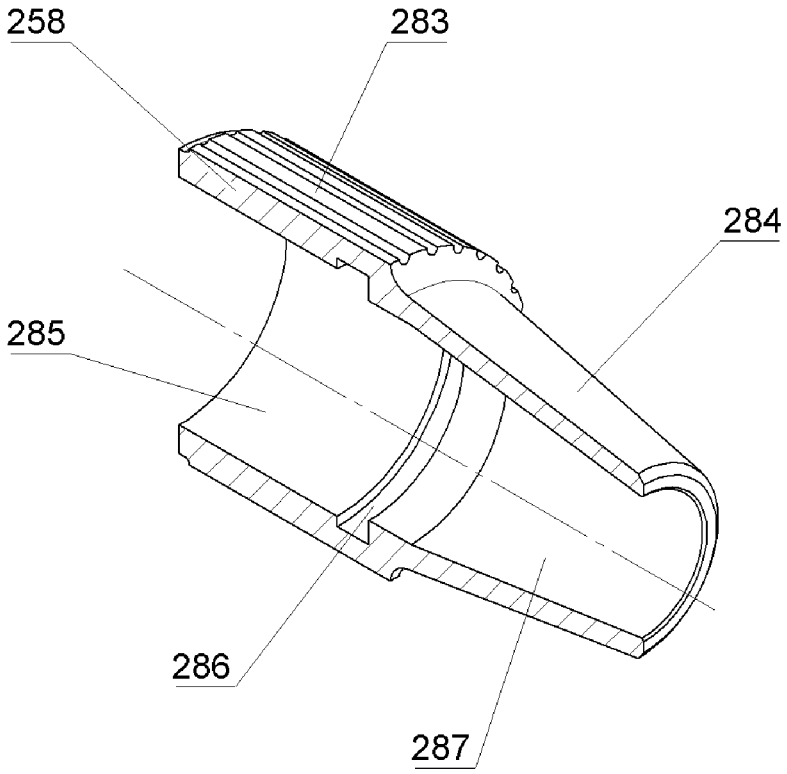
FIG. 54 shows the longitudinal section of the conical nut 258.

FIG. 54 shows the longitudinal section of the conical nut 258. The conical nut 258 is configured in the form of the cylindrical section with the notch 283, which passes into the conical section 284. Inside the cylindrical section 283, the threaded section 285 is configured, which passes into the groove 286, which passes into the inner conical section 287. All elements of the conical nut 258, their shapes and interaction with each other are shown in FIG. 54.

Figure 55:
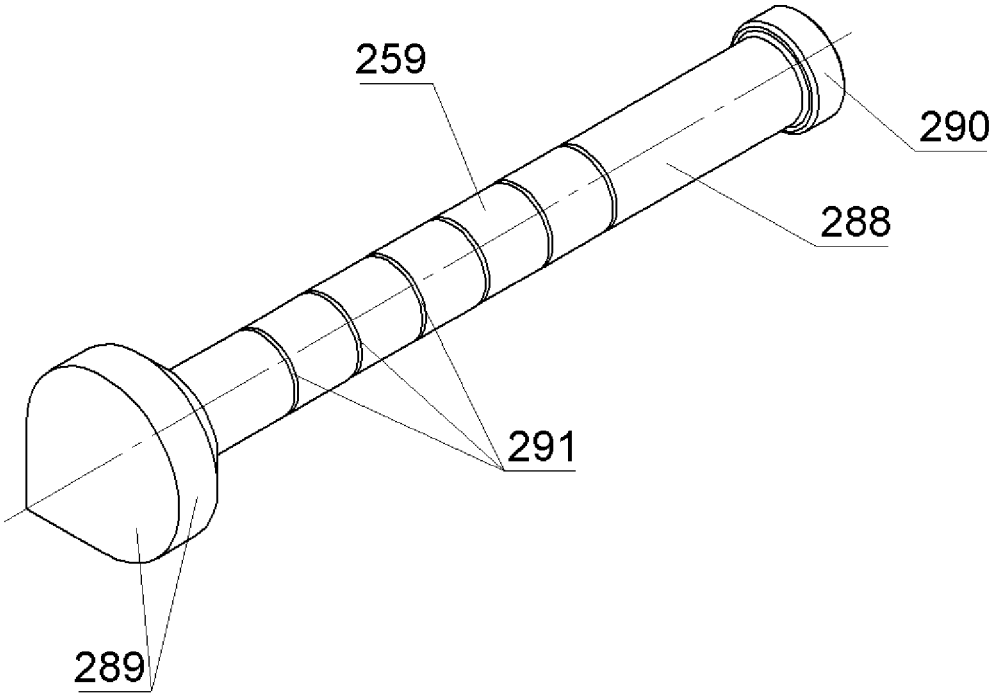
FIG. 55 shows a side view of the withdrawable lock 259.

FIG. 55 shows a side view of the withdrawable lock 259. The withdrawable lock 259 is configured in the form of the rod 288 with the cylinder-conical head 289 at one end, and the cylindrical head 290 at the other end. Along the entire length of the rod 288 the grooves 291 are disposed to act as the ruler and to facilitate operation of the withdrawable lock 259. All elements of the withdrawable lock 259, their shapes and interaction with each other are shown in FIG. 55.

Figure 56:
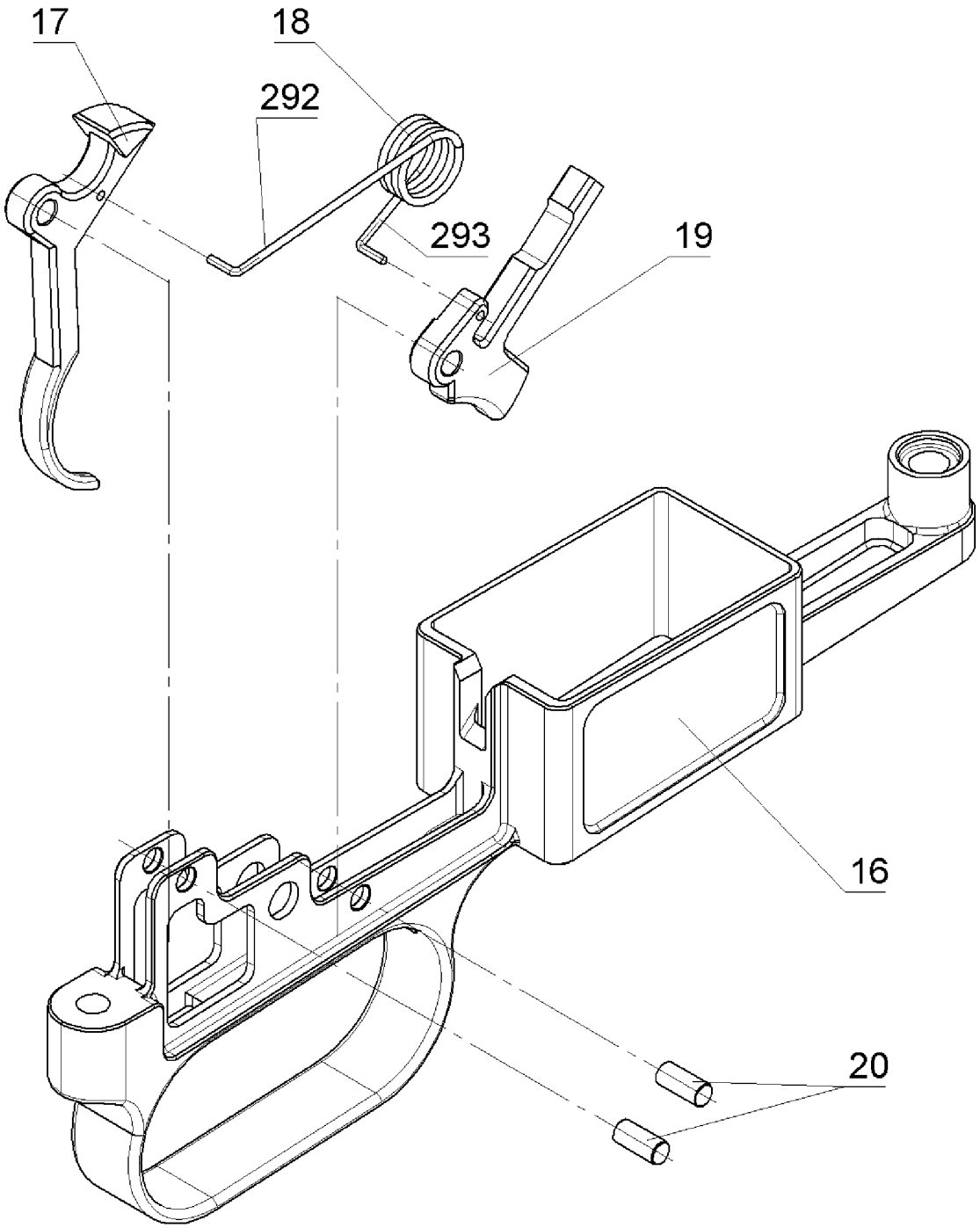
FIG. 56 shows detailing of the trigger guard with the magazine and the mechanisms 3 (side view)

FIG. 56 shows detailing of the trigger guard with the magazine box and the mechanisms 3, (side view). This configuration consists of: the trigger guard with the magazine box 16, the trigger bar 17, the trigger bar spring 18 configured in the form of the spiral spring with the long bent end 292 and the short bent end 293, the magazine catch 19, the axis 20.

Figure 57:
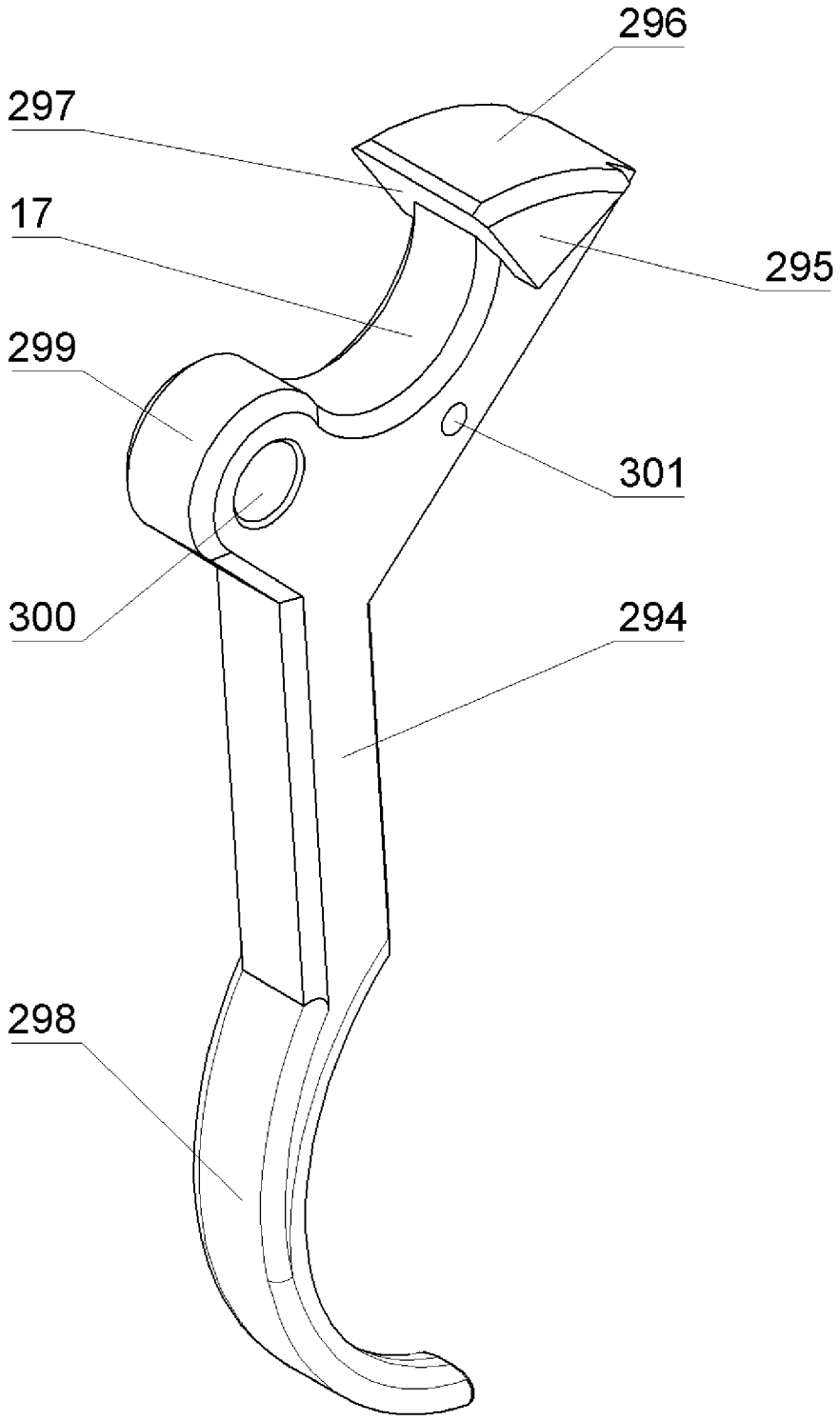
FIG. 57 shows a side view of the trigger bar 17.

FIG. 57 shows a side view of the trigger bar 17. The trigger bar 17 is configured in the form of the complex-shaped plate 294 with the protrusion 295 disposed at one end. In the protrusion 295 the radius surface 296 and the sear platform 297 are configured to interact with the area of the cocking stud 97 of the firing hammer 26. At the other end of the plate 294, the trigger bar 298 is configured in the form of the clamp. In the center of the plate 294 the protrusion 299 with the through-hole 300 is disposed for the axis of the trigger bar and the magazine latch 19. Between the protrusion 295 and the protrusion 299 of the plate 294, the hole 301 is disposed for the long bent end 292 of the trigger bar spring 18. All elements of the trigger bar 17, their shapes and interaction with each other are shown in FIG. 57.

Figure 58:
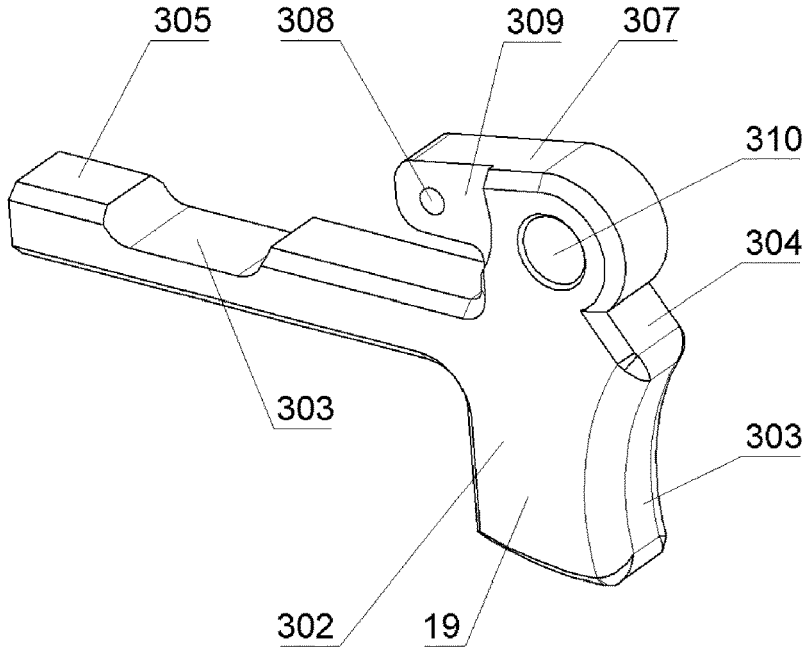
FIG. 58 shows a side view of the magazine latch 19.

FIG. 58 shows a side view of the magazine latch 19. The magazine latch 19 is configured in the form of the lever 302 made of the complex-shaped plate with the button 303 at one end. The support platform 304 is disposed on the button 303. At the other end of the lever 302 the console 305 is configured in the form of the rectangular rod. The slot 306 for the trigger bar spring 18 is disposed in the center of the console 305. Above the button 303, the protrusion 307 is disposed with the hole 308, the slot 309 for the short bent end 293 of the trigger bar spring 18 and the hole 310 for the axis of the trigger bar and the magazine latch 19. All elements of the magazine latch 19, their shapes and interaction with each other are shown in FIG. 58.

Figure 59:
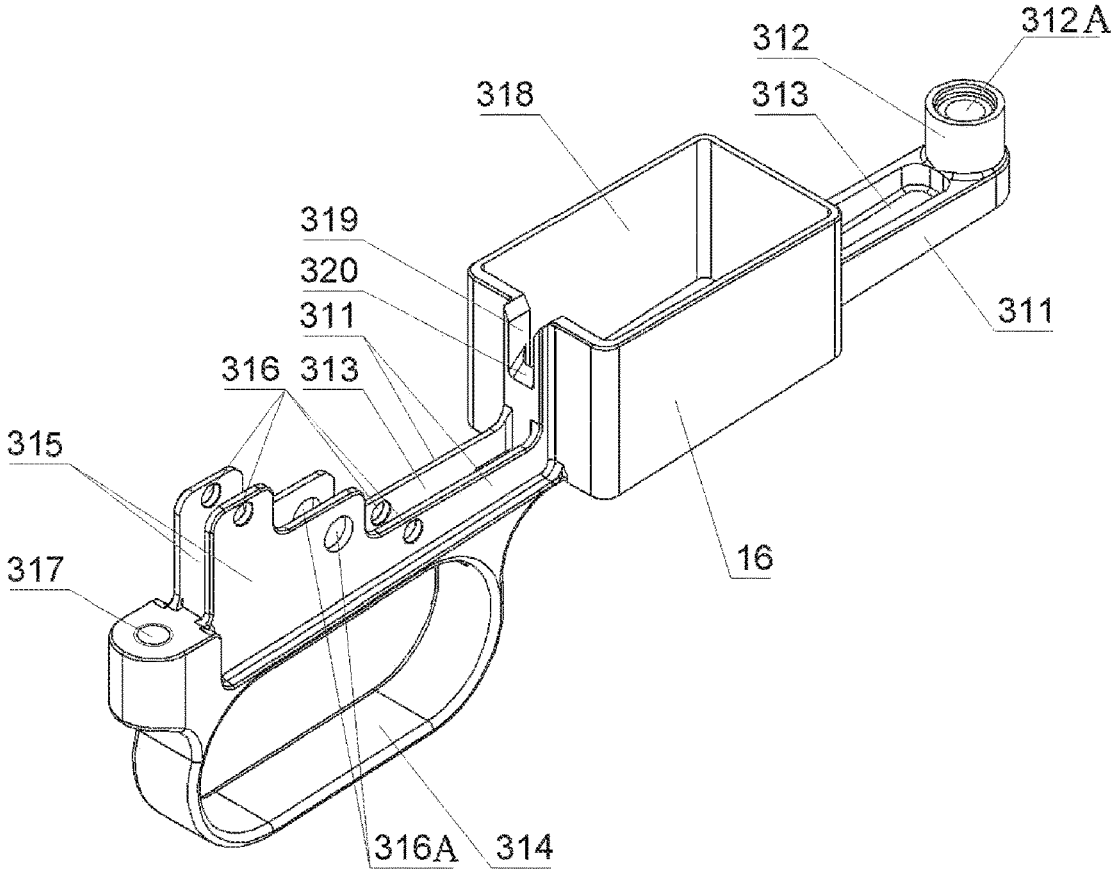
FIG. 59 shows a side view of the trigger guard with the magazine 16.

FIG. 59 shows a side view of the trigger guard with the magazine box 16. The trigger guard with the magazine box 16 is configured in the form of the complex-shaped plate 311 with the cylindrical protrusion 312, in which the hole 312A is disposed for the lower screw of the trigger guard with the magazine box 37, and the slot 313 at one end. At the other end of the plate 311, the trigger guard 314, the complex-shaped protrusion and the slot 313 are disposed. In the protrusion 315 the through holes 316 for the axis of the trigger bar 17 and the magazine latch 19 are disposed, and the hole 316 for the cross screw of the buttstock 34. In front of the trigger guard 314, the threaded hole 317 is disposed in the plate 311 for the upper screw 36 of the trigger guard with the magazine box. In the center of the plate 311, the magazine box 318 is disposed for the magazine 7, with the slot 319 and the inclined platform 320 for the magazine latch (19). All elements of the trigger guard with a magazine box 16, their shapes and interaction with each other are shown in FIG. 59.

Figure 60:
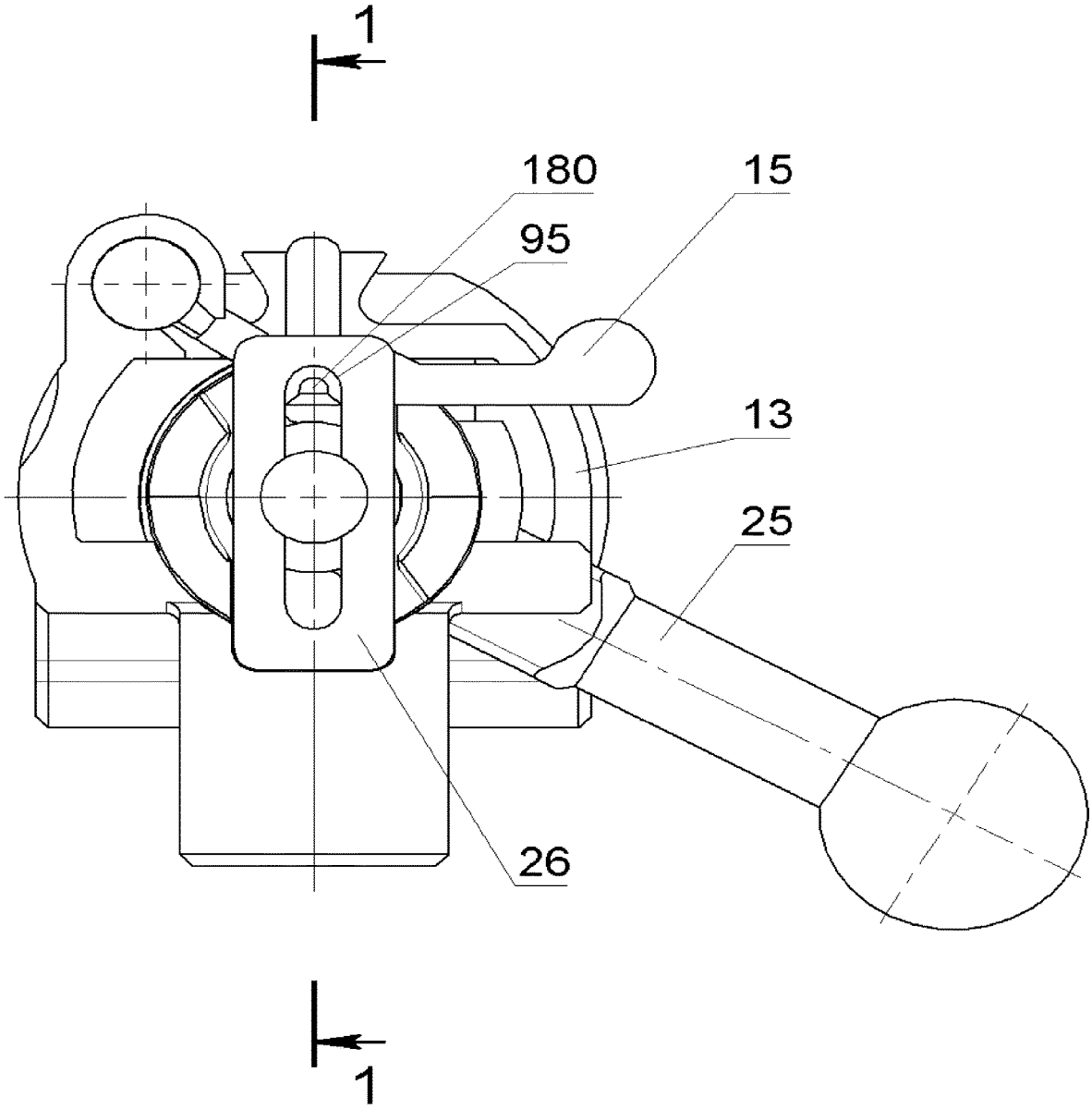
FIG. 60, FIG. 61 (Section 1-1 in FIG. 60) show operation of the safety 15 in the position of protection.
Figure 61:
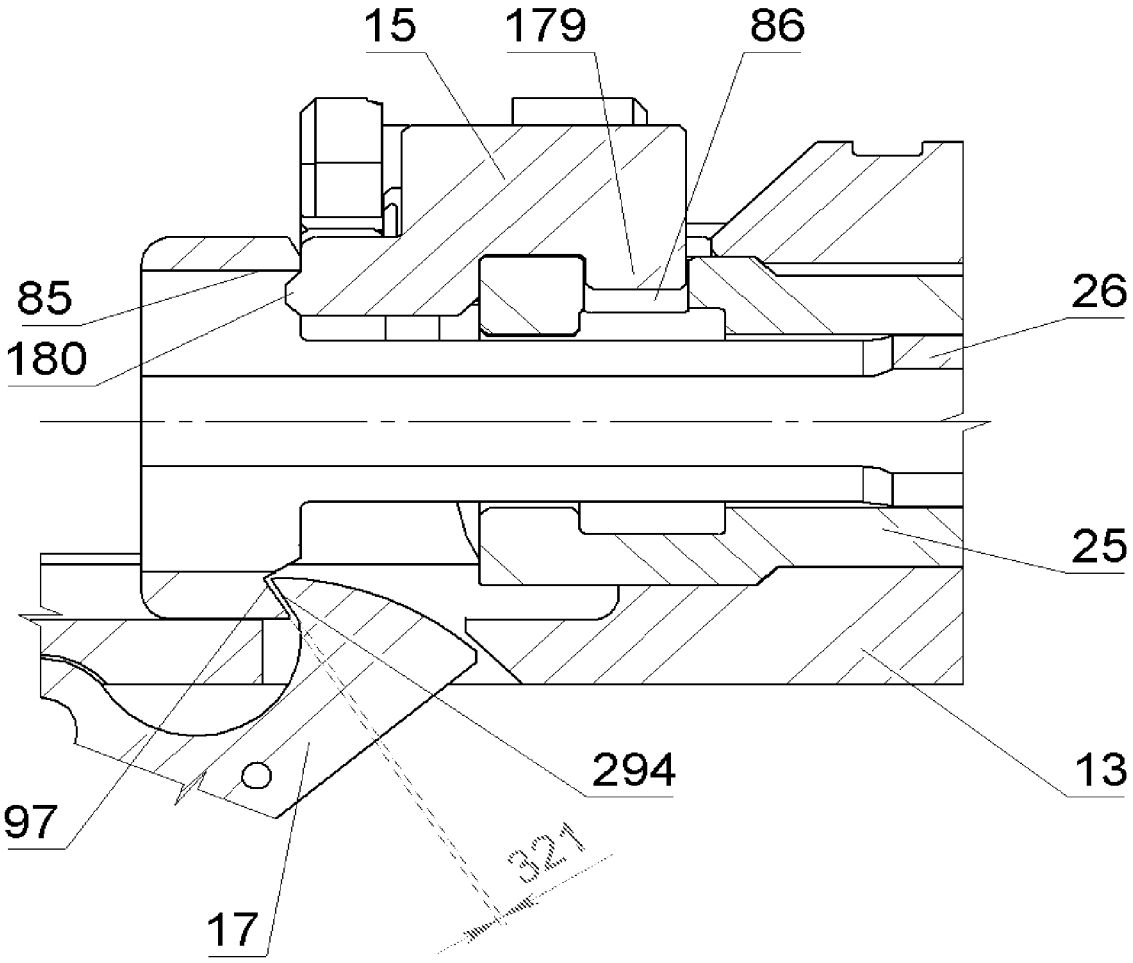

FIG. 60, FIG. 61 (Section 1-1 related to FIG. 60) show operation of the safety 15 in position of prevention. The safety 15 in the position of prevention is closed completely, and the firing hammer 26, the bolt body 25 have no any possibility to move. The firing hammer is in the cocked position. When trying to cock the weapons 1A, 1B, 1C, the conical protrusion 180 of the safety 15 rests against the slot 95 of the firing hammer 26, and the safety lug 179 of the safety 15 engages with the rectangular hole 86 of the bolt body 25 and disables the forward movement of the firing hammer 26, and turning of the bolt body 25, thereby preventing the cocking process of the weapons 1A, 1B, 1C. Between the platform of the cocking stud 97 and the sear platform 297 of the trigger bar 17, the safety gap 321 is disposed, which takes into account the wear of the rubbing surfaces of the firing hammer 26 and the trigger bar 17. The safety gap 321 increases the service life and enhance the reliability of the mutual operation of the firing hammer 26 and the safety 15.

Figure 62:
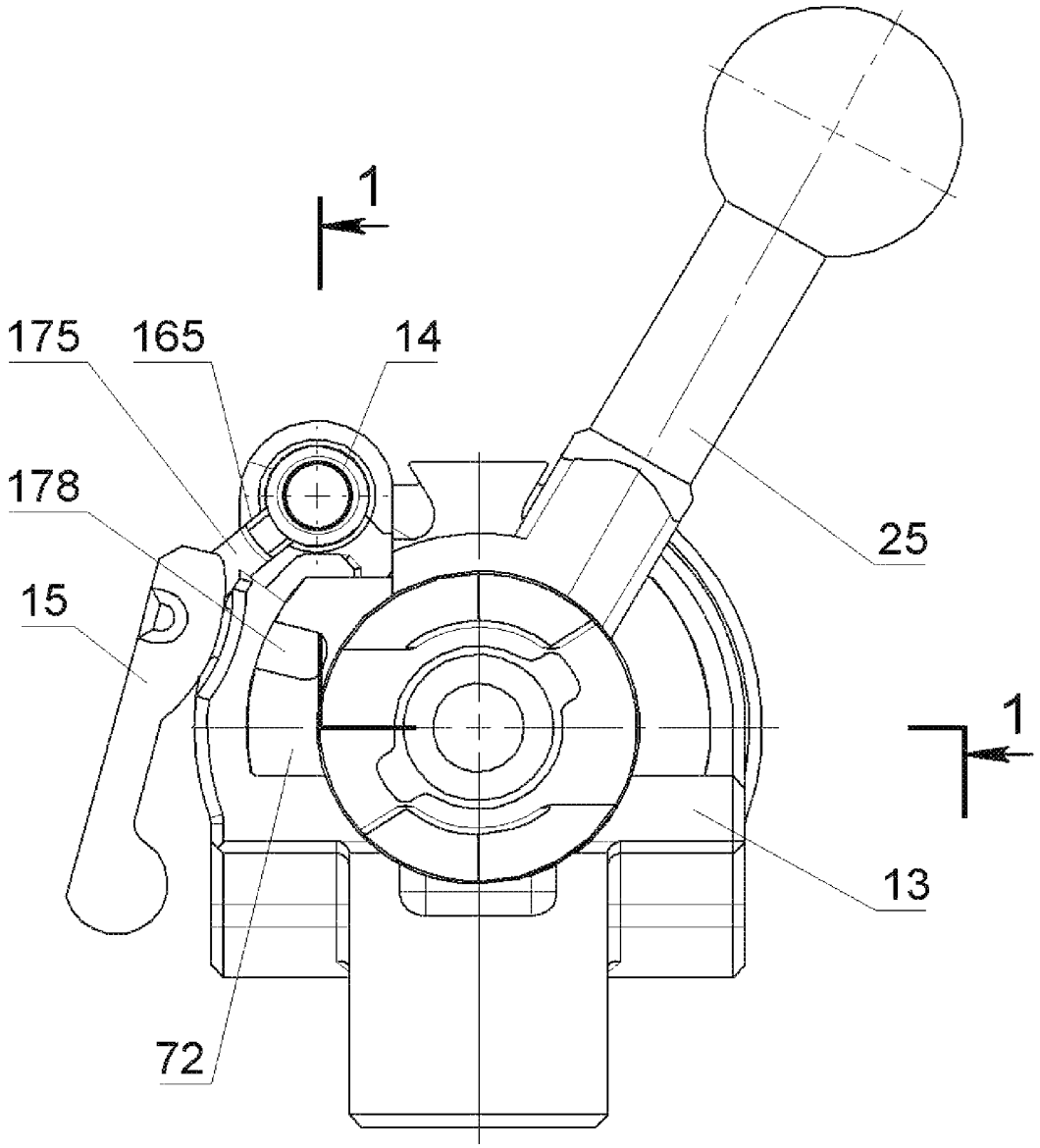
FIG. 62, FIG. 63 (Section 1-1 in FIG. 62) show operation of the safety 15 in firing position.
Figure 63:
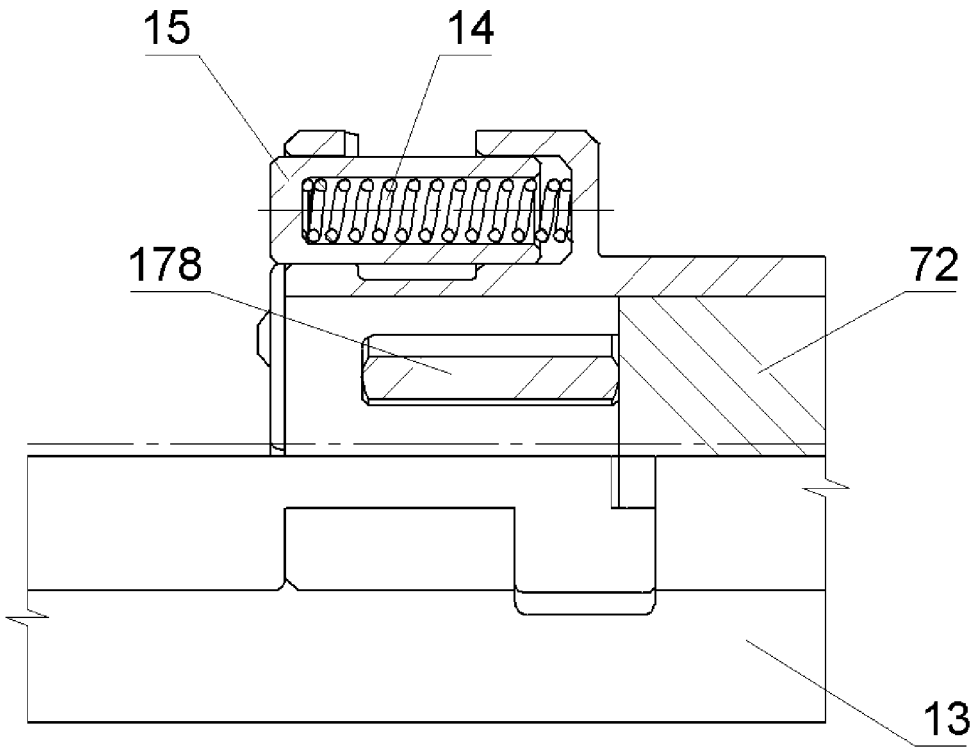

FIG. 62, FIG. 63 (Section 1-1 in FIG. 62) shows operation of the safety 15 in firing position. The safety 15 in firing position is open completely. The bolt 4 is configured to rotate and to reciprocate in the receiver 13, thereby ensuring the operation of the bolt 4. When the bolt 4 is in the extreme rear position, the locking lug 72 of the bolt body 25 rests against the fixing plate 178 of the safety 15 and prevents the bolt body 25 to come out of the receiver 13. The safety 15 is continuously spring-loaded by the safety spring 14 and locked in the firing position to prevent unauthorized opening due to interaction of the protrusion 175 of the safety with the blind slot 165 of the receiver 13.

Figure 64:
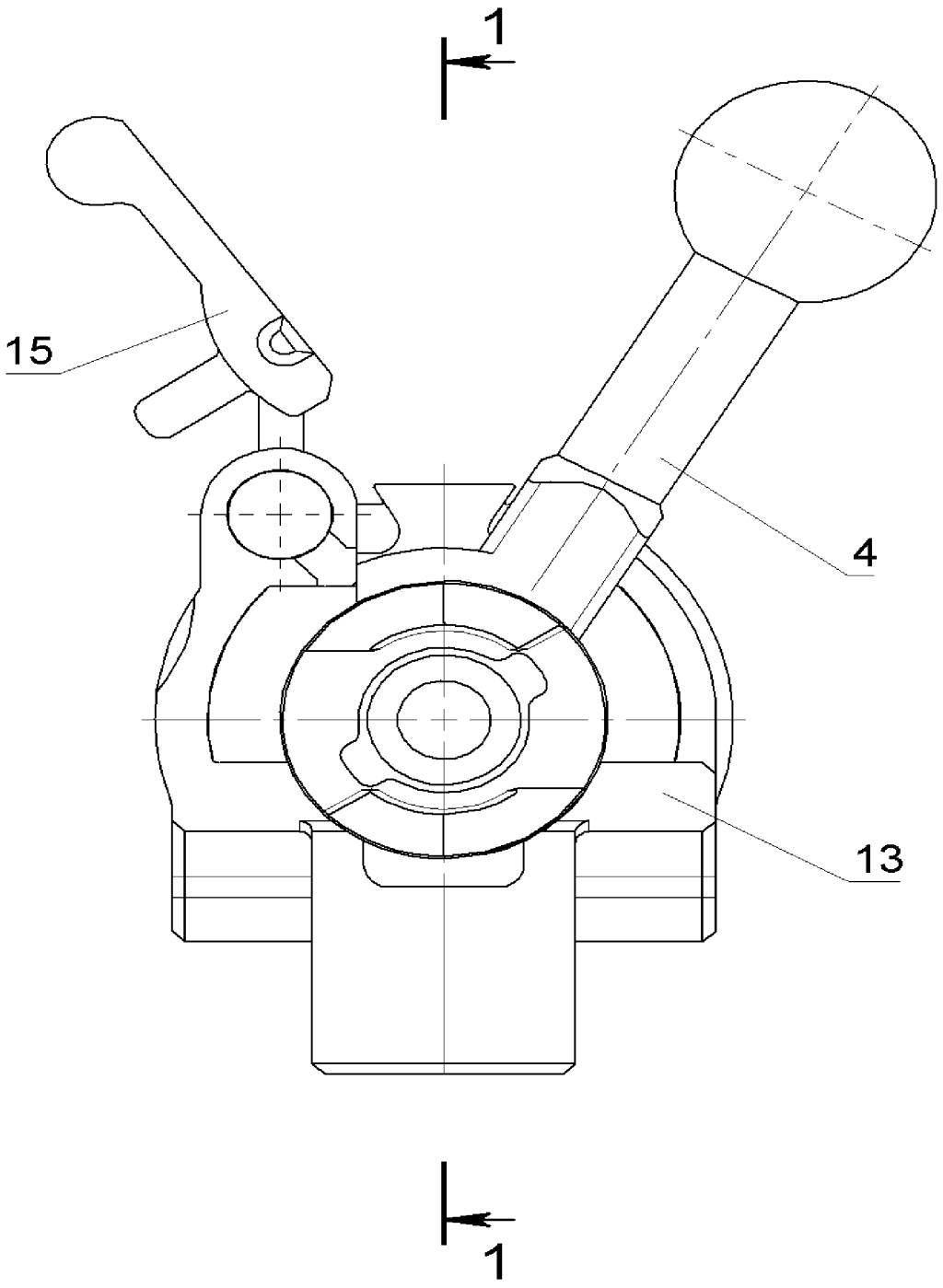
FIG. 64, FIG. 65 (Section 1-1 in FIG. 64) show operation of the safety 15 in the position of unbreech of the bolt 4 from the weapon 1A, 1B, 1C.
Figure 65:
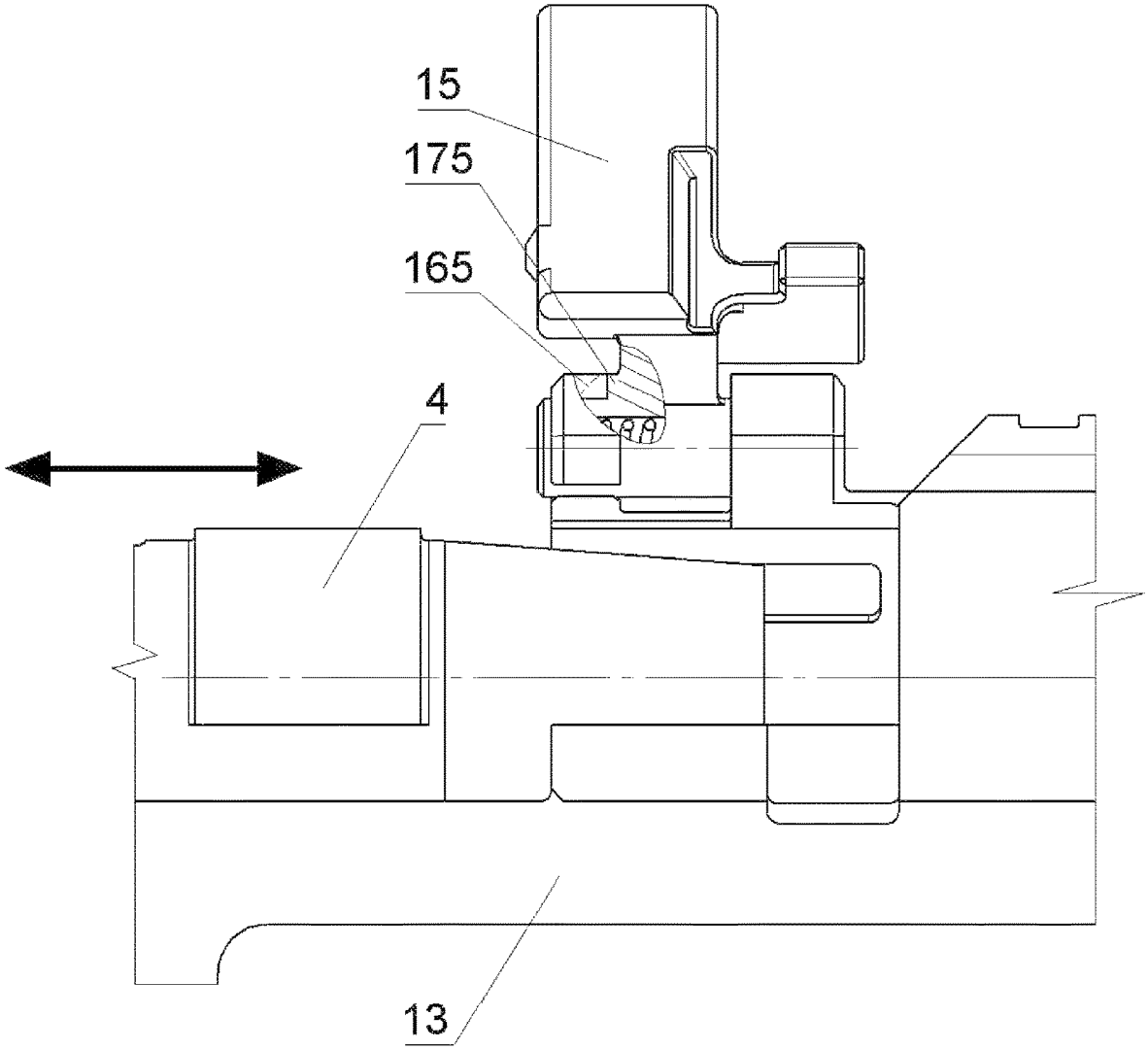

FIG. 64, FIG. 65 (Section 1-1 related to FIG. 64) shows operation of the safety 15 in the unbreech position of the bolt 4 as for the weapon 1A, 1B, 1C. The safety 15 in the position of the bolt 4 unbreech from weapons 1A, 1B, 1C is in the middle position, and the bolt 4 can be easily removed and inserted into the receiver 13. The safety 15 is continuously spring-loaded by safety spring 14 and locked in the unbreech position to prevent unauthorized displacement due to interaction of the protrusion 175 of the safety 15 with the blind groove 165 of the receiver 13.

Figure 66:
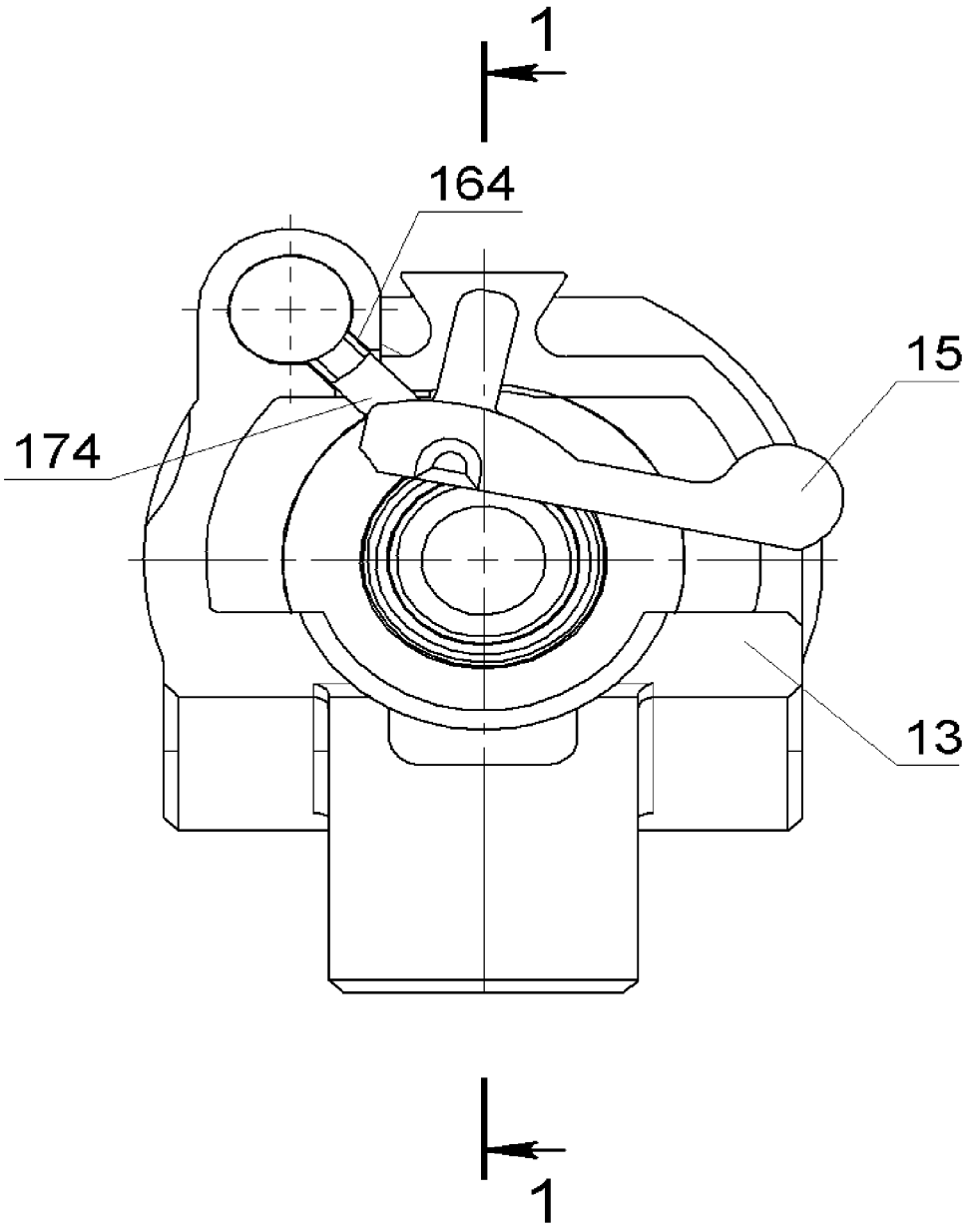
FIG. 66, FIG. 67 (Section 1-1 in FIG. 66) show disassembly of the safety 15 in the weapon 1A, 1B, 1C.
Figure 67:
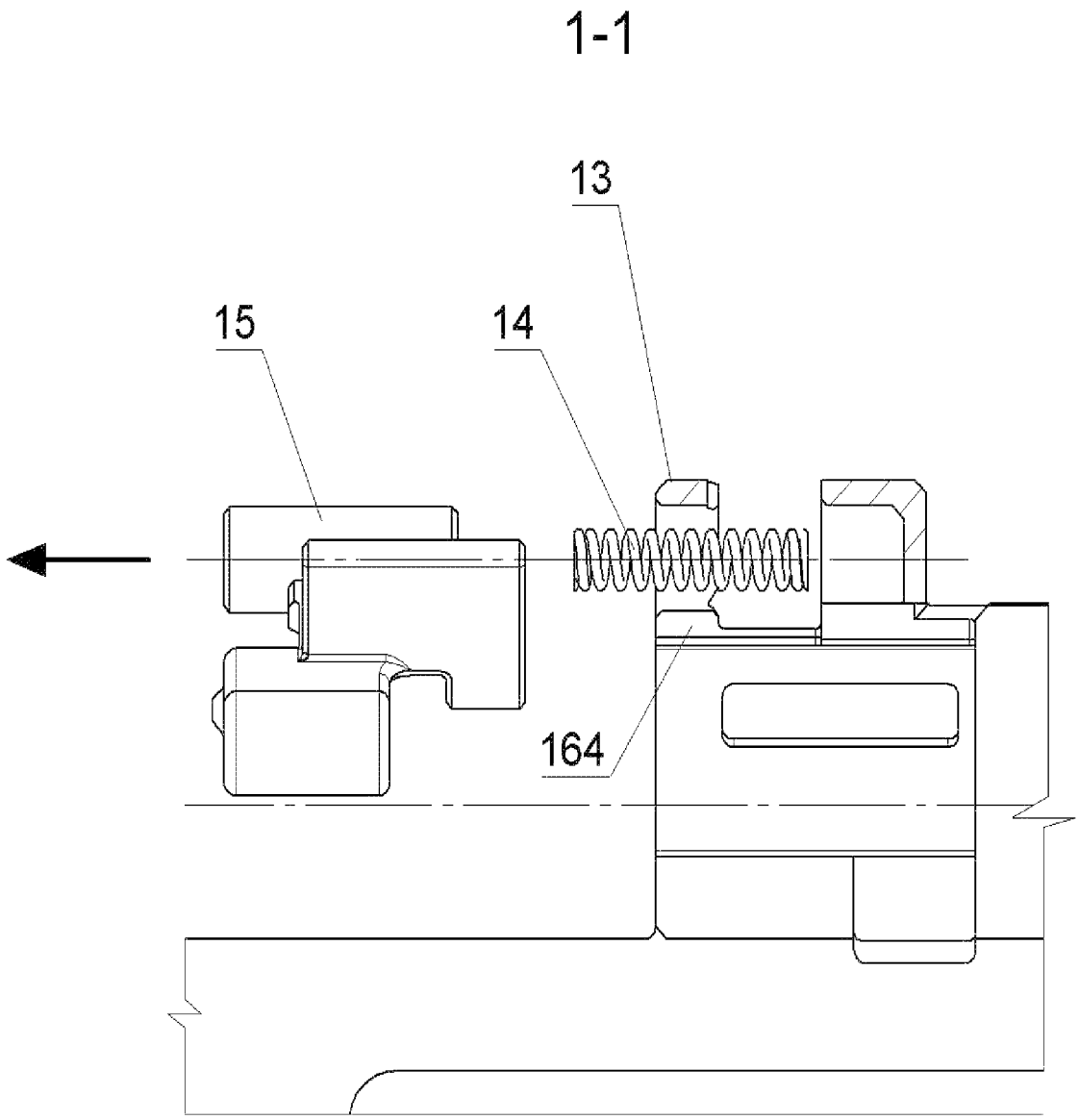

FIG. 66, FIG. 67 (Section 1-1 in FIG. 66) show disassembly of the safety 15 in the weapon 1A, 1B, 1C. The safety 15 with the safety spring 14 in the unbreech position of the weapon 1A, 1B, 1C is in the lower position, and the base 174 of the safety 15 is connected with the through slot 164, of the receiver 13 which enables to freely insert and extract the safety 15 with the safety spring 14 into the receiver 13.

Figure 68:
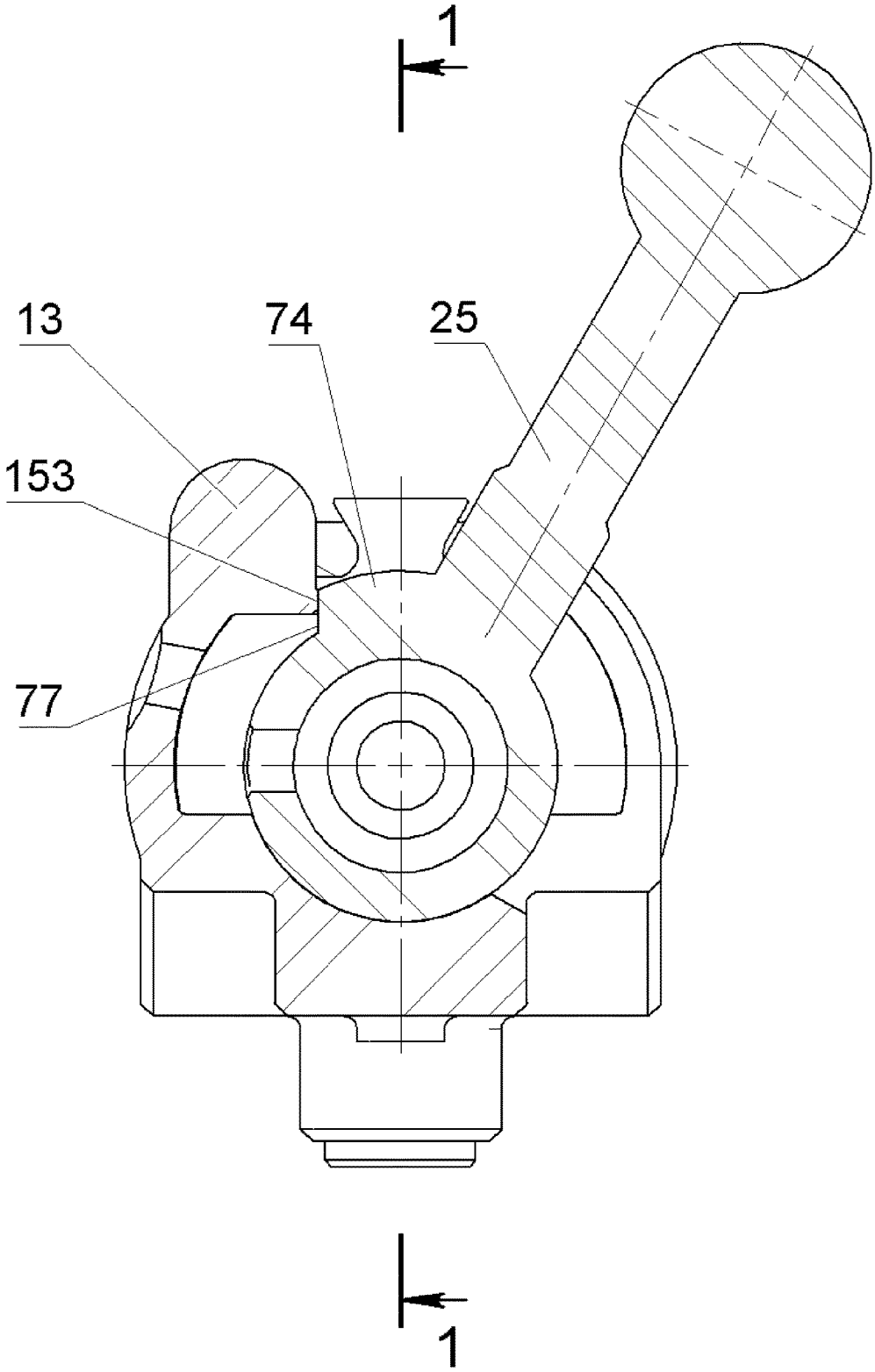
FIG. 68, FIG. 69 (Section 1-1 in FIG. 68) show operation of the firing hammer 26 in the open position of the bolt 4.
Figure 69:
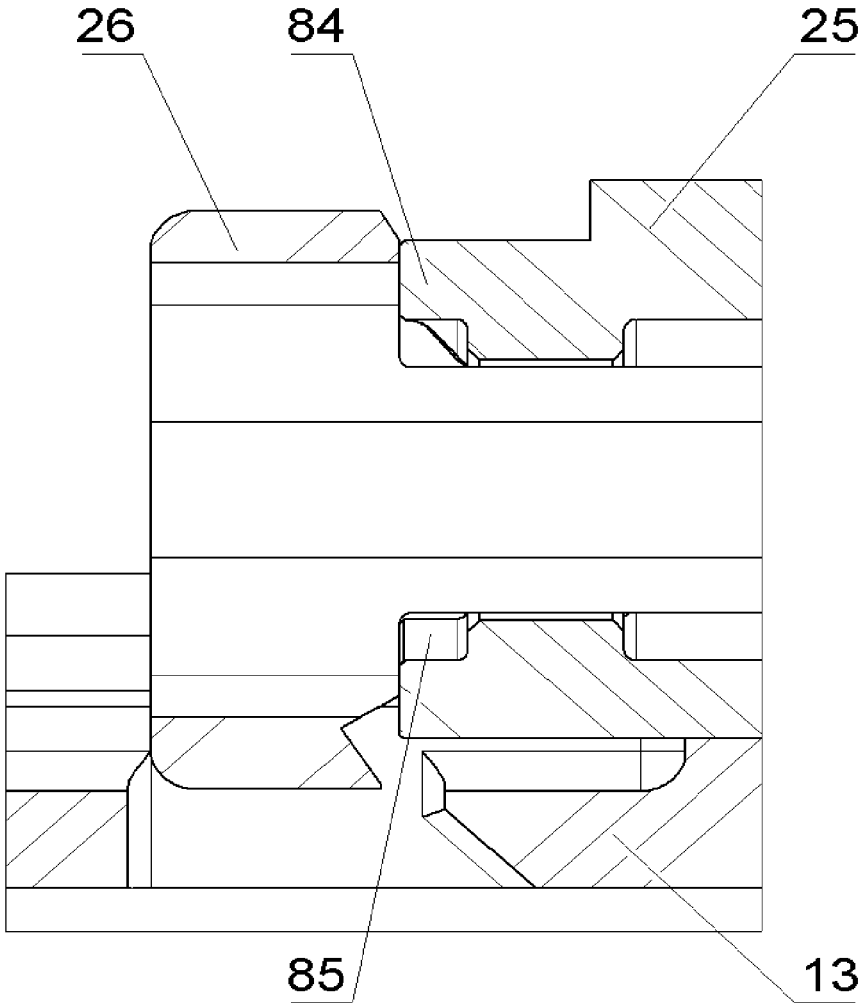

FIG. 68, FIG. 69 (Section 1-1 related to FIG. 68) shows operation of the firing hammer 26 in the open position of the bolt 4. When the bolt 4 is opened, the bolt body 25 is in the position in which the area 77 of the base 74 of the bolt body 25 rests against the leading notch 153 of the receiver 13. At the same time, the screwed protrusions 84 with screwed surfaces 85, when the bolt body 25 in the receiver 13 is turned, will apart the firing hammer 26 in the bolt body 25 for the height of the protrusions 84, which ensures the safe removal of the misfired caseless ammunition 38 by the bolt 4.

Figure 70:
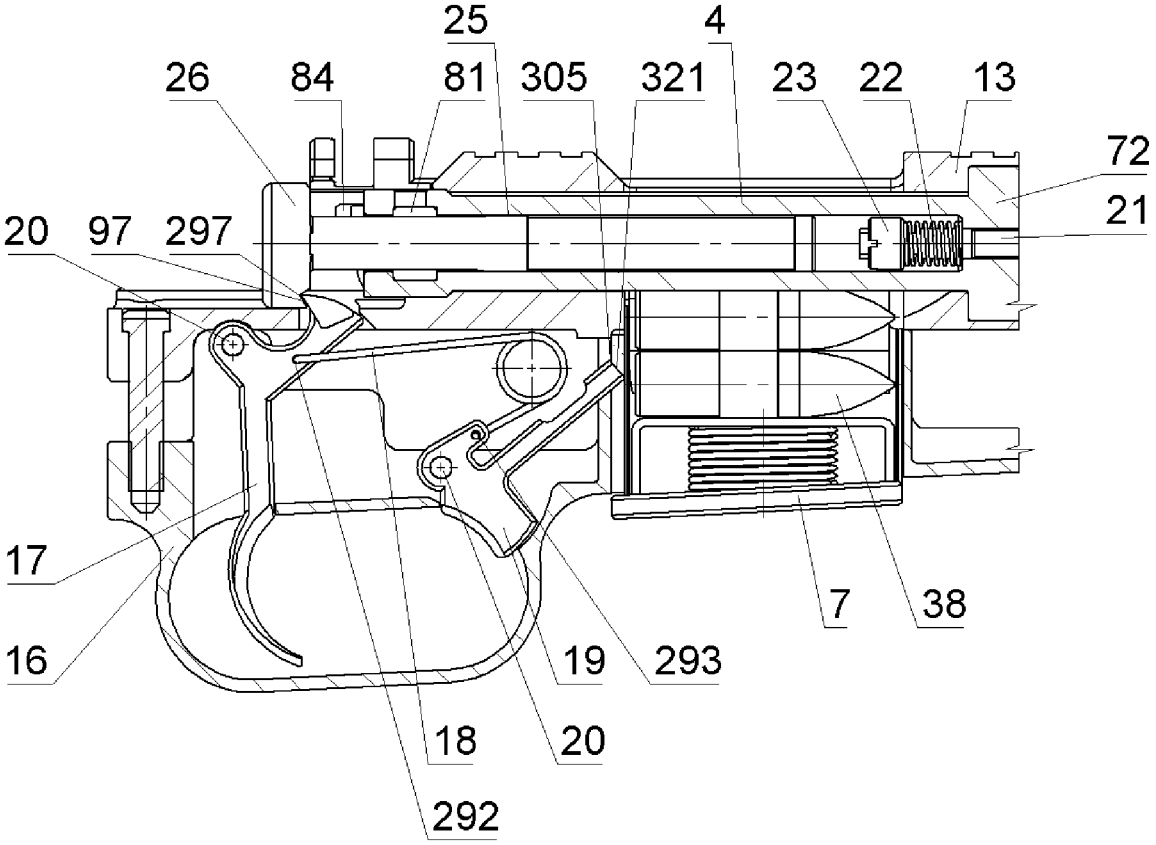
FIG. 70, FIG. 71, FIG. 72 show operation of the mechanisms of the trigger guard with the magazine 16.
Figure 71:
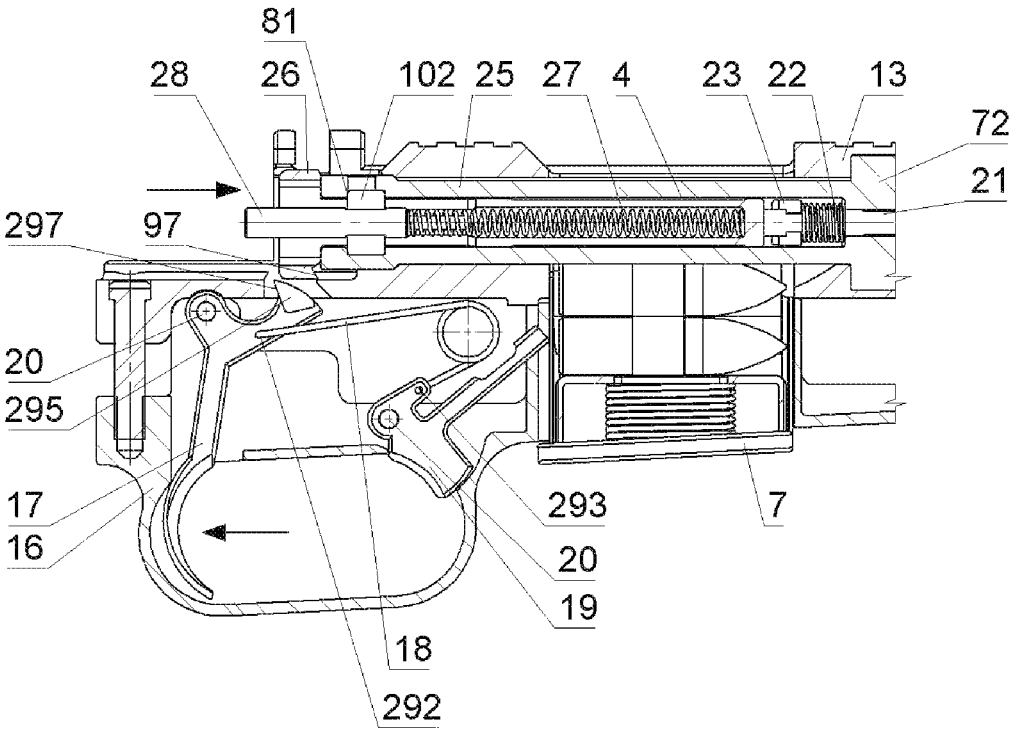
Figure 72:
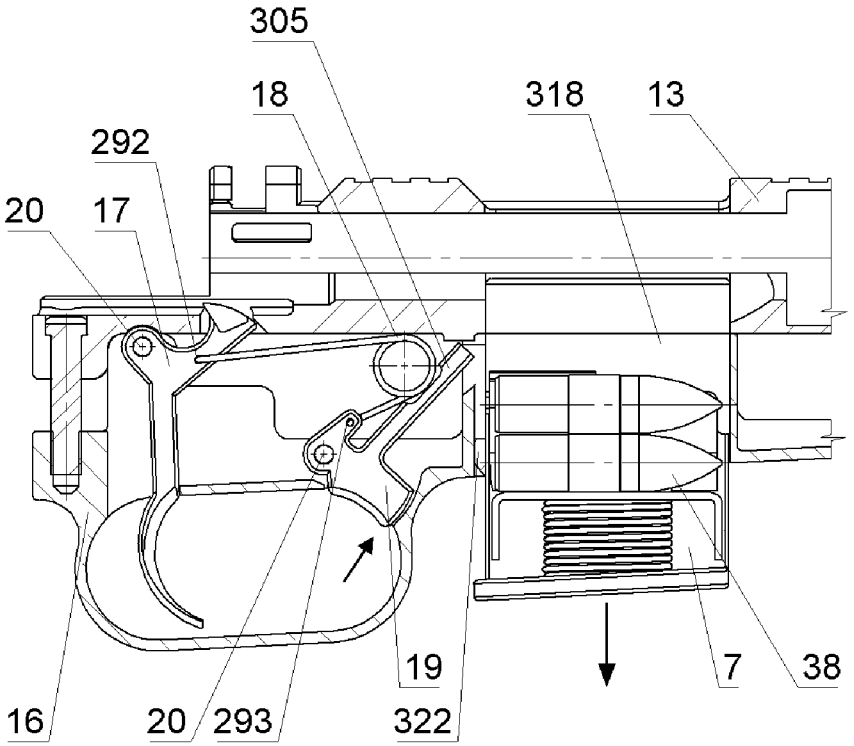

FIG. 70, FIG. 71, FIG. 72 show operation of the mechanisms of the trigger guard with the magazine box 16. When the trigger bar 17 is pressed, the trigger bar 17, turning on the axis 20, slides off from the platform of the cocking stud 97 of the firing hammer 26 by its sear platform 297 of the protrusion 295. In this position the trigger bar spring 18 and the mainspring 27 will be in the maximum load mode, and the compressive force due to the mainspring 27 is transferred via the protrusions 102 of the mainspring latch 28 in the grooves 81 to the bolt body 25, and the end of the mainspring latch 28, buried in the firing hammer 26, gives the warning about cocking of the firing hammer 26. Under the action of the mainspring 27, the firing hammer 26 strikes the firing pin 21. Then the firing pin 21, via the firing pin latch 23, compresses the spring of the firing pin latch 22 and pins on the igniting primer of the ammunition 38 by means of its conical part 52. The shot takes place. To fire the next shot, it is necessary to release the trigger bar 17, then turn the bolt 4 until it stops, and the locking lugs 72 of the bolt body 25 will drop out of engagement with the receiver 13, and the screwed protrusion 84 of the bolt body 25 will push back the firing hammer 26 and relieve the pressure from the firing pin 21. The firing pin 21, via the firing pin latch p 23, under action of the spring of the firing pin latch 22 will take the extreme rear position. Further, it is required to push back the bolt 4 back until it stops, return it forward until it stops, with seizing up the ammunition 38 and forcing it to the cartridge 11 by means of the receiver 13. Then, the bolt body 25 is to be turned in clockwise direction until it stops, and therefore the bolt 4 will be locked in the receiver 13. At the same time, the trigger bar 17 under the action of the long bent end 292 of the trigger bar spring 18 rises up to the extreme upper position and the protrusion 295 of the trigger bar 17 with its sear platform 297 embarks on the path of movement of the firing hammer 26. Then, the firing hammer 26, with its area of the cocking stud 97, enters behind the sear platform 297 of the trigger bar 17, and thereby will be placed on the cocking stud. The weapons 1A, 1B, 1C are now ready for the next shot; and to continue firing, it is required to press the trigger bar 17.

When firing using the weapons 1A, 1B, 1C, the magazine is in the magazine box 318 of the trigger guard with the magazine box 16, the console 305 of the magazine latch 19 is set behind the protrusion with the inclined platform 322 of the magazine 7, and the magazine latch 19, via the short bent end 293 of the trigger bar spring 18, will be set under constant pressure, thereby ensuring reliable fastening of the magazine 7 within operation of the weapons 1A, 1B, 1C.

To remove the magazine from the weapon 1A, 1B, 1C, it is necessary to press the magazine latch 19; the magazine latch 19 will rotate about its axis 20 and the console 305 of the magazine latch 19 will come out of engagement with the protrusion with the inclined platform 322 of the magazine 7, and the magazine 7 can be removed from weapons 1A, 1B, 1C.

To install the magazine into the weapons 1A, 1B, 1C, it is required to insert the magazine 7 into the magazine box 318 of the trigger guard with the magazine box 16. When the protrusion with the inclined platform 322 of the magazine 7 will come against the console 305 and presses on it, the magazine latch 19 will rotate about its axis 20, and the console 305 of the magazine latch 19 will come out of engagement with the protrusion with the inclined platform 322 of the magazine 7. Further, the magazine 7 will rise and abut against the receiver 13, and, under the action of the short bent end 293 of the trigger bar spring 18, the magazine latch 19 will rotate about its axis 20, and the console 30 of the magazine latch 19 will come into engagement with the protrusion with the inclined platform 322 of the magazine 7, which ensure reliable fastening of the magazine 7 in weapons 1A, 1B, 1C.

Figure 73:
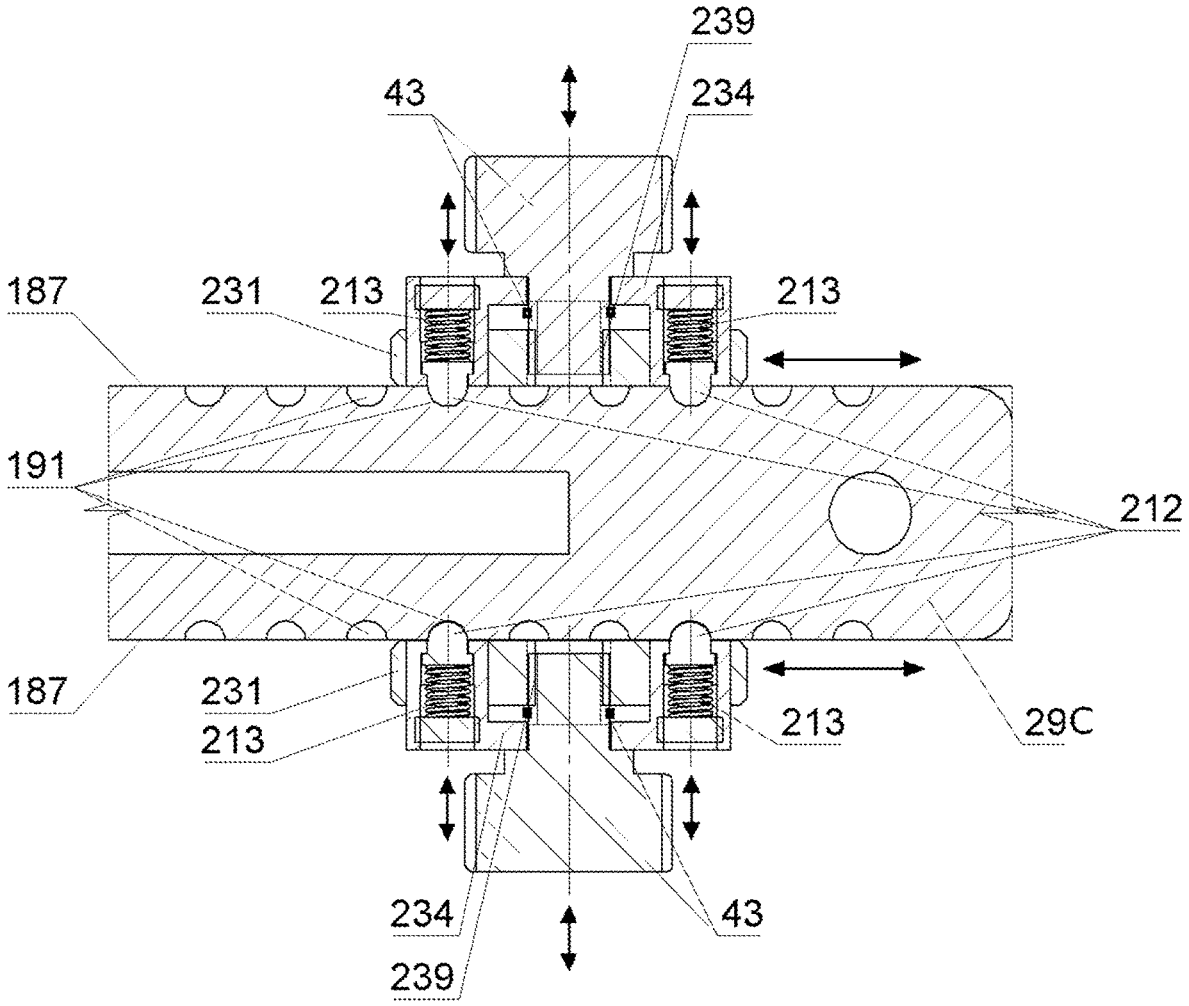
FIG. 73, FIG. 74 show the vertical and the horizontal adjustment of the adjustable cheek piece 42.
Figure 74:
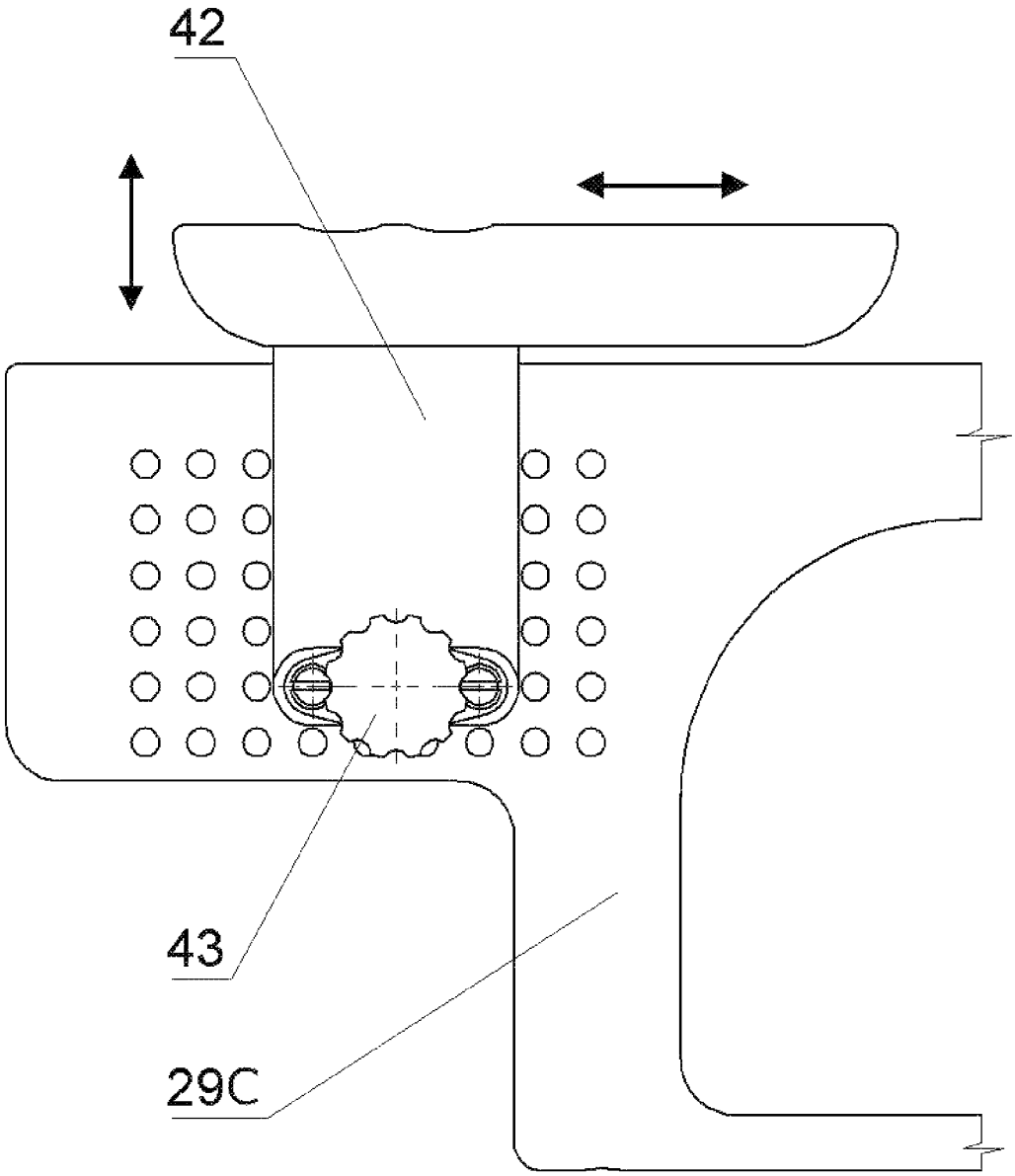

FIG. 73, FIG. 74 show the vertical and the horizontal adjustment of the adjustable cheek piece 42. For the purpose of vertical and horizontal adjustment of the adjustable cheek piece 42, it is necessary to unscrew the latches of the adjustable cheek piece 43 from the threaded holes 239 of the cheek piece clamp 231 at a distance so that the sleeve stop 241 displaced by the spring rings of the latches of the adjustable cheek piece 43, would move apart from the spherical recesses 191 on the side surfaces of the console 187 of the skeletal buttstock 29C, and with them the retaining pins 212 of the sleeve stop 241 will be displaced at a distance at which the spherical sections of the retaining pin 212, spring-loaded by the retaining pin spring 213, begin to drop out of the spherical recesses 191. In such condition, the adjustable cheek piece 42 will move vertically and horizontally within the area of the spherical recesses 191. After installing the adjustable cheek piece 42 in the position appropriate for the shooter, the latches of the adjustable cheek piece 43 should be tightened, and this will ensure secure fastening of the adjustable cheek piece 42 on the weapon 1C.

Figure 75:
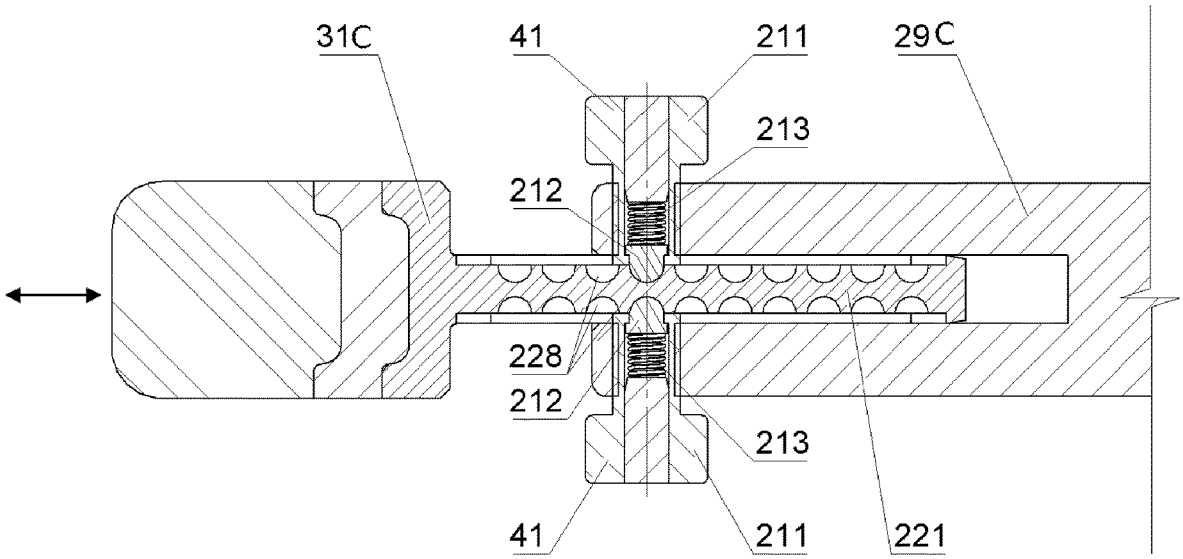
FIG. 75, FIG. 76, FIG. 77 show the length adjustment of the adjustable back plate 31C.
Figure 76:
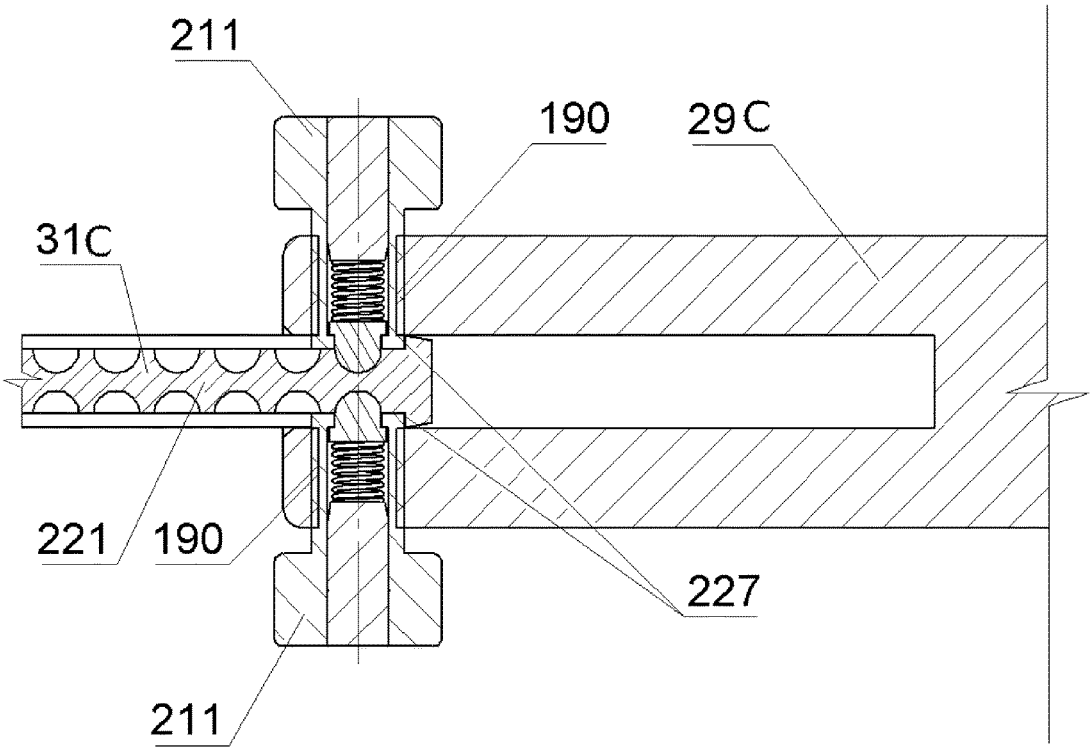
Figure 77:
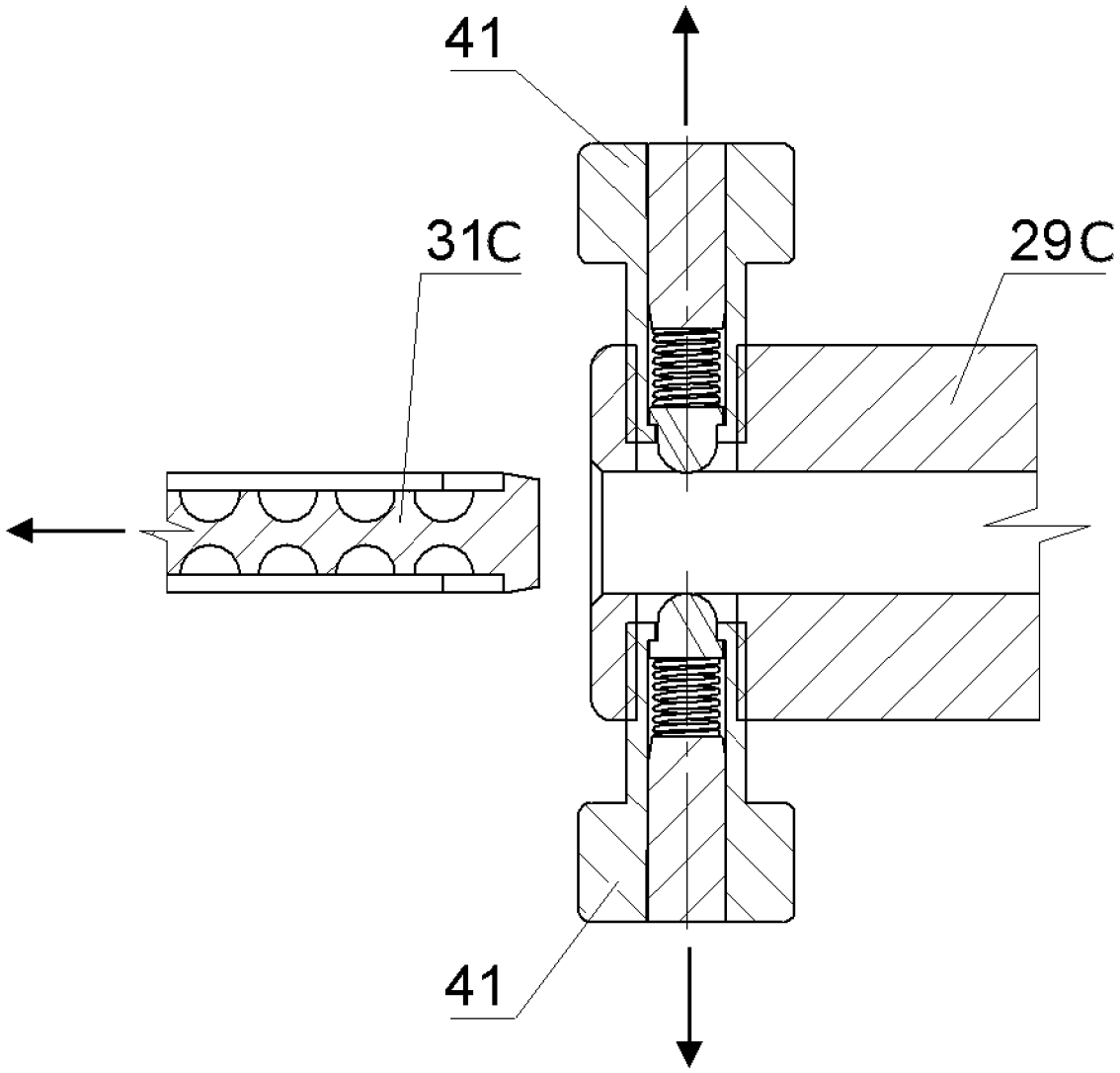

FIG. 75, FIG. 76, FIG. 77 show the length adjustment of the adjustable back plate 31C. To adjust the length of the adjustable back plate 31C, is required to unscrew the adjusting screws 211 for the adjustable back plate latch 41 from the threaded holes 190 of the skeletal buttstock 29C at a distance so that the adjusting screws 211 would displace the retaining pins 212 at a distance at which the spherical sections of the retaining pin 212, spring-loaded by the retaining pin spring 213, begin to drop out of the spherical recesses 228 of the back plate bracket 221. In such condition, the adjustable back plate 31C is displaced over the length within the area of the spherical recesses 228. After installing the adjustable back plate 31C in the position appropriate for the shooter, the latches of the adjustable back plate 41 should be tightened, and this will ensure secure fastening of the adjustable back plate 31C on the weapon 1C.

To remove the adjustable back plate 31C from the skeletal buttstock 29C, it is required to unscrew the adjusting screws 211 to a distance at which the spherical parts of the retaining pin 212 move away from the slots 227 of the back plate bracket 221, and the adjustable back plate 31C can be removed.

Figure 78:
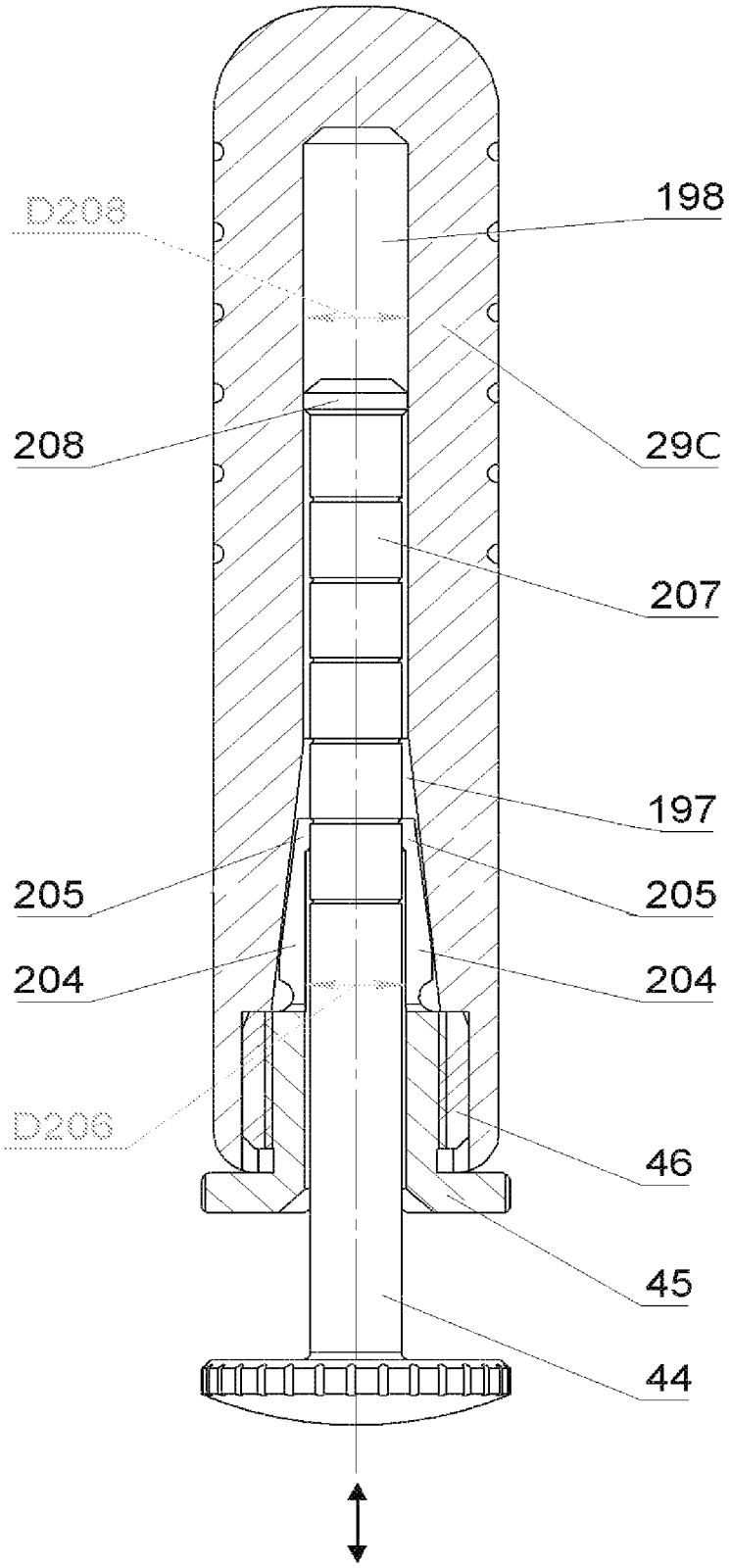
FIG. 78 shows the height adjustment of the stop 44.

FIG. 78 shows the height adjustment of the stop 44. To adjust the height of the stop 44 it is required to unscrew the stop lock 45 by a couple of turns from the threaded bushing of the stop lock 46, and the lugs of the retaining clamps 204 of the stop lock 45 will move apart and the cylindrical protrusions 205 at the ends of the lugs of the retaining clamps 204 will release the stop 44 and they will be able to move freely in the blind hole 198 of the skeletal buttstock 29C. The drop-out of the stop 44 from the skeletal buttstock 29C is prevented by the cylindrical head 208 at the end of the rod 207 of the stop 44. After installing the stop 44 in a position appropriate for the shooter, the stop lock 45 should be tightened, while the lugs of the retaining clamps 204 of the stop lock 45 will be joined due to the conical hole 197 of the skeletal buttstock 29C, and the cylindrical protrusions 205 at the ends of the lugs of the retaining clamps 204 will fasten the stop 44 and it would not will be able to move in the blind hole 198 of the skeletal buttstock 29C, which will ensure reliable fastening of the stop 44 on the weapon 1C.

To remove the stop 44 from the skeletal buttstock 29C, it is required to unscrew completely the stop lock 45 from the threaded bushing of the stop lock 46, then the stop lock will be removed together with the stop 44 as a single assembly unit, then the stop 44 is to be dismantled by taking it out from the stop lock 45; this is possible due to the fact that within passage of the cylindrical head 208 the cylindrical protrusions 205 at the ends of the lugs of the retaining clamps 204 will freely move apart and allow passage of the cylindrical head 208 with the rod 207 of the stop 44 through the hole 206 of the stop lock 45; in this case, the condition should be met under which the diameter D208 of the cylindrical head 208 is less than the diameter D206 of the hole 206 of the stop lock 45.

Figure 79:
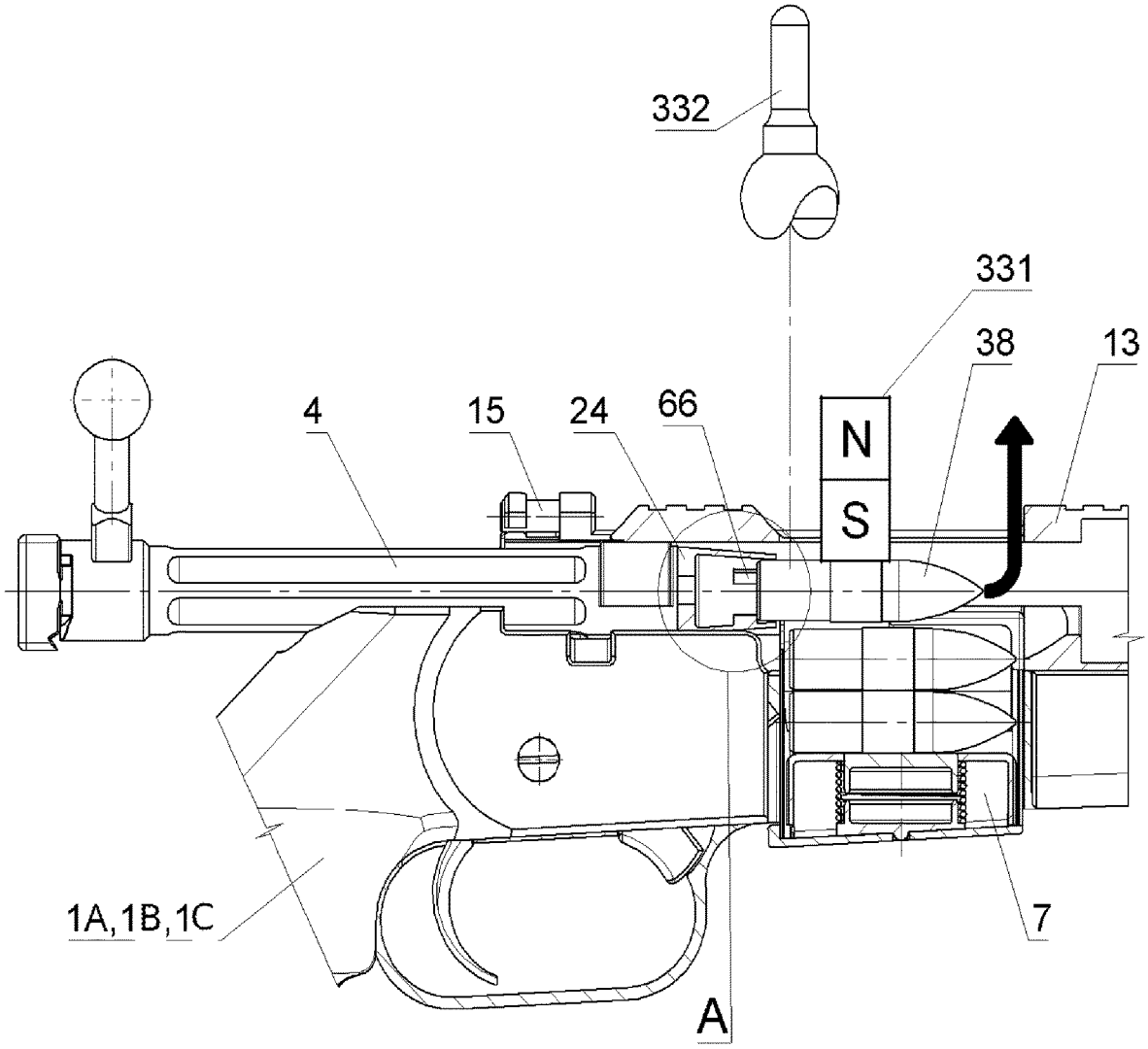
FIG. 79 shows a fragment of the side view of the weapons 1A, 1B, 1C within extraction.
Figure 80:
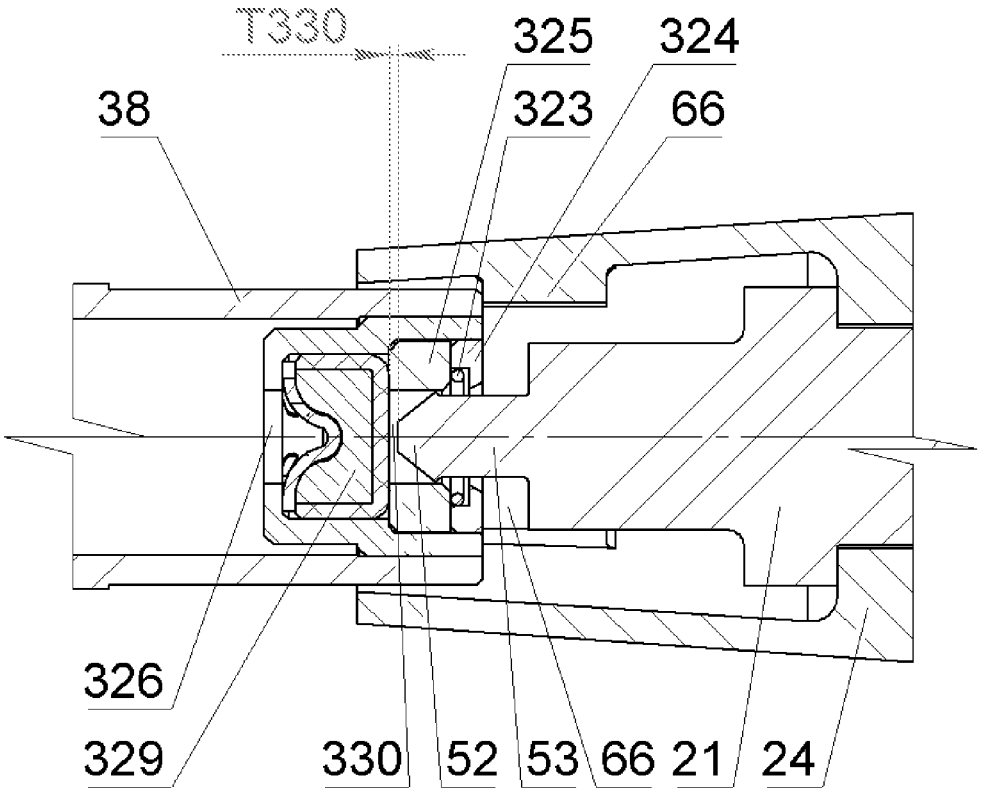
FIG. 80 shows unit A for mechanical extraction related to FIG. 79.
Figure 81:
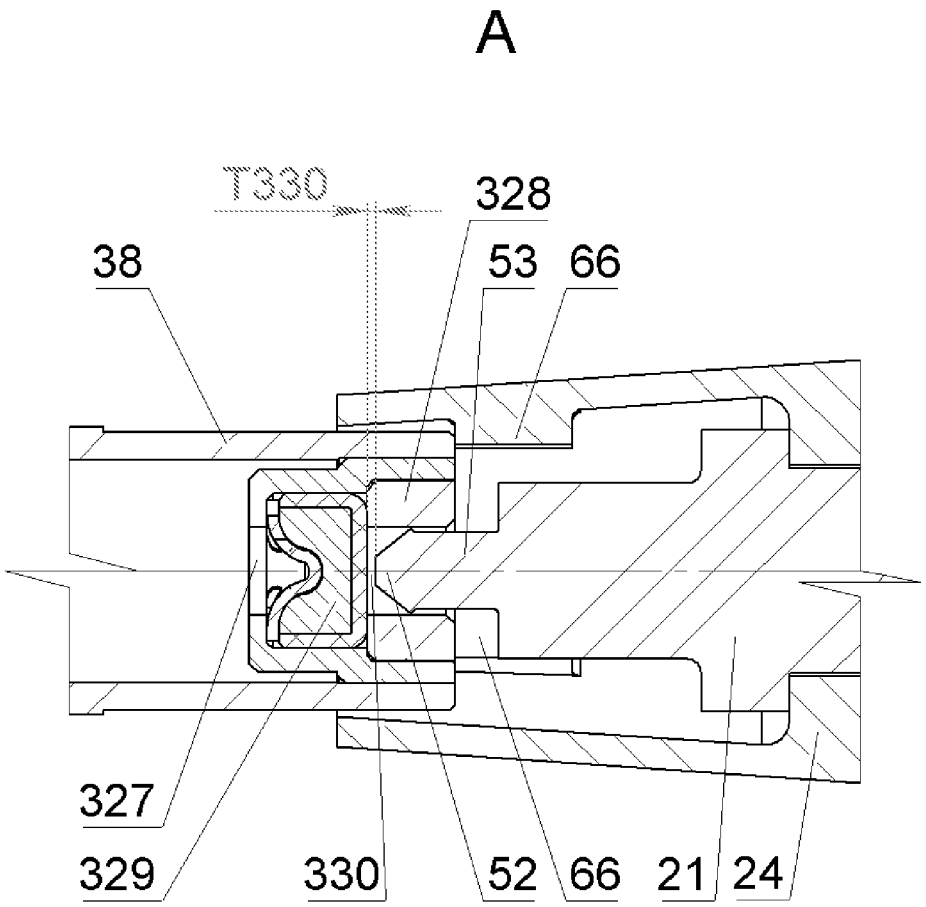
FIG. 81 shows unit A for magnetic extraction related to FIG. 79.
Figure 82:
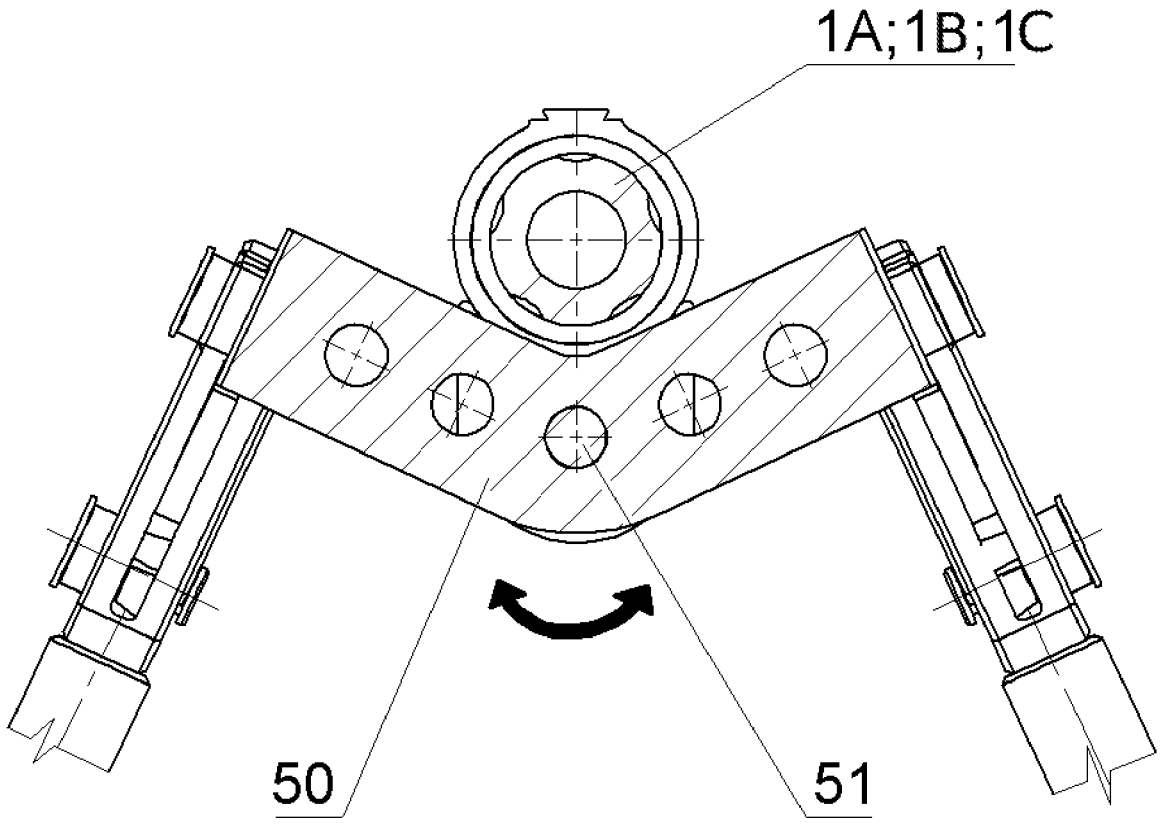
FIG. 82, FIG. 83, FIG. 84, FIG. 85 show operation of the folding adjustable bipod 50.
Figure 83:
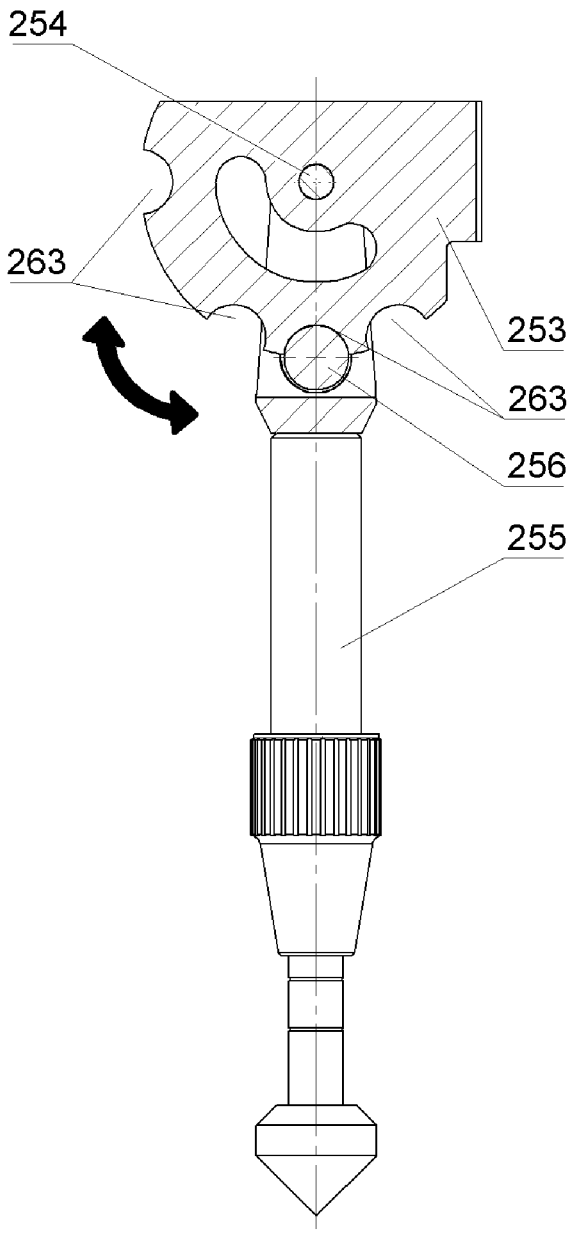
Figure 84:
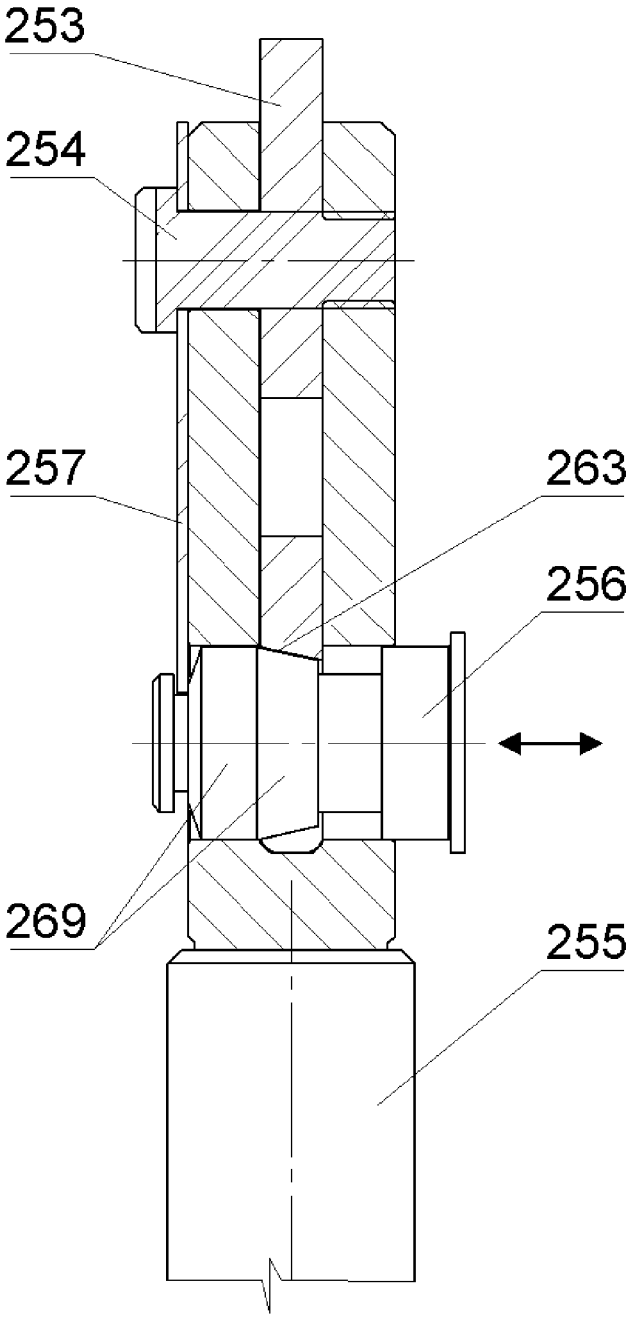

FIG. 79 shows fragment of the side view of the weapons 1A, 1B, 1C within extraction, FIG. 80 shows unit A for mechanical extraction related to FIG. 79, FIG. 81 shows unit A for magnetic extraction related to FIG. 79. For the purpose of extraction it is necessary to open and to pull back the bolt 4 up to extreme rear position, and the rear part of the ammunition 38 is in the conical bushing 24 of the bolt 4, and bears against the protrusions 66, and the rear part of the ammunition 38 is retained in the cylindrical part of the smaller diameter 53 by means of inclined protrusion 54 of the firing pin 21, under effect of the expanding ring 323 disposed in the external marker-washer 324 and in the inner washer 325 of the ignition block 326 for mechanical extraction. For the purpose of magnetic extraction of ammunition 38, there is the magnetic extraction marker-washer 328 within the ignition block 327, which is magnetically attached to the firing pin 21. The gap 330 is disposed between the end of the conical part 52, the firing pin 21 and the capsule with the anvil 329 of the ignition block 326 or 327. The thickness T330 of the gap 330 is 0.03-0.05 D, where D is the outer diameter of the ammunition 38. The gap 330 between the end of the conical part 52 of the firing pin 21 and the capsule with the anvil 329 of the ignition block 326 or 327 ensures impossibility for the capsule with the anvil 329 to be pined on by the conical part 52 of the firing pin 21, and this ensures the safety during charging and recharging cycle. Further, it is necessary to remove the ammunition 38 from the weapons 1A, 1B, 1C using the magnet 331 or the hand extractor 332 configured in the form of the rod with the semi-circular plate.

In accordance with the second method of extraction of the ammunition 38, it is required to turn the safety 15 into middle position, to open and to remove the bolt 4 from the weapon 1A, 1B, 1C. Further, it is required to remove by hand the ammunition 38 from the bolt 4 and install the bolt 4 in the receiver 13, delivering another ammunition 38 from the magazine 7 to the cartridge 11 of the receiver, if necessary. Set the safety 15 into the position of prevention.

FIG. 82, FIG. 83, FIG. 84, FIG. 85 show operation of the folding adjustable bipod 50. This is achieved by the fact that the folding adjustable bipod 50 is configured for lateral oscillation on the latch of the bipod 51, and it can be fixed in the desired position by screwing tightly to the weapon 1A or 1B or 1C by the latch of the bipod 51.

The bipod stub 255 of the folding adjustable bipod 50 can be folded in various positions. In this case they are fastened without backlashes. For this purpose, the button 266 of the bipod stubs latch 256 is to be pressed until it stops, and the conic-cylindrical part 269 of the bipod stubs latch 256 will come out of engagement with the semi-circular conical hole 263 of the bipod bracket 253, thus the bipod stub 255 will be able to rotate on the screw of the bipod stub 254 in the bipod bracket 253. Further, while holding the bipod stubs latch 256, spring-loaded by the plate spring of the latch 257, in the pressed position, the bipod stub 255 should be set in the desired position, while the latch of the bipod stubs 256 will be aligned with the semi-circular conical hole 263 of the bipod bracket 253. Further, it is required to release the bipod stubs latch 256. Under the action of the plate spring of the latch 257, it is engaged by its conic-cylindrical part 269 of the bipod stubs latch 256 with the semi-circular conical hole 263 of the bipod bracket 253, and the bipod stub 255 will be fixed without any backlash. All above operations should be repeated with the second bipod stub 255.

Figure 85:
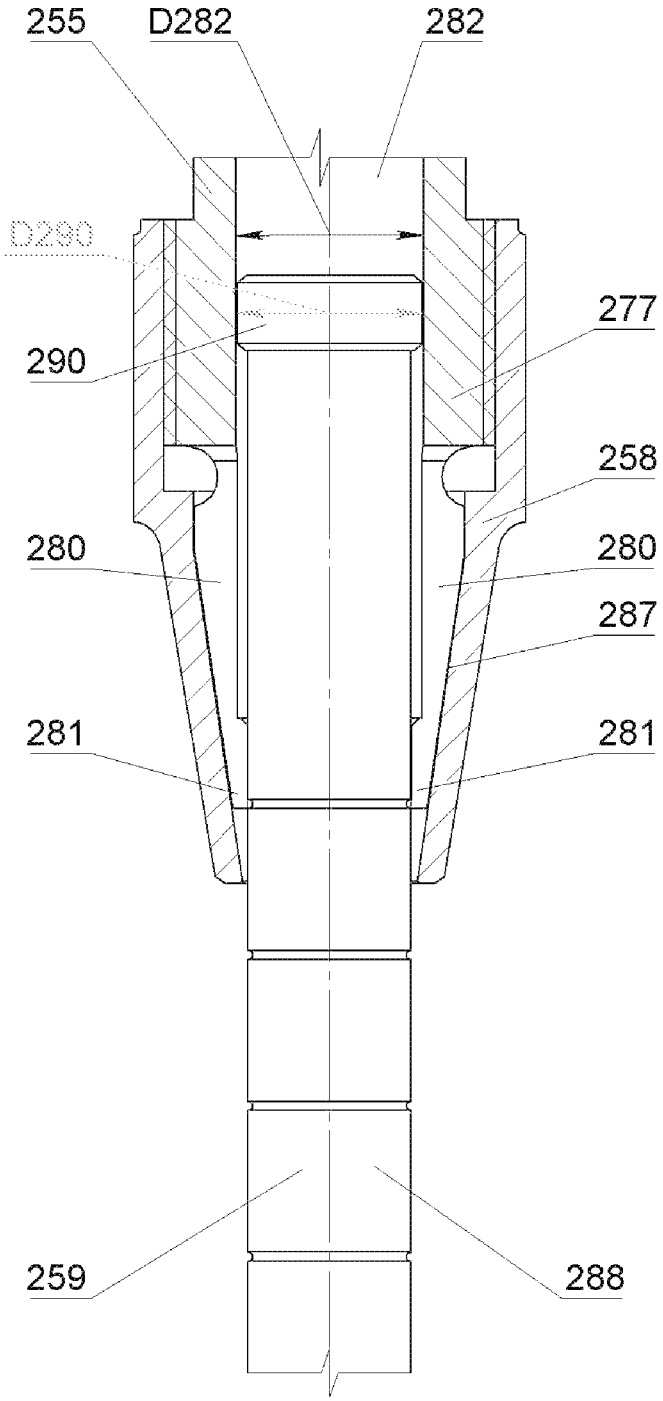

FIG. 85 shows the height adjustment of the withdrawable lock 259. To adjust the height of the withdrawable lock 259 it is required to unscrew the conical nut 258 by a couple of turns from the cylindrical section with the outer thread 277 of the bipod stub 255, and the lugs of the retaining clamps 280 of the bipod stub 255 will move apart and the cylindrical protrusions 281 at the ends of the lugs of the retaining clamps 280 will release the withdrawable lock 259 and it will be able to move freely in the longitudinal hole 282 of the bipod stub 255. The drop-out of the withdrawable lock 259 from the bipod stub 255 is prevented by the cylindrical head 290 at the end of the rod 288 of the withdrawable lock 259. After installing the withdrawable lock 259 in a position appropriate for the shooter, the conical nut 258 should be tightened, while the lugs of the retaining clamps 280 of the bipod stub 255 will be joined due to the conical section 287 of the conical nut 258, and the cylindrical protrusions 281 at the ends of the lugs of the retaining clamps 280 will fasten the withdrawable lock 259 and it will not be able to move in the longitudinal hole 282 of the bipod stub 255, which ensure reliable fastening of the withdrawable lock 259 on the adjustable bipod 50.

To remove the withdrawable lock 259 from the bipod stub 255, it is required to unscrew completely the conical nut 258 from the cylindrical section with the outer thread 277 of the bipod stub 255, then the conical nut 258 will be removed together with the withdrawable lock 259 as a single assembly unit, now the withdrawable stop 259 is to dismantled by taking it out from the conical nut 258, this is possible due to the fact that within passage of the cylindrical head 290 the cylindrical protrusions 281 at the ends of the lugs of the retaining clamps 280 will freely move apart and pass the cylindrical head 290 with the rod 288 of the withdrawable lock 259 through the longitudinal hole 282 of the bipod stub 255.

Figure 86:
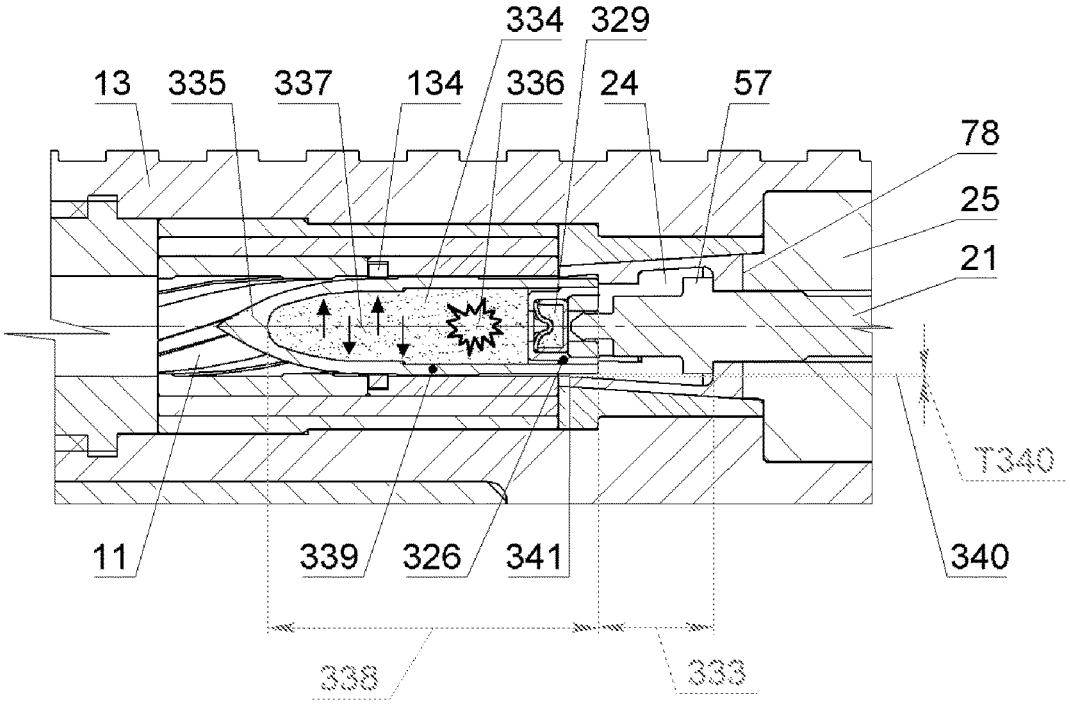
FIG. 86 shows operation of the weapons 1A, 1B, 1C within the lock time.

FIG. 86 shows operation of the weapons 1A, 1B, 1C within the lock period. The lock time 333 lasts from the start of the ignition of the propellant 334 (solid, liquid, gaseous) until the start of the projectile 335 rifling into the grooves of the multifunctional cartridge 11.

During this period, the following processes take place: after the impact action of the firing hammer 26 against the firing pin 21, the firing pin 21 breaks the capsule with the anvil 329 inside the ignition block 326 or 327 and the force flame 336 ignites the propellant 334 (solid, liquid, gaseous). A gases 337 start to evolve at high temperature and pressure. The entire process takes place in the closed space of the projectile chamber 338 for the propellant. Under the action of gases 337 the cylindrical piston 57 of the firing pin 21 will press the conical bushing of the bolt 24 to the glazed area 78 of the bolt body 25, thereby blocking the leakage of gases 337 into the receiver 13. When the pressure of the gas $P_k$ will reach the pressure at which the spring-loaded half rings 134 are unfasten, the projectile 335 with its leading cylindrical part 339 will pass through the spring-loaded half rings 134 and abut against the grooves of the multifunctional cartridge 11. Further, when the gas pressure $P_o$ reaches the force pressure level, the projectile 335 begins to rifle with its leading cylindrical part 339 into the grooves of the multifunctional cartridge 11. At this moment, the gap 340 between the rear cylindrical part 341 of the projectile 335 and the inner surface of the multifunction cartridge 11 starts to decrease and the projectile 335 starts to move forward. The thickness T340 of the gap 340 depends on a number of the values and it is calculated depending on each specific ammunition.

Figure 87:
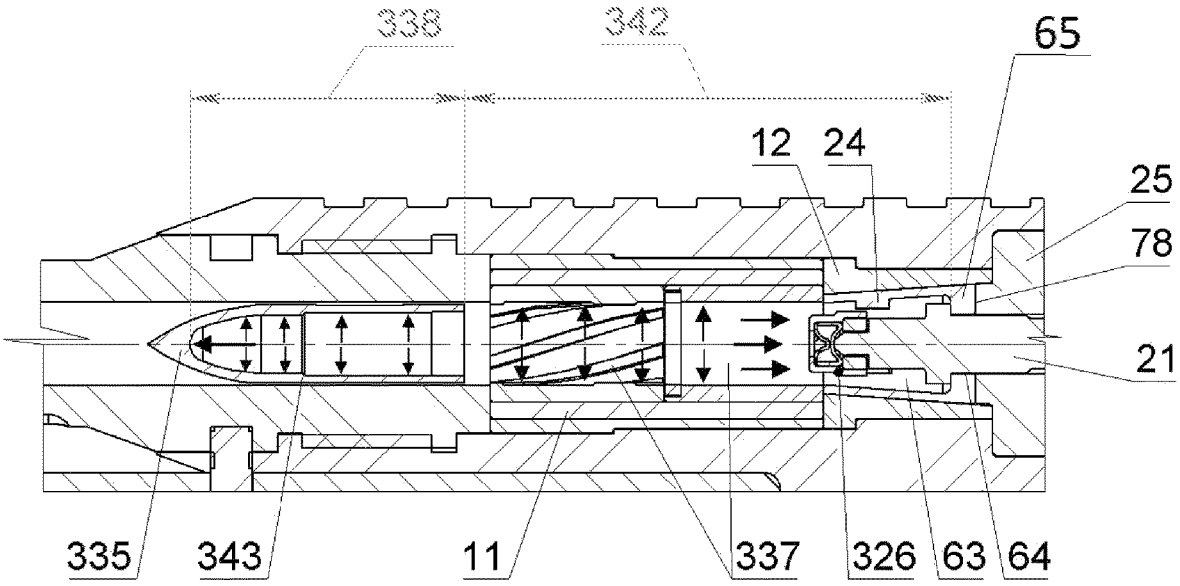
FIG. 87 shows operation of the weapon 1A and 1B or 1C within a ignition time 342.

FIG. 87 shows operation of the weapon 1A and 1B or 1C within the ignition time 342. The ignition time 342 lasts from the start of rifling of the projectile 335 by its leading cylindrical part 339 in the multifunctional cartridge 11 until complete outlet of the projectile 335 from the multifunctional cartridge 11. The following processes take place within this period.

1. Obturation. With a sharp increase of the pressure in the projectile chamber 338 for the propellant, the gases 337 in the space of the multifunctional cartridge 11 under high-pressure press the ignition block 326 or 327 against the cylindrical piston 57. Thus, the gases 337 are locked from breakthrough into the through-hole 82 of the bolt body 25. The gases 337 bypass the ignition block 326 or 327 and enter the space formed by the blind conical hole 63 of the conical bushing of the bolt 24 and the cylindrical piston 57 of the firing pin 21. Since the gases 337 act in all directions, one portion of the gases 337 applies the pressure against the thick wall 65 of the conical bushing of the bolt 24, which is pressed against the glazed area 78 of the bolt body 25. This prevents the gases 337 from the breakthrough into the weapon 1A, 1B, 1C. Another portion of the gases 337 applies the pressure on the walls in the blind conical hole 63 of the conical bushing of the bolt 24 and on the conical bushing of the receiver 12. The gases 337 apply the pressure on the cylindrical piston 57, which, with its end, locks the leakage of gas 337 between the firing pin 21 and the -hole 64 of the conical bushing of the bolt 24.

2. Rifling. The projectile 335 passes through the grooves of the multifunctional cartridge 11, while the screwed channels 343 are rifled on the projectile 335. Projectile 335 obtains the required circular velocity for a stable shot. At the moment the projectile 335 leaves the threaded section of the multifunctional cartridge 11, the gas pressure P 337 has the maximum value, the maximum temperature T and 70% of the initial velocity $V_0$ of the projectile. The combustion process of the propellant 334 (solid, liquid, gaseous) will be completed. Under the action of the gas pressure 337, the walls of the projectile 335 are deformed and the gap 340 between the rear cylindrical part 341 of the projectile 335 and the inner surface of the multifunctional cartridge 11 is closed. The gases 337 in the projectile chamber 338 reforge the walls of the projectile 335. The chips formed due to creation of the screwed channels 343 on the projectile 335 are blown out by the gases 337 through the screwed channels 343 of the projectile 335 and partially carried away by the gases 337 following the projectile 335. If the pressure of the gases 337 exceeds the allowable value, then the conical bushing of the bolt 24 will crack, allowing the gases 337 to outflow. This precaution ensures protection of the weapon and the shooter. For further use of the weapon, it is necessary to replace the conical bushing of the bolt 24. With increased gas pressure 337, the cracks in the multifunctional cartridge 11 are also possible. For further use of the weapons, it is necessary to replace the multifunctional cartridge 11.

Figure 88:
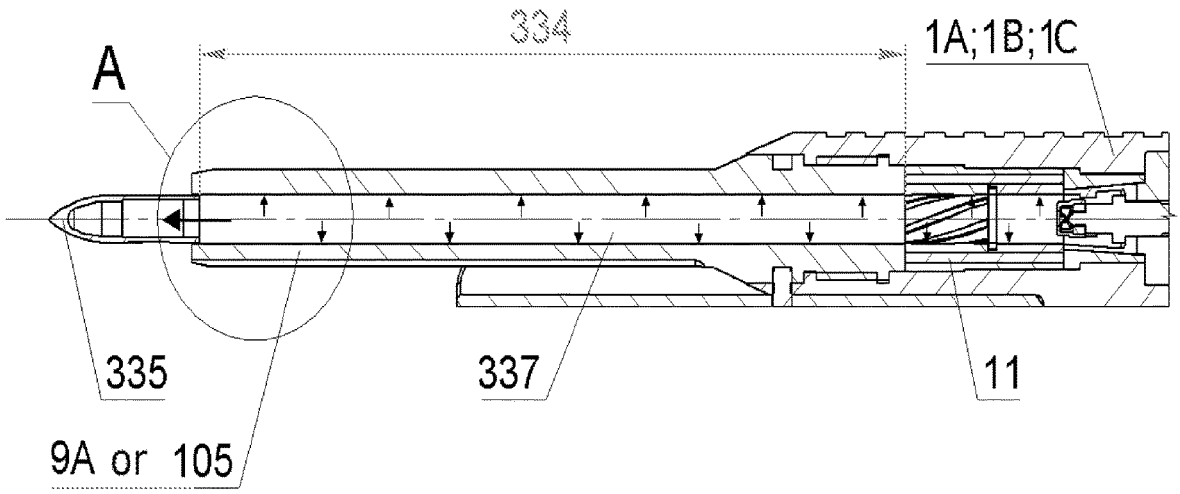
FIG. 88, FIG. 89 show unit A related to FIG. 88 for the weapons 1A, 1B.
Figure 89:
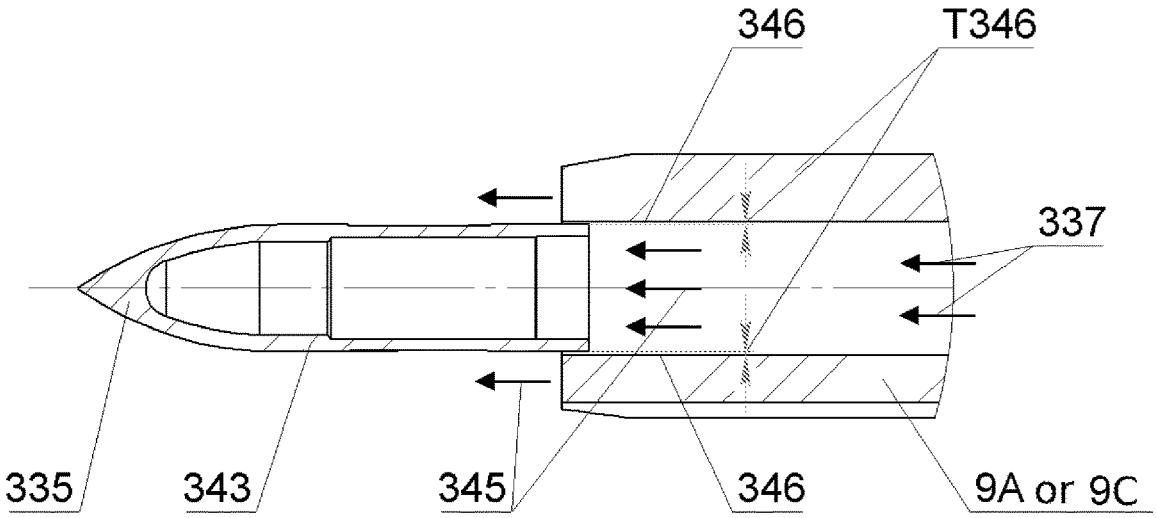
Figure 90:
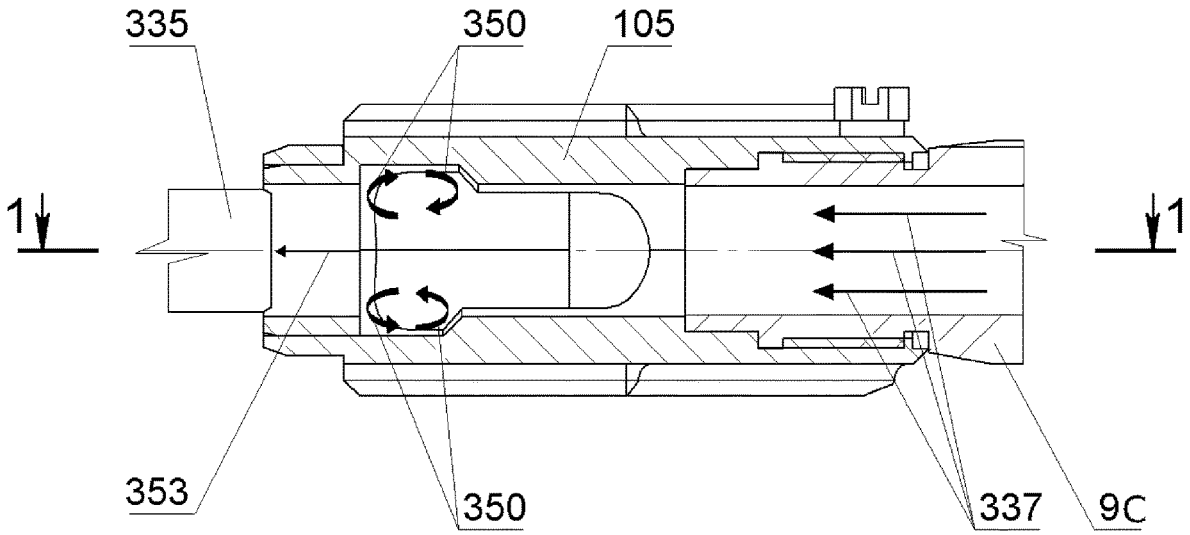
FIG. 90 shows unit A related to FIG. 88 for the weapon 1C.
Figure 91:
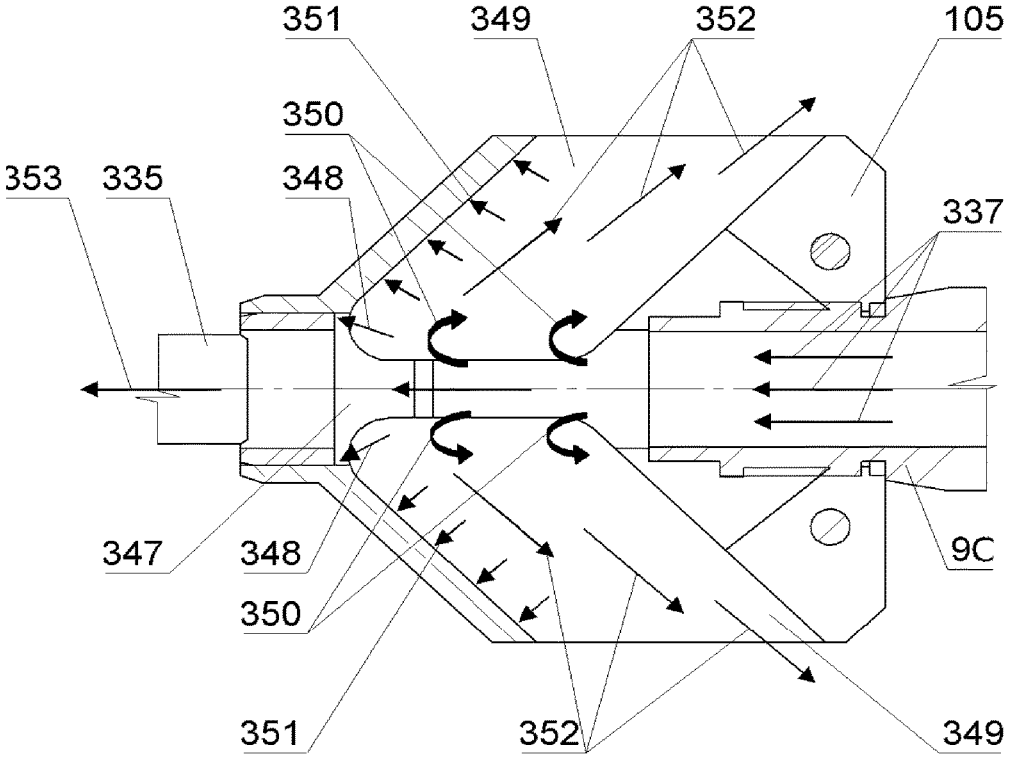
FIG. 91 shows section 1-1 related to FIG. 90 for the weapon 1C.

FIG. 88, FIG. 89 (showing the unit A related to FIG. 88 for the weapons 1A, 1B), FIG. 90 (showing the unit A related to FIG. 88 for the weapon 1C), and FIG. 91 (showing the Section 1-1 related to FIG. 90 for the weapon 1C) represent operation of the weapon 1A, 1B, 1C within the second 1 time 344. The second 1 time 344 lasts from the outlet of the projectile 335 from the threaded section of the multifunctional cartridge 11 up to the moment when the rear part of the projectile 335 reaches the muzzle face 9A—for the weapon 1A, 1B, or the muzzle face of the muzzle break 105 in case of the weapon 1C.

The following processes take place within this period: in case of the weapons 1A, 1B, 1C, when the projectile 335 passes through the smooth bore of the barrel 9A or 9B, the gases 337 will partially blow out the chips formed due to rifling the screwed channels 343 of the projectile 335. In addition, the gases 337 create the gas blanket 345 due to the gap 346 formed by the grooves on the projectile 335, thus reducing the friction of projectile 335 against the smooth surface of the bore of the barrel 9A or 9C. Thickness T346, of the gap 346 is equal to the height of the grooves (rifles) on the projectile 335. Within the second period 344, highly compressed and heated gases 337 expand and apply the pressure on the projectile 335, increasing its velocity V344 up to 98% of the initial velocity $V_0$ of the 335 projectile. The decrease in the pressure of the gases 335 within the second period 344 occurs abruptly according to curvilinear relation. At this, the second period 344 for the weapons 1A, 1B is completed, but for the weapons 1C, operation of the muzzle break 105 is also involved.

In the muzzle break 105, the gases 337, entering at high velocity into the primary chamber 347, impinge against the end surface of the primary chamber 347, creating a reaction 348 acting in the opposite direction of the weapon 1C blowback. Further, the portion of the gases 337 burst into the inclined channels 349 of the muzzle break 105, and at alteration of the gas flow 350, the excessive pressure is generated on the external wall of the inclined channels 349, as a result of which the reaction 351 appears, acting also in the opposite direction of the weapon 1C blowback. Further, the gases 337 in the inclined channels 349 generate the exhaust gas jet stream 352, which, escaping out of the inclined channels 349, generates the thrust force 353 acting in the opposite direction of the weapon 1C blowback. Reactions 348, 351 and the thrust force 353 reduce the blowback of the weapon 1C.

Figure 92:
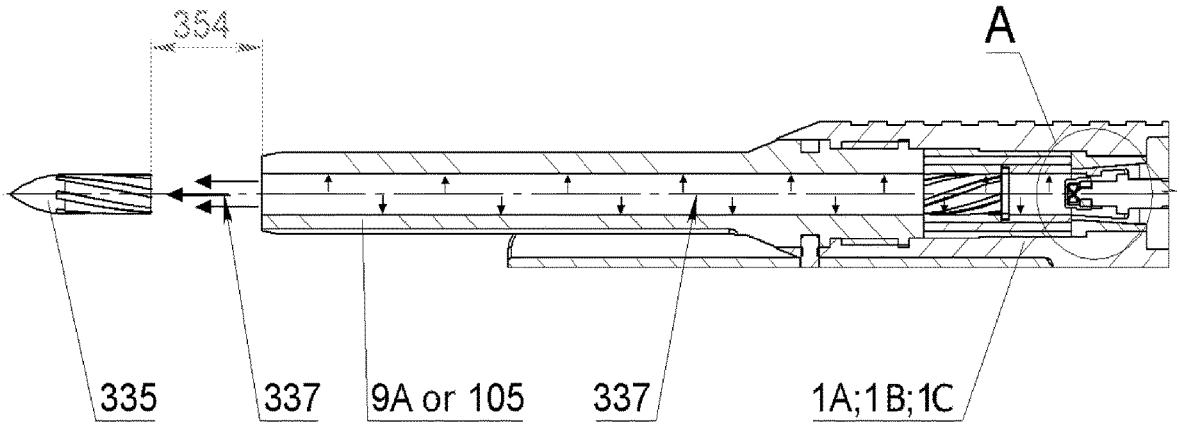
FIG. 92, FIG. 93, FIG. 94 show operation of the weapon within transitional period 454 for the weapon 1A, 1B, 1C.
Figure 93:
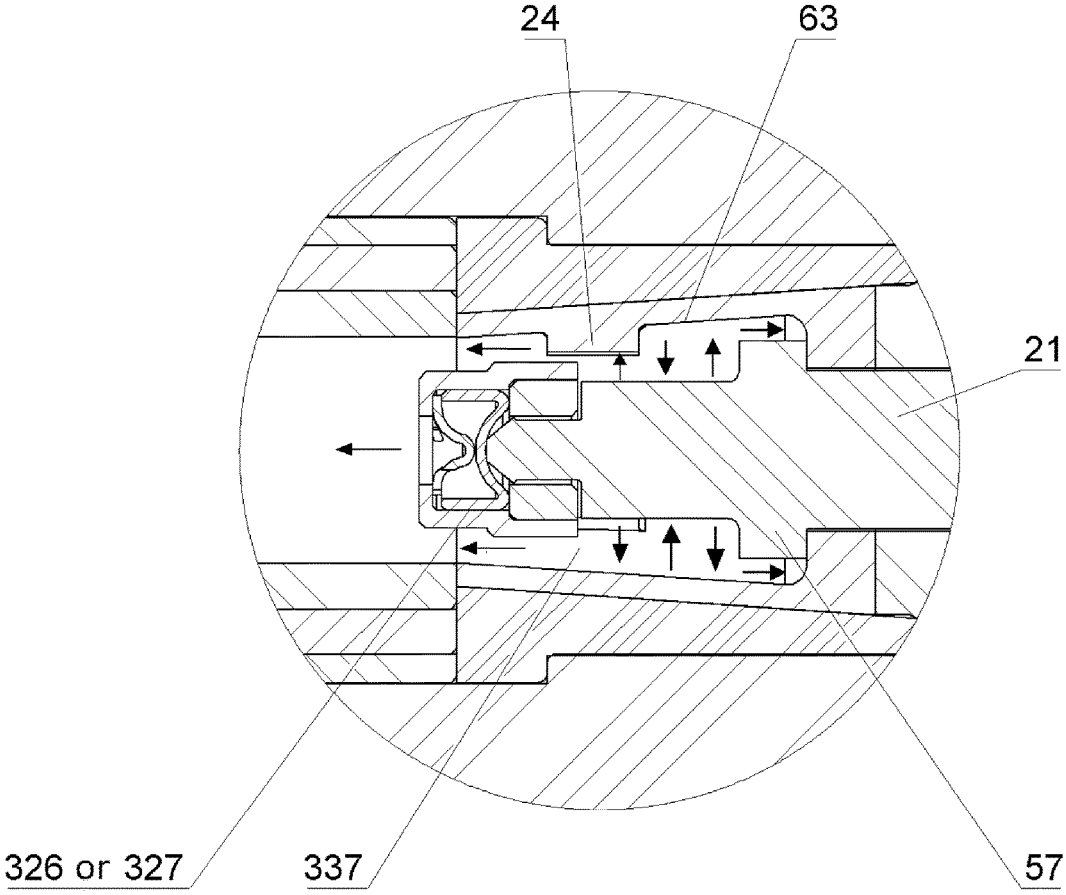
Figure 94:
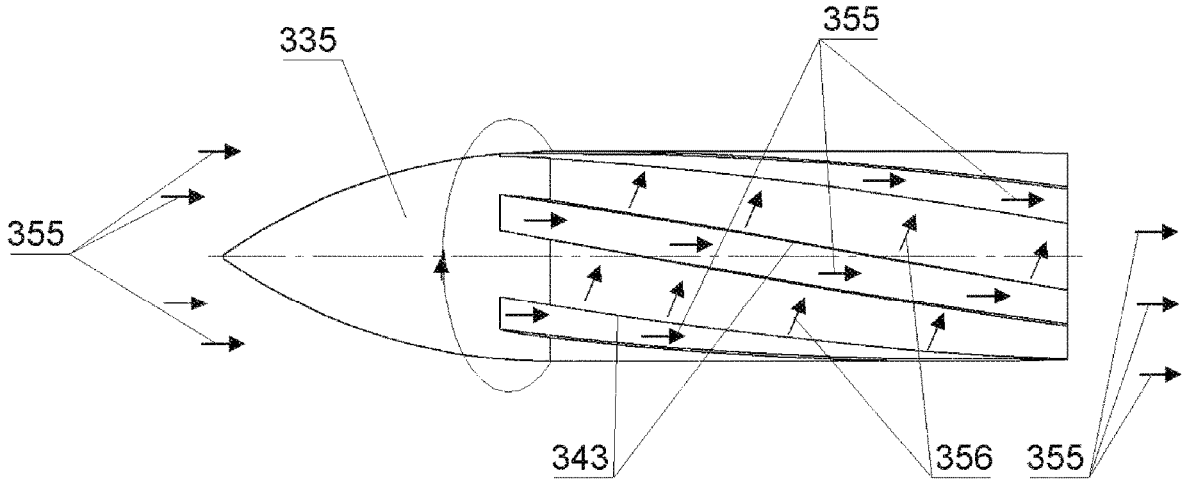

FIG. 92, FIG. 93, FIG. 94 show operation of the weapon within transitional period 354 for the weapons 1A, 1B, 1C. The transitional period 354 lasts from the moment when the projectile 335 reaches the muzzle face of the barrel 9A—for the weapons 1 A, 1B, or the muzzle face in the muzzle break 105 in the case of the weapon 1C, until the moment of the completion of gases 337 impact on the projectile 335. The following processes take place within this period.

The gases 337 pass through the muzzle face of the barrel 9A or the muzzle face of the muzzle break 105 outwards. The projectile 335 reaches the maximum initial velocity $V_{max}$ at a point of about twenty centimetres from the muzzle face of the barrel 9A or the muzzle face of the muzzle break 105. The transition period 354 is completed when the gas pressure 337 applied to the projectile 335 is balanced with the atmospheric pressure. After the projectile 335 leaves the barrel 9A or the muzzle break 105, the air flow 355 enters the screwed channels 343 of the projectile 335 and, passing through them at high velocity, creates the reaction 356, which results in additional rotation of the projectile 335 around its longitudinal axis. Consequently, the stability of the projectile 335 is enhanced throughout entire shot path. When the gases 337 outflow from the barrel 9A or the muzzle break 105, some of the gases 337 remaining in the space formed by the blind conical hole 63 of the conical bushing of the bolt 24 and the cylindrical piston 57 of the firing pin 21 will break the ignition block 326 or 327 from the firing pin 21 and throw it out beyond the barrel 9A or the muzzle break 105 following the projectile 335.

FIG. 86, FIG. 87, FIG. 88, FIG. 89, FIG. 90, FIG. 91, FIG. 92, FIG. 93 and FIG. 94 disclose operation of the proposed caseless weapons 1A, 1B, 1C when firing, which allows in the weapon:

1. To remove completely the blowback within shooting. This is achieved due to the curvilinear nature of the gases 337 operation during the second time 344 in case of the weapon 1A, 1B, and operation of the muzzle break 105 during transitional period 354 in case of the weapon 1C.

2. To enhance the efficiency, to reduce the heat losses and to decrease the heating of the barrel 9A or 9C. This is achieved since the rifling force corresponds to the level of forcing pressure $P_o$, at which the propellant 334 (solid, liquid, gaseous) is completely burned, as well as the maximum pressure $P_{max}$ of the gases 337 and the maximum temperature T, which occur within the ignition time 342 in thick-walled, multi-layered, multifunctional cartridge 11. In the barrel with the smooth bore 9A or 9C, the gases 337 are expanded and cooled abruptly, and the projectile 335 moves in the smooth bore of the barrel 9A or 9C in the gas blanket 345 owing to the gap 346 with minimum friction and appropriate axial rotation of the projectile 335.

3. To reduce the length of the barrel 9A or 9C. This is achieved because the release of all thermal energy occurs in the multifunctional cartridge 11 of the receiver 13 and building up of the basic velocity $V_0$ of the projectile 335 takes place within passing the carbide and refractory threaded bushing 133 of the multifunctional cartridge 11. Therefore, the maximum speed $V_{max}$ of the projectile 335 is achieved in the barrel 9A or 9C with the length twice shorter than in case of the traditional shot.

4. To reduce the weight and dimensions of the weapon. This is achieved due to increase of the values of operating temperature and operating pressure. This makes possible to create the weapon 1A or 1B or 1C with small dimensions, low weight, and high muzzle energy of the shot.

Below are examples of the process of assembling the proposed caseless weapon 1A, 1B, 1C.

Process of Assembling of the Caseless Weapon 1A:

1. Using the barrel 9A, the multifunctional cartridge 11, the conical bushing of receiver 12, the receiver 13, the safety spring 14, the safety 15 to assemble the receiver with the barrel and the mechanisms 2A.

2. Using the trigger guard with the magazine box 16, the trigger bar 17, the trigger bar spring 18, the magazine latch 19, the axis of the trigger bar and the magazine latch 19 to assemble the trigger guard with the magazine box and mechanisms 3.

3. Using the firing pin 21, the spring of firing pin latch 22, the firing pin latch 23, the conical bushing of the bolt 24, the bolt body 25, the firing hammer 26, the mainspring 27 and the mainspring latch 28 to assemble the bolt 4.

4. Using the handguard 248, the threaded bushing of the bipods 33 to assemble the handguard 5A.

5. Using the hunting buttstock 29A, the threaded bushings for the back plate screws 30, the back plate 31A, the back plate screws 32 to assemble the hunting buttstock 6A.

6. Using the receiver with the barrel and the mechanisms 2A, the trigger guard with the magazine box and the mechanisms 3, the handguard 5A, the hunting buttstock 6A, the barrel latch 10, the cross screw of the buttstock 34, the nut of the cross screw 35 of the buttstock, the upper screw of the trigger bar with magazine box 36, the lower screw 37 of the trigger guard with the magazine box to assemble the weapon 1A without the bolt 4 and the magazine 7. Install the bolt 4 into the weapon 1A.

7. Fit up the magazine 7 with the ammunition 38 and insert it into the weapon 1A.

8. Set the safety 15 to the "fire" mode.

9. Pull and release the bolt 4. The weapon 1A is ready to fire.

Process of Assembling of the Caseless Weapon 1B:

1. Using the barrel 9A, the multifunctional cartridge 11, the conical bushing of receiver 12, the receiver 13, the safety spring 14, the safety 15 to assemble the receiver with the barrel and the mechanisms 2A.

2. Using the trigger guard with the magazine box 16, the trigger bar 17, the trigger bar spring 18, the magazine latch 19, the axis of the trigger bar and the magazine latch 19 to assemble the trigger guard with the magazine box and mechanisms 3.

3. Using the firing pin 21, the spring of firing pin latch 22, the firing pin latch 23, the conical bushing of the bolt 24, the bolt body 25, the firing hammer 26, the mainspring 27 and the mainspring latch 28 to assemble the bolt 4.

4. Using the gunstock 8, the threaded bushings for the back plate screw 30, the back plate 31A, the back plate screws 32, the threaded bushing of the bipods 33 to assemble the hunting gunstock 1B.

6. Using the receiver with the barrel and the mechanisms 2A, the trigger guard with the magazine box and the mechanisms 3, the hunting gunstock 1B, the barrel latch 10, the upper screw 36 of the trigger guard with magazine box, the lower screw of the trigger guard with magazine box 37 to assemble the weapon 1B without the bolt 4 and the magazine 7.

Install the bolt 4 into the weapon 1A.

7. Fit up the magazine 7 with the ammunition 38 and insert it into the weapon 1A.

8. Set the safety 15 to the "fire" mode.

9. Pull and release the bolt 4. The weapon 1A is ready to fire.

Process of Assembling of the Caseless Weapon 1C:

1. Using the lower part of the muzzle break 47, the upper part of muzzle break 48, the screws of the muzzle break 49 to assemble the muzzle break 105 is to be assembled.

2. Using the muzzle break 105, the barrel 9C, the multifunctional cartridge 11, the conical bushing of receiver 12, the receiver 13, the safety spring 14, the safety 15 to assemble the trigger housing with mechanisms 2C.

3. Using the trigger guard with the magazine box 16, the trigger bar 17, the trigger bar spring 18, the magazine latch 19, the axis of the trigger bar and the magazine latch 19 to assemble the trigger guard with the magazine box and mechanisms 3.

4. Using the firing pin 21, the spring of firing pin latch 22, the firing pin latch 23, the conical bushing of the bolt 24, the bolt body 25, the firing hammer 26, the mainspring 27 and the mainspring latch 28 to assemble the bolt 4.

5. Using the bipod bracket 253, the screws of the bipod stubs 254, the bipod stubs 255, the bipod stubs latches 256, the plate springs of the latch 257, the conical nuts 258, the withdrawable locks 259 to assemble the folding adjustable bipod 50.

6. Using the handguard 248, the threaded bushing of the bipods 33, the folding adjustable bipod 50, the latch of the bipod 51 to assemble the handguard with the bipods 5C.

7. Using the back plate bracket 221, the back plate extension piece 222, the back plate 223, the back plate screws 224 to assemble the adjustable back plate 31C.

8. Using the sleeve stops 241, the retaining pins 212, the retaining pin springs 213, the thrust screws 242 to assemble the rests of the cheek piece clamp 234.

9. Using the cheek piece clamp 231, the cheek piece 232, the cheek piece screws 233, the latch of adjustable cheek piece 43, the rests of the cheek piece clamp 234 to assemble the adjustable cheek piece 42.

10. Using the adjusting screws 211, the retaining pins 212, the retaining pin springs 213, the stop screws 214 to assemble the adjustable back plate latches 41.

11. Using the skeletal buttstock 29C, the adjustable back plate 31C, the latch of the adjustable back plate 41, the adjustable cheek piece 42, the latch of adjustable cheek piece 43, the stop 44, the latch of the stop 45, the threaded bushing of latch of the stop 46 to assemble the skeletal buttstock with adjustable back plate and the cheek piece 6C.

12. Using the receiver with the barrel and the mechanisms 2C, the trigger guard with the magazine box and the mechanisms 3, the handguard with the bipods 5C, the skeletal buttstock with adjustable back plate and cheek piece 6C, the barrel latch 10, the transverse screw of the buttstock 34, the nut of the cross screw 35 of the buttstock, the upper screw of the trigger guard with magazine box 36, the lower screw 37 of the trigger guard with magazine box to assemble the weapon 1C without the bolt 4 and the magazine 7.

13. Install the bolt 4 into the weapon 1C.

14. Fit up the magazine 7 with the ammunition 38 and insert it into the weapon 1C.

15. Set the safety 15 to the "fire" mode.

16. Pull and release the bolt 4. The weapon 1C is ready to fire.

Below are the examples of the process of shot using the proposed caseless weapon 1A, 1B, 1C.

The Process of Shot for Caseless Weapons 1A, 1B, 1C During Firing:

1. Set the safety 15 to the "fire" mode.

2. Press the trigger bar 17, the firing hammer 26 will fall off the cocking stud.

3. The mainspring 27 will move the firing hammer with high energy, and it strikes the firing pin 21.

4. The firing hammer 21 punctures and breaks the capsule with the anvil 329, which ignites the propellant 334 (solid, liquid, gaseous).

5. The propellant 334 (solid, liquid, gaseous) burns with the release of the gases 337 with high temperature and pressure.

6. The projectile 335 is rifled, acquiring the axial rotation, and picks up the speed.

8. The projectile 335 flies out of the barrel 9C and the gas pressure 337 on the projectile 335 is balanced with the atmospheric pressure. The shot is completed.

9. To continue firing it is required to pull and release the bolt 4, in which case the bolt 4 at returning, and passing the magazine 7, picks up the next ammunition 38, sends it into the multifunctional cartridge 11 and locks on the locking lugs 129; and the firing hammer 26 is raised and sets on the cocking stud. The weapons 1A, 1B. 1C are ready for the next shot.

The proposed new high-accuracy caseless magazine weapons 1A, 1B, 1C can be applied for army, police, hunting, sports, and operates with maximum efficiency.

The invention claimed is:

1. A caseless magazine weapon (1A), which contains a bolt (4) interacting with a receiver (13), configured to reciprocate and rotate about the axis in a guiding slots (158) of the receiver (13), and the said receiver (13) is mounted in the hunting buttstock (6A), a handguard (248), and fixed by a trigger guard with the magazine box (16), an upper screw (36) and a lower screw (37), and the hunting buttstock (6A) is fixed by a cross screw (34), the nut of the cross screw (35), and, in the trigger guard with magazine box (16), a magazine (7) is installed; a trigger bar (17) is installed on an axis (20) configured for axial rotation, and interacting with a firing hammer (26); a trigger bar spring (18) and the magazine latch (19) on the axis (20), configured to ensure axial rotation, and the said trigger bar (17) and a magazine latch (19) are spring-loaded by the trigger bar spring (18), and the magazine latch (19) interacts with the magazine (7), and a conical bushing (12) of a receiver (13) is mounted in the receiver (13) and a multifunctional cartridge (11) is mounted on said conical bushing of the receiver (12);

a barrel (9A) with rear end screwed into the receiver (13) and fixed with a barrel latch (10);

a safety (15), spring-loaded through a safety spring (14), which is disposed in the receiver (13) and configured to reciprocate and to rotate about the axis;

the handguard (248), wherein the bolt (4) contains a firing pin (21), which is mounted in a conical bushing of the bolt (24), which is configured to rotate on the firing pin (21) and, at the same time, it is permanently pressed by a spring of the firing pin latch (22) to a bolt body (25), and the firing pin (21) is installed in a through-hole (82) of the bolt body (25) and capable to reciprocate; it is loaded by the spring of the firing pin latch (22) and fixed by a firing pin latch (23), inserted into a central blind cylindrical channel (79) of the bolt body (25) and configured to reciprocate, and the bolt (4) contains the firing hammer (26) installed into central blind cylindrical channel (79) and configured for reciprocal motion; and the mainspring capable to compress and expand in the firing hammer (26) is disposed inside the firing hammer (26) and fixed by a mainspring latch (28) in the bolt body (25);

the firing pin (21) is configured in the form of stepped shaft, which has a conical part (52) at front, which passes into a cylindrical part with smaller diameter (53), and an inclined protrusion (54) is formed at the joint of the conical part (52) and the cylindrical part with smaller diameter (53), and the angle of the inclined protrusion (d54) relative to the axis of the firing pin (55) is equal to 30-45 degrees, and the cylindrical part with the smaller diameter (53) passes into a cylindrical part with the bigger diameter (56), which passes into a cylindrical piston (57), and said the cylindrical piston (57) passes into a rod section with a groove (58), where a rear groove (59) passes into a square part (60) with a cylindrical protrusions (61) disposed at the end of the square part (60), and the rear groove (59), the square part (60) and the cylindrical protrusions (61) interacts with the firing pin latch (23);

the conical bushing of the bolt (24) is configured to rotate on the firing pin (21) and pressed by the spring of the firing pin latch (22) to a glazed area (78) at the end of a cylindrical head (70) of the bolt body (25), and the said conical bushing of the bolt (24) is configured in the form of a truncated cone (62) with a blind conical hole (63), which passes into a hole (64), which forms the wall (65) at the outlet of the big base of the truncated cone (62), and at inlet of the blind conical hole (63) there are at least three a protrusions (66), which interact with a caseless ammunition (38);

the bolt body (25) has a cylindrical part (67), which passes into the thinner cylindrical part (68), where a slots (69) are disposed along the perimeter of outer part of a thinner cylindrical part (68), and the thinner cylindrical part (68) passes into the cylindrical head (70), and a chamfer (71) is disposed at the passage from the cylindrical part (67) into the thinner cylindrical part (68), and at the passage from the thinner cylindrical part (68) into the cylindrical head (70) a locking lugs (72) are made in the form of two protrusions with the ends made in the form of a radius surfaces (73), and the corbelling protrusion consisting of a base (74) and a leading protrusion (75), configured to interact with a leading notch (153) of the receiver (13), and the leading protrusion (75) is the third locking lug of the bolt (4) and interacts with a protrusion (154) of the receiver (13), and the leading protrusion (75) is provided with a handle (76) in the form of the rod with a ball at the end, and at the end face of the base (74) a are (77) is disposed to interact with the leading notch (153) of the receiver (13), and the handle (76) is disposed at an angle to the locking lugs (72), and the face end of the cylindrical head (70) has the glazed area (78) to interact with the conical bushing of the bolt (24);

the central blind cylindrical channel (79) is disposed inside the bolt body (25) and configured to interact with the firing hammer (26), the spring of the firing pin latch (22), the firing pin latch (23), and in the rear part of the central cylindrical channel (79), there are two a lead-in slots (80) and a groove (81) to interact with a protrusions (102) of the mainspring latch (28); whereupon in the front end of the central cylindrical channel (79) the through-hole (82) is disposed to interact with the firing pin (21), and at an end (83) of the cylindrical part (67) are made two screwed protrusions (84) with a screwed surfaces (85) configured to interact with firing hammer (26) are disposed, and the cylindrical part (67) has a rectangular hole (86) to interact with a safety lug (179) of the safety (15);

the firing pin latch (23) is made in the form of a washer (87) with a blind hole (88), a through-hole (89) is made behind the blind hole (88), which repeats the shape of the end of the square part (60) with the cylindrical protrusions (61) of the firing pin (21), and in the washer (87) at inlet of the blind hole (88), a spinways (90) are disposed, and the through-hole (89) in the washer (87) forms a projection (91), configured to fix the firing pin latch (23) on the firing pin (21);

the firing hammer (26) is configured as a rod (92) with a groove (93) at one end, and at the other end of the rod (92) the hammer (94) is disposed in the form of the rectangular bar, and a slot (95) is made in the hammer (94) and in the adjacent part of the rod (92), configured to interact with the firing hammer (26) with the mainspring latch (28), and a blind hole (96) is disposed inside the firing hammer (26) to interact with a mainspring (27), and at the bottom of the hammer (94), from the side of the rod (92), the cocking stud area (97) is disposed to interact with a sear platform (297) of the trigger bar (17);

the firing hammer (26K) configured as the rod (92) with a washer (98) with a slots (99) at one end, and a holes (100) are on the side surface of the rod (92), and at the other end of the rod (92), there is a hammer (94) configured as the rectangular bar, and the slot (95) is disposed in hammer (94) and in the adjacent part of the rod (92) to interact with the firing hammer (26K) with the mainspring latch (28), and the blind hole (96) is disposed inside the firing hammer (26K) to interact with the mainspring (27), and at the bottom of the hammer (94), from the side of the rod (92), the cocking stud area (97) is disposed to interact with the sear platform (297) of the trigger bar (17);

the mainspring latch (28) is configured in the form of a rod (101) with the two protrusions (102) at one end of the rod (101), and this end passes into a smaller diameter rod (103), and a blind hole (104) is disposed inside the mainspring latch (28);

a muzzle break (105) contains the lower part of a muzzle break (47) in which an upper part of the muzzle break (48) is mounted, and these parts are interconnected by a screws of the muzzle break (49);

the lower part of the muzzle break (47) is configured in the form of the plate (106) with inside a groove (107) at the inlet, which passes into a threaded section (108), which passes into the groove (107), which passes a smooth conical part (109), and the threaded section (108) and the smooth conical part (109) are configured to fix the barrel (9A), and behind the conical part (109), a smooth cylindrical section (110) is disposed with diameter corresponding to the inner bore of the barrel (121), which passes into a cylindrical groove (112), configured to assemble the upper part of the muzzle break (48), and after the assembly of the muzzle break (105), it forms the lock time chamber (347), and the cylindrical groove (112) passes into an outer tube (113), and in the place of the smooth cylindrical section (110) and the cylindrical groove (112), a two slots (114) are disposed at an acute angle to a longitudinal axis (115) of the muzzle break (105), and two slots (114) in the cross section form an angle (116) between themselves, equal to 80-90 degrees, and the slots (114) in the assembled muzzle break (105) form an inclined channel (349) to ensure creation of the exhaust gas jet stream (352) of the propellants, and a threaded holes (117) are made on the outside of the threaded section (108), configured for the screws of the muzzle break (49) at assembling the muzzle break (105);

the upper part of the muzzle break (48) is configured in the form of a plate (106) with the groove (107) at the inlet, which passes into a threaded section (108), which passes into the groove (107), which passes into the smooth conical part (109), and the threaded section (108) and the smooth conical part (109) are configured to fix the barrel (9A), and behind the conical part (109) the smooth cylindrical section (110) with diameter corresponding to an inner channel of the barrel (121) is disposed, which passes into a cylindrical groove (111), and the cylindrical groove (111) is configured to assemble the lower part of the muzzle break (47) and after assembling the muzzle break (105) the lock time chamber (347) is formed in it, and the cylindrical groove (111) passes into an inner tube (118) with an inner smooth hole (119) with diameter corresponding to the inner channel diameter of the barrel (121), and in the place of the smooth cylindrical section (110) and the cylindrical groove (111), the two slots (114) are configured at an acute angle to the longitudinal axis (115) of the muzzle break (105), and the two slots (114) in the cross section form the angle (116) between themselves, equal to 80-90 degrees, and the slots (114) in the assembled muzzle break (105) form the inclined channel (349) to ensure development of the exhaust gas jet stream (352) of the propellants, and a holes (120) are made on the outside of the threaded section (108), configured for a screws of the muzzle break (49) at assembling the muzzle break (105);

the barrel (9A) has the smooth inner channel (121) without grooves, and from outside it is configured with a smooth cylindrical section (122), which passes into a threaded section with the buttress thread (123), which passes into a circular groove (124), which passes into a smooth cylindrical section (125) with a groove (126) to interact with the barrel latch (10), and the smooth cylindrical section (125) passes into a cylindrical section (127), which passes into a cylindrical section (128) with a slots (129) along the outer perimeter, and all said sections of the barrel (9A) are different in thickness;

the multifunctional cartridge (11) comprising a threaded bushing (133), a spring half-rings (134) configured to interact with the careless ammunition (38), an inner smooth bushing (135) with grooves for the spring half-rings (134), at least one a middle bushing (136) and an outer bushing with variable diameter (137), which has a bigger diameter (138), and the threaded bushing (133) configured with two or more threaded slots, and the bushings (133), (135), (136) and (137) are inserted into each other with tension, and the outer surfaces of the bushings (133), (135), (136) and (137) are polished to a full gloss;

the conical bushing of the receiver (13) has a cylindrical section (139), which passes into a smaller cylindrical section (140), and a conical hole (141) is disposed inside of said conical bushing (141), and configured to interact with the conical bushing of the bolt (24), the small base of which is disposed at the end of the cylindrical section (139);

the receiver (13) is configured with the cylindrical part (142), where at the end of the cylindrical part (142), the multi-layered cylindrical hole with threaded section (143) is configured for mounting of the conical bushing of the receiver (12), installation of the multifunctional cartridge (11) and the barrel, and at the inlet of said multi-layered cylindrical hole with threaded section (143) a cross-threaded hole (144) is configured from the bottom to mount the barrel latch (10), and the said multi-layered cylindrical hole with threaded section (143) passes into a cylindrical groove (145), and the cylindrical groove (145) passes into a complex-shaped section (146), which repeats the shape of the front part of the bolt body (25), and at inlet of the complex-shaped section (146), two cylindrical guiding chamfers (147) are disposed, and on top of the receiver (13) a rail (148) is configured to attach the brackets for different sights, and the rear end of the cylindrical part (142) passes into a complex-shaped bar (149) ended with a console (150) and having a protrusion (151) at its end, in which a hole (152) is disposed to mount the upper screw (36); and also at the point of abutment of the console (150) against the complex-shaped bar (149), the leading notch (153) is made with the protrusion (154) and a slot (155) at the bottom of the leading notch (153) of the complex-shaped bar (149) to interact with a leading protrusion (75) of the bolt body (25), as well as a hole (156) in the complex-shaped bar (149) is configured for the magazine (7), a window (157) to eject the ammunition (38), the guiding slots (158) configured for passage of the locking lugs (72) of the bolt body (25), and also, a stepped through-hole (159), for passage of the bolt body (25) is disposed, and at the junction of the console (150) to the bar of complex-shaped (149) there is a protrusion (160) with a blind hole (161) and the protrusion with a through-hole (162) are configured to interact with the safety (15) and the safety spring (14); between the projection (160) and the projection with the through-hole (162), a e slot (163) is disposed, and a through slot (164) is configured in the projection with the through-hole (162) to mount the safety (15), and a blind slots (165) are configured to fix the safety (15) in the "fire" position and to set and release the bolt (4) from the weapon (1A), and a slot (166) is configured in the console (150) for passage of the firing hammer (26) or (26K), and a trapezoidal hole (167) for passage of the trigger bar (17), as well as a rectangular hole (168) at the bottom of the projection (160) and the projection with a through-hole (162) in the guide slot (158) is configured to mount a fixing plate (178) of the safety (15), and a projection (169) is configured in the lower part of the complex-shaped bar (149) to retain the magazine latch (19) in the open position, and a protrusion (170) with a blind threaded hole (171) is configured for the lower screw (37);

the safety (15) in the form of an axis (172) with a blind hole (173) is configured to interact with the safety spring (14), and the axis (172) passes into a base (174) configured in the form of the plate, and a protrusion (175) is disposed on the base (174) to interact with the blind slot (165) of the receiver (13) to retain the safety (15) in the "fire" position and to set and release the bolt (4) from the weapon (1A), and the base (174) passes into a thumb piece (176) configured in the form of the complex-shaped plate, and a cylindrical protrusion (177) is disposed at the end of the thumb piece (176), where the fixing plate (178) with the safety lug (179) is made at the abutment of the base (174) against the thumb piece (176), configured to interact with the locking lug (72) of the bolt body (25) and to fix the locking lug (72) in the receiver (13), and the safety lug (179) interacts with the rectangular hole (86) of the bolt body (25) and is configured to fix the bolt (4) in the receiver (13), and a conical protrusion (180) on the side surface of the thumb piece (176) is configured to interact with the hammer (94) of the firing hammer (26);

the trigger bar (17) is configured in a complex-shaped plate (294) with a protrusion (295) at one end, and the protrusion (295) has a radius surface (296) and the sear platform (297) configured to interact with the platform of the cocking stud (97) of the firing hammer (26), and at the other end of the plate (294) a trigger bar (298) is disposed in the form of the bracket, and in the center of the plate (294) a protrusion (299) with a through-hole (300) is disposed for the axis (20), and a hole (301) is configured between the protrusion (295) and the protrusion (299) of the plate (294) to interact with a long bent end (292) of the trigger bar spring (18);

the magazine latch (19) is configured in a form of a lever (302) made of complex-shaped plate with a button (303) at one end, and a support platform (304) is made on the button (303), and a console (305) is configured in the form of the rectangular rod at the other end of the lever (302), and a slot (306) is disposed in the center of the console (305) to interact with the trigger bar spring (18), while above the button (303) a protrusion (307) is disposed with a hole (308) and a slot (309) configured to interact with a short bent end (293) of the trigger bar spring (18), as well as a hole (310) to interact with the axis (20);

the trigger guard with the magazine box (16) is configured a form of complex-shaped plate (311) with a cylindrical protrusion (312) with the hole (312A) purposed for the lower screw (37), and a slot (313) at one end, and at the other end of the plate (311) there is a trigger guard (314), a complex-shaped protrusion (315), the slot (313), and the projection (315) has a through-hole (316) configured for the axis (20) and the hole (316A) for the cross screw (34), and a threaded hole (317) is disposed in front of the trigger guard (314) in the plate (311), configured for the upper screw (36), as well as a magazine box (318) is in the center of the plate (311) configured to interact with the magazine (7), and a slot (319) with the inclined platform (320), which are configured to interact with the magazine latch (19);

the handguard (248) is configured in a form of a complex-shaped bar (249) with a complex-shaped through-hole (250) disposed inside to interact with the protrusion (170) of the receiver (13), and a stepped hole (251) is made in the bar (249) configured to interact with the barrel latch (10), and a longitudinal blind hole (252) configured to interact with a threaded bushing of the bipod (33);

the hunting buttstock (6A) containing a buttstock (29A) with a threaded bushings (30), on which a back plate (31A) is installed and fixed with the screws of a back plate (32) in the threaded bushings (30).

2. A caseless magazine weapon (1B), which contains a bolt (4) interacting with a receiver (13), configured to reciprocate and rotate about the axis in a guiding slots (158)

of the receiver (13), and the said receiver (13) is mounted in the hunting gunstock (8) and fixed by a trigger guard with the magazine box (16), an upper screw (36), a lower screw (37), a dowel screw (39) and a nut of the dower screw (40), and, in the trigger guard with magazine box (16), a magazine (7) is installed; a trigger bar (17) is installed on an axis (20) configured for axial rotation, and interacting with a firing hammer (26); a trigger bar spring (18) and a magazine latch (19) on the axis (20) are configured to ensure axial rotation, and the said trigger bar (17) and the magazine latch (19) are spring-loaded by the trigger bar spring (18), and the magazine latch (19) interacts with the magazine (7), and a conical bushing (12) of a receiver (13) is mounted in the receiver (13) and a multifunctional cartridge (11) is mounted on said conical bushing of the receiver (12);

a barrel (9A) with rear end screwed into the receiver (13) and fixed with a barrel latch (10);

a safety (15), loaded through a safety spring (14), which is disposed in the receiver (13) and configured to reciprocate and to rotate about the axis;

a handguard 248, wherein the bolt (4) contains a firing pin (21), which is mounted in a conical bushing of the bolt (24), which is configured to rotate on the firing pin (21) and at the same time, it is permanently pressed by a spring of the firing pin latch (22) to a bolt body (25), and the firing pin (21) is installed in a through-hole (82) of the bolt body (25) with ability to reciprocate; it is spring-loaded by the spring of the firing pin latch (22) and fixed by a firing pin latch (23), inserted into a central blind cylindrical channel (79) of the bolt body (25) and configured to reciprocate, and the bolt (4) contains the firing hammer (26) installed into the central blind cylindrical channel (79) and configured for reciprocal motion; and the mainspring capable to compress and expand in the firing hammer (26) is disposed inside the firing hammer (26) and fixed by a mainspring latch (28) in the bolt body (25);

the firing pin (21) is configured in the form of stepped shaft, which has a part (52) at front of it, which passes into a cylindrical part with the smaller diameter (53), and an inclined protrusion (54) is formed at the joint of the conical part (52) and the cylindrical part with the smaller diameter (53), and the angle of the inclined protrusion (d54) relative to the axis of the firing pin (55) is equal to 30-45 degrees, and the cylindrical part with the smaller diameter (53) passes into a cylindrical part with the bigger diameter (56), which passes into a cylindrical piston (57), and said the cylindrical piston (57) passes into a rod section with the grooves (58), where a rear groove (59) passes into a square part (60) with a cylindrical protrusions (61) disposed at the end of the square part (60), and the rear grooves (59), the square part (60) and the cylindrical protrusions (61) interact with the firing pin latch (23);

the conical bushing of the bolt (24) is configured to rotate on the firing pin (21) and pressed by the spring of the firing pin latch (22) to a glazed area (78) at the end of a cylindrical head (70) of the bolt body (25), and the said conical bushing of the bolt (24) is configured in the form of a truncated cone (62) with a blind conical hole (63), which passes into a hole (64), which forms the wall (65) at the outlet of the big base of the truncated cone (62), and at inlet of the blind conical hole (63) there are at least three a protrusions (66), which interact with a caseless ammunition (38);

the bolt body (25) has a cylindrical part (67), which passes into a thinner cylindrical part (68), where a slots (69) are disposed along the perimeter of outer part of the thinner cylindrical part (68), and the thinner cylindrical part (68) passes into the cylindrical head (70), and a chamfer (71) is disposed at the passage from the cylindrical part (67) into the thinner cylindrical part (68), and at the passage from the thinner cylindrical part (68) into the cylindrical head (70) a locking lugs (72) are made in the form of two protrusions with the ends made in the form of a radius surfaces (73), and the corbelling protrusion consisting of a base (74) and the leading protrusion (75), configured to interact with a leading notch (153) of the receiver (13), and the leading protrusion (75) is the third locking lug of the bolt (4) and interacts with the protrusion (154) of the receiver (13), and the leading protrusion (75) is provided with a handle (76) in the form of the rod with a ball at the end, and at the end face of the base (74) a area (77) is disposed to interact with the leading notch (153) of the receiver (13), and the handle (76) is disposed at an angle to the locking lugs (72), and the face end of the cylindrical head (70) has the glazed area (78) to interact with the conical bushing of the bolt (24);

the central blind cylindrical channel (79) is disposed inside the bolt body (25) and configured to interact with the firing hammer (26), the spring of the firing pin latch (22), the firing pin latch (23), and in the rear part of the central cylindrical channel (79), there are two a lead-in slots (80) and a groove (81) to interact with a protrusions (102) of the mainspring latch (28); whereupon in the front end of the central cylindrical channel (79) the through-hole (82) is disposed to interact with the firing pin (21), and at an end (83) of the cylindrical part (67) are made two screwed protrusions (84) with a screwed surfaces (85) configured to interact with firing hammer (26) are disposed, and the cylindrical part (67) has a rectangular hole (86) to interact with a safety lug (179) of the safety (15);

the firing pin latch (23) is made in the form of a washer (87) with a blind hole (88), a through-hole (89) is made behind the blind hole (88), which repeats the shape of the end of the rectangular part (60) with the cylindrical protrusions (61) of the firing pin (21), and in the washer (87) at inlet of the blind hole (88), a spinways (90) are disposed, and the through-hole (89) in the washer (87) forms a projection (91), configured to fix the firing pin latch (23) on the firing pin (21);

the firing hammer (26) is configured as a rod (92) with a grooves (93) at one end, and at the other end of the rod (92) the hammer (94) is disposed in the form of the rectangular bar, and a slot (95) is made in the hammer (94) and in the adjacent part of the rod (92), configured to interact with the firing hammer (26) with the mainspring latch (28), and a blind hole (96) is disposed inside the firing hammer (26) to interact with a mainspring (27), and at the bottom of the hammer (94), from the side of the rod (92), the cocking stud area (97) is disposed to interact with a sear platform (297) of the trigger bar (17);

the firing hammer (26K) configured as the rod (92) with a washer (98) with a slots (99) at one end, and a holes (100) are on the side surface of the rod (92), and at the other end of the rod (92), there is a hammer (94) configured as the rectangular bar, and the slot (95) is disposed in hammer (94) and in the adjacent part of the rod (92) to interact with the firing hammer (26K) with the mainspring latch (28), and the blind hole (96) is disposed inside the firing hammer (26K) to interact with the mainspring (27), and at the bottom of the hammer (94), from the side of the rod (92), the cocking stud area (97) is disposed to interact with the sear platform (297) of the trigger bar (17);

the mainspring latch (28) is configured in the form of a rod (101) with the two protrusions (102) at one end of the rod (101), and this end passes into a smaller diameter rod (103), and a blind hole (104) is disposed inside the mainspring latch (28);

a muzzle break (105) contains a lower part of the muzzle break (47), in which an upper part of the muzzle break (48) is mounted, and these parts are interconnected by the screws of the muzzle break (49);

the lower part of the muzzle break (47) is configured in the form of the plate (106) with inside a groove (107) at the inlet, which passes into a threaded section (108), which passes into the groove (107), which passes into a smooth conical part (109), and the threaded section (108) and the smooth conical part (109) are configured to fix the barrel (9A), and behind the conical part (109), a smooth cylindrical section (110) is disposed with diameter corresponding to an inner channel of the barrel (121), which passes into a cylindrical groove (112), configured to assemble the upper part of the muzzle break (48), and after the assembly of the muzzle break (105), it forms the lock time chamber (347), and the cylindrical groove (112) passes into an outer tube (113), and in the place of the smooth cylindrical section (110) and the cylindrical groove (112), a two slots (114) are disposed at an acute angle to a longitudinal axis (115) of the muzzle break (105), and the two slots (114) in the cross section form an angle (116) between themselves, equal to 80-90 degrees, and the slots (114) in the assembled muzzle break (105) form an inclined channel (349) to ensure development of the exhaust gas jet stream (352) of the propellants, and a threaded holes (117) are made on the outside of the threaded section (108), configured for the screws of a muzzle break (49) at assembling the muzzle break (105);

the upper part of the muzzle break (48) is configured in the form of a plate (106) with the groove (107) at the inlet, which passes into a threaded section (108), which passes into the groove (107), which passes into the smooth conical part (109), and the threaded section (108) and the smooth conical part (109) are configured to fix the barrel (9A), and behind the conical part (109) the smooth cylindrical section (110) with diameter corresponding to the inner channel of the barrel (121) is disposed, which passes into a cylindrical groove (111), and the cylindrical groove (111) is configured to assemble the lower part of the muzzle break (47) and after assembling the muzzle break (105) the lock time chamber (347) is formed in it, and the cylindrical groove (111) passes into the inner tube (118) with an inner smooth hole (119) with diameter corresponding to the inner channel diameter of the barrel (121), and in the place of the smooth cylindrical section (110) and the cylindrical groove (111), the two slots (114) are configured at an acute angle to the longitudinal axis (115) of the muzzle break (105), and the two slots (114) in the cross section form the angle (116) between themselves, equal to 80-90 degrees, and the slots (114) in the assembled muzzle break (105) form an inclined channel (349) to ensure development of the exhaust gas jet stream (352) of the propellants, and a holes (120) are made on the outside of the threaded section (108), configured for the screws of the muzzle break (49) at assembling the muzzle break (105);

the barrel (9A) has the smooth inner channel (121) without grooves, and from outside it is configured with a smooth cylindrical section (122), which passes into a threaded section with a buttress thread (123), which passes into a circular groove (124), which passes into a smooth cylindrical section (125) with a groove (126) to interact with the barrel latch (10), and the smooth cylindrical section (125) passes into a cylindrical section (127), which passes into a cylindrical section (128) with a slots (129) along the outer perimeter, and all said sections of the barrel (9A) are different in thickness;

the multifunctional cartridge (11) comprising a threaded bushing (133), a spring half-rings (134) configured to interact with the careless ammunition (38), a inner smooth bushing (135) with grooves for the spring half-rings (134), at least one a middle bushing (136) and an outer bushing with variable diameter (137), which has a bigger diameter (138), and the threaded bushing (133) configured with two or more threaded slots, and the bushings (133), (135), (136) and (137) are inserted into each other with tension, and the outer surfaces of the bushings (133), (135), (136) and (137) are polished to a full gloss;

the conical bushing of the receiver (13) has a cylindrical section (139), which passes into a smaller cylindrical section (140), and a conical hole (141) is disposed inside of said conical bushing (141), and configured to interact with the conical bushing of the bolt (24), the small base of which is disposed at the end of the cylindrical section (139);

the receiver (13) is configured with cylindrical part (142), where at the end of the cylindrical part (142), the multi-layered cylindrical hole with threaded section (143) is configured for mounting of the conical bushing of the receiver (12), installation of the multifunctional cartridge (11) and the barrel, and at the inlet of said multi-layered cylindrical hole with threaded section (143) a cross-threaded hole (144) is configured from the bottom to mount the barrel latch (10), and the said multi-layered cylindrical hole with threaded section (143) passes into a cylindrical groove (145), and the cylindrical groove (145) passes into a complex-shaped section (146), which repeats the shape of the front part of the bolt body (25), and at inlet of the complex-shaped section (146), two cylindrical guiding chamfers (147) are disposed, and on top of the receiver (13) a rail (148) is configured to attach the brackets for different sights, and the rear end of the cylindrical part (142) passes into a complex-shaped bar (149), ended with a console (150) having a protrusion (151) at its end, in which a hole (152) is disposed to mount the upper screw (36); and also at the point of abutment of the console (150) against the complex-shaped bar (149), a leading notch (153) is made with the protrusion (154) and a slot (155) at the bottom of the leading notch (153) of the complex-shaped bar (149) to interact with the leading protrusion (75) of the bolt body (25), as well as a hole (156) in the complex-shaped bar (149) is configured for the magazine (7), a window (157) to eject the ammunition (38), the guiding slots (158) configured for passage of the locking lugs (72) of the bolt body (25), and also, f stepped through-hole (159) for passage of the bolt body (25), and at the junction of the console (150) to the bar of complex-shaped (149) there is a protrusion (160) with a blind hole (161) and the protrusion with a through-hole (162) are configured to interact with the safety (15) and the safety spring (14); between the projection (160) and the projection with the through-hole (162), a slot (163) is disposed, and a through slot (164) is configured in the projection with the through-hole (162) to mount the safety (15), and a blind slots (165) are configured to fix the safety (15) in the "fire" position and to set and release the bolt (4) from the weapon (1C), and a slot (166) is configured in the console (150) for passage of the firing hammer (26) or (26K)), and a trapezoidal hole (167) for passage of the trigger bar (17), as well as a rectangular hole (168) at the bottom of the projection (160) and the projection with a through-hole (162) in the guide slot (158) is configured to mount a fixing plate (178) of the safety (15), and a projection (169) is configured in the lower part of the complex-shaped bar (149) to retain the magazine latch (19) in the open position, and a protrusion (170) with a blind threaded hole (171) configured for the lower screw (37);

the safety (15) in the form of an axis (172) with a blind hole (173) is configured to interact with the safety spring (14), and the axis (172) passes into a base (174) configured in the form of the plate, and a protrusion (175) is disposed on the base (174) to interact with the blind slot (165) of the receiver (13) to retain the safety (15) in the "fire" position and to set and release the bolt (4) from the weapon (1A), and the base (174) passes into a thumb piece (176) configured in the form of the complex-shaped plate, and a cylindrical protrusion (177) is disposed at the end of the thumb piece (176), where the fixing plate (178) with the safety lug (179) is made at the abutment of the base (174) against the thumb piece (176), configured to interact with the locking lug (72) of the bolt body (25) and to fix the locking lug (72) in the receiver (13), and the safety lug (179) interacts with the rectangular hole (86) of the bolt body (25) and is configured to fix the bolt (4) in the receiver (13), and a conical protrusion (180) on the side surface of the thumb piece (176) is configured to interact with the hammer (94) of the firing hammer (26);

the trigger bar (17) is configured in a form of a complex-shaped plate (294) with a protrusion (295) at one end, and the protrusion (295) has a radius surface (296) and the sear platform (297) configured to interact with the platform of the cocking stud (97) of the firing hammer (26), and at the other end of the plate (294) a trigger bar (298) is disposed in the form of the bracket, and in the center of the plate (294) a protrusion (299) with a through-hole (300) is disposed for the axis (20), and a hole (301) is configured between the protrusion (295) and the protrusion (299) of the plate (294) to interact with a long bent end (292) of the trigger bar spring (18);

the magazine latch (19) is configured in a form of a lever (302) made of complex-shaped plate with a button (303) at one end, and a support platform (304) is made on the button (303), and a console (305) is configured in the form of the rectangular rod at the other end of the lever (302), and a slot (306) is disposed in the center of the console (305) to interact with the trigger bar spring (18), while above the button (303) a protrusion (307) is disposed with a hole (308) and a slot (309) configured to interact with a short bent end (293) of the trigger bar spring (18), as well as a hole (310) to interact with the axis (20);

the trigger guard with the magazine box (16) is configured in a form of complex-shaped plate (311) with a cylindrical protrusion (312) with the hole (312A) purposed for the lower screw (37), and a slot (313), and at the end of the plate (311), a trigger guard (314), a complex-shaped protrusion (315), the slot (313) are disposed, and the projection (315) has a through-hole (316) configured for the axis (20) and the hole (316A) for the cross screw (34), and a threaded hole (317) is disposed in front of the trigger guard (314) in the plate (311), configured for the upper screw (36), as well as a magazine box (318) is in the centre of the plate (311) configured to interact with the magazine (7), and a slot (319) with the inclined platform (320) is configured to interact with the magazine latch (19);

the handguard (248) is configured in a form of a complex-shaped bar (249) with a complex-shaped through-hole (250) disposed inside to interact with the protrusion (170) of the receiver (13), and a stepped hole (251) is made in the bar (249) configured to interact with the barrel latch (10), and a longitudinal blind hole (252) configured to interact with the threaded bushing of the bipod (33);

the hunting gunstock containing the gunstock (8) with a threaded bushings (30), on which a back plate (31A) is installed and fixed with the screws of a back plate (32) in the threaded bushings (30), and also the threaded bushing (33) is installed in the gunstock (8).

3. A caseless magazine weapon (1C), which contains a bolt (4) interacting with a receiver (13), configured to reciprocate and rotate about the axis in a guiding slots (158) of the receiver (13), and the said receiver (13) is mounted in a skeletal buttstock (29C), a handguard (248), and fixed by a trigger guard with the magazine box (16), an upper screw (36) and a lower screw (37), and the skeletal buttstock (29C) is fixed by a cross screw (34), the nut of the cross screw (35), and, in the trigger guard with magazine box (16), a magazine (7) is installed; the trigger bar (17) is installed on an axis (20) and configured for axial rotation, and interacting with a firing hammer (26), a trigger bar spring (18) and a magazine latch (19) on the axis (20), configured to ensure axial rotation, and the said trigger bar (17) and the magazine latch (19) are spring-loaded by the trigger bar spring (18), and the magazine latch (19) interacts with the magazine (7), and a conical bushing (12) of a receiver (13) is mounted in the receiver (13) and a multifunctional cartridge (11) is mounted on said conical bushing of the receiver (12);

a barrel (9C) with the muzzle break (105) screwed on the front end of it and fixed by the screws of the muzzle break (49), and the rear end is screwed into the receiver (13) and fixed by a barrel latch (10);

a safety (15), spring-loaded through a safety spring (14), which is disposed in the receiver (13) and configured to reciprocate and to rotate about the axis;

fixed at front side by a latch of the bipod (51) in the handguard (248) a folding adjustable bipod (50);

an adjustable cheek piece (42) fixed on the skeletal buttstock (29C) by a latches of adjustable cheek piece (43);

a adjustable back plate (31C) fixed on the skeletal buttstock (29C) by a latch of the adjustable back plate (41);

the handguard (248), wherein the bolt (4) contains a firing pin (21), which is mounted in a conical bushing of the bolt (24) and configured to rotate on the firing pin (21) and at the same time, it is permanently pressed by the spring of the firing pin latch (22) to a bolt body (25), and the firing pin (21) is installed in a through-hole (82) of the bolt body (25) with ability to reciprocate; it is loaded by the spring of the firing pin latch (22) and fixed by a firing pin latch (23), inserted into a central blind cylindrical channel (79) of the bolt body (25) and configured to reciprocate, and the bolt (4) contains the firing hammer (26) installed into the central blind cylindrical channel (79) and configured for reciprocal motion; and the mainspring capable to compress and expand in the firing hammer (26) is disposed inside the firing hammer (26) and fixed by a mainspring latch (28) in the bolt body (25);

the firing pin (21) is configured in the form of stepped shaft, which has a conical part (52) at front, which passes into a cylindrical part with the smaller diameter (53), and an inclined protrusion (54) is formed at the joint of the conical part (52) and the cylindrical part with the smaller diameter (53), and the angle of the inclined protrusion (d54) relative to the axis of the firing pin (55) is equal to 30-45 degrees, and the cylindrical part with the smaller diameter (53) passes into a cylindrical part with the bigger diameter (56), which passes into a cylindrical piston (57), and said the cylindrical piston (57) passes into the rod section with the grooves (58), where a rear groove (59) passes into a square part (60) with a cylindrical protrusions (61) disposed at the end of the square part (60), and the rear grooves (59), the square part (60) and the cylindrical protrusions (61) interact with the firing pin latch (23);

the conical bushing of the bolt (24) is configured to rotate on the firing pin (21) and pressed by the spring of the firing pin latch (22) to a glazed area (78) at the end of a cylindrical head (70) of the bolt body (25), and the said conical bushing of the bolt (24) is configured in the form of a truncated cone (62) with a blind conical hole (63), which passes into a hole (64), which forms the wall (65) at the outlet of the big base of the truncated cone (62), and at inlet of the blind conical hole (63) there are at least three a protrusions (66), which interact with a caseless ammunition (38);

the bolt body (25) has a cylindrical part (67), which passes into a thinner cylindrical part (68), where a slots (69) are disposed along the perimeter of outer part of the thinner cylindrical part (68), and the thinner cylindrical part (68) passes into the cylindrical head (70), and a chamfer (71) is disposed at the passage from the cylindrical part (67) into the thinner cylindrical part (68), and at the passage from the thinner cylindrical part (68) into the cylindrical head (70) a locking lugs (72) are made in the form of two protrusions with the ends made in the form of a radius surfaces (73), and the corbelling protrusion consisting of a base (74) and a leading protrusion (75), configured to interact with the leading notch (153) of the receiver (13), and the leading protrusion (75) is the third locking lug of the bolt (4) and interacts with the protrusion (154) of the receiver (13), and the leading protrusion (75) is provided with a handle (76) in the form of the rod with a ball at the end, and at the end face of the base (74) a area th(77) is disposed to interact with the leading notch (153) of the receiver (13), and the handle (76) is disposed at an angle to the locking lugs (72), and the face end of the cylindrical head (70) has the glazed area (78) to interact with the conical bushing of the bolt (24);

the central blind cylindrical channel (79) is disposed inside the bolt body (25) and configured to interact with the firing hammer (26), the spring of the firing pin latch (22), the firing pin latch (23), and in the rear part of the central cylindrical channel (79), there are two a lead-in slots (80) and a groove (81) to interact with a protrusions (102) of the mainspring latch (28); whereupon in the front end of the central cylindrical channel (79) the through-hole (82) is disposed to interact with the firing pin (21), and at an end (83) of the cylindrical part (67) are made two screwed protrusions (84) with a screwed surfaces (85) configured to interact with firing hammer (26) are disposed, and the cylindrical part (67) has a rectangular hole (86) to interact with a safety lug (179) of the safety (15);

the firing pin latch (23) is made in the form of a washer (87) with a blind hole (88), a through-hole (89) is made behind the blind hole (88), which repeats the shape of the end of the square part (60) with the cylindrical protrusions (61) of the firing pin (21), and in the washer (87) at inlet of the blind hole (88), a spinways (90) are disposed, and the through-hole (89) in the washer (87) forms a projections (91), configured to fix the firing pin latch (23) on the firing pin (21);

the firing hammer (26) is configured as a rod (92) with a grooves (93) at one end, and at the other end of the rod (92) the hammer (94) is disposed in the form of the rectangular bar, and a slot (95) is made in the hammer (94) and in the adjacent part of the rod (92), configured to interact with the firing hammer (26) with the mainspring latch (28), and a blind hole (96) is disposed inside the firing hammer (26) to interact with a mainspring (27), and at the bottom of the hammer (94), from the side of the rod (92), the cocking stud area (97) is disposed to interact with a sear platform (297) of the trigger bar (17);

the firing hammer (26K) configured as the rod (92) with a washer (98) with a slots (99) at one end, and a holes (100) are on the side surface of the rod (92), and at the other end of the rod (92), there is a hammer (94) configured as the rectangular bar, and the slot (95) is disposed in hammer (94) and in the adjacent part of the rod (92) to interact with the firing hammer (26K) with the mainspring latch (28), and the blind hole (96) is disposed inside the firing hammer (26K) to interact with the mainspring (27), and at the bottom of the hammer (94), from the side of the rod (92), the cocking stud area (97) is disposed to interact with the sear platform (297) of the trigger bar (17);

the mainspring latch (28) is configured in the form of a rod (101) with the two protrusions (102) at one end of the rod (101), and this end passes into a smaller diameter rod (103), and a blind hole (104) is disposed inside the mainspring latch (28);

the muzzle break (105) contains a lower part of the muzzle break (47), in which an upper part of the muzzle break (48) is mounted, and these parts are interconnected by the screws of the muzzle break (49);

the lower part of the muzzle break (47) is configured in the form of the plate (106) with inside a groove (107) at the inlet, which passes into the threaded section (108), which passes into the groove (107), which passes into a smooth conical part (109), and the threaded section (108) and the smooth conical part (109) are configured to fix the barrel (9A), and behind the conical part (109), a smooth cylindrical section (110) is disposed with diameter corresponding to an inner channel of the barrel (121), which passes into a cylindrical groove (112), configured to assemble the upper part of the muzzle break (48), and after the assembly of the muzzle break (105), it forms the lock time chamber (347), and the cylindrical groove (112) passes into an outer tube (113), and in the place of the smooth cylindrical section (110) and the cylindrical groove (112), a two slots (114) are disposed at an acute angle to a longitudinal axis (115) of the muzzle break (105), and the two slots (114) in the cross section form an angle (116) between themselves, equal to 80-90 degrees, and the slots (114) in the assembled muzzle break (105) form an inclined channel (349) to ensure development of the exhaust gas jet stream (352) of the propellants, and a threaded holes (117) are made on the outside of the threaded section (108), configured for the screws of a muzzle break (49) at assembling the muzzle break (105);

the upper part of the muzzle break (48) is configured in the form of a plate (106) with the groove (107) at the inlet, which passes into a threaded section (108), which passes into the groove (107), which passes into the smooth conical part (109), and the threaded section (108) and the smooth conical part (109) are configured to fix the barrel (9A), and behind the conical part (109) the smooth cylindrical section (110) with diameter corresponding to the inner channel of the barrel (121) is disposed, which passes into a cylindrical groove (111), and the cylindrical groove (111) is configured to assemble the lower part of the muzzle break (47) and after assembling the muzzle break (105) the lock time chamber (347) is formed in it, and the cylindrical groove (111) passes into an inner tube (118) with an inner smooth hole (119) with diameter corresponding to the inner channel diameter of the barrel (121), and in the place of the smooth cylindrical section (110) and the cylindrical groove (111), the two slots (114) are configured at an acute angle to the longitudinal axis (115) of the muzzle break (105), and two slots (114) in the cross section form the angle (116) between themselves, equal to 80-90 degrees, and the slots (114) in the assembled muzzle break (105) form the inclined channel (349) to ensure development of the exhaust gas jet stream (352) of the propellants, and a holes (120) are made on the outside of the threaded section (108), configured for the screws of the muzzle break (49) at assembling the muzzle break (49);

the barrel (9C) has the smooth inner channel (121) without grooves, and from outside it is configured with a smooth cylindrical section (122), which passes into a threaded section with the buttress thread (123), which passes into a circular groove (124), which passes into a smooth cylindrical section (125) with a groove (126) to interact with the barrel latch (10), and the smooth cylindrical section (125) passes into a cylindrical section (127), which passes into a cylindrical section (128) with a slots (129) along the outer perimeter, which passes into a slot (130), and all said sections of the barrel (9C) are different in thickness;

the multifunctional cartridge (11) comprising a threaded bushing (133), a spring half-rings (134) configured to interact with the careless ammunition (38), a inner smooth bushing (135) with grooves for the spring half-rings (134), at least one a middle bushing (136) and an outer bushing with variable diameter (137), which has a bigger diameter (138), and the threaded bushing (133) configured with two or more threaded slots, and the bushings (133), (135), (136) and (137) are inserted into each other with tension, and the outer surfaces of the bushings (133), (135), (136) and (137) are polished to a full gloss;

the conical bushing of the receiver (13) has a cylindrical section (139), which passes into a smaller cylindrical section (140), and a conical hole (141) is disposed inside of said conical bushing (141), and configured to interact with the conical bushing of the bolt (24), the small base of which is disposed at the end of the cylindrical section (139);

the receiver (13) is configured with cylindrical part (142), where at the end of the cylindrical part (142), the multi-layered cylindrical hole with threaded section (143) is configured for mounting of the conical bushing of the receiver (12), installation of the multifunctional cartridge (11) and the barrel, and at the inlet of said multi-layered cylindrical hole with threaded section (143) a cross-threaded hole (144) is configured from the bottom to mount the barrel latch (10), and the said multi-layered cylindrical hole with threaded section (143) passes into a cylindrical groove (145), and the cylindrical groove (145) passes into a complex-shaped section (146), which repeats the shape of the front part of the bolt body (25), and at inlet of the complex-shaped section (146), two cylindrical guiding chamfers (147) are disposed, and on top of the receiver (13) a rail (148) is configured to attach the brackets for different sights, and the rear end of the cylindrical part (142) passes into a complex-shaped bar (149), ended with a console (150) having a protrusion (151) at its end, in which a hole (152) is disposed to mount the upper screw (36); and also at the point of abutment of the console (150) against the complex-shaped bar (149), the leading notch (153) is made with a protrusion (154) and a slot (155) at the bottom of the leading notch (153) of the complex-shaped bar (149) to interact with the leading protrusion (75) of the bolt body (25), as well as a hole (156) in the complex-shaped bar (149) is configured for the magazine (7), a window (157) to eject the ammunition (38), the guiding slots (158) configured for passage of the locking lugs (72) of the bolt body (25), and also, a stepped through-hole (159) for passage of the bolt body (25), and at the junction of the console (150) to the bar of complex-shaped (149) there is a protrusion (160) with a blind hole (161) and the protrusion with a through-hole (162) are configured to interact with the safety (15) and the safety spring (14); between the projection (160) and the projection with the through-hole (162), a slot (163) is disposed, and a through slot (164) is configured in the projection with the through-hole (162) to mount the safety (15), and a blind slots (165) are configured to fix the safety (15) in the "fire" position and to set and release the bolt (4) from the weapon (1C), and a slot (166) is configured in the console (150) for passage of the firing hammer (26) or (26K)), and a trapezoidal hole (167) for passage of the trigger bar (17), as well as a rectangular hole (168) at the bottom of the projection (160) and the projection with the through-hole (162) in the guide slot (158) is configured to mount a fixing plate (178) of the safety (15), and a projection (169) is configured in the lower part of the complex-shaped bar (149) to retain the magazine latch (19) in the open position, and a protrusion (170) with a blind threaded hole (171) configured for the lower screw (37);

the safety (15) in the form of an axis (172) with a blind hole (173) is configured to interact with the safety spring (14), and the axis (172) passes into a base (174)

configured in the form of the plate, and a protrusion (175) is disposed on the base (174) to interact with the blind slot (165) of the receiver (13) to retain the safety (15) in the "fire" position and to set and release the bolt (4) from the weapon (1A), and the base (174) passes into a thumb piece (176) configured in the form of the complex-shaped plate, and a cylindrical protrusion (177) is disposed at the end of the thumb piece (176), where the fixing plate (178) with the safety lug (179) is made at the abutment of the base (174) against the thumb piece (176), configured to interact with the locking lug (72) of the bolt body (25) and to fix the locking lug (72) in the receiver (13), and the safety lug (179) interacts with the rectangular hole (86) of the bolt body (25) and is configured to fix the bolt (4) in the receiver (13), and a conical protrusion (180) on the side surface of the thumb piece (176) is configured to interact with the hammer (94) of the firing hammer (26);

the trigger bar (17) is configured in a form of a complex-shaped plate (294) with a protrusion (295) at one end, and the protrusion (295) has a radius surface (296) and the sear platform (297) configured to interact with the platform of the cocking stud (97) of the firing hammer (26), and at the other end of the plate (294) a trigger bar (298) is disposed in the form of the bracket, and in the center of the plate (294) a protrusion (299) with a through-hole (300) is disposed for the axis (20), and a hole (301) is configured between the protrusion (295) and the protrusion (299) of the plate (294) to interact with a long bent end (292) of the trigger bar spring (18);

the magazine latch (19) is configured in a form of a lever (302) made of complex-shaped plate with a button (303) at one end, and a support platform (304) is made on the button (303), and a console (305) is configured in the form of the rectangular rod at the other end of the lever (302), and a slot (306) is disposed in the center of the console (305) to interact with the trigger bar spring (18), while above the button (303) a protrusion (307) is disposed with a hole (308) and a slot (309) configured to interact with a short bent end (293) of the trigger bar spring (18), as well as a hole (310) to interact with the axis (20);

the trigger guard with the magazine box (16) is configured in a form of complex-shaped plate (311) with a cylindrical protrusion (312) with the hole (312A) purposed for the lower screw (37), and a slot (313) at one end, and at the other end of the plate (311) there is a trigger guard (314), a complex-shaped protrusion (315), the slot (313), and the projection (315) has a through-hole (316) configured for the axis (20) and the hole (316A)— for the cross screw (34), and a threaded hole (317) is disposed in front of the trigger guard (314) in the plate (311), configured for the upper screw (36), as well as a magazine box (318) is in the centre of the plate (311) configured to interact with the magazine (7), and a slot (319) with the inclined platform (320), which are configured to interact with the magazine latch (19);

the handguard (248) is configured in the form of the complex-shaped bar (249) with a complex-shaped through-hole (250) disposed inside to interact with the protrusion (170) of the receiver (13), and a stepped hole (251) is made in the bar (249) configured to interact with the barrel latch (10), and a longitudinal blind hole (252) configured to interact with a threaded bushing of the bipod (33);

the folding adjustable bipod (50) contains a bipod bracket (253) configured for axial rotation on the latch of the bipod—(51), bipod stubs (255) installed on the bipod bracket (25) and fixed with screws of bipod stubs (254), and they are configured for axial rotation on the screws of the bipod stubs (254); it also contains bipod stubs latches (256) configured to reciprocate and is spring-loaded by plate springs (257), and interact at the same time with the bipod bracket (253) and the bipod stubs (255), it also contains conical nuts (258) and withdrawable locks (259);

the bipod bracket (253) is configured in a form of a flat bent plate (260) of complex shape with the protrusions (261) at the ends, and through-holes (262) are disposed in the protrusions (261) and configured for the screws of the bipod stubs (254), and semi-circular conical holes (263) are disposed on the external walls of the protrusions (261) configured for interaction and fixing the bipod stubs (255) in the bipod bracket (253) by the bipod stubs latch (256), and the external walls of the protrusions (261) are configured radius (264), and through-hole (265) configured to interact with the latch of the bipod (51) is disposed in a center of the flat bent plate (260);

the bipod stubs latch (256) is configured in the form of the stepped cylinder, which starts from a release button (266), which passes into a cylindrical part (267) with a smaller diameter, which passes into a cylindrical part (268) with a smaller diameter, which passes into a conic-cylindrical part (269) with a larger diameter, which passes into a cylindrical part (270) with a smaller diameter, which ends with a washer (271);

the bipod stub (255) is configured in the form of a complex-shaped plate (272), which passes into a tube (273), and a through slot (274) is disposed in the upper part of the plate (272) and configured to interact with the bipod bracket (253), as well as a through threaded hole (275) configured to interact with the screw of the bipod stub (254), and a through-hole (276) is disposed in the lower part of the plate (272) to interact with the bipod stubs latch (256), and the tube (273) passes into a cylindrical section with an outer thread (277), which passes into a radius groove (278), and the groove (278) passes into the conical head with through cross slots (279), which form lugs of retaining clamps (280), and a cylindrical protrusion (281) is disposed at the ends of the lugs of the retaining clamps (280) configured to fix the withdrawable lock (259), and a longitudinal hole (282) is disposed inside the bipod stub (255) configured to interact with the withdrawable lock (259);

the conical nut (258) is configured in the form of a cylindrical section with a notch (283), which passes into a conical section (284), a threaded section (285) is disposed inside the cylindrical section (283), which passes into a groove (286), which passes into an inner conical section (287);

the withdrawable lock (259) is configured in a form of a rod (288) with a cylinder-conical head (289) at one end, and a cylindrical head (290) at the other end, with grooves (291) disposed along the entire length of the rod (288);

the skeletal buttstock (29C) is configured in the form of a complex-shaped bar (181) with a through hole (182) disposed inside, which has formed a firing handle (183), a rack (184), a lower jumper (185), a upper jumper (186), and a console (187) is disposed in the bar (181) at the side of the rack (184), and a grasp (188) is configured in the bar (181) at the side of the firing handle (183), and a blind longitudinal hole (189) is disposed in the console (187) to interact with the adjustable back plate (31C), and a threaded holes (190) to interact with the latch of the adjustable back plate (41), besides, the side surfaces of the console (187) has the rows of a spherical recesses (191) to interact with a retaining pin (212) for the adjustable back plate latch (41), and a slots (192) are disposed inside the grasp (188) configured to mount the receiver (13), and a slots (193) configured to mount the trigger guard with magazine box (16), and a cross hole (194) is disposed in the grasp (188) configured to mount the cross screw (34) and the nut of the cross screw (35), and also a vertical hole (195) is made to mount the upper screw of the trigger guard with the magazine box (36), and a hole (196) is disposed in a rack (184) to mount a threaded bushing of the stop lock (46), which passes into a conical hole (197) configured to interact with the stop lock (45), and the conical hole (197) passes into a blind hole (198) configured to interact with a stop (44);

the stop lock (45) is configured in the form of a cylindrical section with the notches (199), which passes into a groove (200), which passes into a cylindrical section with an outer thread (201), which passes into a radius groove (202), which passes into the conical head with the through cross slots (203), which form the lugs of the retaining clamps (204), and a cylindrical protrusion (205) is made at the ends of the lugs of the retaining clamps (204), which is configured to fix the stop (44), and a hole (206) is made inside the stop lock (45) to interact with the stop (44);

the stop (44) is configured in the form of a rod (207) with a cylindrical head (208) at one end with the disk with notches at the other end, and the grooves (210) are disposed along the entire length of the rod (207);

the latch of the adjustable back plate (41) containing an adjusting screw (211), in which a blind hole (218) with a threaded section (219) and a through-hole (220) is disposed, the retaining pin (212) configured to reciprocate is spring-loaded by a retaining pin spring (213), and the retaining pin spring (213) interacts with the retaining pin (212) at one side and fixed by a stop screw (214) at another side, it is capable to compress and expand in the blind hole (218);

the adjusting screw (211) is configured in the form of a threaded rod (215) with a cylindrical head (216), with a semi-circular slots (217), and the blind hole (218) with the threaded section (219) is disposed inside the adjusting screw (211), and the blind hole (218) passes into the through-hole (220);

the adjustable back plate (31C) contains a back plate bracket (221) into which a back plate extension piece (222) and a back plate (223) are installed, which are connected to the back plate bracket (221) by the back plate screws (224);

the back plate bracket (221) is configured in the form of a longitudinal plate (225) and a transverse plate (226) connected at right angles to each other, and a slot (227) is disposed at side surfaces of the longitudinal plate (225) and a number of spherical recesses (228) are disposed inside the slot, and the slot (227) and the spherical recesses (228) are configured to interact with the latch of the adjustable back plate (41), and the transverse plate (226) repeats the shape of the back plate (223), and a complex-shaped blind hole (229) is disposed inside the transverse plate (226) to fix the back plate extension piece (222), and threaded holes (230) are disposed inside the transverse plate (226) and configured for the back plate screws (224);

the adjustable cheek piece (42) containing a cheek piece clamp (231) rigidly connected to a cheek piece (232) by cheek piece screws (233), and the adjustable cheek piece latches s (43) are made in the form of the threaded rod with the ring spring and the cylindrical head with semi-circular slots to interact with rests of the cheek piece clamp (234) configured to reciprocate in the cheek piece clamp (231), and they are configured for joint reciprocal motion with the latches of the adjustable cheek piece (43);

the cheek piece clamp (231) is configured in a form of a bent plate (235) with free ends (236), whereoutside the free ends (236) protrusions (237) are configured, and at the edges of the protrusions (237) through-holes (238) are configured to interact with the rests of the cheek piece clamp (234), and in the center of the protrusions (237) threaded holes (239) are configured to interact with the latches of the adjustable cheek piece (43), and in the upper part of the bent plate (235) the threaded holes (240) are configured to interact with the cheek piece screws (233);

the rest of the cheek piece clamp (234) containing sleeve stop (241), in which into the blind holes with the threaded section (245) and through holes (246) the retaining pins (212) are installed which are configured to reciprocate and spring-loaded by the retaining pin spring (213), and the retaining pin springs (213) interacts with the retaining pin (212) at one side, and at another side, it is fixed by thrust screws (242) and capable to compress and expand in the blind holes with the threaded section (245);

the sleeve stop (241) is configured in a form of a plate (243) with cylindrical protrusions (244) disposed at the ends of the plate (243), and the blind holes with the threaded section (245) and the through-holes (246) are configured in the cylindrical protrusions (244) to interact with the retaining pin (212), the retaining pin spring (213), the thrust screw (242), and in the center of the plate (243) a threaded hole (247) is configured to interact with the latches of the adjustable cheek piece (43).

4. The weapon according to claim 1 wherein the threaded bushing (133) and an inner smooth bushing (135) are made of carbide and refractory material.

5. The weapon according to claim 1 wherein the spring half-rings (134) are made of carbide and refractory material.

6. The weapon according to claim 2 wherein the threaded bushing (133) and the inner smooth bushing (135) are made of carbide and refractory material.

7. The weapon according to claim 3 wherein the threaded bushing (133) and an inner smooth bushing (135) are made of carbide and refractory material.

8. The weapon according to claim 2 wherein the spring half-rings (134) are made of carbide and refractory material.

9. The weapon according to claim 3 wherein the spring half-rings (134) are made of carbide and refractory material.

* * * * *